US009535343B2

(12) United States Patent
Nukada et al.

(10) Patent No.: US 9,535,343 B2
(45) Date of Patent: Jan. 3, 2017

(54) IMAGE FORMING METHOD, IMAGE FORMING APPARATUS, AND PROCESS CARTRIDGE

(71) Applicant: FUJI XEROX CO., LTD., Tokyo (JP)

(72) Inventors: Katsumi Nukada, Kanagawa (JP); Hidekazu Hirose, Kanagawa (JP); Tomoya Sasaki, Kanagawa (JP); Yuko Iwadate, Kanagawa (JP); Kenji Kajiwara, Kanagawa (JP); Tatsuki Sano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/602,513

(22) Filed: Jan. 22, 2015

(65) Prior Publication Data

US 2016/0091804 A1 Mar. 31, 2016

(30) Foreign Application Priority Data

Sep. 26, 2014 (JP) ..... 2014-196871

(51) Int. Cl.
*G03G 5/047* (2006.01)
*G03G 5/02* (2006.01)
(Continued)

(52) U.S. Cl.
CPC ..... *G03G 5/02* (2013.01); *G03G 5/0592* (2013.01); *G03G 9/09708* (2013.01);
(Continued)

(58) Field of Classification Search
CPC ..... G03G 13/08; G03G 13/04; G03G 15/00; G03G 9/09791
See application file for complete search history.

(56) References Cited

U.S. PATENT DOCUMENTS 5,411,827 A 5/1995 Tamura et al.
5,427,880 A 6/1995 Tamura et al.
(Continued)

FOREIGN PATENT DOCUMENTS

JP S62-251757 A 11/1987
JP H05-40360 A 2/1993
(Continued)

OTHER PUBLICATIONS

Nakai, H. et al., "Technologies for High Durability and Reliability of the Photconductor Unit," Ricoh Technical Report, Dec. 2012, pp. 37-43, No. 38.

*Primary Examiner* — Peter Vajda
(74) *Attorney, Agent, or Firm* — Oliff PLC

(57) ABSTRACT

An image forming method satisfies the following Expressions:

$0.01<Rmf<0.20$ Expression (A1):

$0.005<Rmf/Wh<5.000$ Expression (B1):

$0.002<Rmf/Wl<1.000$ Expression (B2):

$1.0<Wh\max/Wh\min<2.5$ Expression (C1):

$1.0<Wl\max/Wl\min<2.5$ Expression (C2):

wherein, when a content of the fatty acid metal salt particles with respect to the entire weight of the toner is set as Rmf, an average abrasion rate of the electrophotographic photoreceptor is set as Wh, a maximum abrasion rate of the electrophotographic photoreceptor is set as Whmax, and a minimum abrasion rate of the electrophotographic photoreceptor is set as Whmin, and an average abrasion rate of the electrophotographic photoreceptor is set as Wl, a maximum abrasion rate of the electrophotographic photoreceptor is set
(Continued)

as Wlmax, and a minimum abrasion rate of the electrophotographic photoreceptor is set as Wlmin.

12 Claims, 6 Drawing Sheets

(51) Int. Cl.
*G03G 21/00* (2006.01)
*G03G 5/05* (2006.01)
*G03G 9/097* (2006.01)

(52) U.S. Cl.
CPC ..... *G03G 9/09791* (2013.01); *G03G 21/0011* (2013.01); *G03G 21/0094* (2013.01)

(56) References Cited

U.S. PATENT DOCUMENTS

| | | | | |
|---|---|---|---|---|
| 5,456,989 | A | 10/1995 | Nogami et al. | |
| 5,496,671 | A | 3/1996 | Tamura et al. | |
| 5,695,898 | A | 12/1997 | Go et al. | |
| 6,175,703 | B1 * | 1/2001 | Nakazono | G03G 9/0819 399/111 |
| 6,503,675 | B1 * | 1/2003 | Kabai | G03G 9/09708 430/108.3 |
| 2002/0119382 | A1 | 8/2002 | Nakata et al. | |
| 2003/0044708 | A1 * | 3/2003 | Matsunaga | G03G 9/08711 430/108.22 |
| 2004/0043312 | A1 | 3/2004 | Kikuchi et al. | |
| 2004/0248024 | A1 | 12/2004 | Suzuki et al. | |
| 2004/0253527 | A1 | 12/2004 | Suzuki et al. | |
| 2007/0122724 | A1 | 5/2007 | Suzuki et al. | |
| 2007/0178400 | A1 | 8/2007 | Kikuchi et al. | |
| 2008/0020305 | A1 | 1/2008 | Suzuki et al. | |
| 2009/0130580 | A1 * | 5/2009 | Dojo | G03G 9/0819 430/106.1 |
| 2013/0052572 | A1 * | 2/2013 | Nukada | G03G 15/75 430/56 |
| 2013/0122408 | A1 | 5/2013 | Haruyama | |

FOREIGN PATENT DOCUMENTS

| | | | |
|---|---|---|---|
| JP | H05-216249 | A | 8/1993 |
| JP | H07-72640 | A | 3/1995 |
| JP | H07-146564 | A | 6/1995 |
| JP | 2852464 | B2 | 2/1999 |
| JP | 2000-019749 | A | 1/2000 |
| JP | 2000-206715 | A | 7/2000 |
| JP | 2000-206717 | A | 7/2000 |
| JP | 2001-166509 | A | 6/2001 |
| JP | 2001-175016 | A | 6/2001 |
| JP | 2002-082469 | A | 3/2002 |
| JP | 3287678 | B2 | 6/2002 |
| JP | 2004-012986 | A | 1/2004 |
| JP | 2004-302450 | A | 10/2004 |
| JP | 2005-062301 | A | 3/2005 |
| JP | 2005-062302 | A | 3/2005 |
| JP | 2006-084711 | A | 3/2006 |
| JP | 2006-138956 | A | 6/2006 |
| JP | 2007-079244 | A | 3/2007 |
| JP | 2007-086522 | A | 4/2007 |
| JP | 2007-304246 | A | 11/2007 |
| JP | 2007-310181 | A | 11/2007 |
| JP | 2010-054884 | A | 3/2010 |
| JP | 2012-123209 | A | 6/2012 |
| JP | 2013-044820 | A | 3/2013 |
| JP | 2013-105046 | A | 5/2013 |

* cited by examiner

IMAGE FORMING METHOD, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2014-196871 filed Sep. 26, 2014.

BACKGROUND

1. Technical Field

The present invention relates to an image forming method, an image forming apparatus, and a process cartridge.

2. Related Art

An electrophotographic image forming apparatus generally has the following configurations and processes. That is, a surface of an electrophotographic photoreceptor is charged to a polarity and a potential, a charged surface of the electrophotographic photoreceptor is selectively erased by image exposure to form an electrostatic latent image, a toner is then attached to the electrostatic latent image, the latent image is developed as a toner image, and the toner image is transferred to a recording medium and is output as an image-formed material.

In recent years, the electrophotographic photoreceptor has an advantage of rapidly obtaining high printing quality, and therefore the electrophotographic photoreceptor has been widely used in fields of a copying machine, a laser beam printer, and the like.

As the electrophotographic photoreceptor used in these image forming apparatuses, an electrophotographic photoreceptor (inorganic photoreceptor) using an inorganic photoconductive material such as selenium, a selenium-tellurium alloy, a selenium-arsenic alloy, or cadmium sulfide in the related art has been known, and in recent years, an organic photoreceptor (organic photoreceptor) using an organic photoconductive material having excellent advantages in the points of manufacturability and disposability at low cost has become the mainstream.

It has been proposed to improve strength by providing a protection layer on the surface of the electrophotographic photoreceptor, in order to obtain a long life and high reliability of the electrophotographic photoreceptor.

SUMMARY

According to an aspect of the invention, there is provided an image forming method including:

charging a surface of an electrophotographic photoreceptor by a charging device disposed to be in contact with or be adjacent to the surface of the electrophotographic photoreceptor which includes a conductive base and a photosensitive layer provided on the conductive base and in which an uppermost layer is configured with a cured film of a composition having a reactive charge transport material;

forming an electrostatic latent image on a charged surface of the electrophotographic photoreceptor;

developing the electrostatic latent image formed on the surface of the electrophotographic photoreceptor with a developer including a toner including toner particles and fatty acid metal salt particles to form a toner image;

transferring the toner image to a surface of a recording medium; and cleaning the surface of the electrophotographic photoreceptor with a cleaning blade in contact with the surface of the electrophotographic photoreceptor, wherein, when a content of the fatty acid metal salt particles with respect to the entire weight of the toner is set as Rmf (% by weight), an average abrasion rate of the electrophotographic photoreceptor is set as Wh (nm/1,000 rotations), a maximum abrasion rate of the electrophotographic photoreceptor is set as Whmax (nm/1,000 rotations), and a minimum abrasion rate of the electrophotographic photoreceptor is set as Whmin (nm/1,000 rotations), in a case where an image having three image patterns having different image densities is repeatedly formed in a high temperature and high humidity environment, and an average abrasion rate of the electrophotographic photoreceptor is set as Wl (nm/1,000 rotations), a maximum abrasion rate of the electrophotographic photoreceptor is set as Wlmax (nm/1,000 rotations), and a minimum abrasion rate of the electrophotographic photoreceptor is set as Wlmin (nm/1,000 rotations), in a case where an image having three image patterns having different image densities is repeatedly formed in a low temperature and low humidity environment, the following Expression (A1), the following Expression (B1), the following Expression (B2), the following Expression (C1), and the following Expression (C2) are satisfied:

$$0.01<Rmf<0.20 \quad \text{Expression (A1):}$$

$$0.005<Rmf/Wh<5.000 \quad \text{Expression (B1):}$$

$$0.002<Rmf/Wl<1.000 \quad \text{Expression (B2):}$$

$$1.0<Wh\text{max}/Wh\text{min}<2.5 \quad \text{Expression (C1):}$$

$$1.0<Wl\text{max}/Wl\text{min}<2.5. \quad \text{Expression (C2):}$$

BRIEF DESCRIPTION OF THE DRAWINGS

Exemplary embodiments of the present invention will be described in detail based on the following figures, wherein.

DETAILED DESCRIPTION

Figure 1:
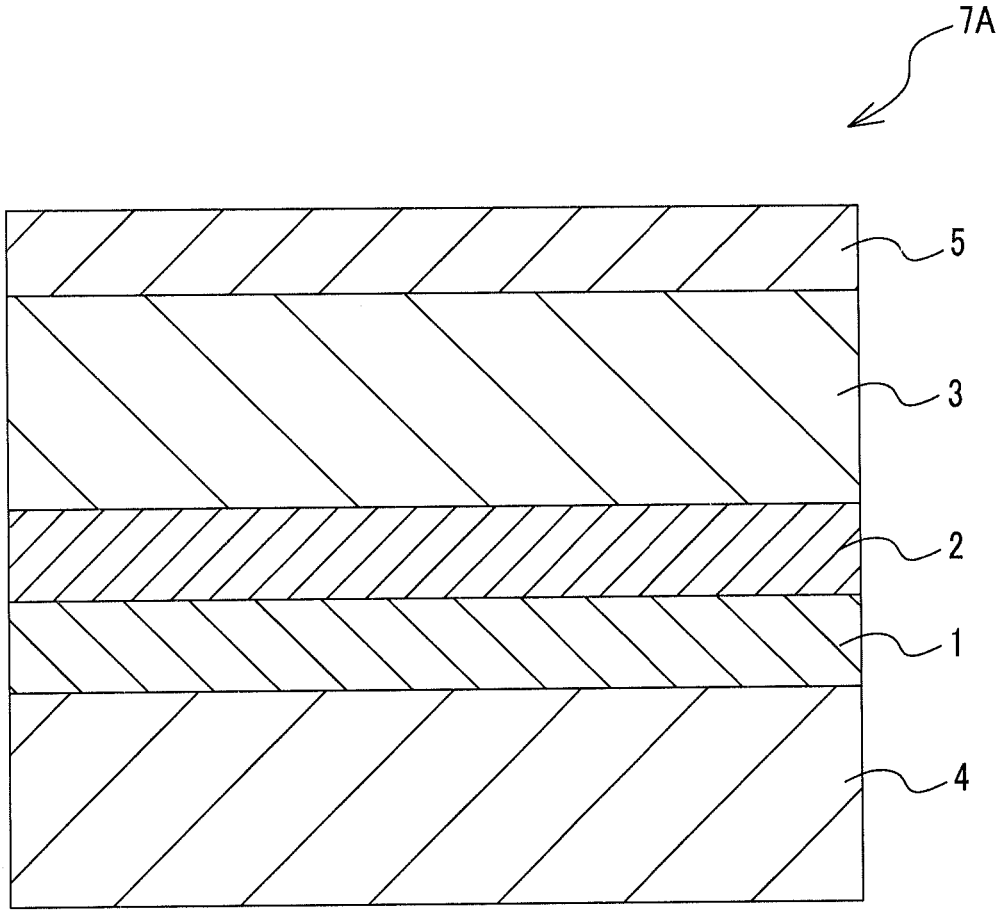
FIG. 1 is a partially cross-sectional view schematically showing an example of a layer configuration of an electrophotographic photoreceptor according to the exemplary embodiment.

Hereinafter, the exemplary embodiments which are examples of the invention will be described.

A image forming method according to the exemplary embodiment includes a charging step of charging a surface of an electrophotographic photoreceptor (hereinafter, also referred to as a "photoreceptor") by a charging device disposed to be in contact with or be adjacent to a surface of the photoreceptor, an electrostatic latent image forming step of forming an electrostatic latent image on the charged surface of the photoreceptor, a developing step of developing the electrostatic latent image formed on the surface of the photoreceptor with a developer containing a toner to form a toner image, a transfer step of transferring the toner image to a surface of a recording medium, and a cleaning step of cleaning the surface of the photoreceptor with a cleaning blade in contact with the surface of the photoreceptor.

An image forming apparatus (image forming apparatus according to the exemplary embodiment) which executes the image forming method according to the exemplary embodiment includes a photoreceptor, a charging unit that is disposed to be in contact with or be adjacent to a surface of the photoreceptor and charges the surface of the photoreceptor, an electrostatic latent image forming unit that forms an electrostatic latent image on the charged surface of the photoreceptor, a developing unit that accommodates a developer containing a toner and develops the electrostatic latent image formed on the surface of the photoreceptor with the developer to form a toner image, a transfer unit that transfers the toner image to a surface of a recording medium, and a cleaning unit that includes a cleaning blade which is in contact with the surface of the photoreceptor and cleans the surface of the photoreceptor.

The photoreceptor includes a conductive base and a photosensitive layer provided on the conductive base, and is a photoreceptor (hereinafter, also referred to as a "curing photoreceptor") in that an upper most layer is configured with a cured film of a composition containing a reactive charge transport material. The developer contains toner including toner particles and fatty acid metal salt particles.

In the image forming method according to the exemplary embodiment, when a content of the fatty acid metal salt particles with respect to the entire weight of the toner is set as Rmf (% by weight), an average abrasion rate of the photoreceptor is set as Wh (nm/1,000 rotations), a maximum abrasion rate of the photoreceptor is set as Whmax (nm/1,000 rotations), and a minimum abrasion rate of the photoreceptor is set as Whmin (nm/1,000 rotations), in a case where an image having three image patterns having different image densities is repeatedly formed in a high temperature and high humidity environment, and an average abrasion rate of the photoreceptor is set as Wl (nm/1,000 rotations), a maximum abrasion rate of the photoreceptor is set as Wlmax (nm/1,000 rotations), and a minimum abrasion rate of the photoreceptor is set as Wlmin (nm/1,000 rotations), and in a case where an image having three image patterns having different image densities is repeatedly formed in a low temperature and low humidity environment, Expression (A1), Expression (B1), Expression (B2), Expression (C1), and Expression (C2) are satisfied.

$$0.01<Rmf<0.20 \quad \text{Expression (A1):}$$

$$0.005<Rmf/Wh<5.000 \quad \text{Expression (B1):}$$

$$0.002<Rmf/Wl<1.000 \quad \text{Expression (B2):}$$

$$1.0<Wh\text{max}/Wh\text{min}<2.5 \quad \text{Expression (C1):}$$

$$1.0<Wl\text{max}/Wl\text{min}<2.5 \quad \text{Expression (C2):}$$

Figure 6:
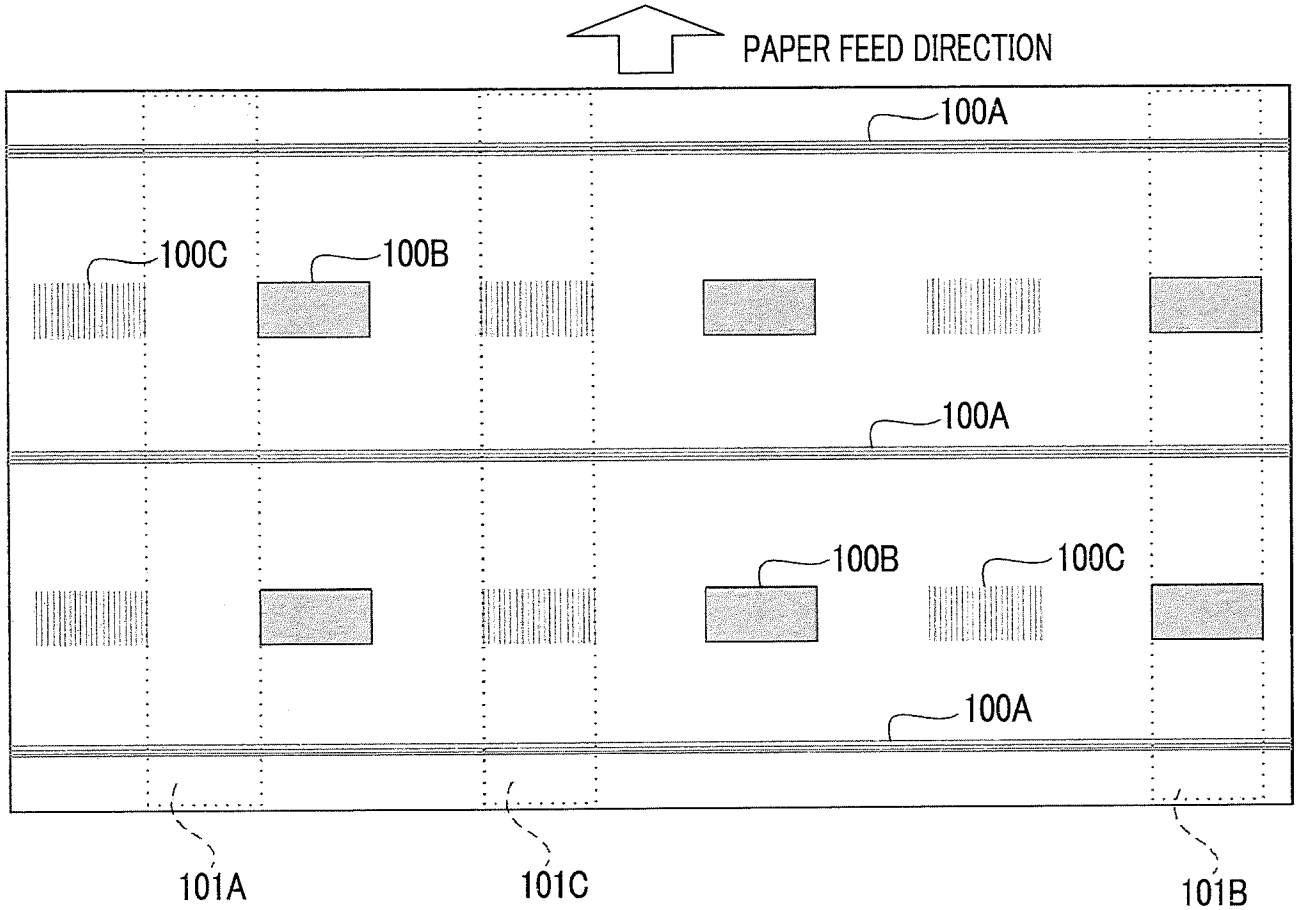
FIG. 6 is a schematic view showing an image pattern.

Herein, the expression "in a case where an image having three image patterns having different image densities is repeatedly formed in a high temperature and high humidity environment or in a low temperature and low humidity environment" indicates "a case of performing output of forming 50,000 images, each of which is formed of three thin line images (image density of this portion is 50%) 100A having a width of 2 mm drawn along a paper longitudinal direction with a repeated thin line image having 4 dot lines and 4 dot spaces arranged along a paper transverse feed direction (short direction), six 18 mm×9 mm solid images 100B having an image density of 100%, and six 18 mm×9 mm repeated thin line images (image density of this portion is 50%) 100C having 4 dot lines and 4 dot spaces arranged along a paper longitudinal direction, on an A4-sized paper as a recording medium, by transportation in the transverse feed direction (short direction) of the A4-sized paper, as shown in FIG. 6, in a high temperature and high humidity environment (environment of a temperature of 28° C. and humidity of 80% RH) or in a low temperature and low humidity environment (environment of a temperature of 8° C. and humidity of 20% RH)".

Herein, images in each of which the three solid images 100B and the three thin line images 100C are arranged at equal intervals are respectively formed between the three thin line images 100A having a width of 2 mm drawn along the paper longitudinal direction.

That is, an image formed of a first image pattern 101A having an image density of 1.4% which only includes the thin line images 100A, a second image pattern 101B having an image density of 10% which includes the thin line images 100A and the solid images 100B, and a third image pattern 101C having an image density of 5.7% which includes the thin line images 100A and the thin line images 100C are formed on the A4-sized paper as a recording medium.

The image density of each image pattern is shown as an average value of image densities in the paper feed direction (in the exemplary embodiment, the transverse feed direction (short direction)). A portion of the first-image pattern which only includes the thin line images 100A having a width of 2 mm with repeated thin line images having 4 dot lines and 4 dot spaces has a density defined with three images×2 mm having the image density of 50% with respect to a paper width of 210 mm, as (2×3×50%)/210=1.4%. In the same manner, a portion of the second image pattern 101B which includes the thin line images 100A and the solid images 100B has a density defined as {(2×3×50%)+(9×2×100%)}/210=10%, and a portion of the third image pattern 101C having an image density of 5.7% which includes the thin line images 100A and the thin line images 100C has a density defined as {(2×3×50%)+(9×2×50%)}/210=5.7%.

The average abrasion rate of the photoreceptor, the maximum abrasion rate of the photoreceptor, and the minimum abrasion rate of the photoreceptor in each environment are values measured by the following method.

A film thickness profile of an uppermost layer along a longitudinal direction of the photoreceptor in an area corresponding to an image forming area excluding both ends of the photoreceptor in an axial direction is measured using an optical film thickness measuring apparatus (line interference film thickness measuring device). The film thickness profile of the uppermost layer is created as an average value measured with four portions (four portions at 0°, 90°, 180°, and 270° when seen from the cross section of the photoreceptor) disposed at equal intervals in a circumferential direction of the photoreceptor. In each environment, the film thickness profiles of the uppermost layer are created before and after the output of forming the image, and the average abrasion rate of the photoreceptor, the maximum abrasion rate of the photoreceptor, and the minimum abrasion rate of the photoreceptor are respectively calculated based on a difference between the film thickness profiles of the uppermost layer before and after the output.

Each abrasion rate is calculated by converting the value into an abrasion rate per 1,000 rotations (cycles) of the photoreceptor. That is, each abrasion rate is an abrasion rate per 1,000 rotations (cycles) of the photoreceptor.

With the above configurations, in the image forming method (apparatus) according to the exemplary embodiment, an image with suppressed unevenness in density is obtained for a long time, even when an image having a low image density (image density of 1.4%) or a high image density (image density of 10%) is repeatedly formed in the high temperature and high humidity environment (environment of a temperature of 28° C. and humidity of 80% RH) or in the low temperature and low humidity environment (environment of a temperature of 8° C. and humidity of 20% RH). The reason therefor is not clear, but the following reason is assumed.

In the related art, a technology of controlling the abrasion of the uppermost layer of the photoreceptor using a toner containing fatty acid metal salt particles is known. However, in a case where the curing photoreceptor in which the uppermost layer is configured with the cured film of the composition containing a reactive charge transport material is used, the mechanical strength of the uppermost layer is high, and accordingly, the abrasion of the uppermost layer may be excessively suppressed in both environments of the high temperature and high humidity environment and the low temperature and low humidity environment. If the abrasion of the uppermost layer is excessively suppressed, fatty acid metal salt may be easily excessively accumulated on the surface of the photoreceptor. Particularly, in a case where a contact type or an approaching type charging system is used, an effect of discharge may be strong, a lubricating property may be decreased due to deterioration of the accumulated fatty acid metal salt, and a discharge product may easily remain.

Accordingly, when the image is repeatedly formed, mechanical load is applied to the cleaning blade and cracks or abrasion may occur. This causes poor cleaning quality, and the unevenness in density of the image may easily occur. This phenomenon easily occurs when an image including a solid image having a high image density is repeatedly formed. This is due to the following reasons. The solid image is an image having a large amount of the toner and the amount of the fatty acid metal salt particles supplied to the surface of the photoreceptor also increases, and accordingly, this causes partially poor cleaning quality, and the unevenness in density easily occurs. That is, the amount of the toner supplied to the surface of the photoreceptor (that is, the supplied amount of the fatty acid metal salt particles) changes depending on the degree of the image density, and a difference in ease of occurrence of the unevenness in density is formed.

As described above, it is found that, in the image forming method (apparatus) of applying the toner containing fatty acid metal salt particles and the curing photoreceptor, performing the charging using the contact type or approaching type charging system, and performing the cleaning by a cleaning blade system, even when the image having a low image density or a high image density is repeatedly formed in the high temperature and high humidity environment or in the low temperature and low humidity environment, it is necessary to appropriately abrade the uppermost layer of the photoreceptor according to the content of the fatty acid metal salt particles in the toner (that is, the amount of the fatty acid metal salt particles supplied to the surface of the photoreceptor), in order to suppress the unevenness in density of the image.

Therefore, in the image forming method according to the exemplary embodiment, Expression (A1), Expression (B1), Expression (B2), Expression (C1), and Expression (C2) are satisfied. That is, the content of the fatty acid metal salt particles is controlled, and the amount of the fatty acid metal salt supplied to the surface of the curing photoreceptor is limited, so as to satisfy Expression (A1). In addition, when the image having three image patterns having different image densities is repeatedly formed in each environment, a ratio of the content of the fatty acid metal salt particles in the toner (that is, the amount of the fatty acid metal salt particles supplied to the surface of the photoreceptor) to the average abrasion rate of the photoreceptor is controlled, and uppermost layer of the photoreceptor is appropriately abraded, so as to satisfy Expression (B1) and Expression (B2). Further, a ratio of the maximum abrasion rate and the minimum abrasion rate of the photoreceptor is controlled, and a difference between the maximum abrasion rate and the minimum abrasion rate of the photoreceptor is decreased, so as to satisfy Expression (C1) and Expression (C2).

As described above, the protection, the abrasion (refreshing), and the lubricating property are properly controlled in the uppermost layer of the curing photoreceptor. Accordingly, the attachment of the discharge product to the surface of the curing photoreceptor, and the poor cleaning quality due to abrasion or cracks on the cleaning blade are suppressed for a long time.

Therefore, in the image forming method (apparatus) according to the exemplary embodiment, an image with the suppressed unevenness in density is obtained for a long time, even when the image having the low image density or the high image density is repeatedly formed in the high temperature and high humidity environment or in the low temperature and low humidity environment.

In addition, in the image forming method (apparatus) according to the exemplary embodiment, the attachment of the discharge product to the surface of the photoreceptor, and the poor cleaning quality due to abrasion or cracks on the cleaning blade are suppressed, and thus image deletion is also easily suppressed for a long time.

In a commonly used color image forming method (apparatus) in which image forming steps (image forming units) of a cyan image, a magenta image, a yellow image, and a black image are combined with each other, 20% to 30% of images output in practice are color images. That is, in practice, the image-forming using the image forming steps (image forming units) of a cyan image, a magenta image, a yellow image, and a black image occupies only 20% to 30% of the entire output. Meanwhile, in practice, the image forming step (image forming unit) of a black image is used in most output, and accordingly, the unevenness in density of the image easily occurs, and the life thereof is shortest. The same applies to a monochrome image forming method (apparatus) using only the image forming step (image forming unit) of a black image, because this image forming step is most frequently used in the practice.

As described above, the image forming method (apparatus) according to the exemplary embodiment is applied to the image forming step (image forming unit) of a black image which is most frequently used in practice.

Specifically, the image forming method according to the exemplary embodiment includes a developing step of developing an electrostatic latent image formed on the surface of the photoreceptor with a developer containing a black toner to form a black toner image. In addition, the image forming apparatus according to the exemplary embodiment includes a developing unit which accommodates a developer containing a black toner, and develops an electrostatic latent image formed on the surface of the photoreceptor with a developer to form a black toner image.

Herein, the image forming method (apparatus) according to the exemplary embodiment satisfies Expression (A1), but preferably satisfies the following Expression (A1-2), and more preferably satisfies the following Expression (A1-3), in order to suppress the unevenness in density of the image.

The image forming method (apparatus) satisfies Expression (B1), but preferably satisfies the following Expression (B1-2), and more preferably satisfies the following Expression (B1-3), in order to suppress the unevenness in density of the image.

The image forming method (apparatus) satisfies Expression (B2), but preferably satisfies the following Expression (B2-2), and more preferably satisfies the following Expression (B2-3), in order to suppress the unevenness in density of the image.

The image forming method (apparatus) satisfies Expression (C1), but preferably satisfies the following Expression (C1-2), and more preferably satisfies the following Expression (C1-3), in order to suppress the unevenness in density of the image.

The image forming method (apparatus) satisfies Expression (C2), but preferably satisfies the following Expression (C2-2), and more preferably satisfies the following Expression (C2-3), in order to suppress the unevenness in density of the image.

$0.01<Rmf<0.20$ Expression (A1):

$0.015<Rmf<0.19$ Expression (A1-2):

$0.02<Rmf<0.18$ Expression (A1-3):

$0.005<Rmf/Wh<5.000$ Expression (B1):

$0.005<Rmf/Wh<4.950$ Expression (B1-2):

$0.005<Rmf/Wh<4.900$ Expression (B1-3):

$0.002<Rmf/Wl<1.000$ Expression (B2):

$0.002<Rmf/Wl<0.950$ Expression (B2-2):

$0.002<Rmf/Wl<0.900$ Expression (B2-3):

$1.0<Wh\mathrm{max}/Wh\mathrm{min}<2.5$ Expression (C1):

$1.050<Wh\mathrm{max}/Wh\mathrm{min}<2.450$ Expression (C1-2):

$1.100<Wh\mathrm{max}/Wh\mathrm{min}<2.400$ Expression (C1-3):

$1.0<Wl\mathrm{max}/Wl\mathrm{min}<2.5$ Expression (C2):

$1.050<Wl\mathrm{max}/Wl\mathrm{min}<2.450$ Expression (C2-2):

$1.100<Wl\mathrm{max}/Wl\mathrm{min}<2.400$ Expression (C2-3):

In the image forming method (apparatus) according to the exemplary embodiment of the invention, the fatty acid metal salt particles are particles of zinc stearate having a median diameter based on a volume of 0.1 μm to 10.0 μm, in order to satisfy Expression (B1), Expression (B2), Expression (C1), and Expression (C2) and to suppress the unevenness in density of the image. When these particles are used as the fatty acid metal salt particles, a specific surface area of the particles increases, contact efficiency of the particles and the surface of the photoreceptor is improved, and an excessive decrease in a coverage ratio of the fatty acid metal salt with respect to the surface of the photoreceptor is suppressed. Accordingly, the photoreceptor is easily appropriately abraded, and the fatty acid metal salt hardly remains on the surface of the photoreceptor. As a result, the above expressions are easily satisfied, and the unevenness in density of the image is easily suppressed.

In the image forming method (apparatus) according to the exemplary embodiment of the invention, the toner further include inorganic abrasive particles, in order to satisfy Expression (B1), Expression (B2), Expression (C1), and Expression (C2) and to suppress the unevenness in density of the image. When the toner includes the inorganic abrasive particles and the content of the inorganic abrasive particles with respect to the entire weight of the toner is set as Rab (% by weight), the following Expression (A2) (preferably Expression (A2-2) and more preferably Expression (A2-3)) is satisfied, in the same viewpoints as those described above. When the inorganic abrasive particles are included in the toner so as to satisfy the following Expression (A2), the photoreceptor is easily appropriately abraded, and the fatty acid metal salt hardly remains on the surface of the photoreceptor. As a result, the above expressions are easily satisfied, and the unevenness in density of the image is easily suppressed.

$0.01<Rab<0.30$ Expression (A2):

$0.015<Rab<0.30$ Expression (A2-2):

$0.02<Rab<0.30$ Expression (A2-3):

In order to satisfy Expression (B1), Expression (B2), Expression (C1), and Expression (C2) and to suppress the unevenness in density of the image, the inorganic abrasive particles may be particles having a median diameter based on a volume of 0.1 μm to 10.0 μm and may be at least one kind of particle selected from the group consisting of cerium oxide particles and strontium titanate particles. When these particles are used as the inorganic abrasive particles, the photoreceptor is easily appropriately abraded, and the fatty acid metal salt hardly remains on the surface of the photoreceptor. As a result, the above expressions are easily satisfied, and the unevenness in density of the image is easily suppressed.

When the content of the fatty acid metal salt with respect to the entire weight of the toner is set as Rmf (% by weight) and the content of the inorganic abrasive particles with respect to the entire weight of the toner is set as Rab (% by weight), the following Expression (D1) (preferably Expression (D1-2) and more preferably Expression (D1-3)) is satisfied, in order to satisfy Expression (B1), Expression (B2), Expression (C1), and Expression (C2) and to suppress the unevenness in density of the image.

$0.1<Rmf/Rab<3.0$ Expression (D1):

$0.1<Rmf/Rab<2.5$ Expression (D1-2):

$0.1<Rmf/Rab<2.0$ Expression (D1-3):

In the image forming method (apparatus) according to the exemplary embodiment of the invention, the toner further includes inorganic lubricant particles, in order to satisfy Expression (B1), Expression (B2), Expression (C1), and Expression (C2) and to suppress the unevenness in density of the image. The inorganic lubricant particles is boron nitride particles, in the same viewpoints as those described above. When the inorganic lubricant particles are included in the toner, an appropriate lubricating property is applied to the surface of the photoreceptor and this is easily maintained. As a result, the above expressions are easily satisfied, and the unevenness in density of the image is easily suppressed.

When the toner includes the inorganic lubricant particles and the content of the inorganic lubricant particles with respect to the entire weight of the toner is set as Rlu (% by weight), the following Expression (A3) (preferably Expression (A3-2) and more preferably Expression (A3-3)) is satisfied, in order to satisfy Expression (B1), Expression (B2), Expression (C1), and Expression (C2) and to suppress the unevenness in density of the image.

$$0.01<Rlu<0.5 \quad \text{Expression (A3):}$$

$$0.015<Rlu<0.3 \quad \text{Expression (A3-2):}$$

$$0.02<Rlu<0.3 \quad \text{Expression (A3-3):}$$

In the image forming method (apparatus) according to the exemplary embodiment of the invention, the reactive charge transport material is a chain polymerizable compound including at least a charge transport skeleton and a chain polymerizable functional group in the same molecule, in order to satisfy Expression (B1), Expression (B2), Expression (C1), and Expression (C2) and to suppress the unevenness in density of the image.

Particularly, the chain polymerizable compound is at least one kind selected from chain polymerizable compounds represented by Formulae (I) and (II) (hereinafter, also referred to as "specific chain polymerizable charge transport materials"), in the same viewpoints as those described above and viewpoints of the electrical characteristics and the mechanical strength. The reason therefor is not clear, but the following is assumed.

When a cured film of the composition including at least one kind selected from the specific chain polymerizable charge transport materials (film including a polymer or a crosslinked material (particularly, crosslinked material) of the specific chain polymerizable charge transport materials) is included as the uppermost layer, the uppermost layer has both the excellent electrical characteristics and mechanical strength. In addition, a thick film of the uppermost layer (for example, 10 μm or greater) is also realized. This is due to the following reasons. The specific chain polymerizable charge transport materials have excellent charge transport performance and have a small amount of a polar group such as —OH or —NH— which prevents carrier transportation. In addition, materials are linked to each other by polymerization with a vinylphenyl group (styryl group) having π electrons which are effective in the carrier transportation, and accordingly, generation of residual strain is suppressed, and formation of a structural trap for trapping the charge is suppressed.

In addition, since the specific chain polymerizable charge transport materials have a hydrophobic property so that moisture is hardly adsorbed thereto, compared to an acrylic material, the electrical characteristics are easily maintained for a long time.

Further, the specific chain polymerizable charge transport materials have a higher hydrophobic property than the acrylic material, and has a high affinity with fatty acid metal salt (particularly, zinc stearate). Accordingly, a small amount of fatty acid metal salt (particularly, zinc stearate) is easily applied to the surface of the protection layer (uppermost layer).

Therefore, when the cured film of the composition including at least one kind selected from the specific chain polymerizable charge transport materials (film including a polymer or a crosslinked material of the specific chain polymerizable charge transport materials) is provided as the uppermost layer, the electrical characteristics and the mechanical strength of the uppermost layer are easily improved.

Meanwhile, the specific chain polymerizable charge transport materials have a styryl group and have high affinity with a general non-reactive charge transport material which does not have a reactive group. That is, it is easy to increase the amount of the non-reactive charge transport material included in the uppermost layer. Therefore, it is easy to realize adjustment of the mechanical strength (for example, decrease in mechanical strength) of the uppermost layer according to the amount of the non-reactive charge transport material included therein.

Accordingly, when the specific chain polymerizable charge transport materials are used as the reactive charge transport material, it is effective to control the abrasion rate of the photoreceptor so as to satisfy Expressions described above, and to suppress the unevenness in density of the image.

In the image forming method (apparatus) according to the exemplary embodiment, as a method of adjusting the average abrasion rate, the maximum abrasion rate, and the minimum abrasion rate of the photoreceptor, a method of controlling the mechanical strength of the uppermost layer of the curing photoreceptor, 2) the type, the particle diameter, or the content of the fatty acid metal salt particles in the toner, 3) the type, the particle diameter, or the content of the inorganic abrasive in the toner, and 4) the type, the particle diameter, or the content of the inorganic lubricant in the toner is used, for example.

As the image forming method according to the exemplary embodiment, a known image forming method is applied, such as a method including a fixing step of fixing a toner image transferred to a surface of a recording medium; a direct transfer-type method of directly transferring a toner image formed on a surface of an electrophotographic photoreceptor to a recording medium; an intermediate transfer-type method of primarily transferring a toner image formed on a surface of an electrophotographic photoreceptor to a surface of an intermediate transfer member, and secondarily transferring the toner image transferred to the surface of the intermediate transfer member to a surface of a recording medium; a method including an erasing step of performing charge erasing by irradiating a surface of an image holding member with erasing light after transfer of a toner image and before charging; or a method including a step of increasing a temperature of an electrophotographic photoreceptor and decreasing a relative temperature.

In a case of the intermediate transfer-type method, a transfer method, for example, includes a step including a primary transfer method of primarily transferring a toner image formed on a surface of an image holding member to a surface of an intermediate transfer member and a secondary transfer method of secondarily transferring the toner image transferred to the surface of the intermediate transfer member to a surface of a recording medium.

Meanwhile, as the image forming apparatus according to the exemplary embodiment, a known image forming apparatus is applied, such as an apparatus that includes a fixing unit which fixes a toner image transferred to a surface of a recording medium; a direct transfer-type apparatus that directly transfers a toner image formed on a surface of an electrophotographic photoreceptor to a recording medium; an intermediate transfer-type apparatus that primarily transfers a toner image formed on a surface of an electrophotographic photoreceptor to a surface of an intermediate transfer member, and secondarily transfers the toner image transferred to the surface of the intermediate transfer member to a surface of a recording medium; an apparatus that includes an erasing unit that performs charge erasing by irradiating a surface of an image holding member with erasing light after transfer of a toner image and before charging; or an apparatus that includes an electrophotographic photoreceptor heating member for increasing a temperature of an electrophotographic photoreceptor and decreasing a relative temperature.

In a case of the intermediate transfer-type apparatus, a transfer unit, for example, has a configuration including an intermediate transfer member that transfers a toner image to a surface, a primary transfer unit that primarily transfers the toner image formed on a surface of an image holding member to a surface of the intermediate transfer member and a secondary transfer unit that secondarily transfers the toner image transferred to the surface of the intermediate transfer member to a surface of a recording medium.

The image forming method (apparatus) according to the exemplary embodiment may be either one of a dry developing type image forming method (apparatus) and a wet developing type (developing type using a liquid developer) image forming method (apparatus).

In the image forming apparatus according to the exemplary embodiment, a part including the electrophotographic photoreceptor, for example, may have a cartridge structure (process cartridge) that is detachable from the image forming apparatus. As the process cartridge, for example, a process cartridge that includes an electrophotographic photoreceptor, a developing unit, and a cleaning unit is preferably used. The process cartridge, for example, may include at least one selected from the group consisting of a charging unit, an electrostatic latent image forming unit, and a transfer unit, in addition to the electrophotographic photoreceptor.

Hereinafter, an example of the image forming apparatus according to the exemplary embodiment will be described, but there is no limitation. The major parts shown in the drawing will be described, and descriptions of other parts will be omitted.

Figure 4:
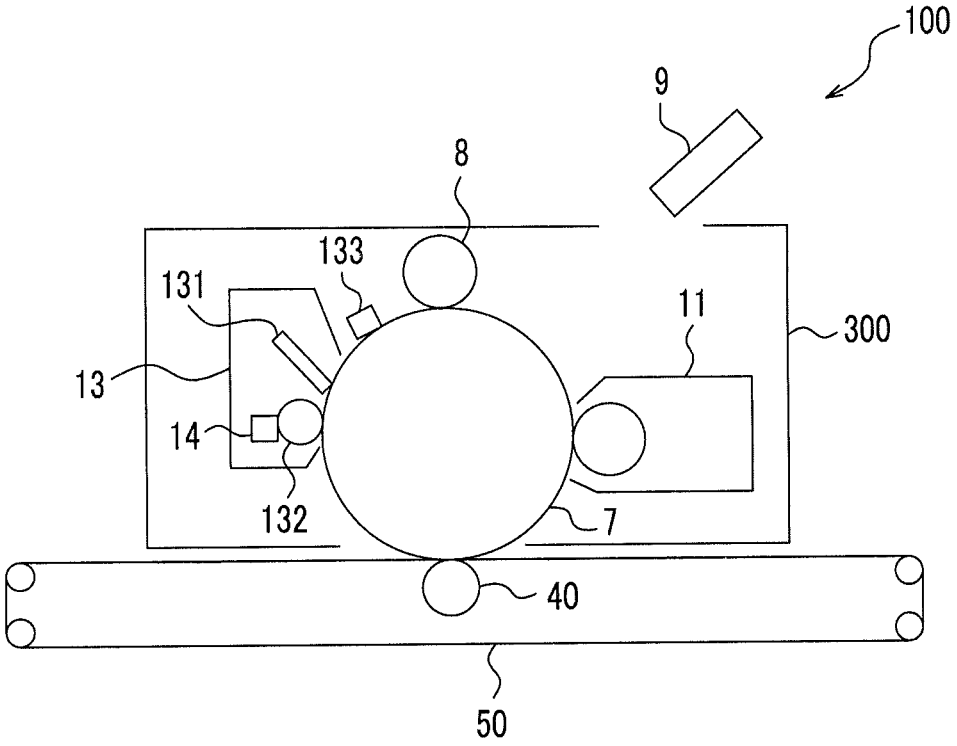
FIG. 4 is a schematic configuration view showing an example of an image forming apparatus according to the exemplary embodiment.

FIG. 4 is a schematic configuration view showing an example of the image forming apparatus according to the exemplary embodiment.

As shown in FIG. 4, an image forming apparatus 100 according to the exemplary embodiment includes a process cartridge 300 including an electrophotographic photoreceptor 7, an exposure device 9 (an example of the electrostatic latent image forming unit), a transfer device 40 (primary transfer unit), and an intermediate transfer member 50. In the image forming apparatus 100, the exposure device 9 is disposed in a position to expose light to the electrophotographic photoreceptor 7 from an opening of the process cartridge 300, the transfer device 40 is disposed in a position opposing the electrophotographic photoreceptor 7 with the intermediate transfer member 50 interposed therebetween, and the intermediate transfer member 50 is disposed so that a part thereof is in contact with the electrophotographic photoreceptor 7. Although not shown, the image forming apparatus further includes a secondary transfer device that transfers a toner image transferred to the intermediate transfer member 50 to a recording medium (for example, paper). The intermediate transfer member 50, the transfer device 40 (primary transfer unit), and the secondary transfer device (not shown) correspond to an example of the transfer unit.

The process cartridge 300 shown in FIG. 4 integrally supports the electrophotographic photoreceptor 7, a charging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, and the cleaning blade 131 is disposed to be in contact with the surface of the electrophotographic photoreceptor 7.

In FIG. 4, as the image forming apparatus, an example of including a fibrous member 132 (having a roll shape) that supplies a lubricant 14 to the surface of the electrophotographic photoreceptor 7 and a fibrous member 133 (having a flat brush shape) which assists in cleaning is shown, but these are disposed as necessary.

Hereinafter, each configuration of the image forming apparatus according to the exemplary embodiment will be described.

Electrophotographic Photoreceptor

The electrophotographic photoreceptor includes a conductive base and a photosensitive layer provided on the conductive base. An uppermost layer of the photoreceptor is configured with a cured film of a composition including a reactive charge transport material.

In the electrophotographic photoreceptor, the uppermost layer may form an uppermost surface of the electrophotographic photoreceptor, and is provided as a layer functioning as a protection layer or a layer functioning as a charge transport layer. In a case where the uppermost layer is the layer functioning as a protection layer, a lower layer of this protection layer includes a photosensitive layer formed of a charge transport layer and a charge generation layer, or a single-layer type photosensitive layer.

Specifically, in a case where the uppermost layer is the layer functioning as a protection layer, the photosensitive layer (the charge generation layer and charge transport layer, or the single-layer type photosensitive layer) and the protection layer as the uppermost layer are formed on the conductive base, in this order. Meanwhile, in a case where the uppermost layer is the layer functioning as a charge transport layer, the charge generation layer and the charge transport layer as the uppermost layer are formed on the conductive base, in this order.

Hereinafter, the electrophotographic photoreceptor according to the exemplary embodiment, in a case where the uppermost layer is the layer functioning as a protection layer, will be described with reference to the drawings. The same reference numerals will be used for the same or corresponding parts in the drawings, and the overlapped description thereof will be omitted.

Figure 2:
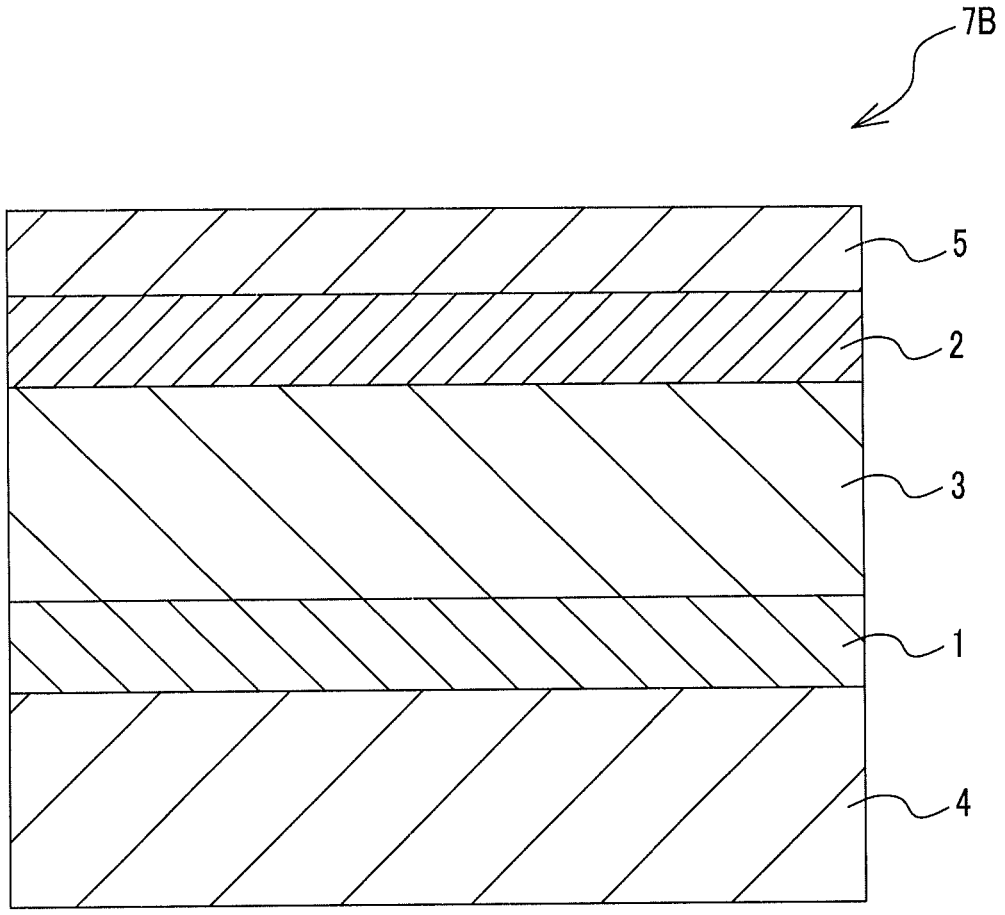
FIG. 2 is a partially cross-sectional view schematically showing another example of a layer configuration of an electrophotographic photoreceptor according to the exemplary embodiment.
Figure 3:
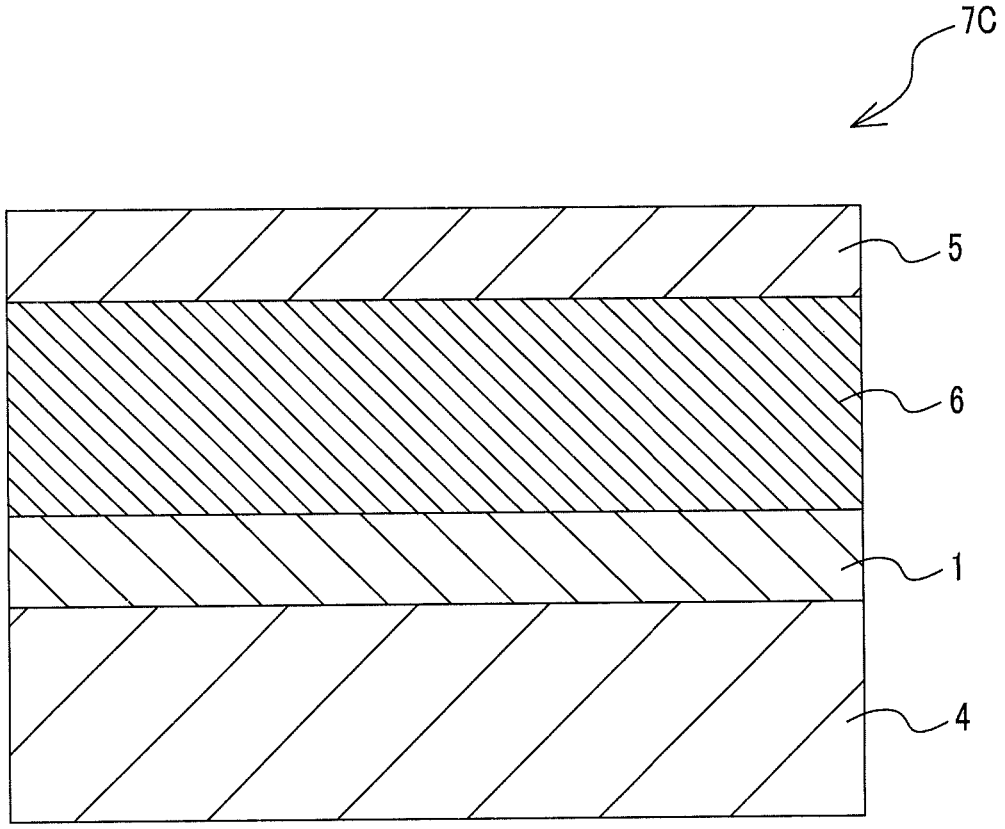
FIG. 3 is a partially cross-sectional view schematically showing still another example of a layer configuration of an electrophotographic photoreceptor according to the exemplary embodiment.

FIG. 1 is a cross-sectional view schematically showing an example of the electrophotographic photoreceptor according to the exemplary embodiment. FIGS. 2 to 3 are cross-sectional views schematically showing other examples of the electrophotographic photoreceptor according to the exemplary embodiment.

An electrophotographic photoreceptor 7A shown in FIG. 1 is a so-called function separation type photoreceptor (or lamination type photoreceptor). An undercoat layer 1 is provided on a conductive base 4, and a charge generation layer 2, a charge transport layer 3, and a protection layer 5 are formed thereon in this order. In the electrophotographic photoreceptor 7A, a photosensitive layer is configured with the charge generation layer 2 and the charge transport layer 3.

In the same manner as that of the electrophotographic photoreceptor 7A shown in FIG. 1, an electrophotographic photoreceptor 7B shown in FIG. 2 is a function separation type photoreceptor in which a function is separated into the charge generation layer 2 and the charge transport layer 3.

In the electrophotographic photoreceptor 7B shown in FIG. 2, the undercoat layer 1 is provided on the conductive base 4, and the charge transport layer 3, the charge generation layer 2, and the protection layer 5 are formed thereon in this order. In the electrophotographic photoreceptor 7B, a photosensitive layer is configured with the charge transport layer 3 and the charge generation layer 2.

An electrophotographic photoreceptor 7C shown in FIG. 3 includes a charge generation material and a charge transport material in the same layer (single-layer type photosensitive layer 6). In the electrophotographic photoreceptor 7C shown in FIG. 3, the undercoat layer 1 is provided on the conductive base 4, and the single-layer type photosensitive layer 6 and the protection layer 5 are formed thereon in this order.

In the electrophotographic photoreceptors 7A, 7B, and 7C shown in FIGS. 1 to 3, the protection layer 5 is set as an uppermost layer disposed at the side farthest from the conductive base 4, and this uppermost layer has the above-described configuration.

In the electrophotographic photoreceptors shown in FIGS. 1 to 3, the undercoat layer 1 may be provided or may not be provided.

Hereinafter, each element will be described based on the electrophotographic photoreceptor 7A shown in FIG. 1 as a representative example. The reference numerals will be omitted in the description.

Conductive Base

Examples of the conductive base include a metal plate, a metal drum, and a metal belt containing metal (aluminum, copper, zinc, chromium, nickel, molybdenum, vanadium, indium, gold, or platinum) or an alloy (stainless steel or the like). Examples of the conductive base further include paper, a resin film, and a belt obtained by coating, evaporating, or laminating a conductive compound (for example, a conductive polymer or indium oxide), metal (for example, aluminum, palladium, or gold), or an alloy. Herein, "conductivity" indicates volume resistivity of less than $10^{13}$ Ωcm.

When the electrophotographic photoreceptor is used in a laser printer, the surface of the conductive base is preferably roughened to have center line average roughness Ra of 0.04 μm to 0.5 μm, in order to suppress interference fringes generated when emitting laser beam. When incoherent light is used as a light source, the roughening for prevention of the interference fringes is not particularly necessary, but the roughening suppresses the generation of defects due to irregularities of the surface of the conductive base, and therefore, is suitable for longer life of the product.

As a roughening method, wet honing performed by suspending an abrasive in water and spraying this solution onto the conductive base, centerless grinding for performing press-contact of the conductive base against rotating grinding stone and continuously performing a grinding process, or anodic oxidation treatment is used, for example.

As the roughening method, a method of dispersing conductive or semiconductive powder in a resin to form a layer on a surface of the conductive base, and performing the roughening by particles dispersed in the layer, without roughening the surface of the conductive base, is also used.

In the roughening process by anodic oxidation, the anodic oxidation is performed in an electrolyte solution by setting a metal (for example, aluminum) conductive base as an anode, to form an oxide film on the surface of the conductive base. Examples of the electrolyte solution include a sulphuric acid solution or an oxalate solution. However, a porous anodic oxide film formed by the anodic oxidation is chemically active in its state, and thus is easily contaminated and has great resistance variation depending on the environment. Therefore, with respect to the porous anodic oxide film, it is preferable to perform a sealing process of sealing micropores of the oxide film by volume expansion due to a hydration reaction in steam under pressure or boiling water (metal salt such as nickel may be added) and changing the oxide film to a more stable hydrous oxide.

A film thickness of the anodic oxide film is, for example, preferably from 0.3 μm to 15 μm. When the film thickness thereof is in the range described above, a barrier property with respect to injection tends to be exhibited and an increase in residual potential due to repeated use tends to be prevented.

Treatment performed by an acidic treatment solution or a boehmite treatment may be performed for the conductive base.

The treatment performed by an acidic treatment solution is, for example, performed as follows. First, the acidic treatment solution including phosphoric acid, chromic acid, and hydrofluoric acid is prepared. Regarding a combination rate of phosphoric acid, chromic acid, and hydrofluoric acid in the acidic treatment solution, for example, the combination rate of phosphoric acid is in a range of 10% by weight to 11% by weight, the combination rate of chromic acid is in a range of 3% by weight to 5% by weight, and the combination rate of hydrofluoric acid is in a range of 0.5% by weight to 2% by weight. Concentration of the entire acid is in a range of 13.5% by weight to 18% by weight. A treatment temperature is, for example, preferably from 42° C. to 48° C. A film thickness of a coated film is preferably from 0.3 μm to 15 μm.

The boehmite treatment is performed by dipping the conductive base in pure water at 90° C. to 100° C. for 5 minutes to 60 minutes, or by bringing the conductive base into contact with heated steam at 90° C. to 120° C. for 5 minutes to 60 minutes, for example. A film thickness of a coated film is preferably from 0.1 μm to 5 μm. This may be further subjected to the anodic oxidation treatment using an electrolyte solution having a low solubility to the coated film, such as adipic acid, boric acid, borate, phosphate, phthalate, maleate, benzoate, tartrate, or citrate.

Undercoat Layer

The undercoat layer is, for example, a layer including inorganic particles and a binder resin.

As the inorganic particles, inorganic particles having powder resistivity (volume resistivity) of $10^2$ Ωcm to $10^{11}$ Ωcm are used, for example.

Among these, as the inorganic particles having the resistivity described above, for example, metal oxide particles such as tin oxide particles, titanium oxide particles, zinc oxide particles, or zirconium oxide particles is used, and zinc oxide particles are particularly preferable.

A specific surface area of the inorganic particles obtained by the BET method may be, for example, equal to or greater than 10 $m^2/g$.

A volume average particle diameter of the inorganic particles is, for example, from 50 nm to 2,000 nm (preferably from 60 nm to 1,000 nm).

A content of the inorganic particles is, for example, preferably from 10% by weight to 80% by weight and more preferably from 40% by weight to 80% by weight, with respect to the binder resin.

The inorganic particles may be subjected to surface treatment. The inorganic particles may be used in combination of two or more kinds of inorganic particles which are subjected to different surface treatment or have different particle diameters.

Examples of a surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropyl methyl dimethoxy silane, and N,N-bis(2-hydroxyethyl)-3-aminopropyltriethoxysilane, but there is no limitation.

The silane coupling agent may be used in combination of two or more kinds thereof. For example, the silane coupling agent having an amino group and another silane coupling agent may be used in combination. Examples of the other silane coupling agent include vinyl trimethoxy silane, 3-methacryloxypropyl-tris(2-methoxyethoxy)silane, 2-(3,4-epoxy cyclohexyl)ethyl trimethoxy silane, 3-glycidoxypropyl trimethoxysilane, vinyltriacetoxysilane, 3-mercaptopropyl trimethoxysilane, 3-aminopropyltriethoxysilane, N-2-(aminoethyl)-3-aminopropyltrimethoxysilane, N-2-(aminoethyl)-3-aminopropyl methyl dimethoxy silane, N,N-bis(2-hydroxyethyl)-3-aminopropyltriethoxysilane, and 3-chloropropyl trimethoxysilane, but there is no limitation.

The surface treatment method to be performed by the surface treatment agent may be any method as long as it is a well-known method, and may be either one of a dry method and a wet method.

An amount of the surface treatment agent used is, for example, preferably from 0.5% by weight to 10% by weight with respect to the inorganic particles.

Herein, the undercoat layer may preferably include an electron accepting compound (acceptor compound) with the inorganic particles, in order to improve long term stability of the electrical characteristics and a carrier blocking property.

Examples of the electron accepting compound include electron transport substances such as a quinone compound such as chloranil or bromanil; a tetracyanoquinodimethane compound; a fluorenone compound such as 2,4,7-trinitrofluorenone or 2,4,5,7-tetranitro-9-fluorenone; an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole; a xanthone compound; a thiophene compound; and a diphenoquinone compound such as 3,3',5,5' tetra-t-butyl diphenoquinone.

Particularly, as the electron accepting compound, a compound having an anthraquinone structure is preferable. Examples of the compound having an anthraquinone structure preferably include a hydroxyanthraquinone compound, an amino anthraquinone compound, and an amino hydroxyanthraquinone compound, and specifically, anthraquinone, alizarin, quinizarin, anthrarufin, and purpurin are preferable.

The electron accepting compound may be included in the undercoat layer to be dispersed with the inorganic particles, or may be included in the undercoat layer in a state of being attached to the surface of the inorganic particles.

As a method of attaching the electron accepting compound to the surface of the inorganic particles, a dry method or a wet method is used, for example.

The dry method is, for example, a method of attaching the electron accepting compound to the surface of the inorganic particles directly or by dripping the electron accepting compound dissolved in an organic solvent and spraying this onto the surface of the inorganic particles with dry air or nitrogen gas, while stirring the inorganic particles with a mixer having great shear force. The dripping or spraying of the electron accepting compound is performed at a temperature equal to or lower than a boiling point of the solvent. After dripping or spraying the electron accepting compound, baking may be performed at a temperature equal to or higher than 100° C. The conditions of the baking are not particularly limited as long as the conditions include a temperature and time at which electrophotographic characteristics are obtained.

The wet method is, for example, a method of dispersing the inorganic particles in a solvent by stirrer, ultrasonic waves, a sand mill, an attritor, or a ball mill, adding the electron accepting compound thereto and stirring or dispersing the mixture, removing the solvent, and attaching the electron accepting compound to the surface of the inorganic particles. As a method of removing the solvent, the solvent is removed by filtration or distillation. After removing the solvent, the baking may be performed at a temperature equal to or higher than 100° C. The conditions of the baking are not particularly limited as long as the conditions include a temperature and time at which electrophotographic characteristics are obtained. In the wet method, moisture in the inorganic particles may be removed before adding the electron accepting compound, and as an example thereof, a method of removing the moisture while stirring and heating the inorganic particles in the solvent or a method of removing the moisture by boiling the inorganic particles with the solvent is used.

The attachment of the electron accepting compound may be performed before or after performing the surface treatment for the inorganic particles by the surface treatment agent, or the attachment of the electron accepting compound and the surface treatment by the surface treatment agent may be performed at the same time.

A content of the electron accepting compound, for example, is from 0.01% by weight to 20% by weight and is preferably from 0.01% by weight to 10% by weight, with respect to the inorganic particles.

Examples of the binder resin to be used in the undercoat layer include a well-known material such as a well-known polymer compound such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, a urethane resin, an alkyd resin, or an epoxy resin; a zirconium chelate compound; a titanium chelate compound; an aluminum chelate compound; a titanium alkoxide compound; an organic titanium compound; and a silane coupling agent.

Examples of the binder resin to be used in the undercoat layer also include a charge transport resin having a charge transport group, a conductive resin (for example, polyaniline), and the like.

Among these, as the binder resin to be used in the undercoat layer, a resin which is not soluble in a coating solvent of an upper layer is preferable, and particularly, a thermosetting resin such as a urea resin, a phenol resin, a phenol-formaldehyde resin, a melamine resin, a urethane resin, an unsaturated polyester resin, an alkyd resin, or an epoxy resin; and a resin obtained by reaction between at least one kind of resin selected from the group consisting of a polyamide resin, a polyester resin, a polyether resin, a methacrylic resin, an acrylic resin, a polyvinyl alcohol resin, and a polyvinyl acetal resin, and a curing agent are preferable.

When these binder resins are used in combination of two or more kinds thereof, the combination rates thereof are set as necessary.

The undercoat layer may include various additives, in order to improve the electrical characteristics, environmental stability, and image quality.

Examples of the additives include well-known materials such as a polycyclic condensed or azo electron transport pigment, a zirconium chelate compound, a titanium chelate compound, an aluminum chelate compound, a titanium alkoxide compound, an organic titanium compound, and a silane coupling agent. The silane coupling agent is used in the surface treatment of the inorganic particles as described above, but may also be added to the undercoat layer as an additive.

Examples of the silane coupling agent as an additive include vinyl trimethoxy silane, 3-methacryloxypropyl-tris (2-methoxyethoxy)silane, 2-(3,4-epoxy cyclohexyl)ethyl trimethoxy silane, 3-glycidoxypropyl trimethoxy silane, vinyltriacetoxysilane, 3-mercaptopropyl trimethoxysilane, 3-aminopropyltriethoxysilane, N-2-(aminoethyl)-3-aminopropyltrimethoxysilane, N-2-(aminoethyl)-3-aminopropyl methyl methoxy silane, N,N-bis(2-hydroxyethyl)-3-aminopropyltriethoxysilane, and 3-chloropropyl trimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl)titanate, titanium acetylacetonate, poly titanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris(ethyl acetoacetate).

These additives may be used alone or as a mixture or a polycondensate of plural compounds.

Vickers hardness of the undercoat layer is equal to or greater than 35.

Surface roughness (ten point average roughness) of the undercoat layer is adjusted to be in a range of ¼n (n is a refractive index of the upper layer) of an exposure laser wavelength λ to be used, to ½λ, in order to suppress moire fringes.

Resin particles or the like may be added into the undercoat layer in order to adjust the surface roughness. Examples of the resin particles include silicone resin particles and cross-linked polymethylmethacrylate resin particles. In addition, the surface of the undercoat layer may be abraded, in order to adjust the surface roughness. Examples of the abrading method include buffing, sandblast treatment, wet honing, and grinding treatment.

The forming of the undercoat layer is not particularly limited, and a well-known forming method is used. For example, the undercoat layer is formed by forming a coated film of an undercoat layer forming coating solution obtained by adding the above components into a solvent, drying the coated film, and heating the coated film, if necessary.

Examples of the solvent used for preparing the undercoat layer forming coating solution include well-known organic solvents, for example, an alcohol solvent, an aromatic hydrocarbon solvent, a halogenated hydrocarbon solvent, a ketone solvent, a ketone alcohol solvent, an ether solvent, and an ester solvent.

Specific examples of these solvents include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a dispersion method of the inorganic particles when preparing the undercoat layer forming coating solution include well-known methods using a roll mill, a ball mill, a vibration ball mill, an attritor, a sand mill, a colloid mill, and a paint shaker.

Examples of the method of applying the undercoat layer forming coating solution onto the conductive base include general methods such as a blade coating method, a wire bar coating method, a spray coating method, a dip coating method, a bead coating method, an air-knife coating method, and a curtain coating method.

A film thickness of the undercoat layer is set, for example, preferably in a range equal to or greater than 15 μm and more preferably in a range of 20 μm to 50 μm.

Intermediate Layer

Although not shown, an intermediate layer may be further provided between the undercoat layer and the photosensitive layer.

The intermediate layer is, for example, a layer including a resin. Examples of the resin used in the intermediate layer include polymer compounds such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin.

The intermediate layer may be a layer including an organic metal compound. Examples of the organic metal compound used in the intermediate layer include organic metal compounds containing metal atoms such as zirconium, titanium, aluminum, manganese, and silicon.

These compounds used in the intermediate layer may be used alone or as a mixture or a polycondensate of plural compounds.

Among these, the intermediate layer is preferably a layer including an organic metal compound containing zirconium atoms or silicon atoms.

The forming of the intermediate layer is not particularly limited, and a well-known forming method is used. For example, the intermediate layer is formed by forming a coated film of an intermediate layer forming coating solution obtained by adding the above components into a solvent, drying the coated film, and heating the coated film, if necessary.

Examples of a coating method for forming the intermediate layer include general methods such as a dip coating method, an extrusion coating method, a wire bar coating method, a spray coating method, a blade coating method, a knife coating method, and a curtain coating method.

A film thickness of the intermediate layer is, for example, preferably set in a range of 0.1 μm to 3 μm. In addition, the intermediate layer may be used as the undercoat layer.

Charge Generation Layer

The charge generation layer is, for example, a layer including a charge generation material and a binder resin. The charge generation layer may be a vapor-deposited layer of the charge generation material. The vapor-deposited layer of the charge generation material is preferable in a case of using incoherent light source such as a light emitting diode (LED) or an organic electro-luminescence (EL) image array.

Examples of the charge generation material include an azo pigment such as bisazo or trisazo; a condensed aromatic pigment such as dibromoanthanthrone; a perylene pigment; a pyrrolopyrrole pigment; a phthalocyanine pigment; zinc oxide; and trigonal selenium.

Among these, a metal phthalocyanine pigment or a metal-free phthalocyanine pigment is preferably used as the charge generation material, in order to respond to near-infrared laser exposure. Specifically, hydroxygallium phthalocyanine disclosed in JP-A-5-263007 and JP-A-5-279591; chlorogallium phthalocyanine disclosed in JP-A-5-98181; dichlorotin phthalocyanine disclosed in JP-A-5-140472 and JP-A-5-140473; and titanyl phthalocyanine disclosed in JP-A-4-189873 are more preferable, for example.

Meanwhile, a condensed aromatic pigment such as dibromoanthanthrone; a thioindigo pigment; a porphyrazine compound; zinc oxide; trigonal selenium; and a bisazo pigment disclosed in JP-A-2004-78147 and JP-A-2005-181992 are preferable as the charge generation material, in order to respond to near-ultraviolet laser exposure.

The charge generation materials described above may be used even in a case of using the incoherent light source such as an LED or an organic EL image array having a center wavelength of light of 450 nm to 780 nm. However, in a viewpoint of resolution, when using the photosensitive layer with a thin film having a thickness equal to or smaller than 20 μm, field intensity in the photosensitive layer increases, and a decrease in charging due to charge injection from the base and image defects which are so-called black spots easily occur. This phenomenon significantly occurs when using a charge generation material such as trigonal selenium or phthalocyanine pigment which easily generates dark current in a p-type semiconductor.

With respect to this, when an n-type semiconductor such as a condensed aromatic pigment, a perylene pigment, or an azo pigment is used as the charge generation material, the dark current is hardly generated, and the image defects called black spots may be prevented even in a case of using a thin film. As the n-type charge generation material, compounds (CG-1) to (CG-27) disclosed in paragraphs [0288] to [0291] of JP-A-2012-155282 are used, for example, but there is no limitation.

The determination of the n-type is performed by polarity of flowing photocurrent, using a generally used time-of-flight method, and a material which easily causes electrons to flow as a carrier than holes is determined as the n-type.

The binder resin used in the charge generation layer is selected from a wide range of insulation resins, and the binder resin may be selected from organic photoconductive polymers such as poly-N-vinylcarbazole, polyvinyl anthracene, polyvinyl pyrene, and polysilane.

Examples of the binder resin include a polyvinyl butyral resin, a polyarylate resin (polycondensate of bisphenols and aromatic divalent carboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, and a polyvinyl pyrrolidone resin. Herein, an "insulation property" indicates volume resistivity equal to or greater than $10^{13}$ Ωcm.

These binder resins are used alone or in combination of two or more kinds thereof.

A combination ratio of the charge generation material and the binder resin is preferably in a range of 10:1 to 1:10 in terms of a weight ratio.

The charge generation layer may additionally include other well-known additives.

The forming of the charge generation layer is not particularly limited, and a well-known forming method is used. For example, the charge generation layer is formed by forming a coated film of a charge generation layer forming coating solution obtained by adding the above components into a solvent, drying the coated film, and heating the coated film, if necessary. The forming of the charge generation layer may be performed by vapor deposition of the charge generation material. The forming of the charge generation layer by the vapor deposition is particularly preferable, in a case of using the condensed aromatic pigment or the perylene pigment as the charge generation material.

Examples of the solvent used for preparing the charge generation layer forming coating solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination of two or more kinds thereof.

As a method of dispersing particles (for example, charge generation material) in the charge generation layer forming coating solution, a media dispersion instrument such as a ball mill, a vibration ball mill, an attritor, a sand mill, or a horizontal sand mill, or a media-less dispersion instrument such as a stirrer, an ultrasonic wave dispersion instrument, a roll mill, or a high-pressure homogenizer is used, for example. As the high-pressure homogenizer, a collision type of dispersing a dispersion by causing liquid-liquid collision or liquid-wall collision in a high pressure state, or a flow-through method of dispersing a dispersion by causing the dispersion to flow through a minute flow path in a high pressure state is used, for example.

When performing the dispersion, an average particle diameter of the charge generation materials in the charge generation layer forming coating solution is equal to or smaller than 0.5 μm, preferably equal to or smaller than 0.3 μm, and more preferably equal to or smaller than 0.15 μm.

Examples of applying the charge generation layer forming coating solution onto the undercoat layer (or onto the intermediate layer) include general methods such as a blade coating method, a wire bar coating method, a spray coating method, a dip coating method, a bead coating method, an air-knife coating method, and a curtain coating method.

A film thickness of the charge generation layer is set, for example, preferably in a range of 0.1 μm to 5.0 μm and more preferably in a range of 0.2 μm to 2.0 μm.

Charge Transport Layer

The charge transport layer is, for example, a layer including a charge transport material and a binder resin. The charge transport layer may be a layer including a polymer charge transport material.

Examples of the charge transport material include electron transport compounds such as a quinone compound such as p-benzoquinone, chloranil, bromanil, or anthraquinone; a tetracyanoquinodimethane compound; a fluorenone compound such as 2,4,7-trinitrofluorenone; a xanthone compound; a benzophenone compound; a cyanovinyl compound; and an ethylene compound. Examples of the charge transport material also include hole transport compounds such as a triarylamine compound, a benzidine compound, an arylalkane compound, an aryl-substituted ethylene compound, a stilbene compound, an anthracene compound, and a hydrazone compound. These charge transport materials are used alone or in combination of two or more kinds thereof, but there is no limitation.

As the charge transport material, a triarylamine derivative represented by the following Structural Formula (a-1) and a benzidine derivative represented by the following Structural Formula (a-2) are preferable, in a viewpoint of charge mobility.

(a-1)

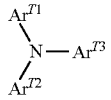

In Structural Formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

As the substituent of each group, a halogen atom, an alkyl group having 1 to 5 carbon atoms, and an alkoxy group having 1 to 5 carbon atoms are used. As the substituent of each group, a substituted amino group substituted with an alkyl group having 1 to 3 carbon atoms is also used.

(a-2)

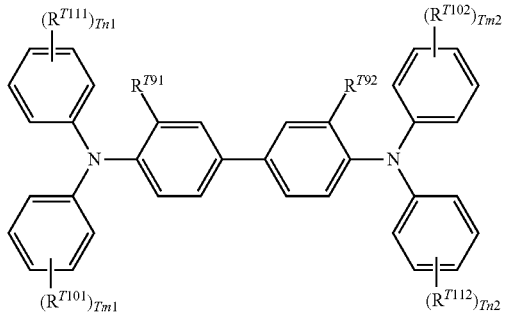

In Structural Formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 to 2.

As the substituent of each group, a halogen atom, an alkyl group having 1 to 5 carbon atoms, and an alkoxy group having 1 to 5 carbon atoms are used. As the substituent of each group, a substituted amino group substituted with an alkyl group having 1 to 3 carbon atoms is also used.

Herein, among the triarylamine derivative represented by Structural Formula (a-1) and the benzidine derivative represented by Structural Formula (a-2), a triarylamine derivative having "$—C_6H_4—CH=CH—CH=C(R^{T7})(R^{T8})$" and a benzidine derivative having "$—CH=CH—CH=C(R^{T15})(R^{T16})$" are particularly preferable, in a viewpoint of charge mobility.

As the polymer charge transport material, a well-known material having a charge transport property such as poly-N-vinylcarbazole or polysilane is used. Polyester polymer charge transport materials disclosed in JP-A-8-176293 and JP-A-8-208820 are particularly preferable. The polymer charge transport materials may be used alone or may be used in combination with a binder resin.

Examples of the binder resin used in the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, a poly-N-vinylcarbazole, and polysilane. Among these, a polycarbonate resin or a polyarylate resin is preferable as the binder resin. These binder resins are used alone or in combination of two or more kinds thereof.

A combination ratio of the charge transport material and the binder resin is preferably from 10:1 to 1:5 in terms of a weight ratio.

The charge transport layer may additionally include other well-known additives.

The forming of the charge transport layer is not particularly limited, and a well-known forming method is used. For example, the charge transport layer is formed by forming a coated film of a charge transport layer forming coating solution obtained by adding the above components into a solvent, drying the coated film, and heating the coated film, if necessary.

Examples of the solvent used for preparing the charge transport layer forming coating solution include commonly-used organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and linear or cyclic ethers such as tetrahydrofuran and ethyl ether. These solvents are used alone or in combination of two or more kinds thereof.

Examples of a coating method when applying the charge transport layer forming coating solution onto the charge generation layer include general methods such as a blade coating method, a wire bar coating method, a spray coating method, a dip coating method, a bead coating method, an air-knife coating method, and a curtain coating method.

A film thickness of the charge transport layer is set, for example, preferably in a range of 5 μm to 50 μm, and more preferably in a range of 10 μm to 30 μm.

Protection Layer

The protection layer (uppermost layer) is the uppermost layer of the electrophotographic photoreceptor and is configured with a cured film of a composition containing a reactive charge transport material. That is, the protection layer includes a polymer or a crosslinked material (preferably a crosslinked material) of the reactive charge transport material.

The protection layer may be configured with a composition further containing other additives such as a non-reactive charge transport material or a compound having an unsaturated bond (unsaturated double bond). That is, the protection layer may further include other additives such as a polymer or a crosslinked material (preferably a crosslinked material) of the reactive charge transport material and the compound having unsaturated bond, or the non-reactive charge transport material.

As curing method of the cured film, radical polymerization by heat, light, or a radiation ray is performed. When the conditions are adjusted so that the reaction does not proceed excessively rapidly, the mechanical strength and the electrical characteristics of the protection layer (uppermost layer) are improved, and the generation of unevenness or wrinkles in the film is also suppressed, and therefore it is preferable to perform the polymerization under the conditions in which the radical generation occurs relatively slowly. In this viewpoint, the thermal polymerization which may easily adjust a polymerization velocity is preferable. That is, the composition for forming the cured film configuring the protection layer (uppermost layer) includes a thermal radial generator or a derivative thereof.

Hereinafter, each element of the protection layer (uppermost layer) configured with the cured film will be described in detail.

Reactive Charge Transport Material

The reactive charge transport material is selected from well-known materials, as long as it is a compound having a charge transport skeleton and a reactive group in the same molecule. Herein, as the reactive group, a chain polymerizable group is exemplified. For example, a functional group which may perform the radical polymerization may be used, and a functional group having a group containing at least a carbon double bond is used, for example. Specifically, the chain polymerizable group is not particularly limited, as long as it is a functional group which may perform the radical polymerization, and for example, a functional group having a group containing at least a carbon double bond is used. Specifically, examples thereof include a vinyl group, a vinyl ether group, a vinyl thioether group, a styryl group, an acryloyl group, a methacryloyl group, and a group containing at least one selected from derivatives thereof. Among these, a vinyl group, a styryl group, an acryloyl group, a methacryloyl group, and a group containing at least one selected from derivatives thereof are preferable as the chain polymerizable functional group, in a viewpoint of an excellent reactivity. In addition, examples of the reactive group include well-known reactive groups such as an epoxy group, —OH, —OR [herein, R represents an alkyl group], —$NH_2$, —SH, —COOH, and —$SiR^{Q1}{}_{3-Qn}(OR^{Q2})_{Qn}$ [herein, $R^{Q1}$ represents a hydrogen atom, an alkyl group, or a substituted or unsubstituted aryl group, $R^{Q2}$ represents a hydrogen atom, an alkyl group, or a trialkylsilyl group, and $_{Qn}$ represents an integer of 1 to 3].

The charge transport skeleton is not particularly limited, as long as it has a well-known structure of the electrophotographic photoreceptor, and is, for example, a skeleton derived from a nitrogen-containing hole transport compound such as a triarylamine compound, a benzidine compound, or a hydrazone compound and has a structure conjugated with the nitrogen atom. Among these, a triarylamine skeleton is preferable.

The chain polymerizable compound at least including a charge transport skeleton and a chain polymerizable functional group in the same molecule is preferable as the reactive charge transport material, in order to suppress unevenness in density of the image. Particularly, among the chain polymerizable compounds, at least one kind selected from specific chain polymerizable charge transport materials (chain polymerizable compounds represented by Formulae (I) and (II)) is preferable, in the same viewpoints as those described above and viewpoints of the electrical characteristics and the mechanical strength.

Specific Reactive Charge Transport Material

A specific reactive charge transport material is at least one selected from the group consisting of reactive compounds represented by Formulae (I) and (II).

(I)

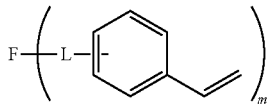

In Formula (I), F represents a charge transport skeleton.

L represents a divalent linking group containing two or more kinds selected from the group consisting of an alkylene group, an alkenylene group, —C(═O)—, —N(R)—, —S—, and —O—. R represents a hydrogen atom, an alkyl group, an aryl group, or an aralkyl group.

m represents an integer of 1 to 8.

(II)

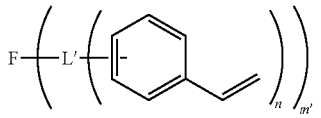

In Formula (II), F represents a charge transport skeleton.

L' represents a trivalent or tetravalent group derived from alkane or alkene, or an (n+1)-valent linking group containing two or more kinds selected from the group consisting of an alkylene group, an alkenylene group, —C(═O)—, —N(R)—, —S—, and —O—. R represents a hydrogen atom, an alkyl group, an aryl group, or an aralkyl group. The trivalent or tetravalent group derived from alkane or alkene means a group obtained by removing three or four hydrogen atoms from alkane or alkene. The same applies hereinafter.

m' represents an integer of 1 to 6. n represents an integer of 2 or 3.

In Formulae (I) and (II), F represents a charge transport skeleton, that is, a structure having a charge transport property, and specific examples thereof include structures having a charge transport property of a phthalocyanine compound, a porphyrin compound, an azobenzene compound, a triarylamine compound, a benzidine compound, an arylalkane compound, an aryl-substituted ethylene compound, a stilbene compound, an anthracene compound, a hydrazone compound, a quinone compound, and a fluorenone compound.

In Formula (I), examples of the linking group represented by L include a divalent linking group in which —C(=O)—O— is inserted between alkylene groups, a divalent linking group in which —C(=O)—N(R)— is inserted between alkylene groups, a divalent linking group in which —C(=O)—S— is inserted between alkylene groups, a divalent linking group in which —O— is inserted between alkylene groups, a divalent linking group in which —N(R)— is inserted between alkylene groups, and a divalent linking group in which —S— is inserted between alkylene groups.

In the linking group represented by L, two groups of —C(=O)—O—, —C(=O)—N(R)—, —C(=O)—S—, —O—, or —S— may be inserted between alkylene groups.

In Formula (I), specific examples of the linking group represented by L include $*—(CH_2)_p—C(=O)—O—(CH_2)_q—$, $*—(CH_2)_p—O—C(=O)—(CH_2)_r—C(=O)—O—(CH_2)_q—$, $*—(CH_2)_p—C(=O)—N(R)—(CH_2)_q—$, $*—(CH_2)_p—C(=O)—S—(CH_2)_q—$, $*—(CH_2)_p—O—(CH_2)_q—$, $*—(CH_2)_p—N(R)—(CH_2)_q—$, $*—(CH_2)_p—S—(CH_2)_q—$, and $*—(CH_2)_p—O—(CH_2)_r—O—(CH_2)_q—$.

Herein, in the linking groups represented by L, p represents an integer of 0 or 1 to 6 (preferably, 1 to 5). q represents an integer of 1 to 6 (preferably, 1 to 5). r represents an integer of 1 to 6 (preferably, 1 to 5).

In the linking groups represented by L, "*" represents a part linked with F.

Meanwhile, in Formula (II), examples of the linking group represented by L' include an (n+1)-valent linking group in which —C(=O)—O— is inserted between alkylene groups linked in a branched manner, an (n+1)-valent linking group in which —C(=O)—N(R)— is inserted between alkylene groups linked in a branched manner, an (n+1)-valent linking group in which —C(=O)—S— is inserted between alkylene groups linked in a branched manner, an (n+1)-valent linking group in which —O— is inserted between alkylene groups linked in a branched manner, an (n+1)-valent linking group in which —N(R)— is inserted between alkylene groups linked in a branched manner, and an (n+1)-valent linking group in which —S— is inserted between alkylene groups linked in a branched manner.

In the linking group represented by L', two groups of —C(=O)—O—, —C(=O)—N(R)—, —C(=O)—S—, —O—, and —S— may be inserted between alkylene groups linked in a branched manner.

In Formula (II), specific examples of the linking group represented by L' include $*—(CH_2)_p—CH[C(=O)—O—(CH_2)_q—]_2$, $*—(CH_2)—CH=C[C(=O)—O—(CH_2)_q—]_2$, $*—(CH_2)_p—CH[C(=O)—N(R)—(CH_2)_q—]_2$, $*—(CH_2)_p—CH[C(=O)—S—(CH_2)_q—]_2$, $*—(CH_2)_p—CH[(CH_2)_r—O—(CH_2)_q—]_2$, $*—(CH_2)_p—CH=C[(CH_2)_r—O—(CH_2)_q—]_2$, $*—(CH_2)_p—CH[(CH_2)_r—N(R)—(CH_2)_q—]_2$, $*—(CH_2)_p—CH[(CH_2)_r—S—(CH_2)_q—]_2$,

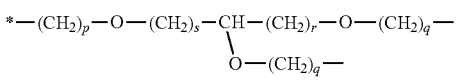

$*—(CH_2)_p—O—C[(CH_2)_r—O—(CH_2)_q—]_3$, and $—(CH_2)_p—C(=O)—O—C[(CH_2)_r—O—(CH_2)_q—]_3$.

Herein, in the linking groups represented by L', p represents an integer of 0 or 1 to 6 (preferably, 1 to 5). q represents an integer of 1 to 6 (preferably, 1 to 5). r represents an integer of 1 to 6 (preferably, 1 to 5). s represents an integer of 1 to 6 (preferably, 1 to 5).

In the linking groups represented by L', "*" represents a part linked with F.

Among these, in Formula (II), as the linking group represented by L', $*—(CH_2)_p—CH[C(=O)—O—(CH_2)_q—]_2$, $*—(CH_2)_p—CH=C[C(=O)—O—(CH_2)_q—]_2$, $*—(CH_2)_p—CH[(CH_2)_r—O—(CH_2)_q—]_2$, and $*—(CH_2)_p—CH=C[(CH_2)_r—O—(CH_2)_q—]_2$ may be used.

Specifically, as groups to be linked to the charge transport skeleton represented by F of the reactive compound represented by Formula (II) (corresponding to groups represented by Formulae (IIA-a)), groups represented by the following Formula (IIA-a1), following Formula (IIA-a2), following Formula (IIA-a3), and following Formula (IIA-a4) are used.

(IIA-a1)

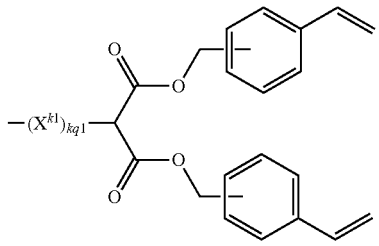

(IIA-a2)

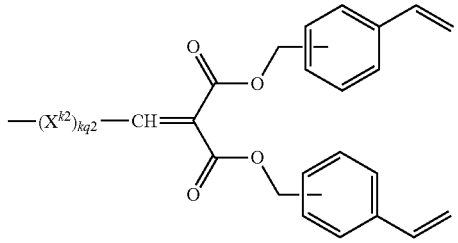

In Formula (IIA-a1) or (IIA-a2), $X^{k1}$ represents a divalent linking group. kq1 represents an integer of 0 or 1. $X^{k2}$ represents a divalent linking group. kq2 represents an integer of 0 or 1.

Herein, as the divalent linking group represented by $X^{k1}$ and $X^{k2}$, $—(CH_2)_p—$ (herein, p represents an integer of 1 to 6 (preferably, 1 to 5)), is used, for example. As the divalent linking group, an alkyleneoxy group is also used.

(IIA-a3)

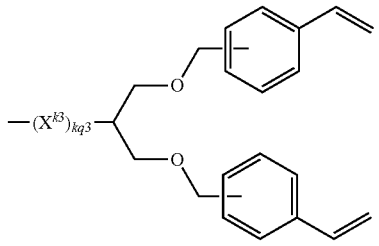

-continued (IIA-a4)

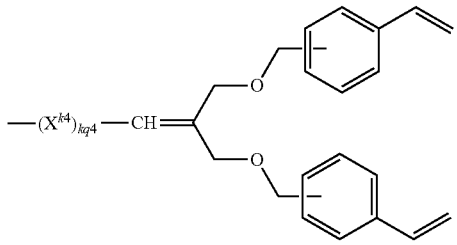

In Formula (IIA-a3) or (IIA-a4), $X^{k3}$ represents a divalent linking group. kq3 represents an integer of 0 or 1. $X^{k4}$ represents a divalent linking group. kq4 represents an integer of 0 or 1. Herein, as the divalent linking group represented by $X^{k3}$ and $X^{k4}$, —$(CH_2)_p$— (herein, p represents an integer of 1 to 6 (preferably, 1 to 5)), is used, for example. As the divalent linking group, an alkyleneoxy group is also used.

In Formulae (I) and (II), as an alkyl group represented by R of "—N(R)—" in the linking groups represented by L and L', a linear or branched alkyl group having 1 to 5 (preferably, 1 to 4) carbon atoms is used, and specific examples thereof include methyl group, an ethyl group, a propyl group, and a butyl group.

As an aryl group represented by R of "—N(R)—", an aryl group having 6 to 15 (preferably, 6 to 12) carbon atoms is used, and specific examples thereof include phenyl group, a toluyl group, a xylyl group, and a naphthyl group.

As an aralkyl group, an aralkyl group having 7 to 15 (preferably, 7 to 14) carbon atoms is used, and specific examples thereof include a benzyl group, a phenethyl group, and a biphenyl methylene group.

In Formulae (I) and (II), m preferably represents an integer of 1 to 6.

m' preferably represents an integer of 1 to 6.

n preferably represents an integer of 2 or 3.

Next, the preferable compounds of the reactive compound represented by Formulae (I) and (II) will be described.

As the reactive compounds represented by Formulae (I) and (II), reactive compounds having a charge transport skeleton (structure having a charge transport property) derived from a triarylamine compound as F is used.

Specifically, as the reactive compound represented by Formula (I), at least one kind of a compound selected from the group consisting of reactive compounds represented by Formula (I-a), Formula (I-b), Formula (I-c), and Formula (I-d) is preferable.

Meanwhile, as the reactive compound represented by Formula (II), a reactive compound represented by Formula (II-a) is preferable.

Reactive Compound Represented by Formula (I-a)

The reactive compound represented by Formula (I-a) will be described.

When the reactive compound represented by Formula (I-a) is used as the specific reactive charge transport material, it is easy to prevent deterioration of electrical characteristics due to an environmental change. The reason therefor is not clear, but the followings are assumed.

First, in the reactive compound having a (meth)acrylic group used in the related art, hydrophilicity of the (meth) acrylic group is strong with respect to a part of a skeleton which realizes the charge transport performance at the time of polymerization, and therefore, this may cause some sort of a layer separation state and may inhibit hopping conduction. Accordingly, in a case of using a charge transport film including a polymer or a crosslinked material of the reactive compound having the (meth)acrylic group, charge transport efficiency decreases, and environmental stability decreases due to partial adsorption of moisture.

With respect to this, the reactive compound represented by Formula (I-a) has a vinyl chain polymerizable group having hydrophilicity which is not strong, and has plural skeletons which realize the charge transport performance in one molecule. These skeletons are linked to each other by a linking group which does not have an aromatic ring or conjugated bond such as a conjugated double bond and has flexibility. By having such a structure, the efficient charge transport performance and the high strength are obtained, and the formation of the layer separation state at the time of polymerization is prevented. As a result, the protection layer (uppermost layer) including a polymer or a crosslinked material of the reactive compound represented by Formula (I-a) have both excellent charge transport performance and excellent mechanical strength, and may decrease environmental dependency (temperature and humidity dependency) of the charge transport performance.

As described above, when using the reactive compound represented by Formula (I-a), it is easy to prevent deterioration of the electrical characteristics due to environmental change.

(I-a)

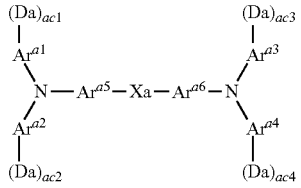

In Formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group. Xa represents a divalent linking group obtained by combining groups selected from an alkylene group, —O—, —S—, and ester. Da represents a group represented by the following Formula (IA-a). ac1 to ac4 each independently represent an integer of 0 to 2. Herein, the total of Da is 1 or 2.

(IA-a)

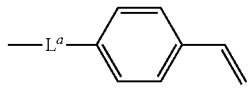

In Formula (IA-a), $L^a$ represents a divalent linking group represented by *—$(CH_2)_{an}$—O—$CH_2$— and to be linked to the groups represented by $Ar^{a1}$ to $Ar^{a4}$ at *. an represents an integer of 1 or 2.

Hereinafter, Formula (I-a) will be described in detail.

In Formula (I-a), the substituted or unsubstituted aryl groups represented by $Ar^{a1}$ to $Ar^{a4}$ may be the same as or may be different from each other.

Herein, examples of a substituent of the substituted aryl group include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, as a substituent other than "Da".

In Formula (I-a), $Ar^{a1}$ to $Ar^{a4}$ are preferably any of the following Structural Formulae (1) to (7).

The following Structural Formulae (1) to (7) also show "-$(D)_c$" which collectively represents "-$(Da)_{ac1}$" to "-$(Da)_{ac1}$" which may be linked to $Ar^{a1}$ to $Ar^{a4}$.

(1)

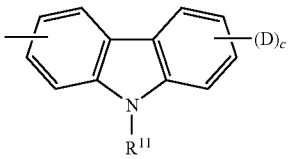

(2)

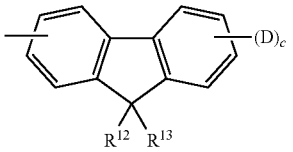

(3)

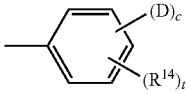

(4)

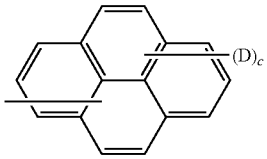

(5)

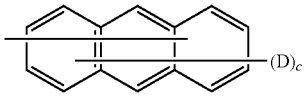

(6)

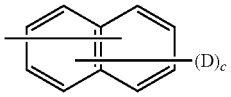

(7)

In Structural Formulae (1) to (7), $R^{11}$ represents one kind selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms. $R^{12}$ and $R^{13}$ each independently represent one kind selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. $R^{14}$ represents one kind selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group. s represents 0 or 1. t represents an integer of 0 to 3. Z' represents a divalent organic linking group.

Herein, in Formula (7), Ar is preferably represented by the following Structural Formula (8) or (9).

(8)

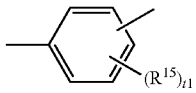

(9)

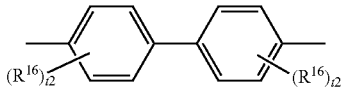

In Structural Formulae (8) and (9), $R^{15}$ and $R^{16}$ each independently represent one kind selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t1 and t2 each represent an integer of 0 to 3.

In Formula (7), Z' is preferably represented by any one of the following Structural Formulae (10) to (17).

(10)

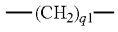

(11)

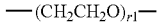

(12)

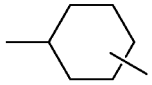

(13)

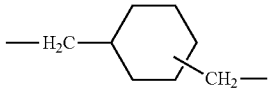

(14)

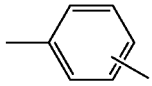

(15)

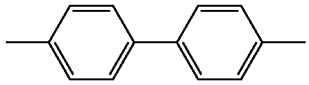

(16)

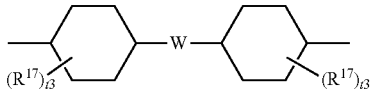

(17)

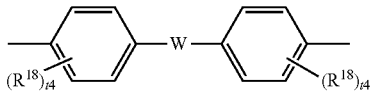

In Structural Formulae (10) to (17), $R^{17}$ and $R^{18}$ each independently represent one kind selected from the group consisting of an alkyl group having 1 to 4 carbon atoms, an alkoxy group having 1 to 4 carbon atoms or a phenyl group substituted with an alkoxy group having 1 to 4 carbon atoms, an unsubstituted phenyl group, an aralkyl group having 7 to 10 carbon atoms, and a halogen atom. W represents a divalent group. q1 and r1 each independently represent an integer of 1 to 10. t3 and t4 each independently represent an integer of 0 to 3.

In Structural Formulae (16) and (17), W is preferably any one of divalent groups represented by the following Structural Formulae (18) to (26). Herein, in Formula (25), u represents an integer of 0 to 3.

(18) $—CH_2—$

(19) $—C(CH_3)_2—$

(20) —O—

(21) —S—

(22) $—C(CF_3)_2—$

(23) $—Si(CH_3)_2—$ (24)

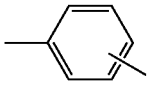

(25)

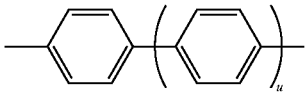

(26)

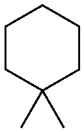

Regarding the substituted or unsubstituted arylene group represented by $Ar^{a5}$ and $Ar^{a6}$ in Formula (I-a), this arylene group is an arylene group obtained by removing one hydrogen atom at a desired position, from the aryl group exemplified in the description of $Ar^{a1}$ to $Ar^{a4}$.

In addition, a substituent of the substituted arylene group is the same as the substituent exemplified as the substituent other than "Da" of the substituted aryl group in the description of $Ar^{a1}$ to $Ar^{a4}$.

In Formula (I-a), the divalent linking group represented by Xa is an alkylene group or a divalent linking group obtained by combining groups selected from an alkylene group, —O—, —S—, and ester, and is a linking group which does not has an aromatic ring or conjugated bond such as a conjugated double bond.

Specifically, as the divalent linking group represented by Xa, an alkylene group having 1 to 10 carbon atoms is also exemplified, and in addition, a divalent group obtained by combining groups selected from an alkylene group having 1 to 10 carbon atoms, —O—, —S—, —O—C(═O)—, and —C(═O)—O— is also exemplified.

In a case where the divalent linking group represented by Xa is an alkylene group, this alkylene group may include a substituent of alkyl, alkoxy, or halogen. Two of these substituents may be coupled with each other and the alkylene group may have such a structure of a divalent linking group represented by Structural Formula (26) disclosed as a specific example of W in Structural Formulae (16) to (17).

Reactive Compound Represented by Formula (I-b)

The reactive compound represented by Formula (I-b) will be described.

When the reactive compound represented by Formula (I-b) is used as the specific reactive charge transport material, it is easy to prevent abrasion of the protection layer (uppermost layer) and to suppress generation of unevenness in density of the image. The reason therefor is not clear, but the followings are assumed.

First, when a bulky charge transport skeleton and a polymerized part (styryl group) are structurally close to each other and are rigid, it is difficult for the polymerized parts to move, and residual strain due to a curing reaction easily remains. Accordingly, a level of a highest occupied molecular orbital (HOMO) for carrier transport is changed due to the strain of the charge transport skeleton, and as a result, energy distribution may be spread (energy disorder: large σ).

With respect to this, when a methylene group and an ether group are interposed therebetween, flexibility is applied to a molecular structure, and the value of σ is easily decreased. In addition, a methylene group and an ether group have a small dipole moment compared to an ether group and amide group, and these results contribute to obtain a small value of σ, and the electrical characteristics are improved. By adding flexibility to the molecular structure, a degree of freedom of a motion of a reacted part (reacted site) increases and a reaction rate is also improved, and accordingly, a film having high strength is obtained.

As described above, a structure in which a linking chain having high flexibility is interposed between the charge transport skeleton and the polymerized part is preferable.

Accordingly, the reactive compound represented by Formulae (I-b) increases a molecular weight of the molecule by the curing reaction, makes the center of gravity hardly move, and increases a degree of freedom of a styryl group. As a result, the protection layer (uppermost layer) including a polymer or a crosslinked material of the reactive compound represented by Formula (I-b) has excellent electrical characteristics and high strength.

As described above, when using the reactive compound represented by Formula (I-b), it is easy to suppress abrasion of the protection layer (uppermost layer) and to suppress generation of unevenness in density of the image.

(I-b)

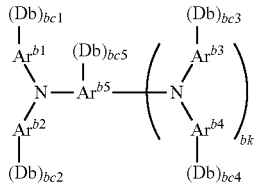

In Formula (I-b), $Ar^{b1}$ to $Ar^{b4}$ each independently represent a substituted or unsubstituted aryl group. $Ar^{b5}$ represents a substituted or unsubstituted aryl group or a substituted or unsubstituted arylene group. Db represents a group represented by the following Formula (IA-b). bc1 to bc5 each independently represent an integer of 0 to 2. bk represents 0 or 1. Herein, the total of Db is 1 or 2.

(IA-b)

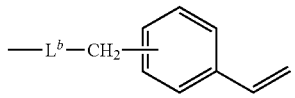

In Formula (IA-b), $L^b$ represents a divalent linking group including a group represented by $*—(CH_2)_{bn}—O—$ and to be linked to a group represented by $Ar^{b1}$ to $Ar^{b5}$ at *. bn represents an integer of 3 to 6.

Hereinafter, Formula (I-b) will be described in detail.

The substituted or unsubstituted aryl group represented by $Ar^{b1}$ to $Ar^{b4}$ in Formula (IA-b) is the same as the substituted or unsubstituted aryl group represented by $Ar^{a1}$ to $Ar^{a4}$ in Formula (I-a).

When bk is 0, $Ar^{b5}$ represents a substituted or unsubstituted aryl group, and this substituted or unsubstituted aryl group is the same as the substituted or unsubstituted aryl group represented by $Ar^{a1}$ to $Ar^{a4}$ in Formula (I-a).

When bk is 1, $Ar^{b5}$ represents a substituted or unsubstituted arylene group, and this substituted or unsubstituted arylene group is the same as the substituted or unsubstituted arylene group represented by $Ar^{a5}$ and $Ar^{a6}$ in Formula (I-a).

Next, Formula (IA-b) will be described in detail.

Examples of the divalent linking group represented by $L^b$ in Formula (IA-b) include $*—(CH_2)_{bp}—O—$ and $*—(CH_2)_{bp}—O—(CH_2)_{bq}—O—$.

Herein, in the linking group represented by $L^b$, bp represents an integer of 3 to 6 (preferably, 3 to 5). bq represents an integer of 1 to 6 (preferably, 1 to 5).

In the linking group represented by $L^b$, "*" represents a part to be linked to the groups represented by $Ar^{b1}$ to $Ar^{b5}$.

Reactive Compound Represented by Formula (I-c)

The reactive compound represented by Formula (I-c) will be described.

When the reactive compound represented by Formula (I-c) is used as the specific reactive charge transport material, scratches are hardly generated on the surface even with repeated use, and image quality deterioration is easily prevented. The reason therefor is not clear, but the followings are assumed.

First, when forming the uppermost layer including a polymer or a crosslinked material of the specific reactive charge transport material, film shrinkage accompanied with the polymerization reaction or the crosslinking reaction or aggregation of a charge transport structure or a structure around a chain polymerizable group occurs. Accordingly, when mechanical load is applied to the surface of the electrophotographic photoreceptor due to repeated use, the film is abraded or a chemical structure in the molecule is broken. Therefore, the film shrinkage or aggregation state is changed, the electrical characteristics of the electrophotographic photoreceptor are changed, and the image quality deterioration occurs.

Meanwhile, since the reactive compound represented by Formula (I-c) has a styrene skeleton as a chain polymerizable group, the reactive compound is excellently compatible with an aryl group which is a main skeleton of the charge transport material, and the film shrinkage or the aggregation of the charge transport structure or the structure around the chain polymerizable group due to the polymerization reaction or the crosslinking reaction is prevented. As a result, the electrophotographic photoreceptor including the protection layer (uppermost layer) including a polymer or a crosslinked material of the reactive compound represented by Formula (I-c) suppresses the image quality deterioration due to the repeated use.

In addition, since the charge transport skeleton and the styrene skeleton are linked to each other with a linking group having a specific group such as —C(=O)—, —N(R)—, or —S— in the reactive compound represented by Formula (I-c), an interaction between the specific group and a nitrogen atom in the charge transport skeleton or between the specific groups occurs. As a result, the strength of the protection layer (uppermost layer) including a polymer or a crosslinked material of the reactive compound represented by Formula (I-c) is further improved.

As described above, when using the reactive compound represented by Formula (I-c), scratches are hardly generated on the surface even with repeated use, and image quality deterioration is easily prevented.

The specific group such as —C(=O)—, —N(R)—, or —S— is a reason for charge transport property deterioration or image quality deterioration under high humidity conditions, due to its polarity or hydrophilicity. However, since the reactive compound represented by Formula (I-c) has a styrene skeleton having higher hydrophobicity than (meth) acryl as the chain polymerizable group, the charge transport property deterioration or the image quality deterioration such as a residual image phenomenon (ghost) due to history of previous cycles hardly occurs.

(I-c)

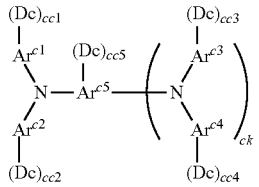

In Formula (I-c), $Ar^{c1}$ to $Ar^{c4}$ each independently represent a substituted or unsubstituted aryl group. $Ar^{c5}$ represents a substituted or unsubstituted aryl group or a substituted or unsubstituted arylene group. Dc represents a group represented by the following Formula (IA-c). cc1 to cc5 each independently represent an integer of 0 to 2. ck represents 0 or 1. Herein, the total of Dc is 1 to 8.

(IA-c)

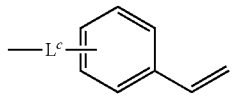

In Formula (IA-c), $L^c$ represents a divalent linking group including one or more groups selected from the group consisting —C(=O)—, —N(R)—, —S—, and a group obtained by combining —C(=O)— with —O—, —N(R)—, or —S—. R represents a hydrogen atom, an alkyl group, an aryl group, or an aralkyl group.

Hereinafter, Formula (I-c) will be described in detail.

The substituted or unsubstituted aryl group represented by $Ar^{c1}$ to $Ar^{c4}$ in Formula (I-c) is the same as the substituted or unsubstituted aryl group represented by $Ar^{a1}$ to $Ar^{a4}$ in Formula (I-a).

When ck is 0, $Ar^{c5}$ represents a substituted or unsubstituted aryl group, and this substituted or unsubstituted aryl group is the same as the substituted or unsubstituted aryl group represented by $Ar^{a1}$ to $Ar^{a4}$ in Formula (I-a).

When ck is 1, $Ar^{c5}$ represents a substituted or unsubstituted arylene group, and this substituted or unsubstituted arylene group is the same as the substituted or unsubstituted arylene group represented by $Ar^{a5}$ and $Ar^{a6}$ in Formula (I-a).

The total of Dc is preferably equal to or greater than 2 and more preferably equal to or greater than 4, in order to obtain a protection layer (uppermost layer) having higher strength. In general, when the number of chain polymerizable groups in one molecule is excessively large, the molecules decrease in movement as the polymerization (crosslinking) reaction proceeds, the chain polymerization reactivity is decreased, and a rate of the non-reactive chain polymerizable group is increased. Therefore, the total of the Dc is preferably equal to or smaller than 7 and more preferably equal to or smaller than 6.

Next, Formula (IA-c) will be described in detail.

Examples of the divalent linking group represented by $L^c$ in Formula (IA-c) include divalent linking groups having —C(=O)—, —N(R)—, —S—, and a group obtained by combining —C(=O)— with —O—, —N(R)—, or —S— (hereinafter, referred to as "specific linking group").

Herein, examples of the specific linking group includes —C(=O)—, —N(R)—, —S—, —C(=O)—O—, —C(=O)—N(R)—, —C(=O)—S—, —O—C(=O)—O—, and —O—C(=O)—N(R)— and preferably include —N(R)—, —S—, —C(=O)—O—, —C(=O)—N(H)—, and —C(=O)—O—, and more preferably include —C(=O)—O—, in the viewpoint of balance between the strength and the polarity (hydrophilic and hydrophobic properties) of the protection layer (uppermost layer).

As the divalent linking group represented by $L^c$, a divalent linking group formed by combining the specific linking group, a residue of saturated hydrocarbon (including any linear, branched, and cyclic types) or aromatic hydrocarbon, and an oxygen atom with each other is exemplified. Among these, a divalent linking group formed by combining the specific linking group, a residue of linear saturated hydrocarbon, and an oxygen atom with each other is used.

The total of carbon atoms included in the divalent linking group represented by $L^c$ is, for example, 1 to 20 and preferably 2 to 10, in the viewpoints of density of the styrene skeletons in the molecule and the chain polymerization reactivity.

Specific examples of the divalent linking group represented by L in Formula (IA-c) include $*—(CH_2)_{cp}—C(=O)—O—(CH_2)_{cq}—$, $*—(CH_2)_{cp}—O—C(=O)—(CH_2)_{cr}—C(=O)—O—(CH_2)_{cq}—$, $*—(CH_2)_{cp}—C(=O)—N(R)—(CH_2)_{cq}—$, $*—(CH_2)_{cp}—C(=O)—S—(CH_2)_{cq}—$, $*—(CH_2)_{cp}—N(R)—(CH_2)_{cq}—$, and $*—(CH_2)_{cp}—S—(CH_2)_{cq}—$.

Herein, in the linking group represented by $L^c$, cp represents an integer of 0, or 1 to 6 (preferably, 1 to 5). cq represents an integer of 1 to 6 (preferably, 1 to 5). cr represents an integer of 1 to 6 (preferably, 1 to 5).

In the linking groups represented by L, "*" represents a part linked with a group represented by $Ar^{c1}$ to $Ar^{c5}$.

Among these, in Formula (IA-c), as the divalent linking group represented by $L^c$, $*—(CH_2)_{cp}—C(=O)—O—CH_2—$ is preferable. That is, the group represented by Formula (IA-c) is preferably a group represented by the following Formula (IA-c1). Herein, in Formula (IA-c1), cp1 represents an integer of 0 to 4.

(IA-c1)

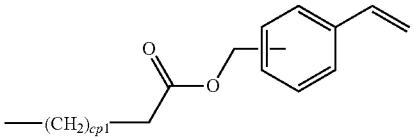

Reactive Compound Represented by Formula (I-d)

The reactive compound represented by Formula (I-d) will be described.

When the reactive compound represented by Formula (I-d) is used as the specific reactive charge transport material, it is easy to prevent abrasion of the protection layer (uppermost layer) and to suppress generation of unevenness in density of the image. The reason therefor is not clear, but the same reason as in the case of the reactive compound represented by Formula (I-b) is assumed.

Particularly, the total of Dd in the reactive compound represented by Formula (I-d) is 3 to 8 which is greater than the case of Formula (I-b), and accordingly, it is easy to form a crosslinked structure (crosslinked network) having a higher crosslinked material to be formed and to further prevent the abrasion of the protection layer (uppermost layer).

(I-d)

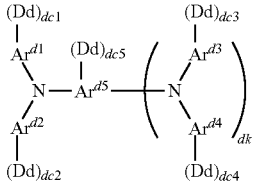

In Formula (I-d), $Ar^{d1}$ to $Ar^{d4}$ each independently represent a substituted or unsubstituted aryl group. $Ar^{d5}$ represents a substituted or unsubstituted aryl group or a substituted or unsubstituted arylene group. Dd represents a group represented by the following Formula (IA-d). dc1 to dc5 each independently represent an integer of 0 to 2. dk represents 0 or 1. Herein, the total of Dd is 3 to 8.

(IA-d)

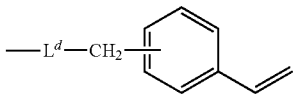

In Formula (IA-d), $L^d$ represents a divalent linking group including a group represented by $*—(CH_2)_{dn}—O—$ and to be linked to a group represented by $Ar^{d1}$ to $Ar^{d5}$ at *. dn represents an integer of 1 to 6.

Hereinafter, Formula (I-d) will be described in detail.

The substituted or unsubstituted aryl group represented by $Ar^{d1}$ to $Ar^{d4}$ in Formula (I-d) is the same as the substituted or unsubstituted aryl group represented by $Ar^{a1}$ to $Ar^{a4}$ in Formula (I-a).

When dk is 0, $Ar^{d5}$ represents a substituted or unsubstituted aryl group, and this substituted or unsubstituted aryl group is the same as the substituted or unsubstituted aryl group represented by $Ar^{a1}$ to $Ar^{a4}$ in Formula (I-a).

When dk is 1, $Ar^{d5}$ represents a substituted or unsubstituted arylene group, and this substituted or unsubstituted arylene group is the same as the substituted or unsubstituted arylene group represented by $Ar^{a5}$ and $Ar^{a6}$ in Formula (I-a).

The total of Dd is preferably equal to or greater than 4, in order to obtain the protection layer (uppermost layer) having higher strength.

Next, Formula (IA-d) will be described in detail.

Examples of the divalent linking group represented by $L^d$ in Formula (IA-d) include $*—(CH_2)_{dp}—O—$ and $*—(CH_2)_{dp}—O—(CH_2)_{dq}—O—$.

Herein, in the linking group represented by $L^d$, dp represents an integer of 1 to 6 (preferably, 1 to 5). dq represents an integer of 1 to 6 (preferably, 1 to 5).

In the linking group represented by $L^d$, "*" represents a part to be linked to the groups represented by $Ar^{d1}$ to $Ar^{d5}$.

Reactive Compound Represented by Formula (II-a)

The reactive compound represented by Formula (II-a) will be described.

When the reactive compound represented by Formula (II) (particularly, Formula (II-a)) is used as the specific reactive charge transport material, it is easy to prevent deterioration of the electrical characteristics even with repeated use for a long time. The reason therefor is not clear, but the followings are assumed.

First, the reactive compound represented by Formula (II) (particularly, Formula (II-a)) is a compound having two or three chain polymerizable reactive groups (styrene groups) with one linking group interposed therebetween from the charge transport skeleton.

Accordingly, when using the reactive compound represented by Formula (II) (particularly, Formula (II-a)), a high degree of curing and the large number of crosslinked parts are maintained, the strain hardly occurs in the charge transport skeleton at the time of the polymerization and crosslinking due to the presence of the crosslinking group, and it is easy to realize both the high degree of curing and excellent charge transport performance.

When using the charge transport compound having a (meth)acrylic group used in the related art, the strain is easily generated as described above, the reactive part has high hydrophilicity, and the charge transport part has high hydrophobicity, and accordingly, microscopic phase separation (micro phase separation) is easily performed. Meanwhile, when using the reactive compound represented by Formula (II) (particularly, Formula (II-a)), the styrene group is included as a reactive group, a structure having a linking group which hardly generates the strain in the charge transport skeleton when being cured (crosslinked) is obtained, the phase separation hardly occurs because the both reactive part and the charge transport part have hydrophobicity, and therefore, efficient charge transport performance and high strength are realized. As a result, the protection layer (uppermost layer) including a polymer or a crosslinked material of the reactive compound represented by Formula (II) (particularly, Formula (II-a)) realizes excellent mechanical strength and more excellent charge transport performance (electrical characteristics).

As described above, when using the reactive compound represented by Formula (II) (particularly, Formula (II-a)), it is easy to prevent deterioration of electrical characteristics even with the repeated use for a long time.

(II-a)

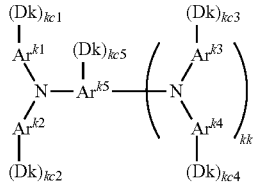

In Formula (II-a), $Ar^{k1}$ to $Ar^{k4}$ each independently represent a substituted or unsubstituted aryl group. $Ar^{k5}$ represents a substituted or unsubstituted aryl group or a substituted or unsubstituted arylene group. Dk represents a group represented by the following Formula (IIA-a). kc1 to kc5 each independently represent an integer of 0 to 2. kk represents 0 or 1. Herein, the total of Dk is 1 to 8.

(IIA-a)

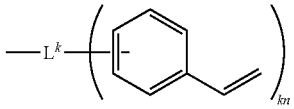

In Formula (IIA-a), $L^k$ represents a trivalent or tetravalent group derived from alkane or alkene, or (kn+1)-valent linking group containing two or more kinds selected from the group consisting of an alkylene group, an alkenylene group, —C(=O)—, —N(R)—, —S—, and —O—. R represents a hydrogen atom, an alkyl group, an aryl group, or an aralkyl group. kn represents an integer of 2 or 3.

Hereinafter, Formula (II-a) will be described in detail.

The substituted or unsubstituted aryl group represented by $Ar^{k1}$ to $Ar^{k4}$ in Formula (II-a) is the same as the substituted or unsubstituted aryl group represented by $Ar^{a1}$ to $Ar^{a4}$ in Formula (I-a).

When kk is 0, $Ar^{k5}$ represents a substituted or unsubstituted aryl group, and this substituted or unsubstituted aryl group is the same as the substituted or unsubstituted aryl group represented by $Ar^{a1}$ to $Ar^{a4}$ in Formula (I-a).

When kk is 1, $Ar^{k5}$ represents a substituted or unsubstituted arylene group, and this substituted or unsubstituted arylene group is the same as the substituted or unsubstituted arylene group represented by $Ar^{a5}$ and $Ar^{a6}$ in Formula (I-a).

The total of Dk is preferably equal to or greater than 2 and more preferably equal to or greater than 4, in order to obtain a protection layer (uppermost layer) having higher strength. In general, when the number of chain polymerizable groups in one molecule is excessively large, the molecules decrease in movement as the polymerization (crosslinking) reaction proceeds, the chain polymerization reactivity is decreased, and a rate of the non-reactive chain polymerizable group is increased. Therefore, the total of the Dk is preferably equal to or smaller than 7 and more preferably equal to or smaller than 6.

Next, Formula (IIA-a) will be described in detail.

The (kn+1)-valent linking group represented by $L^k$ in Formula (IIA-a) is the same as the (n+1)-valent linking group represented by L' in Formula (II).

Hereinafter, the specific reactive charge transport material will be described in detail.

Specifically, specific examples of the charge transport skeleton F of Formulae (I) and (II) (for example, part corresponding to a skeleton excluding Da in Formula (I-a) or Dk in Formula (II-a)), specific examples of a functional group to be linked to the charge transport skeleton F (for example, part corresponding to Da in Formula (I-a) or Dk in Formula (II-a)), and specific examples of the reactive compound represented by Formulae (I) and (II) will be described, but there is no limitation.

The part "*" in the specific examples of the charge transport skeleton F of Formulae (I) and (II) means that the part "*" of the functional group to be linked to the charge transport skeleton F is linked.

That is, for example, Exemplified Compound (I-b)-1 is represented as the specific example of the charge transport skeleton F: (M1)-1 and the specific example of the functional group: (R2)-1, and the following structures are shown as the specific structures.

(I-b)-1
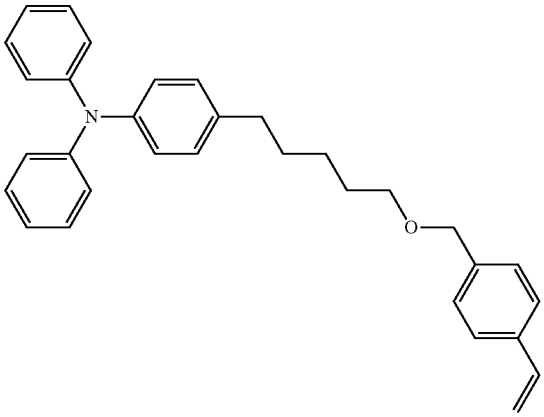
First, specific examples of the charge transport skeleton F are shown as follows.
(M1)-1
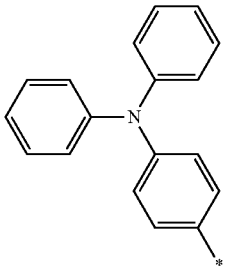
(M1)-2
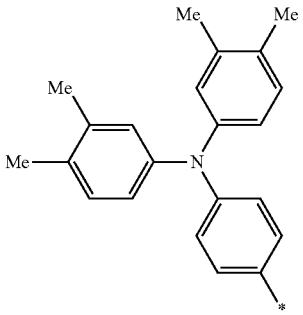
(M1)-3
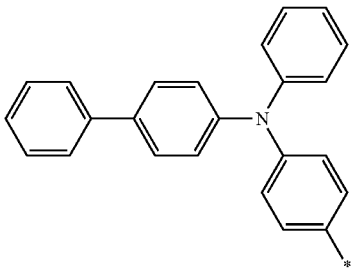
-continued
(M1)-4
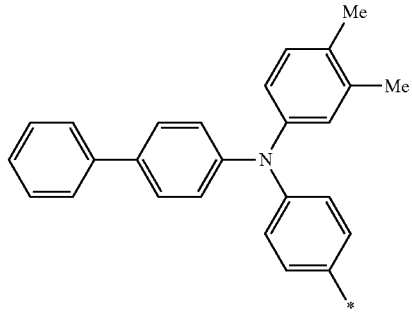
(M1)-5
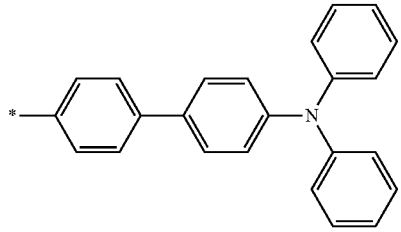
(M1)-6
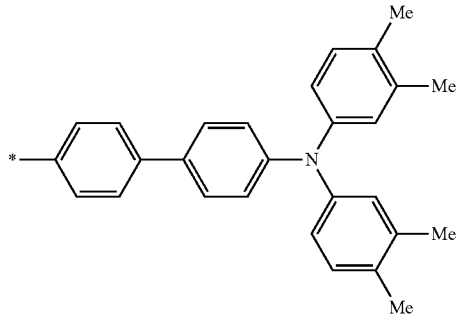
(M1)-7
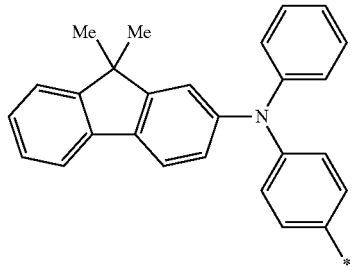
(M1)-8
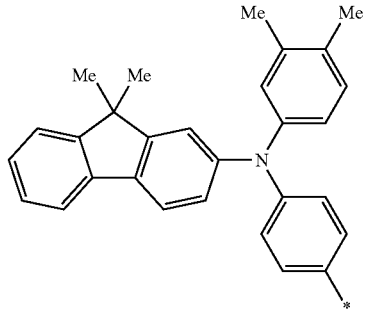

-continued
(M1)-9
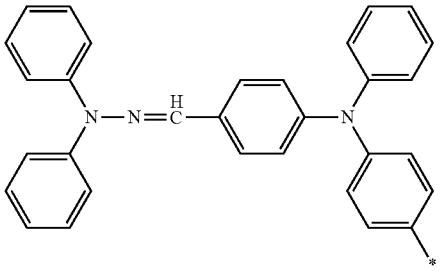
(M1)-10
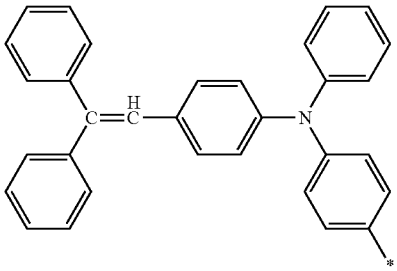
(M1)-11
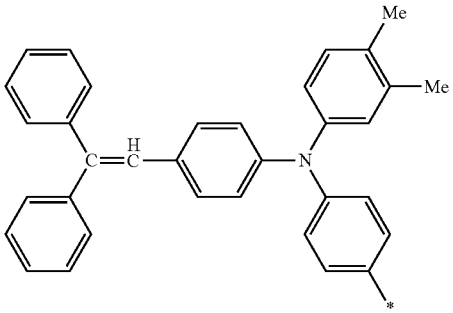
(M1)-12
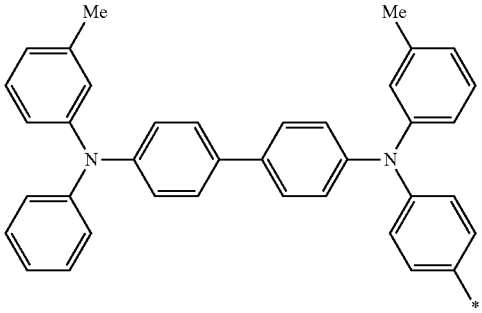
(M1)-13
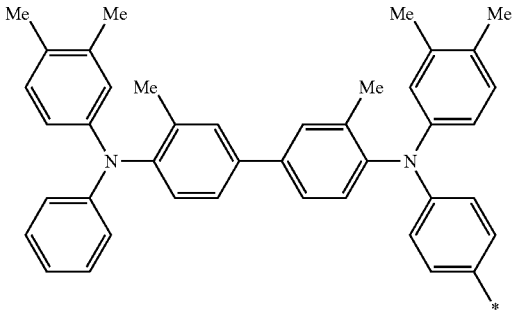
-continued
(M1)-14
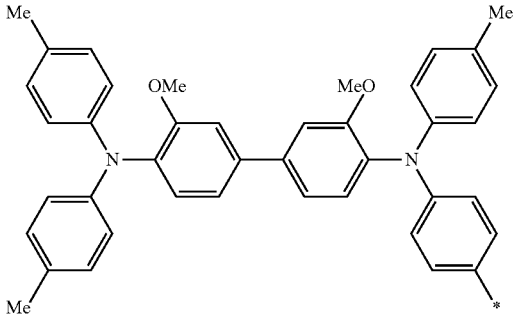
(M1)-15
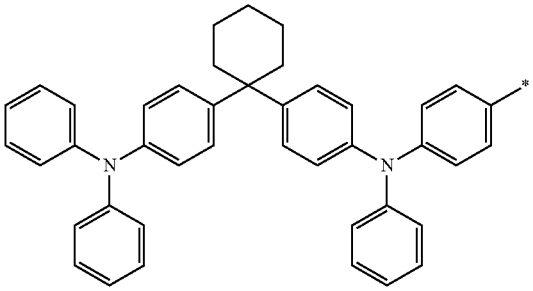
(M1)-16
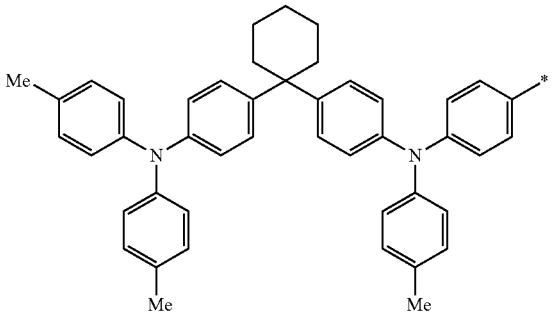
(M1)-17
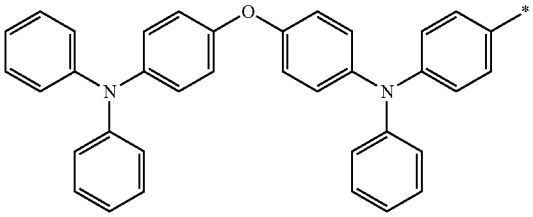
(M1)-18
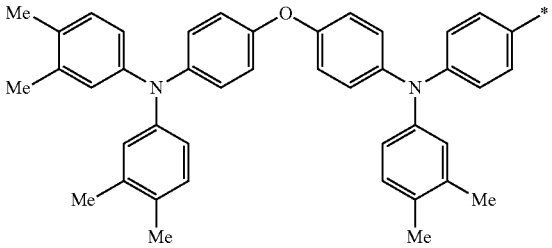

-continued
(M1)-19
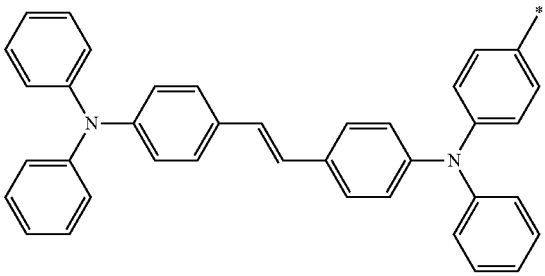
(M1)-20
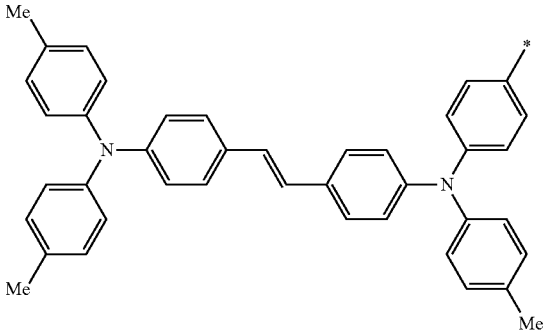
(M1)-21
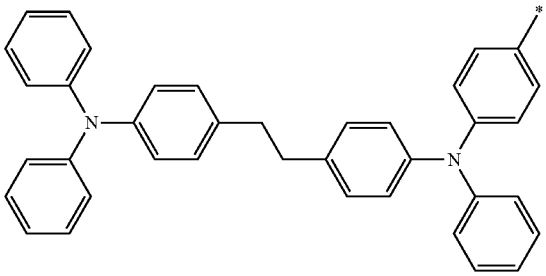
(M1)-22
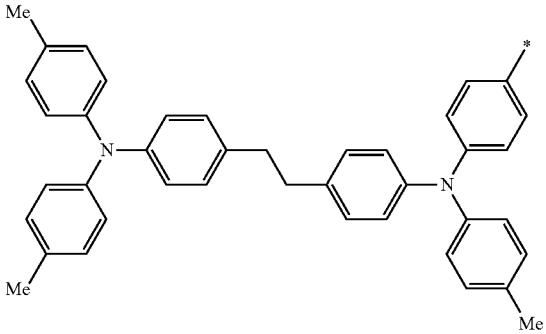
(M2)-1
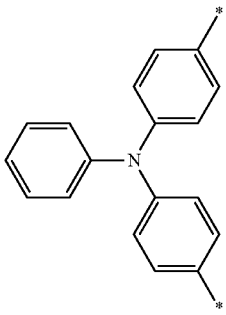
-continued
(M2)-2
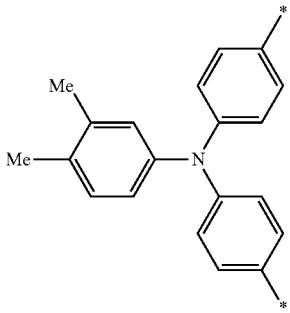
(M2)-3
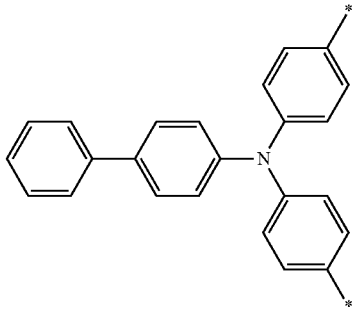
(M2)-4
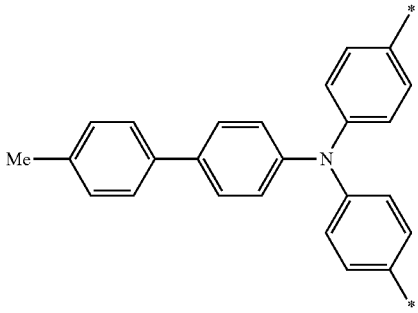
(M2)-5
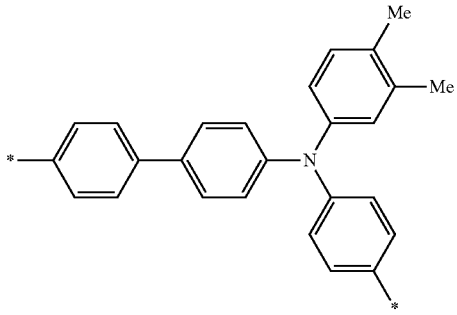
(M2)-6
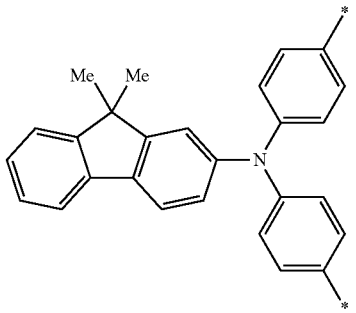

-continued
(M2)-7
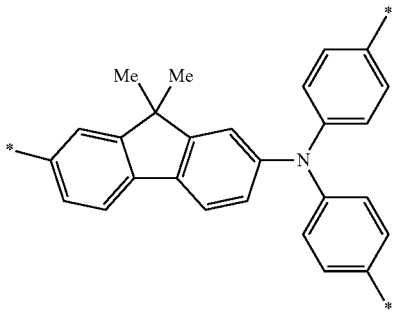
(M2)-8
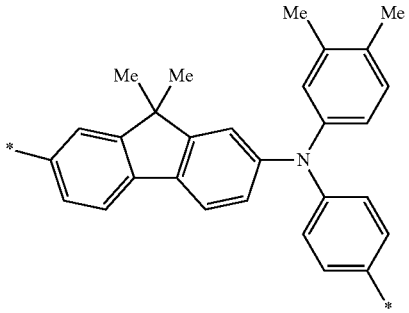
(M2)-9
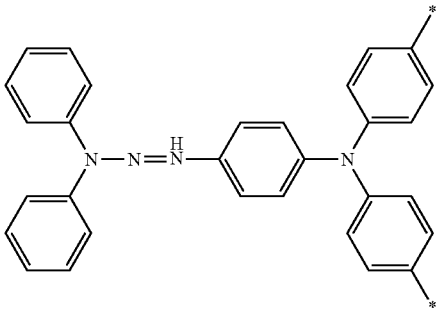
(M2)-10
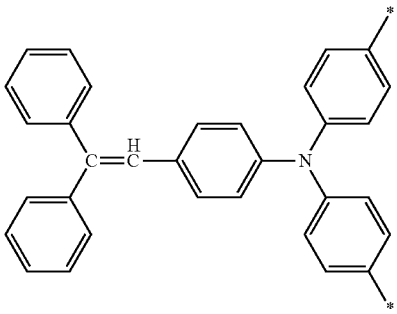
(M2)-11
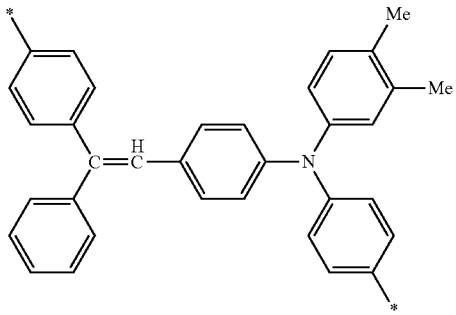
-continued
(M2)-12
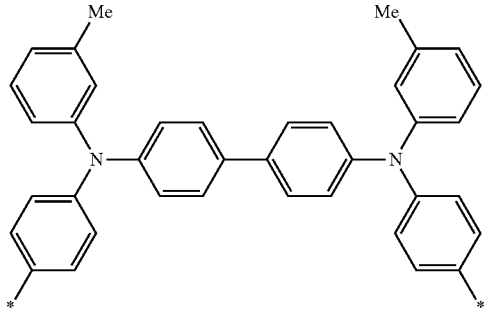
(M2)-13
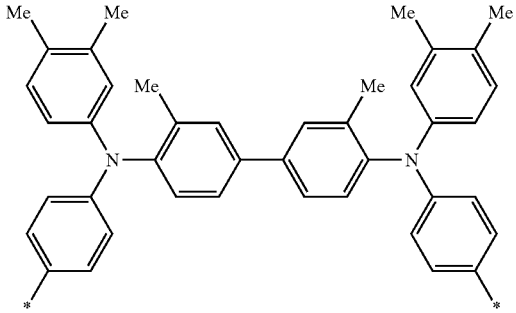
(M2)-14
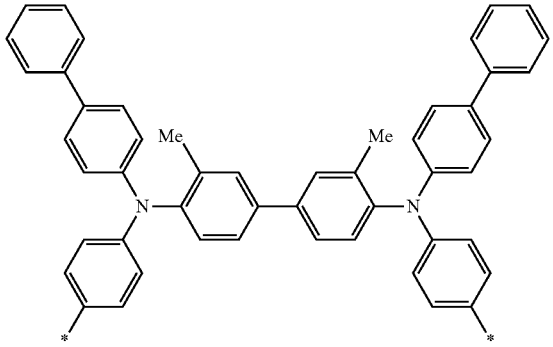
(M2)-15
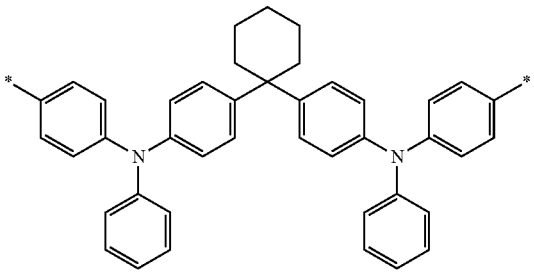

-continued
(M2)-16
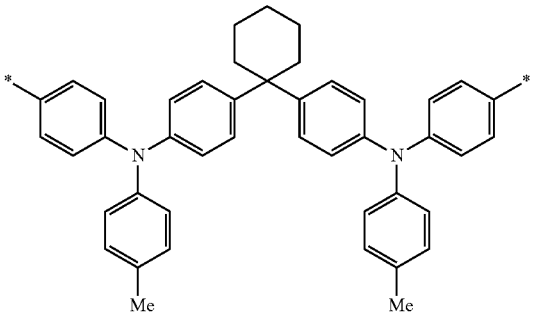
(M2)-17
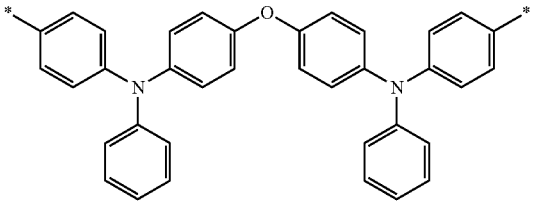
(M2)-18
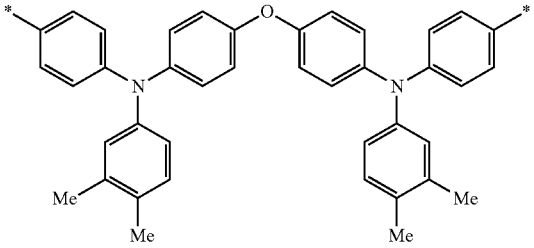
(M2)-19
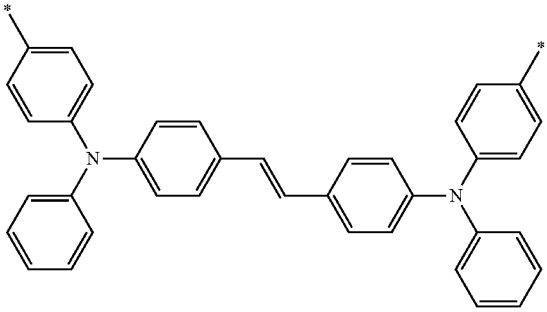
(M2)-20
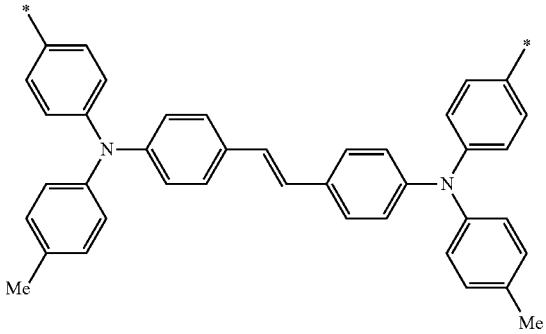
-continued
(M2)-21
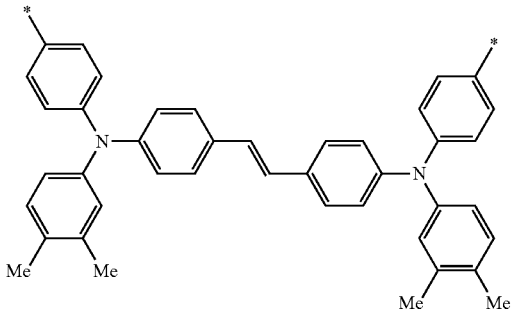
(M2)-22
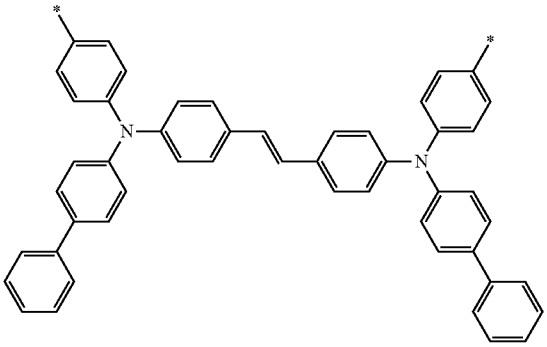
(M2)-23
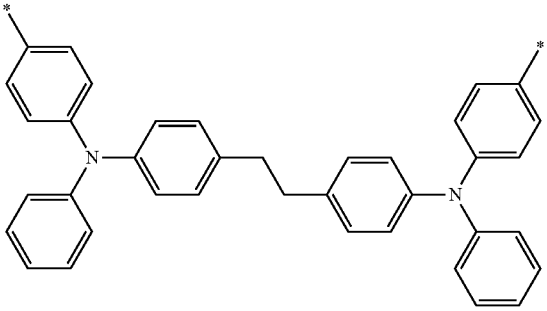
(M2)-24
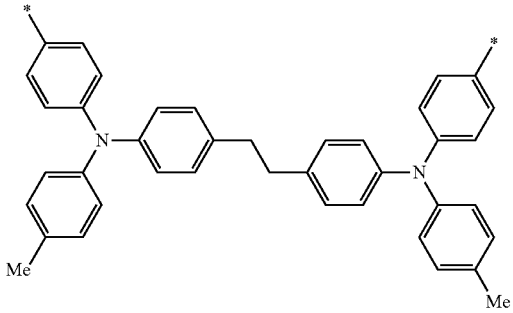

-continued
(M2)-25
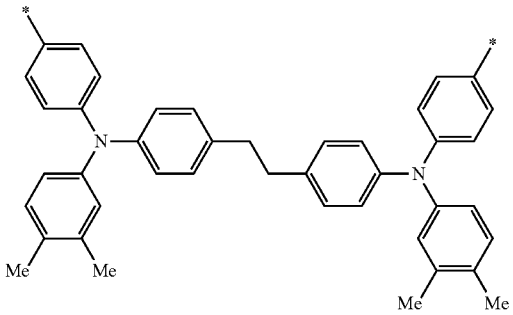
(M2)-26
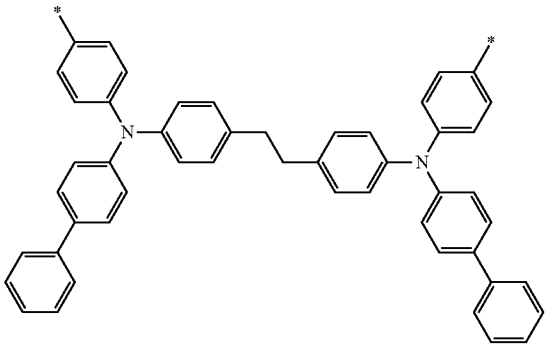
(M2)-27
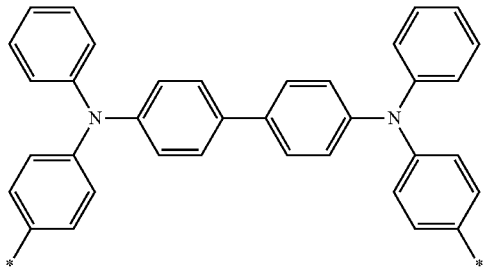
(M2)-28
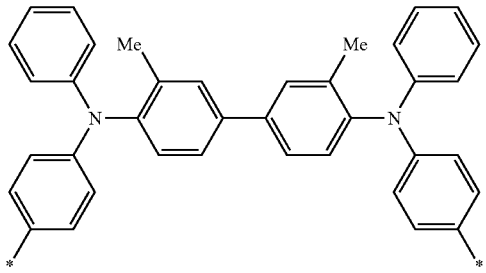
(M3)-1
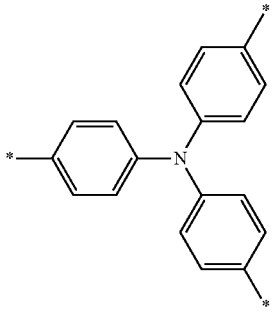
-continued
(M3)-2
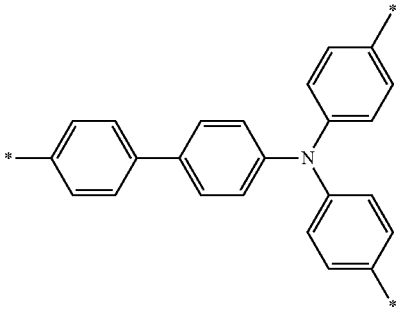
(M3)-3
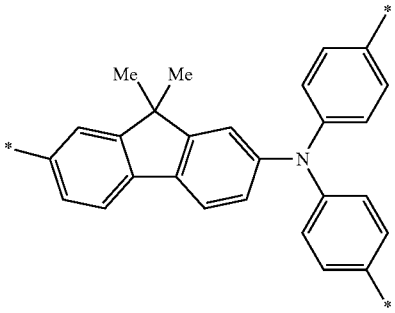
(M3)-4
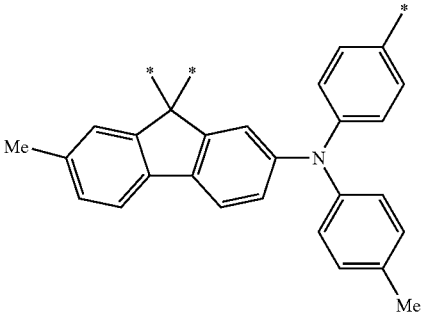
(M3)-5
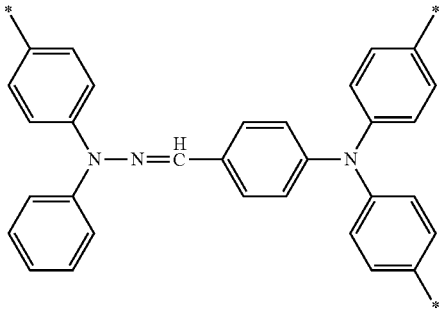
(M3)-6
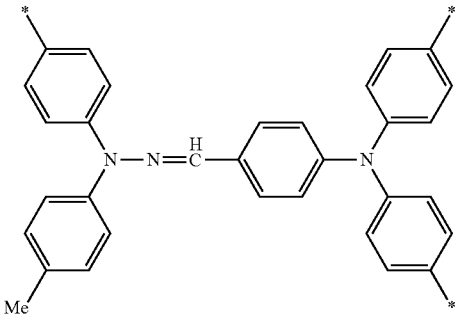

-continued
(M3)-7
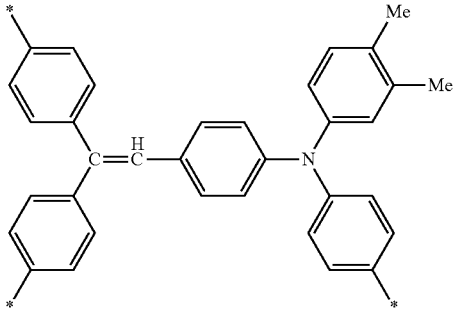
(M3)-8
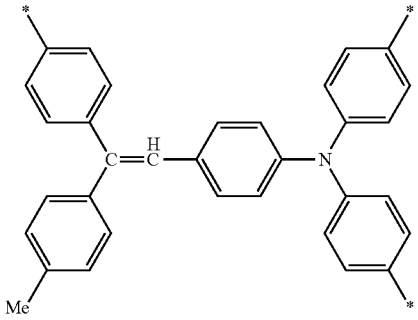
(M3)-9
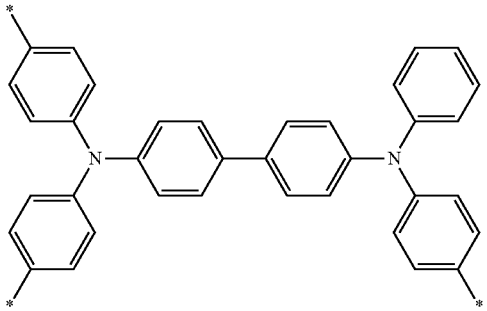
(M3)-10
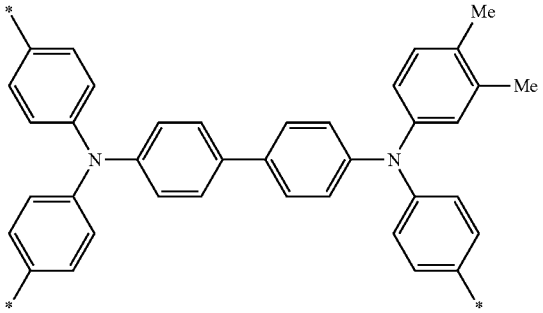
(M3)-11
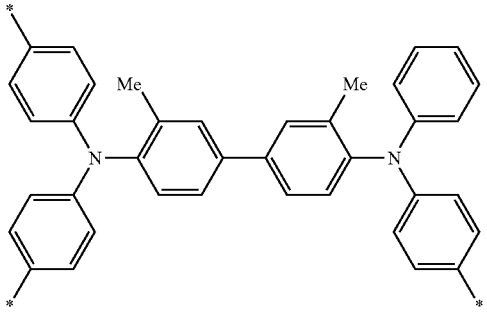
-continued
(M3)-12
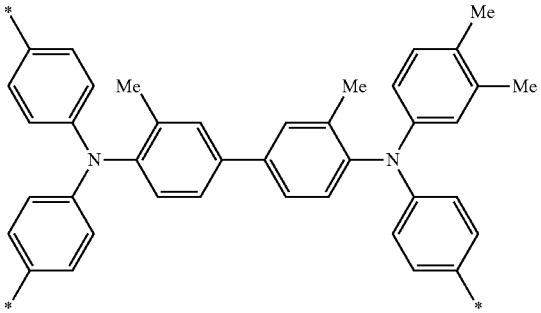
(M3)-13
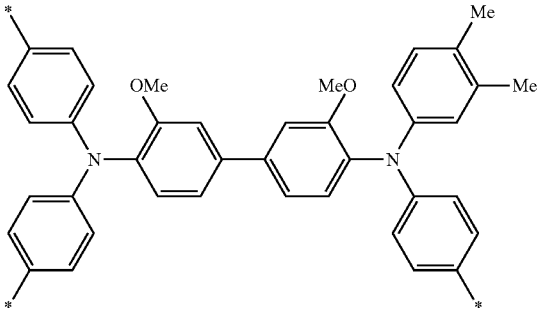
(M3)-14
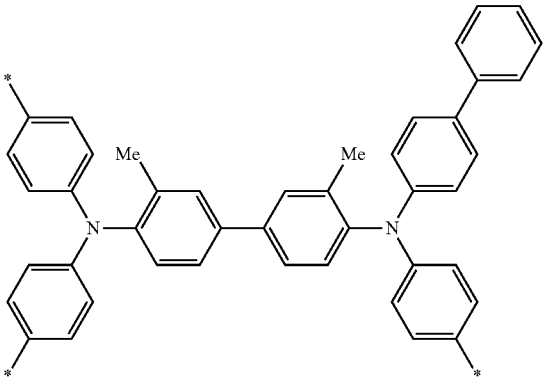
(M3)-15
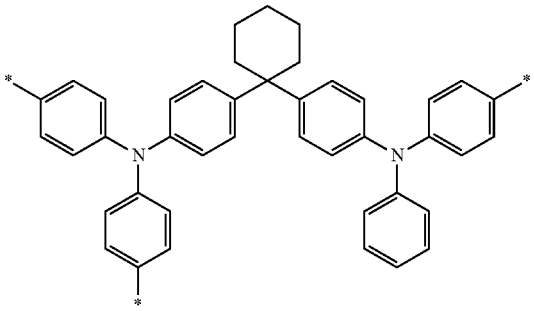

-continued
(M3)-16
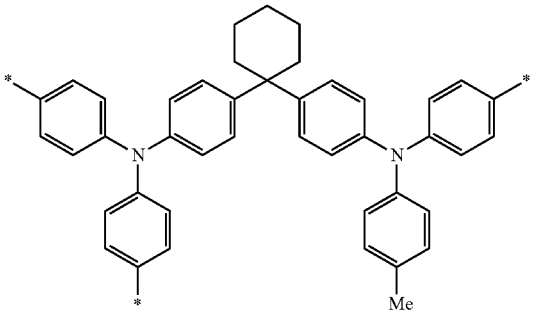
(M3)-17
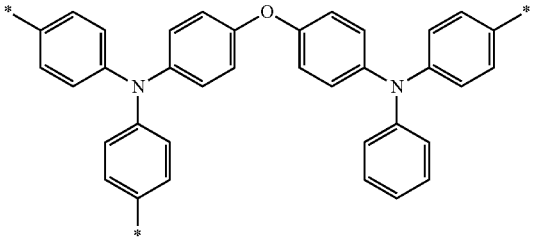
(M3)-18
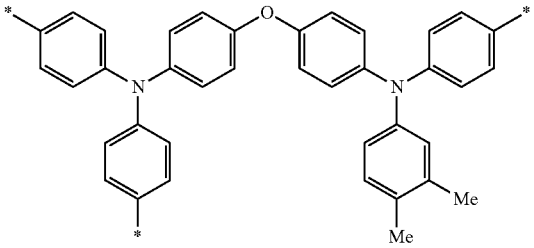
(M3)-19
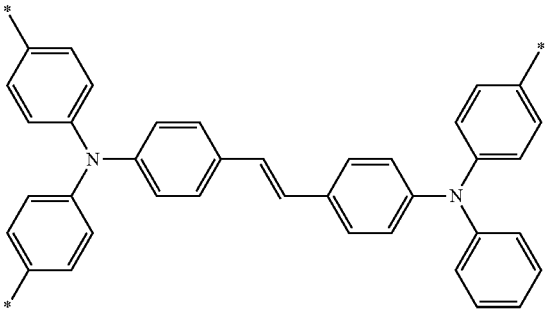
(M3)-20
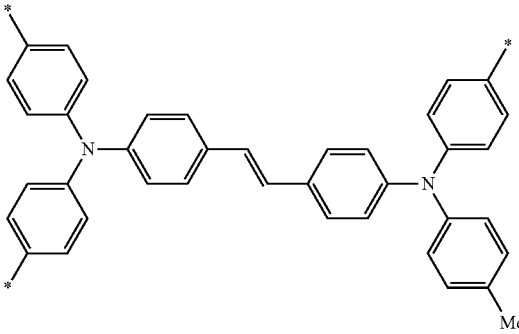
-continued
(M3)-21
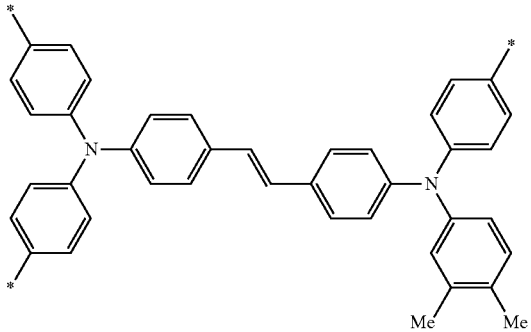
(M3)-22
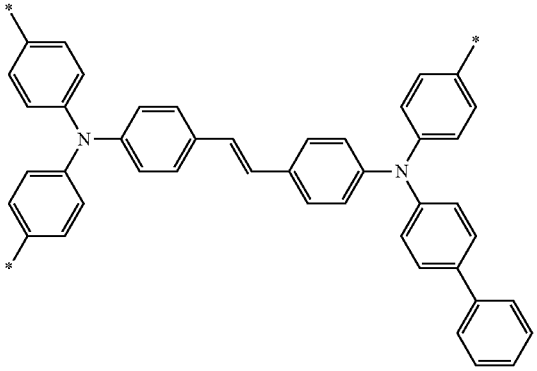
(M3)-23
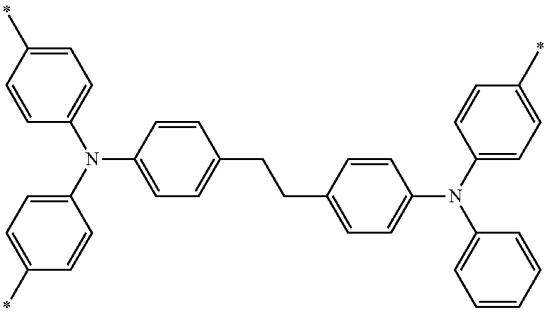
(M3)-24
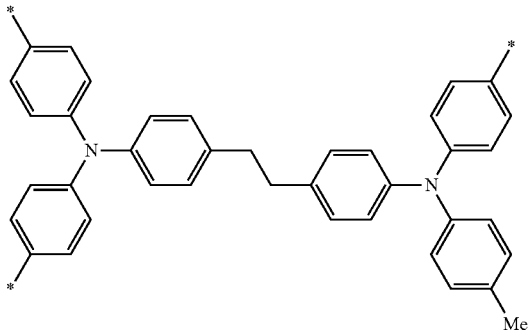

-continued
(M3)-25
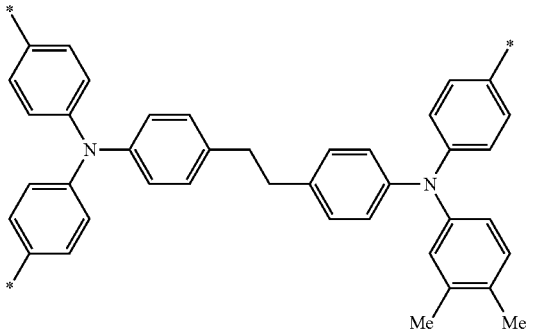
(M3)-26
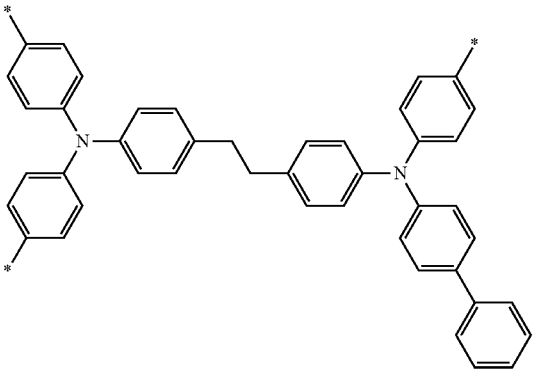
(M4)-1
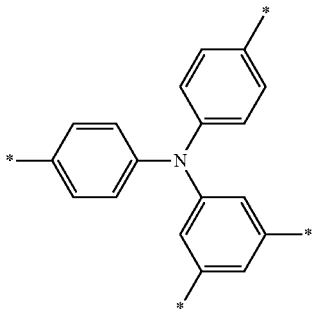
(M4)-2
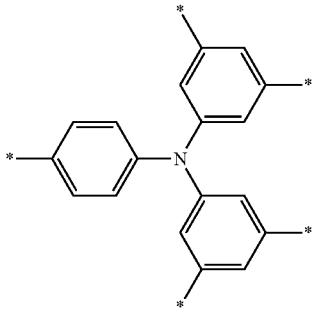
-continued
(M4)-3
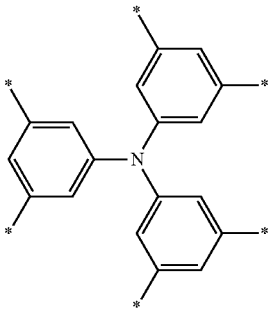
(M4)-4
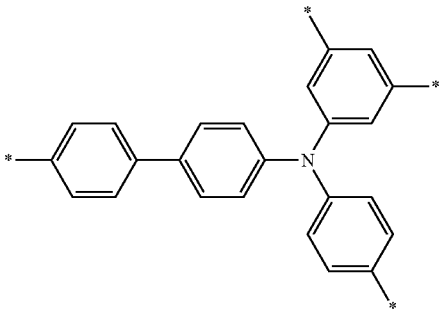
(M4)-5
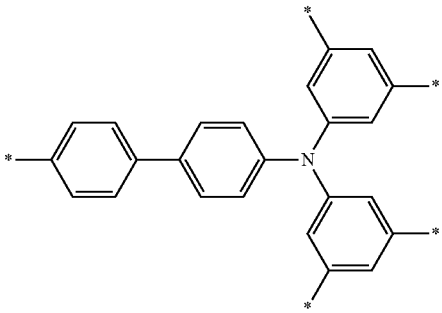
(M4)-6
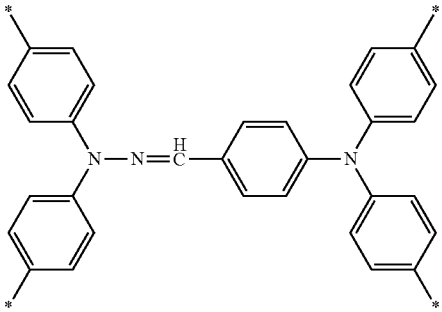
(M4)-7
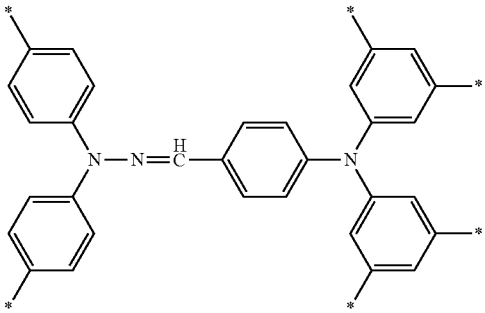

-continued
(M4)-8
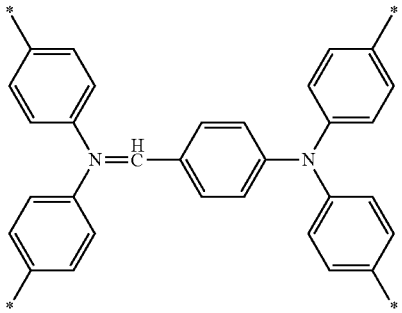
(M4)-9
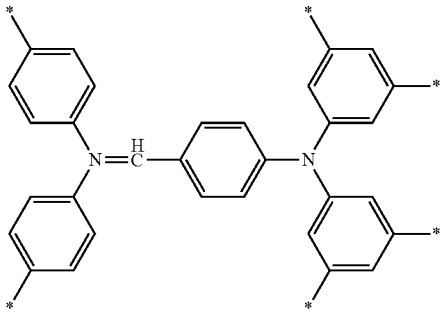
(M4)-10
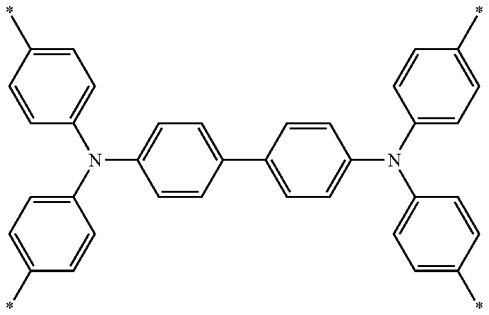
(M4)-11
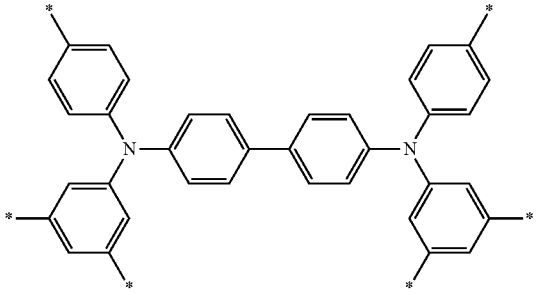
(M4)-12
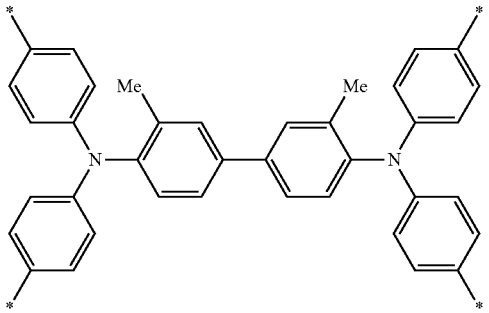
-continued
(M4)-13
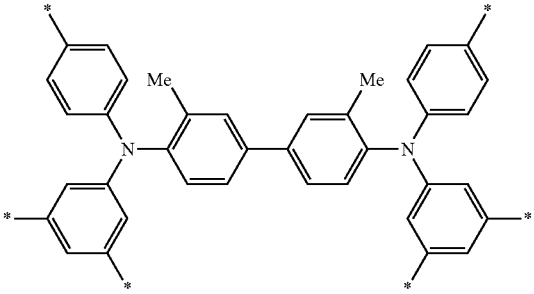
(M4)-14
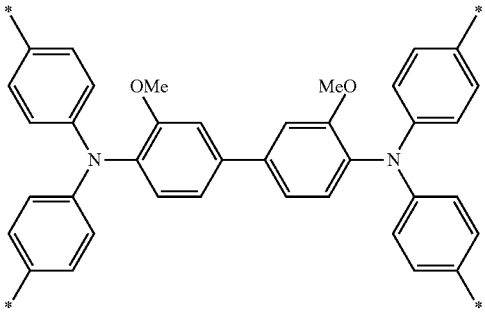
(M4)-15
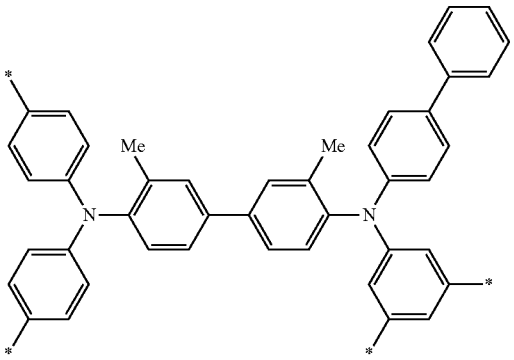
(M4)-16
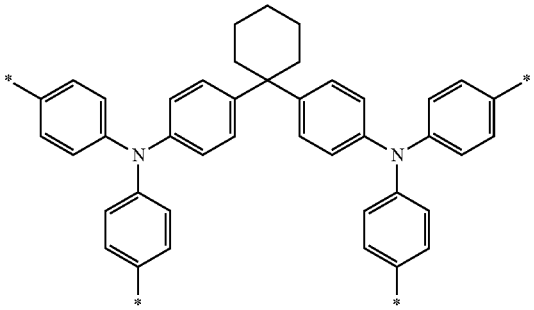

-continued
(M4)-17
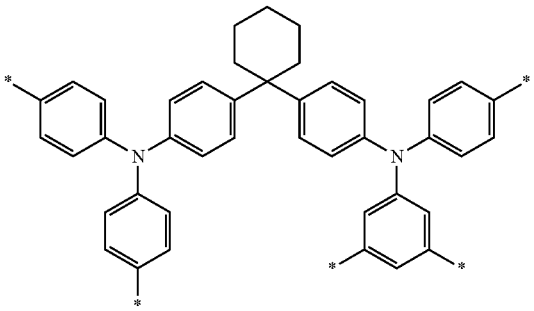
(M4)-18
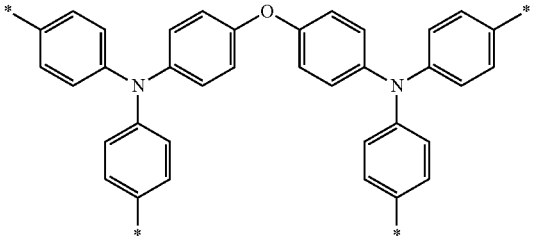
(M4)-19
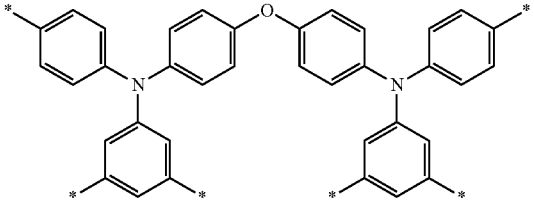
(M4)-20
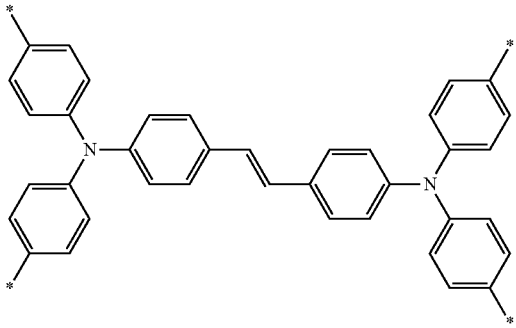
(M4)-21
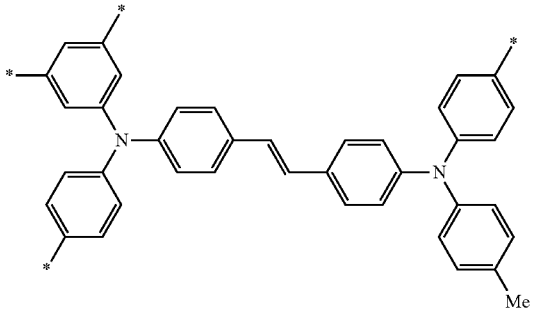
-continued
(M4)-22
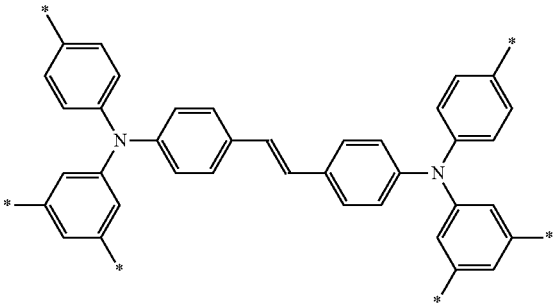
(M4)-23
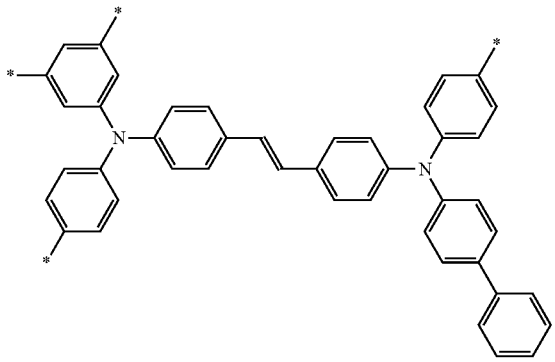
(M4)-24
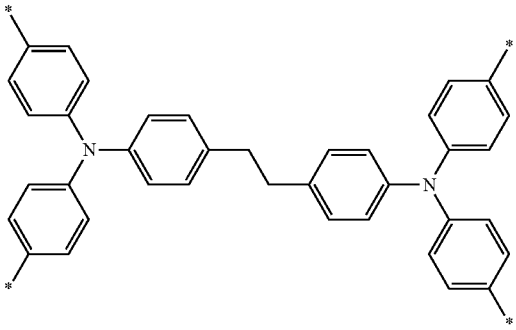
(M4)-25
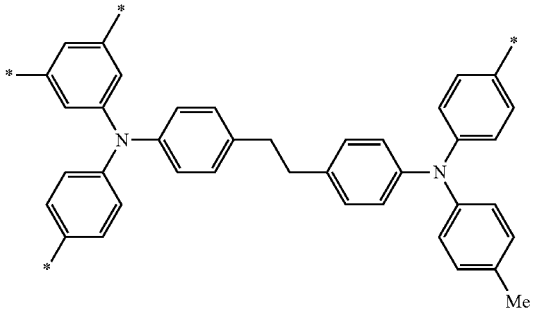

-continued
(M4)-26
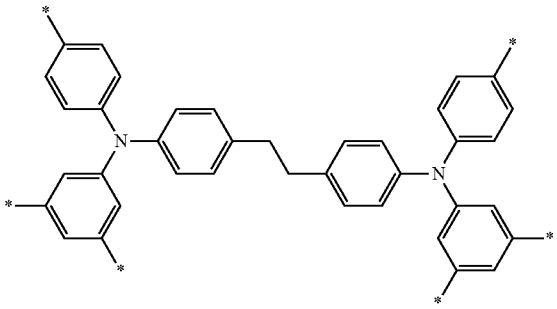
(M4)-27
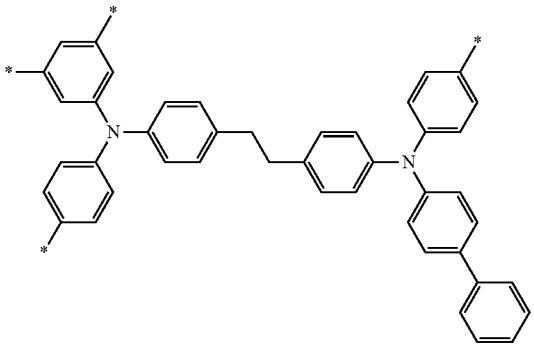
(M4)-28
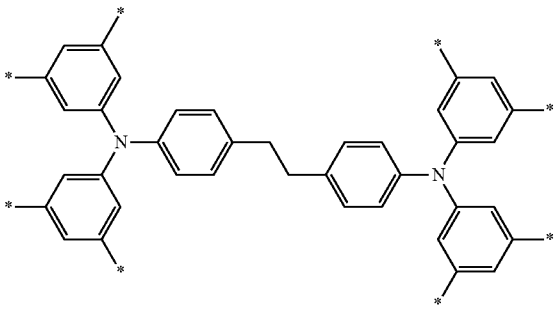
Next, specific examples of the functional group to be linked to the charge transport skeleton F are shown as follows.
(R1)-1
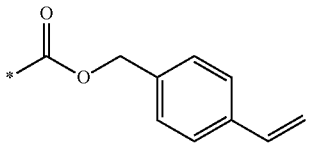
(R1)-2
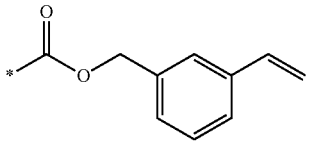
-continued
(R1)-3
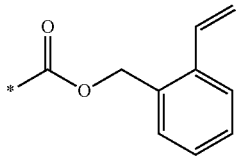
(R1)-4
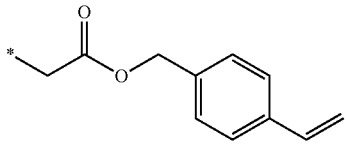
(R1)-5
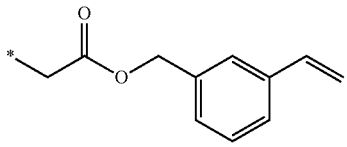
(R1)-6
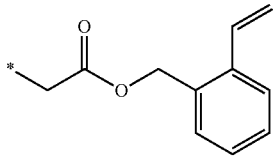
(R1)-7
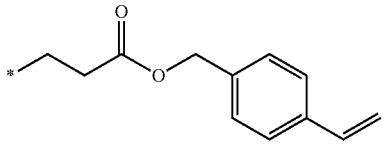
(R1)-8
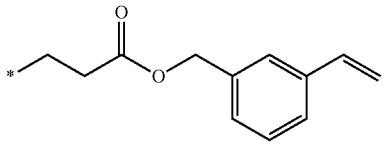
(R1)-9
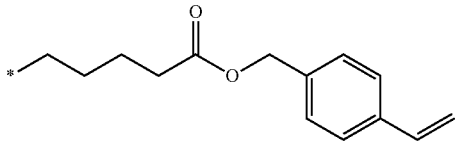
(R1)-10
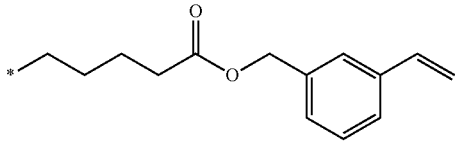
(R1)-11
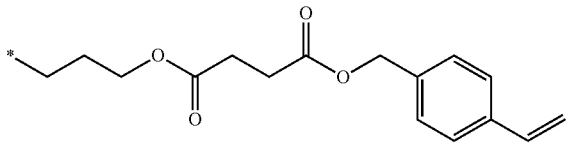
(R1)-12
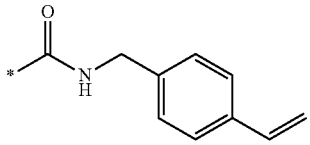

-continued
(R1)-13
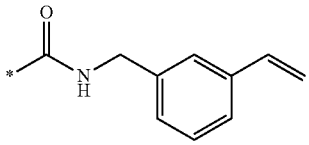
(R1)-14
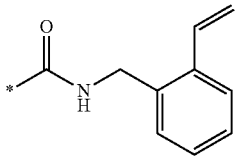
(R1)-15
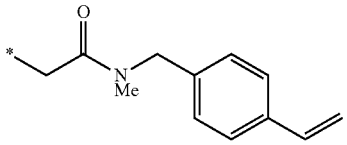
(R1)-16
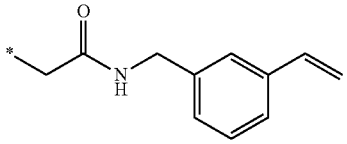
(R1)-17
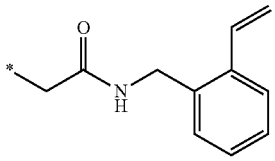
(R1)-18
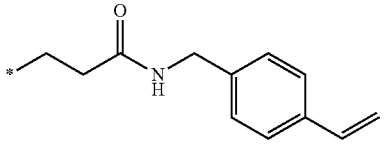
(R1)-19
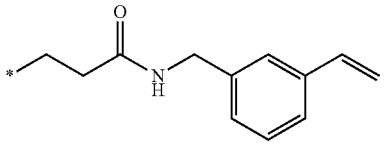
(R1)-20
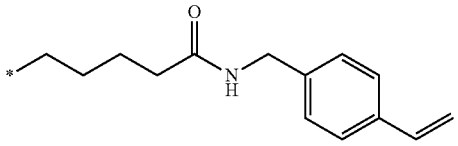
(R1)-21
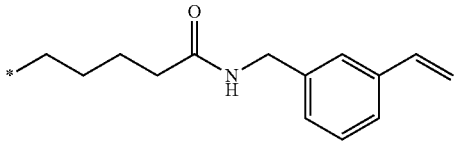
(R1)-22
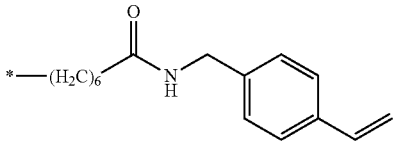
-continued
(R1)-23
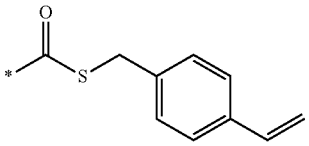
(R1)-24
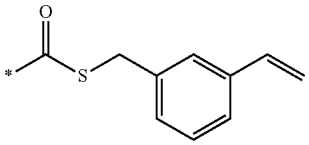
(R1)-25
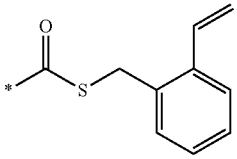
(R1)-26
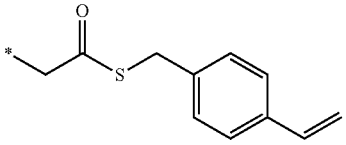
(R1)-27
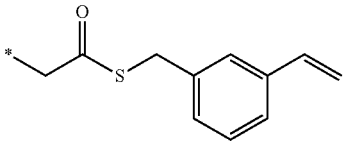
(R1)-28
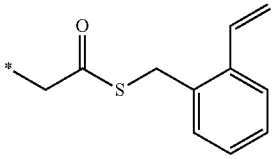
(R1)-29
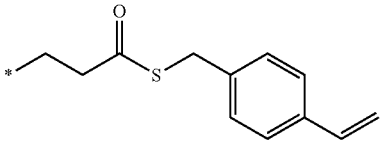
(R1)-30
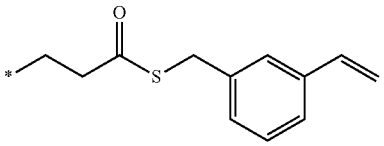
(R1)-31
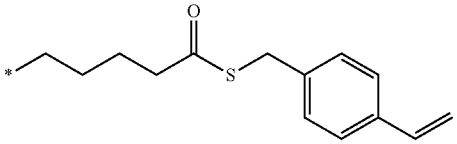
(R1)-32
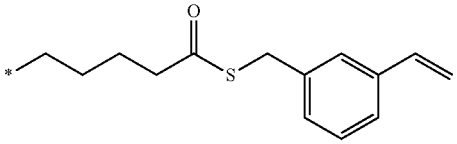

-continued
(R1)-33
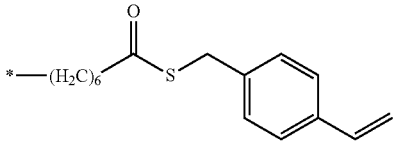
(R1)-34
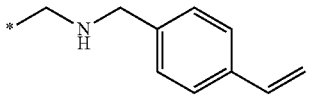
(R1)-35
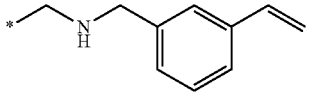
(R1)-36
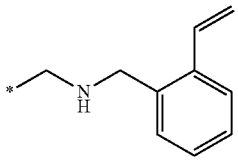
(R1)-37
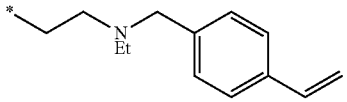
(R1)-38
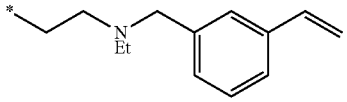
(R1)-39
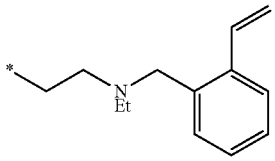
(R1)-40
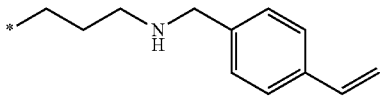
(R1)-41
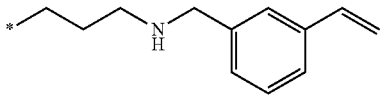
(R1)-42
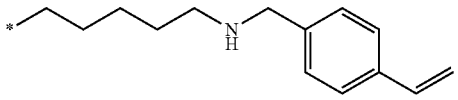
(R1)-43
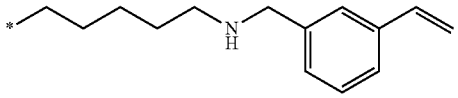
(R1)-44
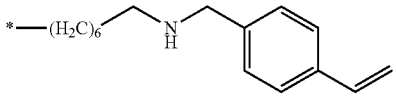
(R1)-45
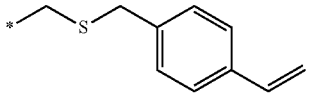
-continued
(R1)-46
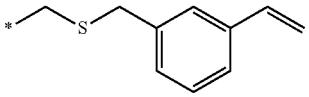
(R1)-47
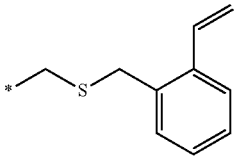
(R1)-48
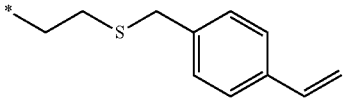
(R1)-49
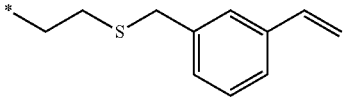
(R1)-50
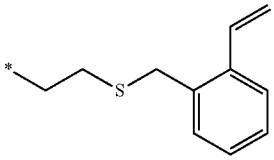
(R1)-51
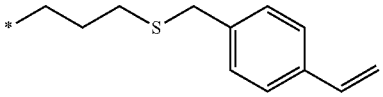
(R1)-52
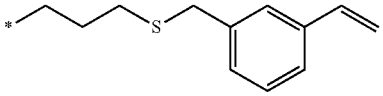
(R1)-53
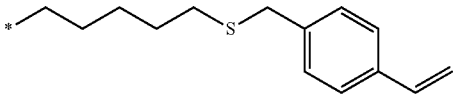
(R1)-54
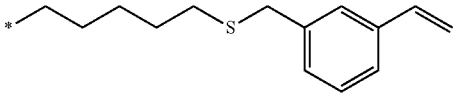
(R1)-55
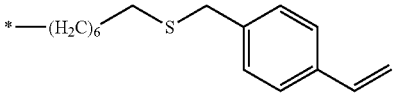
(R2)-1
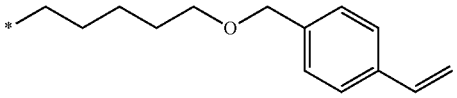
(R2)-2
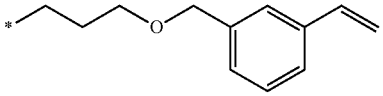
(R2)-3
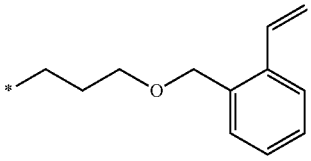

-continued
(R2)-4
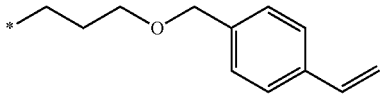
(R2)-5
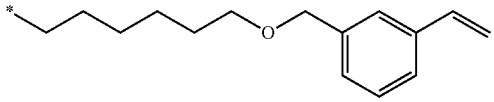
(R2)-6
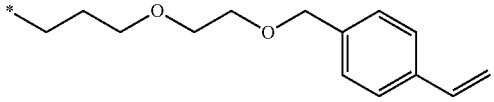
(R2)-7
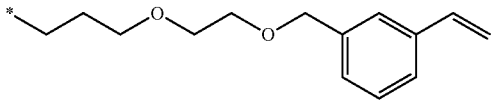
(R2)-8
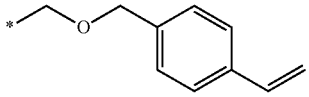
(R2)-9
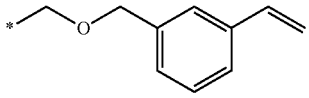
(R2)-10
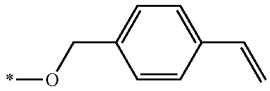
(R2)-11
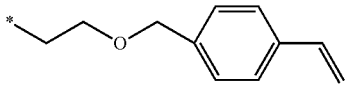
(R3)-1
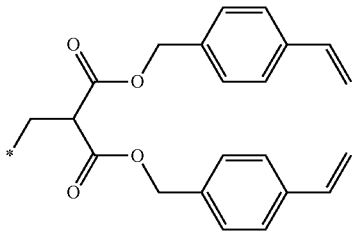
(R3)-2
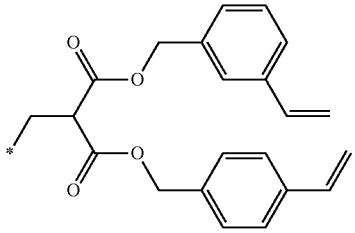
-continued
(R3)-3
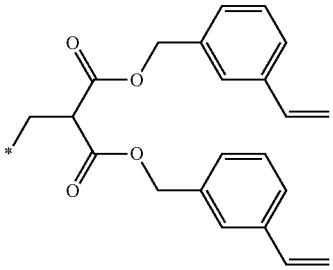
(R3)-4
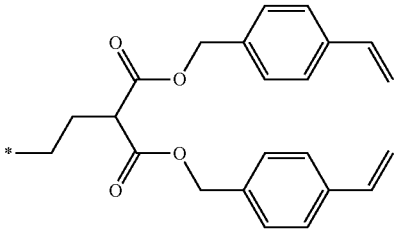
(R3)-5
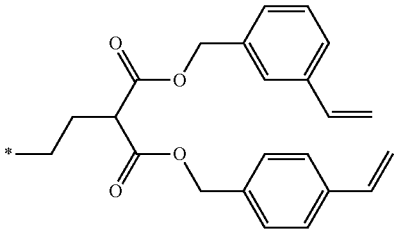
(R3)-6
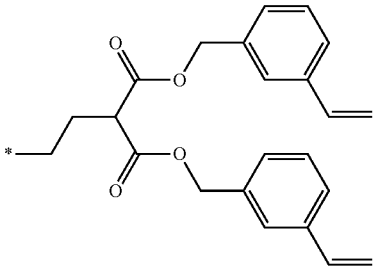
(R3)-7
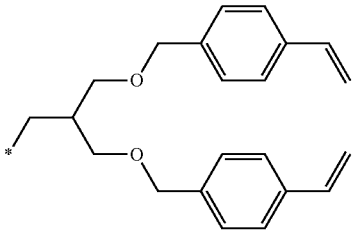
(R3)-8
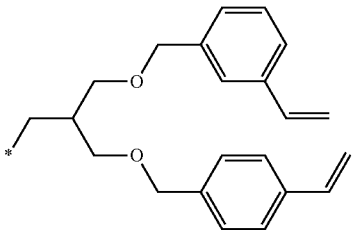

-continued
(R3)-9
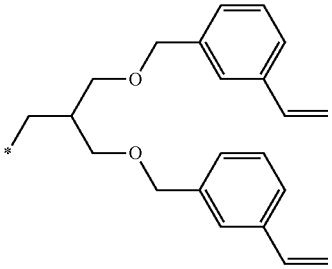
(R3)-10
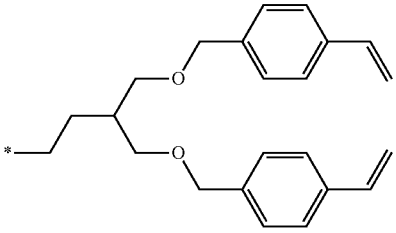
(R3)-11
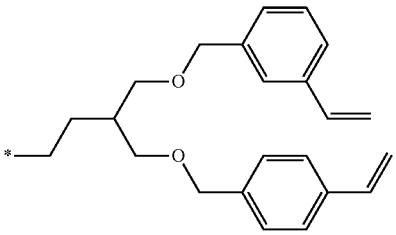
(R3)-12
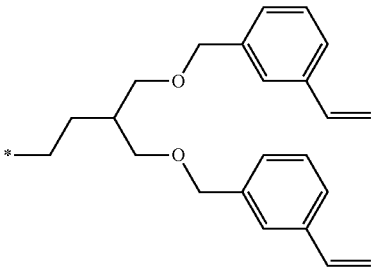
(R3)-13
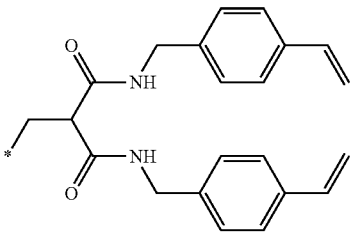
(R3)-14
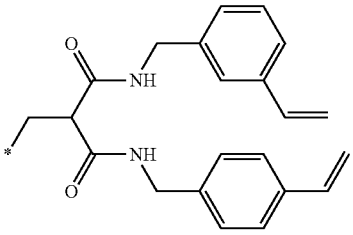
-continued
(R3)-15
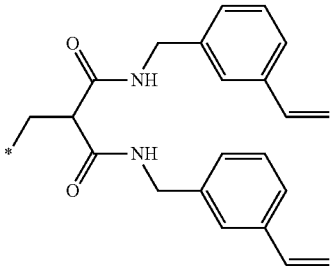
(R3)-16
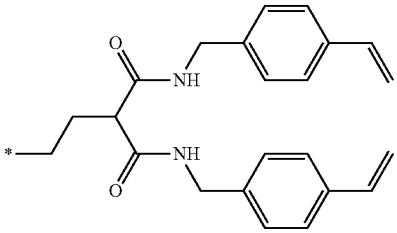
(R3)-17
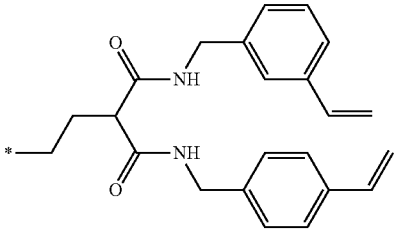
(R3)-18
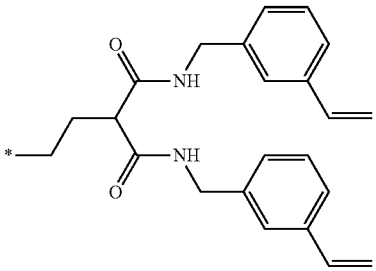
(R3)-19
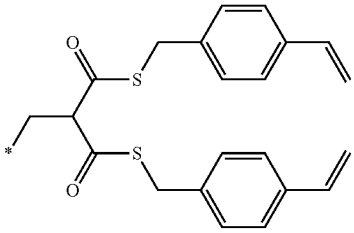
(R3)-20
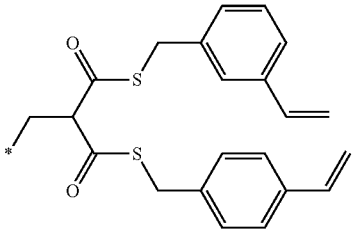

-continued
(R3)-21
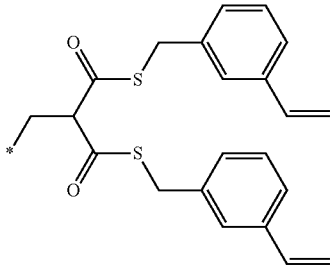
(R3)-22
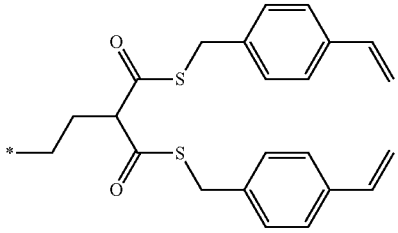
(R3)-23
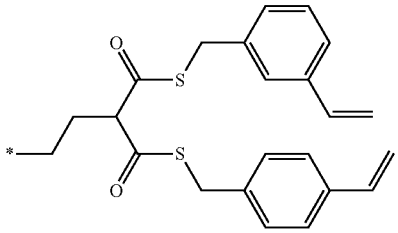
(R3)-24
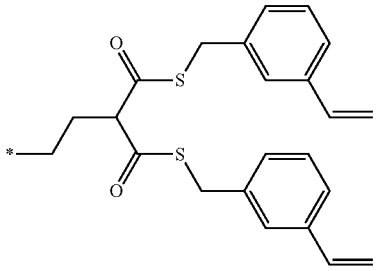
(R3)-25
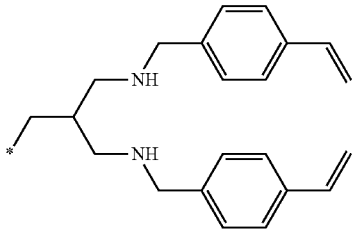
(R3)-26
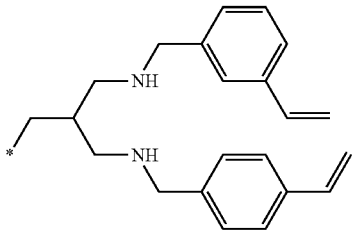
-continued
(R3)-27
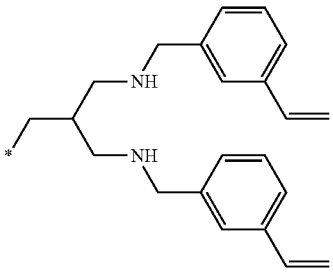
(R3)-28
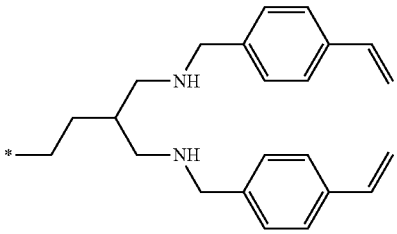
(R3)-29
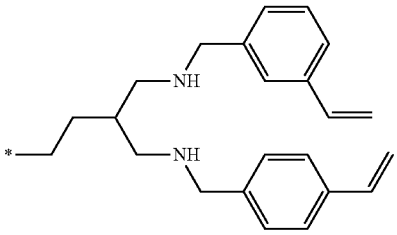
(R3)-30
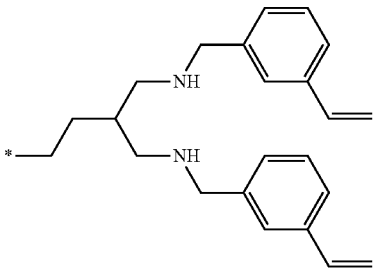
(R3)-31
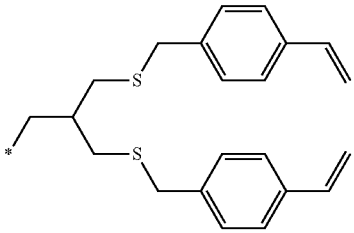
(R3)-32
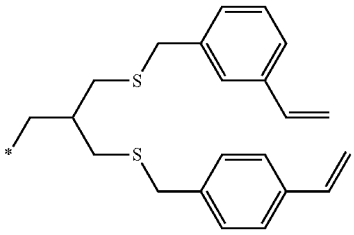

-continued
(R3)-33
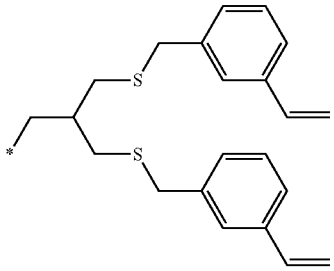
(R3)-34
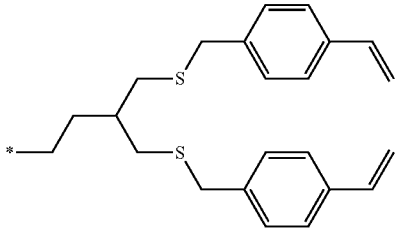
(R3)-35
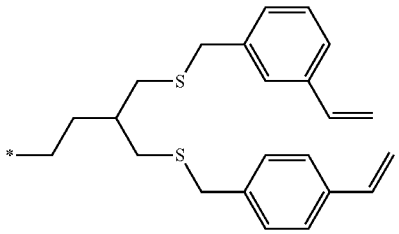
(R3)-36
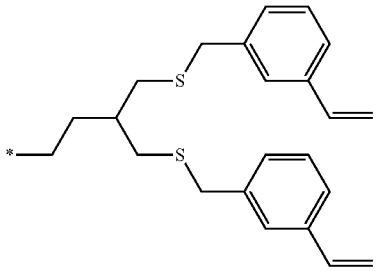
(R3)-37
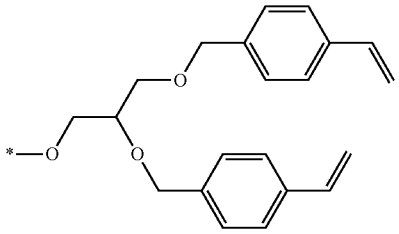
(R3)-38
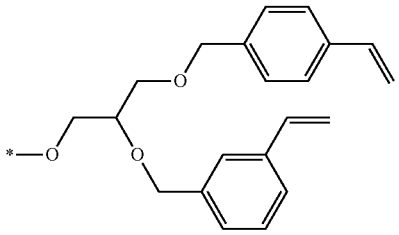
-continued
(R3)-39
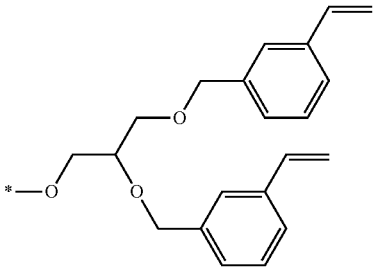
(R3)-40
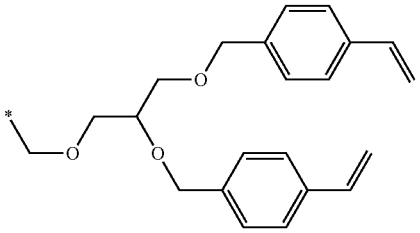
(R3)-41
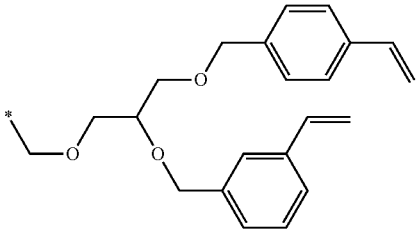
(R3)-42
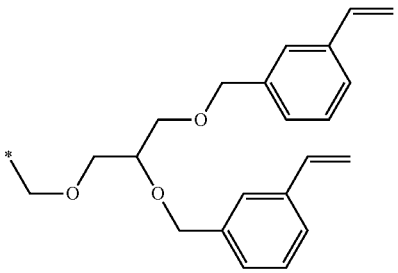
(R3)-43
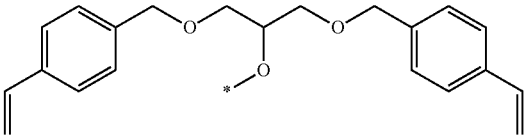
(R3)-44
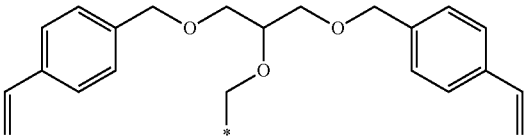

-continued
(R3)-45
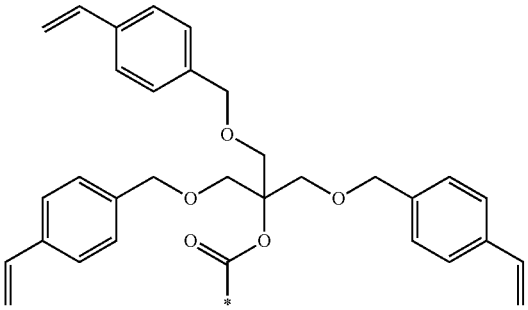
(R3)-46
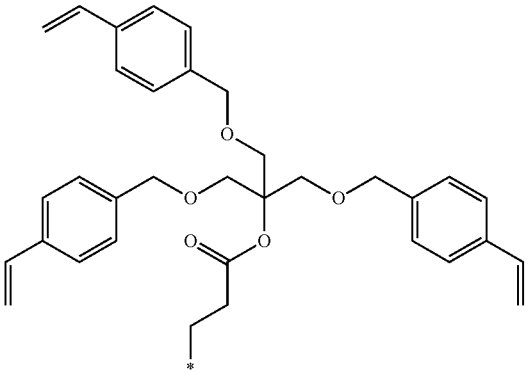
(R3)-47
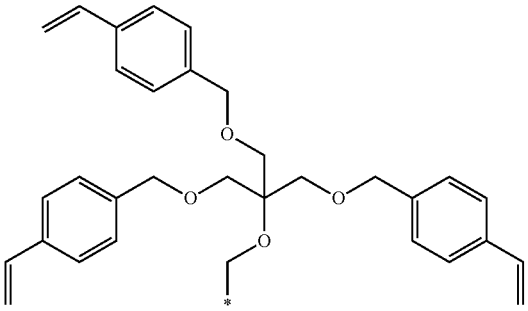
(R3)-48
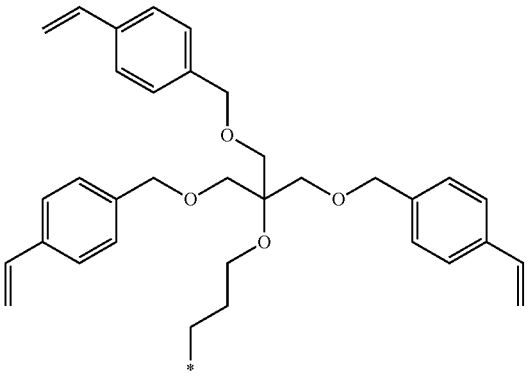
-continued
(R4)-1
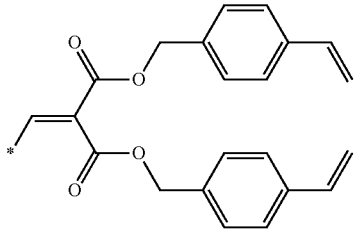
(R4)-2
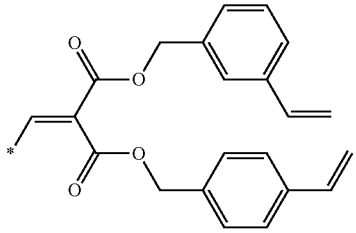
(R4)-3
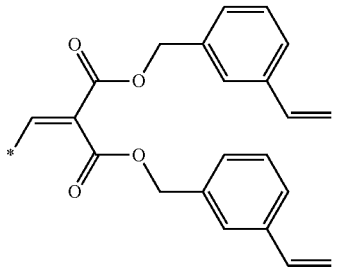
(R4)-4
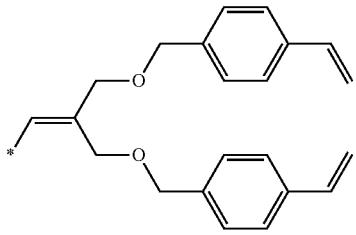
(R4)-5
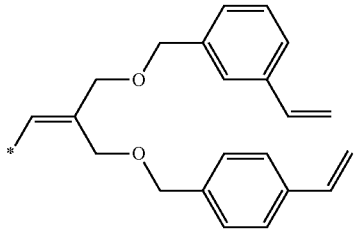
(R4)-6
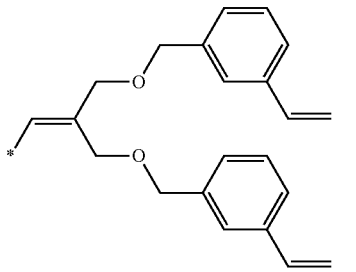
Next, specific examples of the compound represented by Formula (I), specifically Formula (I-a), are shown as follows.

Specific examples of Formula (I) [Formula (1-a)]

| Exemplified Compound | Charge Transport Skeleton F | Functional Group |
|---|---|---|
| (I-b)-1 | (M1)-1 | (R2)-1 |
| (I-b)-2 | (M1)-1 | (R2)-2 |
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by Formula (I), specifically Formula (I-b), are shown as follows.

Specific examples of Formula (I) [Formula (1-b)]

| Exemplified Compound | Charge Transport Skeleton F | Functional Group |
|---|---|---|
| (I-b)-1 | (M1)-1 | (R2)-1 |
| (I-b)-2 | (M1)-1 | (R2)-2 |
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by Formula (I), specifically Formula (I-c), are shown as follows.

Specific examples of Formula (I) [Formula (1-c)]

| Exemplified Compound | Charge Transport Skeleton F | Functional Group |
|---|---|---|
| (I-c)-1 | (M1)-1 | (R1)-1 |
| (I-c)-2 | (M1)-1 | (R1)-2 |
| (I-c)-3 | (M1)-1 | (R1)-4 |
| (I-c)-4 | (M1)-2 | (R1)-5 |
| (I-c)-5 | (M1)-2 | (R1)-7 |
| (I-c)-6 | (M1)-4 | (R1)-3 |
| (I-c)-7 | (M1)-4 | (R1)-7 |
| (I-c)-8 | (M1)-7 | (R1)-6 |
| (I-c)-9 | (M1)-11 | (R1)-4 |
| (I-c)-10 | (M1)-15 | (R1)-5 |
| (I-c)-11 | (M1)-22 | (R1)-5 |
| (I-c)-12 | (M1)-22 | (R1)-1 |
| (I-c)-13 | (M2)-2 | (R1)-1 |
| (I-c)-14 | (M2)-2 | (R1)-3 |
| (I-c)-15 | (M2)-2 | (R1)-7 |
| (I-c)-16 | (M2)-3 | (R1)-4 |
| (I-c)-17 | (M2)-3 | (R1)-7 |
| (I-c)-18 | (M2)-5 | (R1)-6 |
| (I-c)-19 | (M2)-10 | (R1)-4 |
| (I-c)-20 | (M2)-10 | (R1)-5 |
| (I-c)-21 | (M2)-13 | (R1)-1 |
| (I-c)-22 | (M2)-13 | (R1)-3 |
| (I-c)-23 | (M2)-13 | (R1)-7 |
| (I-c)-24 | (M2)-16 | (R1)-5 |
| (I-c)-25 | (M2)-23 | (R1)-7 |
| (I-c)-26 | (M2)-23 | (R1)-4 |
| (I-c)-27 | (M2)-25 | (R1)-7 |
| (I-c)-28 | (M2)-25 | (R1)-4 |
| (I-c)-29 | (M2)-26 | (R1)-5 |
| (I-c)-30 | (M2)-26 | (R1)-7 |
| (I-c)-31 | (M3)-1 | (R1)-2 |
| (I-c)-32 | (M3)-1 | (R1)-7 |
| (I-c)-33 | (M3)-5 | (R1)-2 |
| (I-c)-34 | (M3)-7 | (R1)-4 |
| (I-c)-35 | (M3)-7 | (R1)-2 |
| (I-c)-36 | (M3)-19 | (R1)-4 |
| (I-c)-37 | (M3)-26 | (R1)-1 |
| (I-c)-38 | (M3)-26 | (R1)-3 |
| (I-c)-39 | (M4)-3 | (R1)-3 |
| (I-c)-40 | (M4)-3 | (R1)-4 |
| (I-c)-41 | (M4)-8 | (R1)-5 |
| (I-c)-42 | (M4)-8 | (R1)-6 |
| (I-c)-43 | (M4)-12 | (R1)-7 |
| (I-c)-44 | (M4)-12 | (R1)-4 |
| (I-c)-45 | (M4)-12 | (R1)-2 |
| (I-c)-46 | (M4)-12 | (R1)-11 |
| (I-c)-47 | (M4)-16 | (R1)-3 |
| (I-c)-48 | (M4)-16 | (R1)-4 |
| (I-c)-49 | (M4)-20 | (R1)-1 |
| (I-c)-50 | (M4)-20 | (R1)-4 |
| (I-c)-51 | (M4)-20 | (R1)-7 |
| (I-c)-52 | (M4)-24 | (R1)-4 |
| (I-c)-53 | (M4)-24 | (R1)-7 |
| (I-c)-54 | (M4)-24 | (R1)-3 |
| (I-c)-55 | (M4)-24 | (R1)-5 |
| (I-c)-56 | (M4)-25 | (R1)-1 |
| (I-c)-57 | (M4)-26 | (R1)-3 |
| (I-c)-58 | (M4)-28 | (R1)-4 |
| (I-c)-59 | (M4)-28 | (R1)-5 |
| (I-c)-60 | (M4)-28 | (R1)-6 |
| (I-c)-61 | (M1)-1 | (R1)-15 |
| (I-c)-62 | (M1)-1 | (R1)-27 |
| (I-c)-63 | (M1)-1 | (R1)-37 |
| (I-c)-64 | (M1)-2 | (R1)-52 |
| (I-c)-65 | (M1)-2 | (R1)-18 |
| (I-c)-66 | (M1)-4 | (R1)-31 |
| (I-c)-67 | (M1)-4 | (R1)-44 |
| (I-c)-68 | (M1)-7 | (R1)-45 |
| (I-c)-69 | (M1)-11 | (R1)-45 |
| (I-c)-70 | (M1)-15 | (R1)-45 |
| (I-c)-71 | (M1)-21 | (R1)-15 |

-continued

Specific examples of Formula (I) [Formula (1-c)]

| Exemplified Compound | Charge Transport Skeleton F | Functional Group |
|---|---|---|
| (I-c)-72 | (M1)-22 | (R1)-15 |
| (I-c)-73 | (M2)-2 | (R1)-15 |
| (I-c)-74 | (M2)-2 | (R1)-27 |
| (I-c)-75 | (M2)-2 | (R1)-37 |
| (I-c)-76 | (M2)-3 | (R1)-52 |
| (I-c)-77 | (M2)-3 | (R1)-18 |
| (I-c)-78 | (M2)-5 | (R1)-31 |
| (I-c)-79 | (M2)-10 | (R1)-44 |
| (I-c)-80 | (M2)-10 | (R1)-45 |
| (I-c)-81 | (M2)-13 | (R1)-45 |
| (I-c)-82 | (M2)-13 | (R1)-46 |
| (I-c)-83 | (M2)-13 | (R1)-15 |
| (I-c)-84 | (M2)-16 | (R1)-15 |
| (I-c)-85 | (M2)-23 | (R1)-27 |
| (I-c)-86 | (M2)-23 | (R1)-37 |
| (I-c)-87 | (M2)-25 | (R1)-52 |
| (I-c)-88 | (M2)-25 | (R1)-18 |
| (I-c)-89 | (M2)-26 | (R1)-31 |
| (I-c)-90 | (M2)-26 | (R1)-44 |
| (I-c)-91 | (M3)-1 | (R1)-15 |
| (I-c)-92 | (M3)-1 | (R1)-27 |
| (I-c)-93 | (M3)-5 | (R1)-37 |
| (I-c)-94 | (M3)-7 | (R1)-52 |
| (I-c)-95 | (M3)-7 | (R1)-18 |
| (I-c)-96 | (M3)-19 | (R1)-31 |
| (I-c)-97 | (M3)-26 | (R1)-44 |
| (I-c)-98 | (M3)-26 | (R1)-45 |
| (I-c)-99 | (M4)-3 | (R1)-45 |
| (I-c)-100 | (M4)-3 | (R1)-46 |
| (I-c)-101 | (M4)-8 | (R1)-15 |
| (I-c)-102 | (M4)-8 | (R1)-16 |
| (I-c)-103 | (M4)-12 | (R1)-15 |
| (I-c)-104 | (M4)-12 | (R1)-27 |
| (I-c)-105 | (M4)-12 | (R1)-37 |
| (I-c)-106 | (M4)-12 | (R1)-52 |
| (I-c)-107 | (M4)-16 | (R1)-18 |
| (I-c)-108 | (M4)-16 | (R1)-31 |
| (I-c)-109 | (M4)-20 | (R1)-44 |
| (I-c)-110 | (M4)-20 | (R1)-45 |
| (I-c)-111 | (M4)-20 | (R1)-46 |
| (I-c)-112 | (M4)-24 | (R1)-45 |
| (I-c)-113 | (M4)-24 | (R1)-15 |
| (I-c)-114 | (M4)-24 | (R1)-16 |
| (I-c)-115 | (M4)-24 | (R1)-27 |
| (I-c)-116 | (M4)-25 | (R1)-37 |
| (I-c)-117 | (M4)-26 | (R1)-52 |
| (I-c)-118 | (M4)-28 | (R1)-18 |
| (I-c)-119 | (M4)-28 | (R1)-31 |
| (I-c)-120 | (M4)-28 | (R1)-44 |

Next, specific examples of the compound represented by Formula (I), specifically Formula (I-d), are shown as follows.

Specific examples of Formula (I) [Formula (1-d)]

| Exemplified Compound | Charge Transport Skeleton F | Functional Group |
|---|---|---|
| (I-d)-1 | (M3)-1 | (R2)-2 |
| (I-d)-2 | (M3)-1 | (R2)-7 |
| (I-d)-3 | (M3)-2 | (R2)-2 |
| (I-d)-4 | (M3)-2 | (R2)-4 |
| (I-d)-5 | (M3)-3 | (R2)-2 |
| (I-d)-6 | (M3)-3 | (R2)-4 |
| (I-d)-7 | (M3)-12 | (R2)-1 |
| (I-d)-8 | (M3)-21 | (R2)-3 |
| (I-d)-9 | (M3)-25 | (R2)-3 |
| (I-d)-10 | (M3)-25 | (R2)-4 |
| (I-d)-11 | (M3)-25 | (R2)-5 |
| (I-d)-12 | (M3)-25 | (R2)-6 |
| (I-d)-13 | (M4)-1 | (R2)-7 |

-continued

Specific examples of Formula (I) [Formula (1-d)]

| Exemplified Compound | Charge Transport Skeleton F | Functional Group |
|---|---|---|
| (I-d)-14 | (M4)-3 | (R2)-4 |
| (I-d)-15 | (M4)-3 | (R2)-2 |
| (I-d)-16 | (M4)-8 | (R2)-1 |
| (I-d)-17 | (M4)-8 | (R2)-3 |
| (I-d)-18 | (M4)-8 | (R2)-4 |
| (I-d)-19 | (M4)-10 | (R2)-1 |
| (I-d)-20 | (M4)-10 | (R2)-4 |
| (I-d)-21 | (M4)-10 | (R2)-7 |
| (I-d)-22 | (M4)-12 | (R2)-4 |
| (I-d)-23 | (M4)-12 | (R2)-1 |
| (I-d)-24 | (M4)-12 | (R2)-3 |
| (I-d)-25 | (M4)-22 | (R2)-4 |
| (I-d)-26 | (M4)-24 | (R2)-1 |
| (I-d)-27 | (M4)-24 | (R2)-3 |
| (I-d)-28 | (M4)-24 | (R2)-4 |
| (I-d)-29 | (M4)-24 | (R2)-5 |
| (I-d)-30 | (M4)-28 | (R2)-6 |
| (I-d)-31 | (M3)-1 | (R2)-8 |
| (I-d)-32 | (M3)-1 | (R2)-9 |
| (I-d)-33 | (M3)-2 | (R2)-8 |
| (I-d)-34 | (M3)-2 | (R2)-9 |
| (I-d)-35 | (M3)-3 | (R2)-8 |
| (I-d)-36 | (M3)-3 | (R2)-9 |
| (I-d)-37 | (M3)-12 | (R2)-8 |
| (I-d)-38 | (M3)-12 | (R2)-9 |
| (I-d)-39 | (M4)-12 | (R2)-8 |
| (I-d)-40 | (M4)-12 | (R2)-9 |
| (I-d)-41 | (M4)-12 | (R2)-10 |
| (I-d)-42 | (M4)-24 | (R2)-8 |
| (I-d)-43 | (M4)-24 | (R2)-9 |
| (I-d)-44 | (M4)-24 | (R2)-10 |
| (I-d)-45 | (M4)-28 | (R2)-8 |
| (I-d)-46 | (M4)-28 | (R2)-9 |
| (I-d)-47 | (M4)-28 | (R2)-10 |

Next, specific examples of the compound represented by Formula (II), specifically Formula (II-a), are shown as follows.

Specific examples of Formula (II) [Formula (II-a)]

| Exemplified Compound | Charge Transport Skeleton F | Functional Group |
|---|---|---|
| (II)-1 | (M1)-1 | (R3)-1 |
| (II)-2 | (M1)-1 | (R3)-2 |
| (II)-3 | (M1)-1 | (R3)-7 |
| (II)-4 | (M1)-2 | (R3)-1 |
| (II)-5 | (M1)-2 | (R3)-2 |
| (II)-6 | (M1)-2 | (R3)-3 |
| (II)-7 | (M1)-2 | (R3)-5 |
| (II)-8 | (M1)-2 | (R3)-7 |
| (II)-9 | (M1)-2 | (R3)-8 |
| (II)-10 | (M1)-2 | (R3)-10 |
| (II)-11 | (M1)-2 | (R3)-11 |
| (II)-12 | (M1)-4 | (R3)-1 |
| (II)-13 | (M1)-4 | (R3)-2 |
| (II)-14 | (M1)-4 | (R3)-3 |
| (II)-15 | (M1)-4 | (R3)-5 |
| (II)-16 | (M1)-4 | (R3)-7 |
| (II)-17 | (M1)-4 | (R3)-8 |
| (II)-18 | (M1)-8 | (R3)-1 |
| (II)-19 | (M1)-8 | (R3)-2 |
| (II)-20 | (M1)-8 | (R3)-3 |
| (II)-21 | (M1)-8 | (R3)-5 |
| (II)-22 | (M1)-8 | (R3)-7 |
| (II)-23 | (M1)-8 | (R3)-8 |
| (II)-24 | (M1)-11 | (R3)-1 |
| (II)-25 | (M1)-11 | (R3)-3 |
| (II)-26 | (M1)-11 | (R3)-7 |
| (II)-27 | (M1)-11 | (R3)-9 |
| (II)-28 | (M1)-16 | (R3)-4 |

-continued

Specific examples of Formula (II) [Formula (II-a)]

| Exemplified Compound | Charge Transport Skeleton F | Functional Group |
|---|---|---|
| (II)-29 | (M1)-22 | (R3)-6 |
| (II)-30 | (M1)-22 | (R3)-9 |
| (II)-31 | (M2)-2 | (R3)-1 |
| (II)-32 | (M2)-2 | (R3)-3 |
| (II)-33 | (M2)-2 | (R3)-7 |
| (II)-34 | (M2)-2 | (R3)-9 |
| (II)-35 | (M2)-3 | (R3)-1 |
| (II)-36 | (M2)-3 | (R3)-2 |
| (II)-37 | (M2)-3 | (R3)-3 |
| (II)-38 | (M2)-3 | (R3)-7 |
| (II)-39 | (M2)-3 | (R3)-8 |
| (II)-40 | (M2)-5 | (R3)-8 |
| (II)-41 | (M2)-5 | (R3)-10 |
| (II)-42 | (M2)-10 | (R3)-1 |
| (II)-43 | (M2)-10 | (R3)-3 |
| (II)-44 | (M2)-10 | (R3)-7 |
| (II)-45 | (M2)-10 | (R3)-9 |
| (II)-46 | (M2)-13 | (R3)-1 |
| (II)-47 | (M2)-13 | (R3)-2 |
| (II)-48 | (M2)-13 | (R3)-3 |
| (II)-49 | (M2)-13 | (R3)-5 |
| (II)-50 | (M2)-13 | (R3)-7 |
| (II)-51 | (M2)-13 | (R3)-8 |
| (II)-52 | (M2)-16 | (R3)-1 |
| (II)-53 | (M2)-16 | (R3)-7 |
| (II)-54 | (M2)-21 | (R3)-1 |
| (II)-55 | (M2)-21 | (R3)-7 |
| (II)-56 | (M2)-25 | (R3)-1 |
| (II)-57 | (M2)-25 | (R3)-3 |
| (II)-58 | (M2)-25 | (R3)-7 |
| (II)-59 | (M2)-25 | (R3)-8 |
| (II)-60 | (M2)-25 | (R3)-9 |
| (II)-61 | (M3)-1 | (R3)-1 |
| (II)-62 | (M3)-1 | (R3)-2 |
| (II)-63 | (M3)-1 | (R3)-7 |
| (II)-64 | (M3)-1 | (R3)-8 |
| (II)-65 | (M3)-3 | (R3)-1 |
| (II)-66 | (M3)-3 | (R3)-7 |
| (II)-67 | (M3)-7 | (R3)-1 |
| (II)-68 | (M3)-7 | (R3)-2 |
| (II)-69 | (M3)-7 | (R3)-7 |
| (II)-70 | (M3)-7 | (R3)-8 |
| (II)-71 | (M3)-18 | (R3)-5 |
| (II)-72 | (M3)-18 | (R3)-12 |
| (II)-73 | (M3)-25 | (R3)-7 |
| (II)-74 | (M3)-25 | (R3)-8 |
| (II)-75 | (M3)-25 | (R3)-5 |
| (II)-76 | (M3)-25 | (R3)-12 |
| (II)-77 | (M4)-2 | (R3)-1 |
| (II)-78 | (M4)-2 | (R3)-7 |
| (II)-79 | (M4)-4 | (R3)-7 |
| (II)-80 | (M4)-4 | (R3)-8 |
| (II)-81 | (M4)-4 | (R3)-5 |
| (II)-82 | (M4)-4 | (R3)-12 |
| (II)-83 | (M4)-7 | (R3)-1 |
| (II)-84 | (M4)-7 | (R3)-2 |
| (II)-85 | (M4)-7 | (R3)-7 |
| (II)-86 | (M4)-7 | (R3)-8 |
| (II)-87 | (M4)-9 | (R3)-7 |
| (II)-88 | (M4)-9 | (R3)-8 |
| (II)-89 | (M4)-9 | (R3)-5 |
| (II)-90 | (M4)-9 | (R3)-12 |
| (II)-91 | (M1)-1 | (R3)-13 |
| (II)-92 | (M1)-1 | (R3)-15 |
| (II)-93 | (M1)-1 | (R3)-47 |
| (II)-94 | (M1)-2 | (R3)-13 |
| (II)-95 | (M1)-2 | (R3)-15 |
| (II)-96 | (M1)-2 | (R3)-19 |
| (II)-97 | (M1)-2 | (R3)-21 |
| (II)-98 | (M1)-2 | (R3)-28 |
| (II)-99 | (M1)-2 | (R3)-31 |
| (II)-100 | (M1)-2 | (R3)-33 |
| (II)-101 | (M1)-2 | (R3)-37 |
| (II)-102 | (M1)-2 | (R3)-38 |

-continued

Specific examples of Formula (II) [Formula (II-a)]

| Exemplified Compound | Charge Transport Skeleton F | Functional Group |
|---|---|---|
| (II)-103 | (M1)-2 | (R3)-43 |
| (II)-104 | (M1)-4 | (R3)-13 |
| (II)-105 | (M1)-4 | (R3)-15 |
| (II)-106 | (M1)-4 | (R3)-43 |
| (II)-107 | (M1)-4 | (R3)-48 |
| (II)-108 | (M1)-8 | (R3)-13 |
| (II)-109 | (M1)-8 | (R3)-15 |
| (II)-110 | (M1)-8 | (R3)-19 |
| (II)-111 | (M1)-8 | (R3)-28 |
| (II)-112 | (M1)-8 | (R3)-31 |
| (II)-113 | (M1)-8 | (R3)-33 |
| (II)-114 | (M1)-11 | (R3)-31 |
| (II)-115 | (M1)-11 | (R3)-33 |
| (II)-116 | (M1)-11 | (R3)-34 |
| (II)-117 | (M1)-11 | (R3)-36 |
| (II)-118 | (M1)-16 | (R3)-13 |
| (II)-119 | (M1)-22 | (R3)-15 |
| (II)-120 | (M1)-22 | (R3)-47 |
| (II)-121 | (M2)-2 | (R3)-13 |
| (II)-122 | (M2)-2 | (R3)-15 |
| (II)-123 | (M2)-2 | (R3)-14 |
| (II)-124 | (M2)-2 | (R3)-17 |
| (II)-125 | (M2)-3 | (R3)-15 |
| (II)-126 | (M2)-3 | (R3)-19 |
| (II)-127 | (M2)-3 | (R3)-21 |
| (II)-128 | (M2)-3 | (R3)-28 |
| (II)-129 | (M2)-3 | (R3)-31 |
| (II)-130 | (M2)-5 | (R3)-33 |
| (II)-131 | (M2)-5 | (R3)-37 |
| (II)-132 | (M2)-10 | (R3)-38 |
| (II)-133 | (M2)-10 | (R3)-43 |
| (II)-134 | (M2)-10 | (R3)-13 |
| (II)-135 | (M2)-10 | (R3)-15 |
| (II)-136 | (M2)-13 | (R3)-16 |
| (II)-137 | (M2)-13 | (R3)-48 |
| (II)-138 | (M2)-13 | (R3)-13 |
| (II)-139 | (M2)-13 | (R3)-26 |
| (II)-140 | (M2)-13 | (R3)-19 |
| (II)-141 | (M2)-13 | (R3)-28 |
| (II)-142 | (M2)-16 | (R3)-31 |
| (II)-143 | (M2)-16 | (R3)-33 |
| (II)-144 | (M2)-21 | (R3)-33 |
| (II)-145 | (M2)-21 | (R3)-34 |
| (II)-146 | (M2)-25 | (R3)-35 |
| (II)-147 | (M2)-25 | (R3)-36 |
| (II)-148 | (M2)-25 | (R3)-37 |
| (II)-149 | (M2)-25 | (R3)-15 |
| (II)-150 | (M2)-25 | (R3)-47 |
| (II)-151 | (M3)-1 | (R3)-13 |
| (II)-152 | (M3)-1 | (R3)-15 |
| (II)-153 | (M3)-1 | (R3)-14 |
| (II)-154 | (M3)-1 | (R3)-17 |
| (II)-155 | (M3)-3 | (R3)-15 |
| (II)-156 | (M3)-3 | (R3)-19 |
| (II)-157 | (M3)-7 | (R3)-21 |
| (II)-158 | (M3)-7 | (R3)-28 |
| (II)-159 | (M3)-7 | (R3)-31 |
| (II)-160 | (M3)-7 | (R3)-33 |
| (II)-161 | (M3)-18 | (R3)-37 |
| (II)-162 | (M3)-18 | (R3)-38 |
| (II)-163 | (M3)-25 | (R3)-43 |
| (II)-164 | (M3)-25 | (R3)-13 |
| (II)-165 | (M3)-25 | (R3)-15 |
| (II)-166 | (M3)-25 | (R3)-16 |
| (II)-167 | (M4)-2 | (R3)-48 |
| (II)-168 | (M4)-2 | (R3)-13 |
| (II)-169 | (M4)-4 | (R3)-26 |
| (II)-170 | (M4)-4 | (R3)-19 |
| (II)-171 | (M4)-4 | (R3)-28 |
| (II)-172 | (M4)-4 | (R3)-31 |
| (II)-173 | (M4)-7 | (R3)-32 |
| (II)-174 | (M4)-7 | (R3)-33 |
| (II)-175 | (M4)-7 | (R3)-34 |
| (II)-176 | (M4)-7 | (R3)-35 |

-continued

| Specific examples of Formula (II) [Formula (II-a)] | | |
|---|---|---|
| Exemplified Compound | Charge Transport Skeleton F | Functional Group |
| (II)-177 | (M4)-9 | (R3)-36 |
| (II)-178 | (M4)-9 | (R3)-37 |
| (II)-179 | (M4)-9 | (R3)-15 |
| (II)-180 | (M4)-9 | (R3)-47 |
| (II)-181 | (M2)-25 | (R4)-1 |
| (II)-182 | (M2)-25 | (R4)-4 |
| (II)-183 | (M2)-27 | (R3)-7 |
| (II)-184 | (M2)-28 | (R3)-1 |

The specific chain polymerizable charge transport materials (particularly, chain polymerizable compound represented by Formula (I)) are synthesized as follows.

That is, the specific chain polymerizable charge transport materials are synthesized by etherification of a carboxylic acid or alcohol as a precursor and corresponding chloromethylstyrene.

A synthesis pathway of Exemplified Compound (I-d)-22 of the specific chain polymerizable charge transport material will be shown as follows as an example.

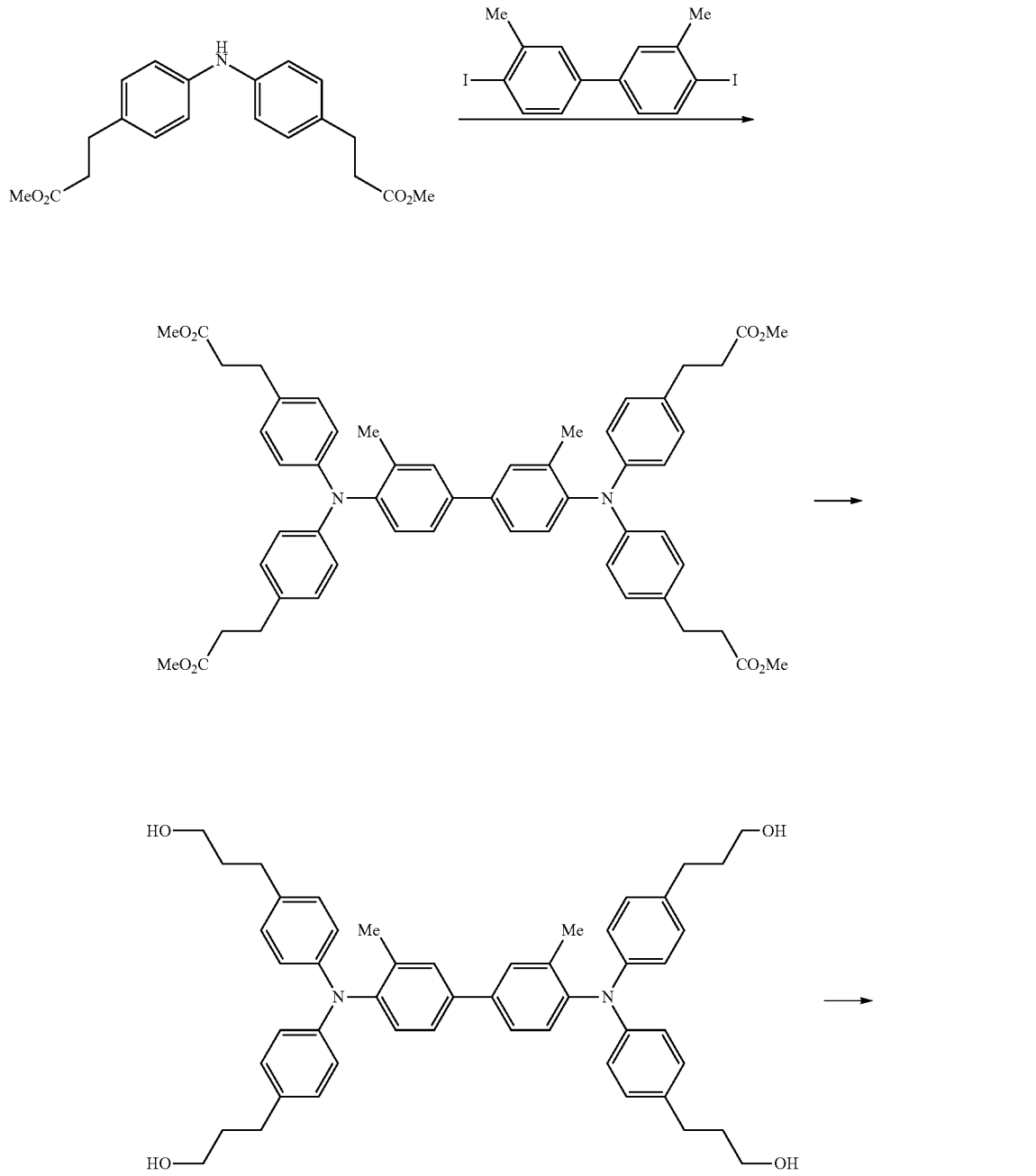

-continued

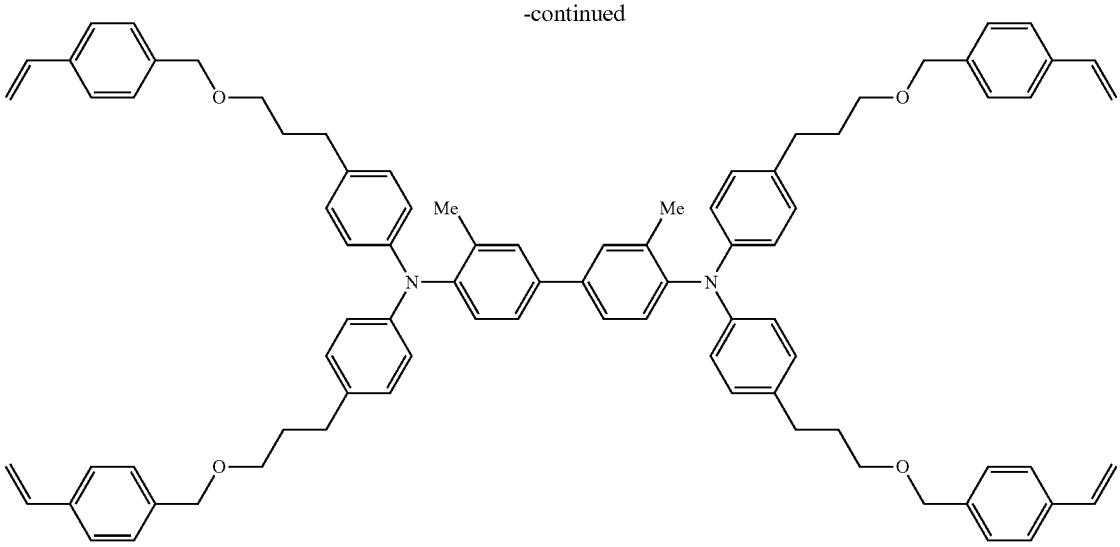

For example, as disclosed in Experimental Chemistry, $4^{th}$ edition, Vol. 20, p. 51, an arylamine compound carboxylic acid obtains an ester group of the arylamine compound by hydrolysis using a basic catalyst (NaOH or $K_2CO_3$) and an acidic catalyst (for example, phosphoric acid or sulfuric acid).

At that time, various elements may be used as a solvent, but alcohol such as methanol, ethanol, or ethylene glycol may be used or water may be mixed with these and be used.

In addition, when solubility of the arylamine compound is low, methylene chloride, chloroform, toluene, dimethyl sulfoxide, ether, or tetrahydrofuran may be added thereto.

An amount of the solvent is not particularly limited, but is from 1 part by weight to 100 parts by weight and preferably from 2 parts by weight to 50 parts by weight, with respect to 1 part by weight of the arylamine compound containing an ester group, for example.

A reaction temperature is, for example, set in a range of a room temperature (for example, 25° C.) to a boiling point of the solvent, and is preferably equal to or higher than 50 degrees, in a viewpoint of a reaction velocity.

An amount of the catalyst is not particularly limited, but is from 0.001 parts by weight to 1 part by weight and preferably from 0.01 parts by weight to 0.5 parts by weight, with respect to 1 part by weight of the arylamine compound containing an ester group, for example.

After the hydrolysis reaction, when the hydrolysis is performed by the basic catalyst, the formed salt is neutralized by acid (for example, hydrochloric acid) and is isolated. In addition, after performing sufficient water washing, drying is performed for use, or if necessary, after performing recrystallization refinement by suitable solvent such as methanol, ethanol, toluene, ethyl acetate, or acetone, drying is performed for use.

As disclosed in Experimental Chemistry, $4^{th}$ edition, Vol. 20, p. 10, alcohol of the arylamine compound is synthesized by reducing an ester group of the arylamine compound to corresponding alcohol using lithium aluminum hydride or sodium borohydride.

For example, when introducing the reactive group by ester bonding, general esterification of performing dehydration condensation of the arylamine compound carboxylic acid and hydroxymethyl styrene by an acid catalyst, or a method of condensing arylamine compound carboxylic acid and halogenated methylstyrene using base such as pyridine, piperidine, triethylamine, dimethylaminopyridine, trimethylamine, DBU, sodium hydride, sodium hydroxide, or potassium hydroxide, may be used, and the method using halogenated methylstyrene is preferable, in order to suppress generation of a byproduct.

An amount of halogenated methylstyrene to be added to the acid of arylamine compound carboxylic acid is equal to or greater than 1 equivalent weight, preferably equal to or greater than 1.2 equivalent weight, more preferably equal to or greater than 1.5 equivalent weight, and an amount of basic acid to be used with respect to halogenated methylstyrene is from 0.8 equivalent weight to 2.0 equivalent weight and preferably from 1.0 equivalent weight to 1.5 equivalent weight.

As the solvent, an aprotic polar solvent such as N-methylpyrrolidone, dimethyl sulfoxide, or N,N-dimethylformamide, a ketone solvent such as acetone or methyl ethyl ketone, an ether solvent such as diethyl ether or tetrahydrofuran, or an aromatic solvent such as toluene, chlorobenzene, or 1-chloronaphthalene is effective, and an amount thereof to be used with respect to 1 part by weight of arylamine compound carboxylic acid is from 1 part by weight to 100 parts by weight and more preferably from 2 parts by weight to 50 parts by weight.

The reaction temperature is not particularly limited. After completing the reaction, the reaction solution is added to water, extracted by a solvent such as toluene, hexane, or ethyl acetate and water-washed, and then, if necessary, refining may be performed, if necessary, using an adsorbent such as activated carbon, silica gel, porous alumina, or activated clay.

When introducing the reactive group by ether bonding, a method of condensing arylamine compound alcohol and halogenated methylstyrene using base such as pyridine, piperidine, triethylamine, dimethylaminopyridine, trimethylamine, DBU, sodium hydride, sodium hydroxide, or potassium hydroxide, is used.

An amount of halogenated methylstyrene to be added to alcohol of the arylamine compound alcohol is equal to or greater than 1 equivalent weight, preferably equal to or greater than 1.2 equivalent weight, more preferably equal to or greater than 1.5, and an amount of basic acid to be used with respect to halogenated methylstyrene is from 0.8 equivalent weight to 2.0 equivalent weight and preferably from 1.0 equivalent weight to 1.5 equivalent weight.

As the solvent, an aprotic polar solvent such as N-methylpyrrolidone, dimethyl sulfoxide, or N,N-dimethylformamide, a ketone solvent such as acetone or methyl ethyl ketone, an ether solvent such as diethyl ether or tetrahydrofuran, or an aromatic solvent such as toluene, chlorobenzene, or 1-chloronaphthalene is effective, and an amount thereof to be used with respect to 1 part by weight of arylamine compound alcohol is from 1 part by weight to 100 parts by weight and more preferably from 2 parts by weight to 50 parts by weight.

The reaction temperature is not particularly limited. After completing the reaction, the reaction solution is added to water, extracted by a solvent such as toluene, hexane, or ethyl acetate and water-washed, and then, if necessary, refining may be performed, if necessary, using an adsorbent such as activated carbon, silica gel, porous alumina, or activated clay.

The specific chain polymerizable charge transport materials (particularly, chain polymerizable compound represented by Formula (II)) are synthesized using general synthesis methods of charge transport material as follows (formylation, esterification, etherification, and hydrogenation), for example.

Formylation: reaction suitable for introducing a formyl group to an aromatic compound heterocyclic compound alkene having an electron-releasing group. It is common to use DMF and oxy phosphorus trichloride, and the reaction temperature is from a room temperature (for example, 25° C.) to approximately 100° C., in many cases.

Esterification: condensation reaction of organic acid and a compound having a hydroxyl group such as alcohol or phenol. It is preferable to use a method of break a balance to approach to an ester side by providing a dehydrating agent or removing water to outside of a system.

Etherification: Williamson synthesis method of condensing alcoxide and an organic halogen compound is general.

Hydrogenation: method of causing hydrogen to react with an unsaturated bond using various catalysts.

The content of the specific chain polymerizable charge transport material, for example, is from 40% by weight to 95% by weight and is preferably from 50% by weight to 95% by weight, with respect to total solid in the composition for layer formation.

Resin Particles

The film configuring the protection layer (uppermost layer) may include resin particles.

Examples of the resin particles include particles of a bisphenol A type or bisphenol Z type polycarbonate resin, particles of an insulating resin such as an acrylic resins, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-acrylic copolymer, a styrene-butadiene copolymer resin, a vinylidene chloride-acrylonitrile copolymer resin, a vinyl chloride-vinyl acetate-maleic acid resin, a silicone resin, a phenol-formaldehyde resin, a polyacrylamide resin, a polyamide resins, or chlorinated rubber, and particles of an organic photoconductive polymer such as polyvinyl carbazole, polyvinyl anthracene, or polyvinyl pyrene.

These resin particles may be hollow particles.

In addition, these resin particles may be used alone or in combination of two or more kinds thereof.

The film configuring the protection layer (uppermost layer) may include fluorine-containing resin particles as the resin particles.

Examples of the fluorine-containing resin particles include particles of a homopolymer of fluoroolefin, or a copolymer of two or more kinds and is a copolymer of one or two or more kinds of fluoroolefin and a nonfluorine monomer.

Examples of fluoroolefin include perhaloolefin such as tetrafluoroethylene (TFE), perfluoro vinyl ether, hexafluoropropylene (HFP), or chlorotrifluoroethylene (CTFE), and non-perfluoroolefin such as vinylidene fluoride (VdF), trifluoroethylene, or vinyl fluoride, and VdF, TFE, CTFE, or HFP is preferable.

Meanwhile, examples of the nonfluorine monomer include hydrocarbon olefin such as ethylene, propylene, or butene, alkyl vinyl ether such as cyclohexyl vinyl ether (CHVE), ethyl vinyl ether (EVE), butyl vinyl ether, or methyl vinyl ether, alkenyl vinyl ether such as polyoxyethylene allyl ether (POEAE) or ethyl allyl ether, an organic silicon compound having a reactive α,β-unsaturated group such as vinyl trimethoxy silane (VSi), vinyl triethoxysilane, or vinyl tris(methoxyethoxy) silane, ester acrylate such as methyl acrylate or ethyl acrylate, ester methacrylate such as methyl methacrylate or ethyl methacrylate, and vinyl ester such as Vinyl acetate, vinyl benzoate, or "VEOVA" (product name, vinyl ester manufactured by Shell Chemical K. K.), and alkyl vinyl ether, allyl vinyl ether, vinyl ester, and an organic silicon compound having a reactive α,β-unsaturated group are preferable.

Among these, an element having a high fluorination rate, and polytetrafluoroethylene (PTFE), a tetrafluoroethylene-hexafluoropropylene copolymer (FEP), a tetrafluoroethylene-perfluoro (alkyl vinyl ether) copolymer (PFA), an ethylene-tetrafluoroethylene copolymer (ETFE), and an ethylene-chlorotrifluoroethylene copolymer (ECTFE) are preferable. Among these, PTFE, FEP, and PFA are particularly preferable.

As the fluorine-containing resin particles, particles obtained by manufacturing a fluorine monomer by a method such as emulsion polymerization (fluororesin aqueous dispersion) may be used as they are, and the dried particles after sufficient water washing may be used.

An average particle diameter of the fluorine-containing resin particles is preferably from 0.01 μm to 100 μm and particularly preferably from 0.03 μm to 5 μm.

The average particle diameter of the fluorine-containing resin particles is a value measured using a laser diffraction-type particle size distribution measuring device LA-700 (manufactured by Horiba, Ltd.).

As the fluorine-containing resin particles, commercially available particles may be used, and for example, as the PTFE particles, Fluon L173JE (manufactured by Asahi Glass Co., Ltd.), Dyneon THV-221AZ, Dyneon 9205 (manufactured by Sumitomo 3M, Ltd.), LUBRON L2, and LUBRON L5 (manufactured by Daikin Industries, Ltd.) are used.

As the fluorine-containing resin particles, particles irradiated with laser beam having an oscillation wavelength of an ultraviolet region may be used. The laser beam incident to the fluorine-containing resin particles is not particularly limited, and an excimer laser or the like is used, for example. As the excimer laser beam, ultraviolet laser beam having a wavelength equal to or smaller than 400 nm and particularly of 193 nm to 308 nm is preferable. Particularly, KrF excimer laser beam (wavelength: 248 nm) and ArF excimer laser beam (wavelength: 193 nm) are preferable. In general, excimer laser beam irradiation is performed in the atmosphere at a room temperature (25° C.) but may be performed in an oxygen atmosphere.

The irradiation conditions of the excimer laser beam depend on the type of fluororesin and a degree of surface reforming to be obtained, but generally, the irradiation conditions are as follows.

Fluence: equal to or greater than 50 $mJ/cm^2$/pulse

Incident energy: equal to or more than 0.1 $J/cm^2$

Number of shots: equal to or less than 100

The generally used irradiation conditions of the particularly preferable KrF excimer laser beam and ArF excimer laser beam are as follows.

KrF

Fluence: from 100 $mJ/cm^2$/pulse to 500 $mJ/cm^2$/pulse

Incident energy: from 0.2 $J/cm^2$ to 2.0 $J/cm^2$

Number of shots: from 1 to 20

ArF

Fluence: from 50 $mJ/cm^2$/pulse to 150 $mJ/cm^2$/pulse

Incident energy: from 0.1 $J/cm^2$ to 1.0 $J/cm^2$

Number of shots: from 1 to 20

A content of the fluorine-containing resin particles is preferably from 1% by weight to 20% by weight and more preferably 1% by weight to 12% by weight with respect to the total solid content of the protection layer (uppermost layer).

Fluorine-Containing Dispersant

The film configuring the protection layer (uppermost layer) may include the fluorine-containing resin particles and a fluorine-containing dispersant.

The fluorine-containing dispersant is used for dispersing the fluorine-containing resin particles in the protection layer (uppermost layer), and thus, preferably has a surfactant action; that is, a substance having a hydrophilic group and a hydrophobic group in a molecule may be used.

As the fluorine-containing dispersant, the following resins obtained by polymerizing reactive monomers (hereinafter, referred to as "specific resins") are used. Specific examples thereof include a random or block copolymer of acrylate having a perfluoroalkyl group and a monomer not having fluorine, a random or block copolymer of acrylate having a methacrylate homopolymer and the acrylate having a perfluoroalkyl group and the monomer not having fluorine, and a random or block copolymer of methacrylate and the monomer not having fluorine. In addition, examples of acrylate having a perfluoroalkyl group include 2,2,2-trifluoroethyl methacrylate, and 2,2,3,3,3-pentafluoropropyl methacrylate.

Examples of the monomer not having fluorine include isobutyl acrylate, t-butyl acrylate, isooctyl acrylate, lauryl acrylate, stearyl acrylate, isobornyl acrylate, cyclohexyl acrylate, 2-methoxyethyl acrylate, methoxy triethylene glycol acrylate, 2-ethoxyethyl acrylate, tetrahydrofurfuryl acrylate, benzyl acrylate, ethyl carbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl acrylate o-phenylphenol, and o-phenylphenol glycidyl ether acrylate. In addition a block or branched polymer disclosed in U.S. Pat. No. 5,637,142 and Japanese Patent No. 4251662 is used. In addition, a fluorine surfactant is used. Specific examples of the fluorine surfactant include SURFLON S-611, SURFLON S-385 (manufactured by AGC Seimi Chemical Co., Ltd.), Ftergent 730FL, Ftergent 750FL (manufactured by Neos Co., Ltd.), PF-636, PF-6520 (manufactured by KITAMURA CHEMICALS CO., LTD.), MEGAFACE EXP, TF-1507, MEGAFACE EXP, TF-1535 (manufactured by DIC Corporation), FC-4430, and FC4432 (manufactured by 3M).

A weight average molecular weight of the specific resin is preferably from 100 to 50,000.

A content of the fluorine-containing dispersant is preferably 0.1% by weight to 1% by weight and more preferably from 0.2% by weight to 0.5% by weight with respect to the total solid content of the protection layer (uppermost layer).

As a method of attaching the fluorine-containing dispersant to the surface of the fluorine-containing resin particles, the fluorine-containing dispersant may be directly attached to the surface of the fluorine-containing resin particles. Alternatively, first, polymerization is performed after the above described monomer may be adsorbed to the surface of the fluorine-containing resin particles, and the specific resin may be formed on the surface of the fluorine-containing resin particles.

The fluorine-containing dispersant may be used with another surfactant. However, the amount thereof is preferably extremely small, and a content of the other surfactant may be from 0 part by weight to 0.1 parts by weight, preferably from 0 part by weight to 0.05 parts by weight, more preferably from 0 part by weight to 0.03 parts by weight, with respect to 1 part by weight of the fluorine-containing resin particles.

As the other surfactant, a nonionic surfactant may be used, and examples thereof include polyoxyethylene alkyl ethers, polyoxyethylene alkyl phenyl ethers, polyoxyethylene alkyl esters, sorbitan alkyl esters, polyoxyethylene sorbitan alkyl esters, glycerol esters, a fluorine surfactant and a derivative thereof.

Specific examples of polyoxyethylenes include EMULGEN 707 (manufactured by Kao Corporation), NAROACTY CL-70, NAROACTY CL-85 (manufactured by Sanyo Chemical Industries), and LEOCOL TD-120 (manufactured by Lion Corporation).

Compound having Unsaturated Bond

The film configuring the protection layer (uppermost layer) may be used with a compound having an unsaturated bond.

As the compound having an unsaturated bond, any one of a monomer, an oligomer, and a polymer may be used. In addition, as the compound having an unsaturated bond, a compound not having the charge transport skeleton is used.

As the compound having an unsaturated bond, the followings are exemplified as the compound not having the charge transport skeleton.

Examples of a monofunctional monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxy triethylene glycol acrylate, 2-ethoxyethyl acrylate, tetrahydrofurfuryl acrylate, benzyl acrylate, ethyl carbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenylphenol acrylate, o-phenylphenol glycidyl ether acrylate, and styrene.

Examples of a difunctional monomer include diethylene glycol di (meth)acrylate, polyethylene glycol di (meth) acrylate, polypropylene glycol di (meth)acrylate, neopentyl glycol di (meth)acrylate, 1,6-hexanediol di (meth)acrylate, divinyl benzene, and diallyl phthalate.

Examples of a trifunctional monomer include trimethylolpropane tri(meth)acrylate, pentaerythritol tri(meth)acrylate, aliphatic tri(meth)acrylate, and trivinylcyclohexane.

Examples of a tetrafunctional monomer include Pentaerythritol tetra(meth)acrylate, ditrimethylolpropane tetra (meth)acrylate, and aliphatic tetra(meth)acrylate.

Examples of a pentafunctional monomer include dipentaerythritol penta(meth)acrylate, dipentaerythritol hexa(meth)acrylate, and (meth)acrylate having a polyester skeleton, a urethane skeleton, and a phosphazene skeleton.

Among the compounds having an unsaturated bond, polymers disclosed in JP-A-5-216249, JP-A-5-323630, JP-A-11-52603, JP-A-2000-264961, and JP-A-2005-2291 are used, for example, as polymers.

When using the compound having an unsaturated bond and not having the charge transport component, the compounds are used alone or in combination of two or more kinds.

A content of the compound having an unsaturated bond and not having the charge transport component is, for example, preferably equal to or smaller than 60% by weight, more preferably equal to or smaller than 55% by weight, and even more preferably equal to or smaller than 50% by weight, with respect to the total solid content of the composition used when forming the protection layer (uppermost layer).

Non-Reactive Charge Transport Material

The film configuring the protection layer (uppermost layer) may also use the non-reactive charge transport material. The non-reactive charge transport material does not have a reactive group. Accordingly, it is effective to use the non-reactive charge transport material in the protection layer (uppermost layer), because the concentration of the charge transport component increases and the electrical characteristics are further improved. In addition, the non-reactive charge transport material may be added to detect a crosslink density and adjust the strength.

As the non-reactive charge transport material, a well-known charge transport material may be used, and specific examples thereof include a triarylamine compound, a benzidine compound, an arylalkane compound, an aryl-substituted ethylene compound, a stilbene compound, an anthracene compound, and a hydrazone compound.

Among these, a compound having a triphenylamine skeleton is preferable, in the viewpoints of charge mobility and compatibility.

An amount of the non-reactive charge transport material to be used with respect to the total solid content in a coating solution for layer formation is preferably from 0% by weight to 30% by weight, more preferably from 1% by weight to 25% by weight, and even more preferably from 5% by weight to 25% by weight.

Other Additives

The film configuring the protection layer (uppermost layer) may be used to be mixed with other coupling agents, particularly a fluorine-containing coupling agent, in order to adjust film formability, flexibility, lubricity, and adhesiveness. As such a compound, various silane coupling agents and commercially available silicone hard coating agents are used. In addition, a silicon compound having a radical polymerizable group and a fluorine-containing compound may be used.

Examples of the silane coupling agent include vinyl trichlorosilane, vinyl trimethoxysilane, vinyl triethoxysilane, 3-glycidoxypropyl methyl diethoxysilane, 3-glycidoxypropyl triethoxysilane, 3-glycidoxypropyl trimethoxysilane, 3-aminopropyl triethoxysilane, 3-aminopropyltrimethoxysilane, 3-aminopropylmethyldimethoxysilane, N-2 (aminoethyl)-3-aminopropyltriethoxysilane, tetramethoxysilane, methyltrimethoxysilane, and dimethyldimethoxysilane.

Examples of the commercially available hard coating agent include KP-85, X-40-9740, X-8239 (all manufactured by Shin-Etsu Chemical Co., Ltd.), AY42-440, AY42-441, and AY49-208 (all manufactured by Dow Corning Toray Co., Ltd.).

In order to apply water repellency or the like, the fluorine-containing compounds such as (tridecafluoro-1,1,2,2-tetrahydrooctyl)triethoxysilane, (3,3,3-trifluoropropyl) trimethoxysilane, 3-(heptafluoroisopropoxy) propyltriethoxysilane, 1H, 1H, 2H, 2H-perfluoroalkyl triethoxysilane, 1H,1H,2H,2H-perfluorodecyl triethoxysilane, and 1H,1H,2H,2H-perfluorooctyl triethoxysilane may be added.

An arbitrary amount of the silane coupling agent is used, but an amount of the fluorine-containing compound is preferably 0.25 times or less based on weight with respect to the compound not having fluorine, in the viewpoint of film formability of the crosslinked film. In addition, a reactive fluorine compound disclosed in JP-A-2001-166510 may be mixed.

As the silicon compound having a radical polymerizable group and the fluorine-containing compound, a compound disclosed in JP-A-2007-11005 is used.

A deterioration inhibitor is preferably added to the film configuring the protection layer (uppermost layer). As the deterioration inhibitor, hindered phenol or hindered amine inhibitor is preferable, and a well-known antioxidant such as an organic sulfur antioxidant, a phosphite antioxidant, a dithiocarbamate antioxidant, a thiourea antioxidant, or a benzimidazole antioxidant may be used.

An amount of the deterioration inhibitor added is preferably equal to or smaller than 20% by weight and more preferably equal to or smaller than 10% by weight.

Examples of hindered phenol antioxidant include IRGANOX 1076, IRGANOX 1010, IRGANOX1098, IRGANOX 245, IRGANOX 1330, IRGANOX 3114, IRGANOX 1076 (all manufactured by Chiba Japan Co., Ltd.), and 3,5-di-t-butyl-4-hydroxybiphenyl.

Examples of hindered amine antioxidant include SANOL LS 2626, SANOL LS 765, SANOL LS 770, SANOL LS 744 (all manufactured by Sankyo Lifetech Co., Ltd.), TINUVIN 144, TINUVIN 622LD (all manufactured by Chiba Japan Co., Ltd.), Mark LA 57, Mark LA 67, Mark LA 62, Mark LA 68, and Mark LA 63 (all manufactured by Adeka Corporation). Examples of thioether component include Sumilizer TPS and Sumilizer TP-D (all manufactured by Sumitomo Chemical Co., Ltd.), and examples of phosphite component include Mark 2112, Mark PEP-8, Mark PEP-24G, Mark PEP-36, Mark 329K, and Mark HP-10 (all manufactured by Adeka Corporation).

Conductive particles or organic or inorganic particles may be added to the film configuring the protection layer (uppermost layer).

As an example of the particles, silicon-containing particles are used. As the silicon-containing particles, particles having silicon in a constituent element are used, and specifically, colloidal silica and silicone particles are used. The colloidal silica used as the silicon-containing particles is selected from silica, having an average particle diameter which is preferably 1 nm to 100 nm and more preferably 10 nm to 30 nm, which is dispersed in an acidic or alkaline aqueous dispersion, or an organic solvent such as alcohol, ketone, or ester. As the particles, commercially available particles may be used.

The solid content of colloidal silica in the protection layer is not particularly limited, but is from 0.1% by weight to 50% by weight and preferably 0.1% by weight to 30% by weight, based on the total solid content of the protection layer.

The silicon particles used as the silicon-containing particles are selected from silicone resin particles, silicone rubber particles, and silicone surface-treated silica particles, and commercially available particles may be used.

The silicone particles have a spherical shape, and an average particle diameter thereof is preferably from 1 nm to 500 nm and more preferably 10 nm to 100 nm.

A content of the silicone particles in the surface layer is preferably from 0.1% by weight to 30% by weight and more preferably from 0.5% by weight to 10% by weight, based on the total solid content of the protection layer.

Examples of other particles include semiconductive metal oxide such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Various well-known dispersion material may be used in order to disperse the particles.

Oil such as silicone oil may be added to the film configuring the protection layer (uppermost layer).

Examples of silicone oil include silicone oil such as dimethyl polysiloxane, diphenyl polysiloxane, or phenyl methyl siloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxanes, or phenol-modified polysiloxane; cyclic dimethyl cyclosiloxanes such as hexamethylcyclotrisiloxane, octamethylcyclotetrasiloxane, decamethylcyclopentasiloxane, or dodecamethylcyclohexasiloxane; cyclic methyl phenyl cyclosiloxanes such as 1,3,5-trimethyl-1,3,5-triphenyl cyclotrisiloxanes, 1,3,5,7-tetramethyl-1,3,5,7-tetraphenyl cyclotetrasiloxane, or 1,3,5,7,9-pentamethyl-1,3,5,7,9-pentaphenyl cyclopentasiloxane; cyclic phenyl cyclosiloxanes such as hexaphenylcyclotrisiloxane; fluorine-containing cyclosiloxanes such as 3-(3,3,3 trifluoropropyl)methylcyclotrisiloxane; hydrosilyl group-containing cyclosiloxanes such as methylhydrosiloxane mixture, pentamethylcyclopentasiloxane, or phenyl hydrocyclosiloxane; and vinyl group-containing cyclosiloxanes such as penta vinyl pentamethylcyclopentasiloxane.

A silicone-containing oligomer, a fluorine-containing acrylic polymer, a silicone-containing polymer, and the like may be added to the film configuring the protection layer (uppermost layer), in order to improve wettability of the coating film.

Metal, metal oxide, carbon black, and the like may be added to the film configuring the protection layer (uppermost layer). As metal, aluminum, zinc, copper, chromium, nickel, silver and stainless steel, or a material obtained by performing vapor deposition of the metal on the surface of the resin particles is used. Examples of metal oxide include zinc oxide, titanium oxide, tin oxide, antimony oxide, indium oxide, bismuth oxide, tin-doped indium oxide, antimony or tantalum-doped tin oxide, and antimony-doped zirconium oxide.

These are used alone or in combination of two or more kinds thereof. When using these in combination of two or more kinds thereof, these may be simply mixed or may be mixed by a solid solution or fusion. An average particle diameter of the conductive particles is equal to or smaller than 0.3 μm and particularly preferably equal to or smaller than 0.1 μm.

Composition

The composition used for forming the protection layer is preferably prepared as a protection layer forming coating solution which is formed by dissolving or dispersing each component in a solvent.

Herein, as the solvent of the protection layer forming coating solution, a ketone solvent or ester solvent in which a difference (absolute value) between the binder resin of the charge transport layer (specific polycarbonate copolymer) and an SP value (parameter of solubility calculated by Feders method) is from 2.0 to 4.0 (preferably, from 2.5 to 3.5) may be used, in order to obtain solubility of the charge transport material and dispersibility of the fluorine-containing resin particles, and to prevent bias of the fluorine-containing resin particles to the surface side of the uppermost layer.

Specific examples of the solvent of the protection layer forming coating solution include a single solvent or mixed solvent of ketones such as methyl ethyl ketone, methyl isobutyl ketone, diisopropyl ketone, diisobutyl ketone, ethyl n-butyl ketone, di-n-propyl ketone, methyl n-amyl ketone, methyl n-butyl ketone, diethyl ketone, and methyl n-propyl ketone; or esters such as isopropyl acetate, isobutyl acetate, ethyl acetate, n-propyl acetate, n-butyl acetate, ethyl isovalerate, isoamyl acetate, isopropyl butyrate, isoamyl propionate, butyl butyrate, amyl acetate, butyl propionate, ethyl propionate, methyl acetate, propionate acid methyl, and allyl acetate. In addition, an ester solution of 0% by weight to 50% by weight (for example, diethyl ether, dioxane, diisopropyl ether, cyclopentyl methyl ether, or tetrahydrofuran) and an alkylene glycol solution (for example, l-methoxy-2-propanol, 1-ethoxy-2-propanol, ethylene glycol mono-isopropyl ether, or propylene glycol monomethyl ether acetate) may be mixed with each other to be used.

Examples of a dispersion method for dispersing the fluorine-containing resin particles in the protection layer forming coating solution include dispersion methods using a media dispersion instrument such as a ball mill, a vibration ball mill, an attritor, a sand mill, or a horizontal sand mill, or a media-less dispersion instrument such as a stirrer, an ultrasonic wave dispersion instrument, a roll mill, or a high-pressure homogenizer. As the dispersion method, a dispersion method such as a collision type of dispersing a dispersion by causing liquid-liquid collision or liquid-wall collision in a high pressure state, or a flow-through method of dispersing a dispersion by causing the dispersion to flow through a minute flow path in a high pressure state, is also used, as the high-pressure homogenizer.

The preparation method of the protection layer forming coating solution is not particularly limited, and the charge transport material, the fluorine-containing resin particles, the fluorine-containing dispersant, and if necessary, the other additives such as the solvent may be mixed with each other using the above disperser, to prepare the protection layer forming coating solution. Alternatively, a mixed solution A including the fluorine-containing resin particles, the fluorine-containing dispersant, and the solvent and a mixed solution B including at least the charge transport material and the solvent may be separately prepared and the mixed solution A and the mixed solution B may be mixed to prepare the protection layer forming coating solution. By mixing the fluorine-containing resin particles and the fluorine-containing dispersant in the solvent, it is easy to attach the fluorine-containing dispersant to the surface of the fluorine-containing resin particles.

When obtaining the protection layer forming coating solution by causing the above components to react with each other, each component may be simply mixed with each other and dissolved in each other, but the components are preferably heated under the conditions of a temperature preferably from a room temperature (20° C.) to 100° C. and more preferably from 30° C. to 80° C., and the time preferably from 10 minutes to 100 hours and more preferably from 1 hour to 50 hours. In this case, it is also preferable to emit ultrasonic waves.

Formation of Protection Layer

The protection layer forming coating solution is applied onto a surface to be coated (charge transport layer) by general methods such as a blade coating method, a wire bar coating method, a spray coating method, a dip coating method, a bead coating method, an air-knife coating method, a curtain coating method, and an ink jet method.

After that, light, electron beams, or heat is applied to the obtained coated film to make radical polymerization occur, and the coated film is cured.

In the curing method, heat, light, or a radiation ray is used. When performing the curing by heat or light, a polymerization initiator is not necessary, but a photosetting catalyst or a thermal polymerization initiator may be used.

As the photosetting catalyst or the thermal polymerization initiator, a well known photosetting catalyst or thermal polymerization initiator is used. As the radiation ray, an electron beam is preferable.

Electron Beam Curing

When using the electron beam, an acceleration voltage is preferably equal to or smaller than 300 KV and optimally equal to or smaller than 150 KV. A dose thereof is in a range preferably from 1 Mrad to 100 Mrad and more preferably from 3 Mrad to 50 Mrad. By setting the acceleration voltage to be equal to or smaller than 300 KV, damage of photoreceptor characteristics due to electron beam irradiation is prevented. In addition, by setting the dose to be equal to or greater than 1 Mrad, crosslinking is sufficiently performed, and by setting the dose to be equal to or smaller than 100 Mrad, the deterioration of photoreceptor is prevented.

The irradiation is performed in an inert gas atmosphere such as nitrogen or argon and at an oxygen concentration of 1000 ppm and preferably 500 ppm, and the heating may be performed at a temperature of 50° C. to 150° C. during or after the irradiation.

Photocuring

As a light source, a high pressure mercury vapor lamp, a low pressure mercury vapor lamp, or a metal halide lamp is used, and a preferable wavelength may be selected using a filter such as a band pass filter. The irradiation time and light intensity are freely selected, but for example, illuminance (365 nm) is equal to or greater than 300 mW/cm$^2$ and preferably equal to or smaller than 1,000 mW/cm$^2$. When performing the irradiation of UV light at 600 mW/cm$^2$, for example, the irradiation may be performed for 5 seconds to 360 seconds.

The irradiation is performed in an inert gas atmosphere such as nitrogen or argon and at oxygen concentration of 1000 ppm or less and preferably 500 ppm or less, and the heating may be performed at a temperature of 50° C. to 150° C. during or after the irradiation.

Examples of the intramolecular cleavage type photosetting catalysts include benzyl ketal, alkylphenone, aminoalkylphenone, phosphine oxide, titanocene, and oxime catalysts.

Specific examples thereof include 2,2-dimethoxy-1,2-diphenyl ethane-1-one as benzyl ketal.

Examples of alkylphenone catalyst include 1-hydroxycyclohexyl-phenyl-ketone, 2-hydroxy-2-methyl-1-phenylpropan-1-one, 1-[4-(2-hydroxyethoxy)-phenyl]-2-hydroxy-2-methyl 1-propane-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyl oxy) acetophenone.

Examples of aminoalkylphenone catalyst include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2(dimethylamino)-2-[(4-methylphenyl) methyl]-1-[4-(4-Morihoniru)phenyl]-1-butanone.

Examples of phosphine oxide catalyst include 2,4,6-trimethyl benzoyl-diphenyl-phosphine oxide, and bis(2,4,6-trimethyl benzoyl)-phenyl phosphine oxide.

Examples of titanocene catalyst include bis(η5-2,4-cyclopentadiene-1-yl)-bis(2,6-difluoro-3-(1H-pyrrol-1-yl)-phenyl) titanium.

Examples of oxime catalyst include 1,2-octanedione, 1-[4-(phenylthio)-, 2-(O-benzoyloxime)], ethanone, 1-[9-ethyl-6-(2-methyl-benzoyl)-9H-carbazole-3-yl]-, and 1-(O-acetyl oxime).

Examples of a hydrogen abstraction type include benzophenone catalyst, thioxanthone catalyst, benzyl catalyst, and Michler's ketone catalyst.

Specific examples of benzophenone catalyst include 2-benzoyl benzoic acid, 2-chloro benzophenone, 4,4'-dichloro benzophenone, 4-benzoyl-4'-methyl diphenyl sulfide, and p,p'-bisdiethylaminobenzophenone.

Examples of thioxanthone catalyst include 2,4-diethyl thioxanthene-9-one, 2-chloro-thioxanthone, and 2-isopropyl thioxanthone.

Examples of benzyl catalyst include benzyl, (±)-camphorquinone, and p-anisyl.

These photoinitiators are used alone or in combination of two or more kinds thereof.

Thermocuring

As the thermal polymerization initiator, a thermal radial generator or a derivative thereof is used, and specific examples thereof include an azo initiator such as V-30, V-40, V-59, V601, V65, V-70, VF-096, VE-073, Vam-10, Vam-111 (manufactured by Wako Pure Chemical Industries, Ltd.), OTazo-15, OTazo-30, AIBN, AMBN, ADVN, or ACVA (manufactured by Otsuka Chemical Co., Ltd.), PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, PERBUTYL Z (manufactured by NOF CORPORATION), Kayaketal AM-C55, Trigonox 36-C75, Laurox, Perkadox L-W75, Perkadox CH-50L, Trigonox TMBH, Kayacumene H, Kayabutyl H-70, Perkadox BC-FF, Kayahexa AD, Perkadox 14, Kayabutyl C, Kayabutyl D, Kayahexa YD-E85, Perkadox 12-XL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPO-70, Trigonox 121, Kayaester O, Kayaester HTP-65W, Kayaester AN, Trigonox 42, Trigonox F-C50, Kayabutyl B, Kayacarbon EH-C70, Kayacarbon EH-W60, Kayacarbon 1-20, Kayacarbon BIC-75, Trigonox 117, and Kayalen 6-70 (manufactured by Kayaku Akzo Corporation), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TAIC, Luperox TAEC, Luperox DC, Luperox 101, Luperox F, Luperox DI, Luperox 130, Luperox 220, Luperox 230, Luperox 233, and Luperox 531 (manufactured by ARKEMA YOSHITOMI, LTD.).

Among these, when using the azo polymerization initiator having a molecular weight equal to or more than 250, the reaction proceeds at a low temperature without generating unevenness, and accordingly, a film having high strength with suppressed unevenness is realized. More preferably, the molecular weight of the azo polymerization initiator is equal to or more than 250 and more preferably equal to or more than 300.

In the inert gas atmosphere such as nitrogen or argon, the heating is performed at oxygen concentration equal to or lower than 1,000 ppm and more preferably equal to or lower than 500 ppm, at a temperature preferably from 50° C. to 170° C. and more preferably from 70° C. to 150° C., and for the time preferably from 10 minutes to 120 minutes and more preferably from 15 minutes to 100 minutes.

The total content of the photosetting catalyst or the thermal polymerization initiator is preferably from 0.1% by weight to 10% by weight, more preferably from 0.1% by weight to 8% by weight, and particularly preferably from 0.1% by weight to 5% by weight, with respect to the total solid content in the dissolved solution for layer formation.

In the exemplary embodiment, when the reaction proceeds rapidly, it is difficult to obtain structural relaxation of the coated film by the crosslinking, and unevenness and wrinkles in the film are easily generated, and therefore, the curing method performed using heat in which the radical generation occurs comparatively slowly is used.

Particularly, by combining the specific chain polymerizable charge transport materials and curing due to heat, the structural relaxation of the coated film is promoted, and it is easy to obtain the protection layer (uppermost layer) having an excellent surface shape.

A film thickness of the protection layer is set to be, for example, preferably from 3 μm to 40 μm, more preferably from 5 μm to 35 μm, and even more preferably from 7 μm to 30 μm.

Hereinabove, the configuration of each layer in the function separation type photoreceptor has been described with reference to the electrophotographic photoreceptor shown in FIG. 1, but each layer of the function separation type electrophotographic photoreceptor shown in FIG. 2 also employs this configuration. When using the single-layer type photosensitive layer of the electrophotographic photoreceptor shown in FIG. 3, the following configurations are preferable.

That is, the single-layer type photosensitive layer (charge generation/charge transport layer) may be configured to include the charge generation material, the charge transport material, and if necessary, the binder resin and other well-known additives. These materials are the same as the materials described for the charge generation material and the charge transport layer.

A content of the charge generation material in the single-layer type photosensitive layer may be from 10% by weight to 85% by weight and is preferably from 20% by weight to 50% by weight, with respect to the total solid content. A content of the charge transport material in the single-layer type photosensitive layer may be from 5% by weight to 50% by weight with respect to the total solid content.

The forming method of the single-layer type photosensitive layer is the same as the forming method of the charge generation layer or the charge transport layer.

A film thickness of the single-layer type photosensitive layer may be, for example, from 5 μm to 50 μm and is preferably from 10 μm to 40 μm.

In the electrophotographic photoreceptor according to the exemplary embodiment, the configuration in which the uppermost layer is the protection layer has been described, but the uppermost layer may have a layer configuration which is not the protection layer.

In a case of using the layer configuration which is not the protection layer, in the electrophotographic photoreceptor shown in FIG. 1, the charge transport layer positioned at the uppermost surface in the layer configuration is set as the uppermost layer. The charge transport layer to be the uppermost layer is configured with the cured film of the specific composition described above.

In addition, when using the layer configuration which is not the protection layer, in the electrophotographic photoreceptor shown in FIG. 3, the single-layer type photosensitive layer positioned at the uppermost surface in the layer configuration is set as the uppermost layer. The single-layer type photosensitive layer to be the uppermost layer is configured with the cured film of the specific composition described above. Herein, the charge generation material is blended with the composition described above.

Charging Device

As the charging device 8, a charging device which is disposed to be in contact with or be adjacent to the surface of the electrophotographic photoreceptor 7 and charges the surface of the electrophotographic photoreceptor is employed. Herein, to dispose the charging device 8 to be adjacent to the electrophotographic photoreceptor, for example, means to dispose the charging device 8 (conductive member thereof (charging member)) to be separated from the surface of the electrophotographic photoreceptor 7 in a range of 1 μm to 200 μm.

Specific examples of the charging device 8 include a contact-type charging member provided by bringing a conductive or semiconductive member such as a charge roller, a charge brush, a charge film, a charge rubber blade, and a charge tube into contact with the surface of the electrophotographic photoreceptor 7, and an approaching type charger provided by separating the conductive or semiconductive member from the surface of the electrophotographic photoreceptor 7.

Exposure Device

Examples of the exposure device 9 include optical devices that expose the surface of the electrophotographic photoreceptor 7 according to an image data, with light such as semiconductor laser light, LED light, or liquid crystal shutter light. A wavelength of the light source is in the spectral sensitivity range of the electrophotographic photoreceptor. The mainstream of the wavelength of the semiconductor laser is near infrared that has an oscillation wavelength near 780 nm. However, the wavelength is not limited to this. For example, lasers having oscillation wavelengths on the order of 600 nm and lasers having oscillation wavelengths near the range of 400 nm to 450 nm may also be used as a blue laser. In order to form a color image, surface-emission laser light sources that output multibeams are also effective.

Developing Device

As the developing device 11, for example, a general developing device that performs development in a contact manner or a non-contact manner of the developer is used. The developing device 11 is not particularly limited as long as it has the above functions, and is selected in accordance with purposes. For example, a well-known developing device having a function of attaching a single-component developer or a two-component developer to the electrophotographic photoreceptor 7 using a brush or a roller is used. Among these, a developing device that uses a developing roller having a developer in a surface is preferably used.

Herein, the developer accommodated in the developing device includes toner particles and fatty acid metal salt particles. The fatty acid metal salt particles are included in the developer as an external additive.

Next, the configuration of the toner particles will be described.

The toner particles, for example, include binder resin. The toner particles may include, if necessary, a colorant, a release agent, and other additives.

Binder Resin

Examples of the binder resins include a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These other binder resins may be used alone or in combination with two or more kinds thereof.

The content of the binder resin is, for example, preferably from 40% by weight to 95% by weight, more preferably from 50% by weight to 90% by weight, and even more preferably from 60% by weight to 85% by weight, with respect to the entirety of toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing Methods for Transition Temperatures of Plastics", from a DSC curve obtained by differential scanning calorimetry (DSC).

The content of the release agent is, for example, preferably from 1% by weight to 20% by weight and more preferably from 5% by weight to 15% by weight, with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure are preferably composed of, for example, a core containing a binder resin, and if necessary, other additives such as a colorant and a release agent, and a coating layer containing a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 mL of a 5% aqueous solution of surfactant (preferably sodium alkylbenzene sulfonate) as a dispersing agent. The obtained material is added to 100 mL to 150 mL of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additives

The external additives include the fatty acid metal salt particles. In addition to the fatty acid metal salt particles, the external additives may include other external additives such as the inorganic abrasive particles or the inorganic lubricant particles from the viewpoint of suppressing generation of the unevenness in density of the image.

Examples of the fatty acid metal salt particles include particles of metal salt of fatty acid (for example, fatty acid such as stearic acid, 12-hydroxystearic acid, behenic acid, montan acid, lauric acid, or other organic acid) and metal (for example, calcium, zinc, magnesium, aluminum or other metal (Na or Li)), for example.

Specific examples of the fatty acid metal salt particles include particles of zinc stearate, calcium stearate, iron stearate, copper stearate, magnesium palmitate, calcium palmitate, manganese oleate, lead oleate, zinc laurate, or zinc palmitate.

Among these, particles of zinc stearate are preferable as the fatty acid metal salt particles, in order to improve the lubricating property, the hydrophobic property, and the wettability with respect to the electrophotographic photoreceptor and to suppress the unevenness in density of the image.

The fatty acid metal salt particles may be mixed particles of plural kinds of fatty acid metal salt. In addition, the fatty acid metal salt particles may be particles including fatty acid metal salt and other components. As the other components, higher fatty alcohol or the like is used, for example. However, 10% by weight or more of fatty acid metal salt is included in the fatty acid metal salt particles.

The median diameter of the fatty acid metal salt particles based on volume is preferably from 0.1 μm to 10.0 μm, more preferably from 0.2 μm to 10.0 μm, and even more preferably from 0.2 μm to 8.0, in order to suppress the unevenness in density of the image.

The median diameter of the fatty acid metal salt particles based on volume is a value measured by the following method. As the measuring device, a laser diffraction and scattering type particle size distribution measuring device "LA-920" (manufactured by Horiba, Ltd.) is used. For setting of the measurement conditions and analysis of measurement data, software dedicated for LA-920 "HORIBA LA-920 for Windows (trade mark) WET (LA-920) Ver. 2.02" is used. In addition, as the measurement solvent, ion exchange water obtained by removing an impure solid in advance is used.

The inorganic abrasive particles are inorganic particles having a function of abrading the surface of the photoreceptor.

Examples of the inorganic abrasive particles include particles of well-known abrasives such as inorganic oxides, nitrides, borides, and carbonates. Specific examples of the inorganic abrasive particles include particles of silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, silicon carbide, boron carbide, titanium carbide, silicon nitride, titanium nitride, boron nitride, calcium carbonate, magnesium carbonate, and hydrotalcite.

Among these, as the inorganic abrasive particles, at least one kind of particles selected from the group consisting of particles of cerium oxide and particles of strontium titanate (particularly, strontium titanate) is preferable, in order to improve an abrasion property, availability, and cost, and to suppress unevenness in density of the image.

The surface of the inorganic abrasive particles may be subjected to hydrophobization treatment by a hydrophobizing agent.

Examples of the hydrophobizing agent include a titan coupling agent such as tetrabutyl titanate, tetra octyl titanate, isopropyl triisostearoyl titanate, isopropyl tridecyl benzene sulfonyl titanate, or bis(dioctyl pyrophosphate)oxyacetate titanate; a silane coupling agent such as 3-(2-aminoethyl) aminopropyltrimethoxysilane, 3-(2-aminoethyl)aminopropyl methyl dimethoxy silane, 3-methacryloxy propyl trimethoxy silane, N-2-(N-vinylbenzylaminoethyl) 3-aminopropyltrimethoxysilane hydrochloride, hexamethyldisilazane, methyltrimethoxysilane, butyltrimethoxysilane, isobutyltrimethoxysilane, hexyl trimethoxy silane, octyl trimethoxy silane, decyl trimethoxy silane, dodecyl trimethoxy silane, phenyl trimethoxysilane, o-methyl phenyl trimethoxysilane, or p-methyl phenyl trimethoxysilane; silicone oil; and higher fatty acid metal salt such as aluminum stearate, zinc stearate, or calcium stearate. These may be used alone or in combination of two or more kinds thereof.

The amount of the hydrophobizing agent is generally from 1 part by weight to 10 parts by weight with respect to 100 parts by weight of the inorganic particles.

The median diameter of the inorganic abrasive particles based on volume is preferably from 0.1 μm to 10.0 μm, more preferably from 1.0 μm to 10.0 μm, and even more preferably from 2.0 μm to 8.0 μm, in order to suppress unevenness in density of the image.

The median diameter of the inorganic abrasive particles based on volume is a value measured in the same manner as that of the median diameter of the fatty acid metal salt particles.

As the inorganic lubricant particles, particles having a function of lubricating due to cleavage of the substance itself, or particles that cause internal slip are used. Specific examples of the inorganic lubricant particles include particles of mica, boron nitride, molybdenum disulfide, tungsten disulfide, talc, kaolinite, montmorillonite, calcium fluoride, or graphite.

Among these, the particles of boron nitride are preferable as the inorganic lubricant particles in order to improve the lubricating property and to suppress the unevenness in density of the image.

A volume average particle diameter of the inorganic lubricant particles is preferably from 0.1 μm to 10 μm, more preferably from 0.2 μm to 10 μm, and even more preferably from 0.2 μm to 8 μm, in order to suppress the unevenness in density of the image.

The volume average particle diameter of the inorganic lubricant particles is a diameter with the cumulative percentage of 50% (D50v) of the equivalent spherical diameter obtained by observation by a scanning electron microscope (SEM) and image analysis of primary particles, and is measured by this method.

As other external additives, inorganic particles having a volume average particle diameter equal to or greater than 5 nm and smaller than 100 nm (preferably, from 5 nm to 80 nm) are used, for example. The inorganic particles are externally added to the toner particles, in order to improve toner fluidity and a charging property. The volume average particle diameter of the inorganic particles is a value measured by the same method as that of the volume average particle diameter of the inorganic lubricant particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particles may be subjected to the hydrophobization treatment. The hydrophobization treatment is performed by dipping the inorganic particles in a hydrophobizing agent, for example. The hydrophobizing agent is not particularly limited, and examples thereof include a silane coupling agent, silicone oil, a titanate coupling agent, and an aluminum coupling agent. These may be used alone or in combination of two or more kinds thereof.

In general, the amount of the hydrophobizing agent is, for example, from 1 part by weight to 10 parts by weight with respect to 100 parts by weight of the inorganic particles.

Examples of other external additive also include resin particles (resin particles such as polystyrene, PMMA, and a melamine resin), and a cleaning activator (e.g., particles of fluorine polymer).

Examples of other external additive also include particles other than the fatty acid metal salt particles and the inorganic lubricant particles. Examples of the lubricant particles include low molecular weight polyolefins such as polypropylene, polyethylene, or polybutene; silicones having a softening point by heating; aliphatic amides such as, oleic acid amide, erucic acid amide, ricinoleic acid amide, or stearic acid amide; vegetable waxes such as carnauba wax, rice wax, candelilla wax, Japan wax, or jojoba oil; animal waxes such as beeswax; mineral or petroleum wax such as montan wax, ozokerite, ceresin, paraffin wax, microcrystalline wax, or Fischer-Tropsch wax; and a modified product thereof.

Manufacturing Method of Toner

Next, a method of manufacturing a toner according to the exemplary embodiment will be described.

The toner according to the exemplary embodiment is obtained by externally adding an external additive to toner particles after manufacturing of the toner particles.

The toner particles may be manufactured using either of a dry manufacturing method (e.g., kneading and pulverizing method) and a wet manufacturing method (e.g., aggregation and coalescence method, suspension and polymerization method, and dissolution and suspension method). The toner particle manufacturing method is not particularly limited to these manufacturing methods, and a known manufacturing method is employed.

The toner according to the exemplary embodiment is manufactured by, for example, adding and mixing an external additive to and with dry toner particles that have been obtained. The mixing is preferably performed with, for example, a V-blender, a Henschel mixer, a Loedige mixer, or the like. Furthermore, if necessary, coarse toner particles may be removed using a vibration sieving machine, a wind classifier, or the like.

Carrier

The carrier is not particularly limited, and known carriers are exemplified. Examples of the carrier include a coated carrier in which surfaces of cores formed of a magnetic particle are coated with a coating resin; a magnetic particle dispersion-type carrier in which magnetic particles are dispersed in and blended into a matrix resin; and a resin impregnation-type carrier in which a porous magnetic particle is impregnated with a resin.

The magnetic particle dispersion-type carrier and the resin impregnation-type carrier may be carriers in which constituent particles of the carrier are cores and have a surface coated with a coating resin.

The mixing ratio (weight ratio) between the toner and the carrier in the two-component developer is preferably from 1:100 to 30:100, and more preferably from 3:100 to 20:100 (toner:carrier).

Cleaning Device

As the cleaning device 13, a cleaning blade-type device including the cleaning blade 131 is used.

The cleaning blade 131 includes a first portion which is in contact with the surface of the electrophotographic photoreceptor 7 and a second portion which is the other part thereof, and a material of a first layer preferably satisfies the following Expression (1) to (3), in order to improve abrasive resistance, settling resistance (permanent deformation resistance), and crack resistance property.

$$3.92 \leq M \leq 29.42 \quad \text{Expression (1)}$$

$$0 < \alpha \leq 0.294 \quad \text{Expression (2)}$$

$$S \geq 250 \quad \text{Expression (3)}$$

[Herein, in Expressions (1) to (3), M represents 100% modulus (MPa), α represents a ratio of a stress change (Δ stress) with respect to strain quantity change (Δ strain quantity) when the strain quantity is from 100% to 200% in a stress-strain curve {Δ stress/Δ strain quantity=(stress with 200% of strain quantity−stress with 100% of strain quantity)/(200−100)}(MPa/%), and S represents breaking elongation (%) measured based on JIS K6251 (No. 3 dumbbell specimen is used).]

The 100% modulus M shown in Expression (1) is obtained by stress at the time of 100% strain which is measured using a No. 3 dumbbell specimen at a tension speed of 500 mm/min based on JIS K6251 (1993). As the measurement device, Strograph AE Elastomer manufactured by Toyo Seiki Seisaku-sho, Ltd. is used.

Meanwhile, α shown in Expression (2) is obtained from the stress-strain curve. The stress and the strain quantity are obtained by a procedure and a method which will be described below. That is, the stress at the time of 100% strain and the stress at the time of 200% strain are obtained by performing the measurement using the No. 3 dumbbell specimen at a tension speed of 500 mm/min based on JIS K6251 (1993). As the measurement device, Strograph AE Elastomer manufactured by Toyo Seiki Seisaku-sho, Ltd. is used.

Herein, examples of the configuration of the cleaning blade 131 include 1) a laminate configuration in which a first layer (an example of the first portion) which is in contact with the surface of the electrophotographic photoreceptor 7 and a second layer (an example of the second portion) as a rear layer on a rear surface of the first layer are provided, and 2) a configuration in which a contact portion (an example of the first portion) which is in contact with the surface of the electrophotographic photoreceptor 7 and is disposed at a corner of the blade and a support portion (an example of the second portion) which supports the contact portion are provided. The second layer as the rear layer may have a single-layer configuration or a multi-layer configuration with two or more layers.

Hereinafter, an example of the cleaning blade 131 having a two-layer configuration formed of the first layer and the second layer (single layer) as the rear layer will be described in detail.

First Layer

When the material of the first layer satisfies Expression (1), an excellent cleaning property is exhibited, and abrasion resistance easily increases. The 100% modulus M is preferably in a range of 5 MPa to 20 MPa and more preferably in a range of 6.5 MPa to 15 MPa.

When the material of the first layer satisfies Expression (2) and Expression (3), the crack resistance property easily increases.

α is preferably equal to or smaller than 0.2 and more preferably equal to or smaller than 0.1. It is preferable if the lower limit value of α is physically as close as possible to 0.

The breaking elongation S is preferably equal to or greater than 300% and more preferably equal to or greater than 350%. Meanwhile, the breaking elongation S is preferably equal to or smaller than 500%, more preferably equal to or smaller than 450%, and even more preferably equal to or smaller than 400%, in the viewpoint of abrasion resistance.

A glass transition temperature Tg of the material of the first layer is preferably equal to or lower than the lower limit of usage environmental temperature of the device (for example, 10° C.), in the viewpoint of stability of contact pressure of the cleaning blade 131.

The glass transition temperature of the material of the first layer is obtained as a peak temperature of tan δ (loss tangent) which is obtained by measuring temperature variance by a viscoelasticity measurement device.

Herein, the tan δ value is derived from storage and loss modulus which will be described below. The stress when strain of a sine wave is applied to linear elastic solid in a steady-state vibration manner is represented in Expression (4). |E*| is called a complex modulus. An elastic member component is represented by Expression (5) and a viscous member component is represented by Expression (6) according to a theory of rheology. Herein, E' is called a storage modulus and E" is called a loss modulus. δ represents a difference in phase angle between the stress and the strain and is called a "dynamic loss angle".

The tan δ value is represented as E"/E' as shown in Expression (7) and is called a "loss tangent", and as the value thereof increases, the linear elastic solid obtained rubber elasticity.

$$\alpha=|E^*|\gamma\cos(\omega t) \quad \text{Expression (4)}$$

$$E'=|E^*|\cos\delta \quad \text{Expression (5)}$$

$$E''=|E^*|\sin\delta \quad \text{Expression (6)}$$

$$\tan\delta=E''/E' \quad \text{Expression (7)}$$

The tan δ value is obtained by measuring sine wave tensile excitation with still strain 5% at 10 Hz at a temperature range of −60° C. to 100° C. using Rheospectoler DVE-V4 (manufactured by Rheology Co., Ltd.)

Impact resilience R of the material of the first layer is preferably 10% or greater, more preferably 15% or more, and even more preferably 20% or more, in an environment at a temperature of 10° C. which is a substantial lower limit of the usage environmental temperature. By setting the impact resilience R of the material of the first layer to be 10% or more, a stick-slip behavior (a microscopic self-oscillation phenomenon caused by repeated attachment and slipping of the first layer with respect to the surface of the electrophotographic photoreceptor 7) easily occurs, and plastic deformation of the first layer hardly occurs. Accordingly, adhesiveness of the first layer and the electrophotographic photoreceptor 7 is improved and it is easy to suppress the poor cleaning quality. The impact resilience R is a value measured based on JIS K6255 (1996).

Next, a material satisfying Expressions (1) to (3) will be described.

The material satisfying Expressions (1) to (3) is not particularly limited as long as it is an elastomer material, but it is particularly preferable to use an elastomer material including a hard segment and a soft segment. Since the elastomer material includes both the hard segment and the soft segment, it is easy to satisfy physical properties shown in Expressions (1) to (3), and a higher level of both the abrasion resistance and the crack resistance property is satisfied.

The "hard segment" and the "soft segment" mean segments which are configured with a material configuring the former which is relatively harder than a material configuring the latter, and a material configuring the latter which is relatively softer than a material configuring the former, in the elastomer material.

Herein, a glass transition temperature of the elastomer material including the hard segment and the soft segment is preferably in a range of −50° C. to 30° C. and more preferably in a range of −30° C. to 10° C. When the glass transition temperature is equal to or lower than 30° C., it is easy to suppress the occurrence of embrittlement in the practical use temperature range at which the cleaning blade is used. In addition, when the glass transition temperature is equal to or higher than −50° C., it is easy to obtain sufficient hardness and stress in the practically used range.

Accordingly, in order to realize the glass transition temperature in the range described above, the glass transition temperature of the material configuring the hard segment of the elastomer material (hereinafter, may be referred to as a "hard segment material") is preferably in a range of 30° C. to 100° C. and more preferably in a range of 35° C. to 60° C. Meanwhile, the glass transition temperature of the material configuring the soft segment (hereinafter, may be referred to as a "soft segment material") is preferably in a range of −100° C. to −50° C. and more preferable in a range of −90° C. to −60° C.

When using the hard segment material and the soft segment material having the glass transition temperature in the range described above, a weight ratio of the material configuring the hard segment material with respect to the total amount of the hard segment material and the soft segment material (hereinafter, may be referred to as a "hard segment material ratio") is preferably in a range of 46% by weight to 96% by weight, and more preferably in a range of 50% by weight to 90% by weight, and even more preferably in a range of 60% by weight to 85% by weight.

When the hard segment material ratio is equal to or greater than 46% by weight, the abrasion resistance of an edge of the first layer is ensured, and it is easy to prevent the abrasion. Accordingly, it is easy to maintain an excellent cleaning property for a long time. When the hard segment material ratio is equal to or smaller than 96% by weight, the edge of the first layer does not become excessively hard, and it is easy to obtain flexibility and extensibility. Thus, it is easy to prevent occurrence of cracks and to maintain excellent cleaning property for a long time.

The combination of the hard segment material and the soft segment material is not particularly limited, and a well-known resin material is selected so as to have a combination in which one of them is relatively harder than the other one and the other one is relatively softer than the one of them. The following combination is preferable.

That is, a polyurethane resin is preferably used as the hard segment material. A weight average molecular weight of the polyurethane resin in this case is preferably in a range of 1,000 to 4,000 and more preferably in a range of 1,500 to 3,500.

When the weight average molecular weight thereof is equal to or greater than 1,000, elasticity of the polyurethane resin configuring the hard segment is hardly lost, in a case where the cleaning blade 131 is used in the low temperature environment. Accordingly, it is possible to suppress poor cleaning quality. In addition, when the weight average molecular weight thereof is equal to or smaller than 4,000, excessive permanent strain of the polyurethane resin configuring the hard segment hardly occurs. Therefore, the edge of the first layer easily maintains contact pressure with respect to the electrophotographic photoreceptor 7, and accordingly, it is easy to suppress poor cleaning quality.

As the polyurethane resin used as the hard segment material, PLACCEL 205, or PLACCEL 240 manufactured by Daicel Corporation is used, for example.

The pressing pressure of the cleaning blade 131 is preferably from 1.7 gf/mm to 6.5 gf/mm and more preferably from 2.0 gf/mm to 6.0 gf/mm. When the pressing pressure is equal to or greater than the lower limit, it is easy to suppress poor cleaning quality of the toner even when the blade having high strength is used. When the pressing pressure is equal to or smaller than the upper limit, friction between the cleaning blade and the photoreceptor does not excessively increases, and it is easy to suppress generation of stripes due to torque increase, the abrasion of the photoreceptor, and the cracks on the blade edge and the generation of the ghost due to the friction between the cleaning blade and the photoreceptor.

Transfer Device

As the transfer device 40, a well-known charger such as a contact-type charging member using a roller, a film, or a rubber blade, a scorotron charger using corona discharge, or a scorotron charger is used, for example.

Intermediate Transfer Member

As the intermediate transfer member 50, a belt-shaped intermediate transfer member (intermediate transfer belt) including polyimide, polyamide-imide, polycarbonate, polyarylate, polyester, or rubber, to which semiconductivity is applied, is used. The shape of the intermediate transfer member may be a drum shape or the like, in addition to the belt shape.

Figure 5:
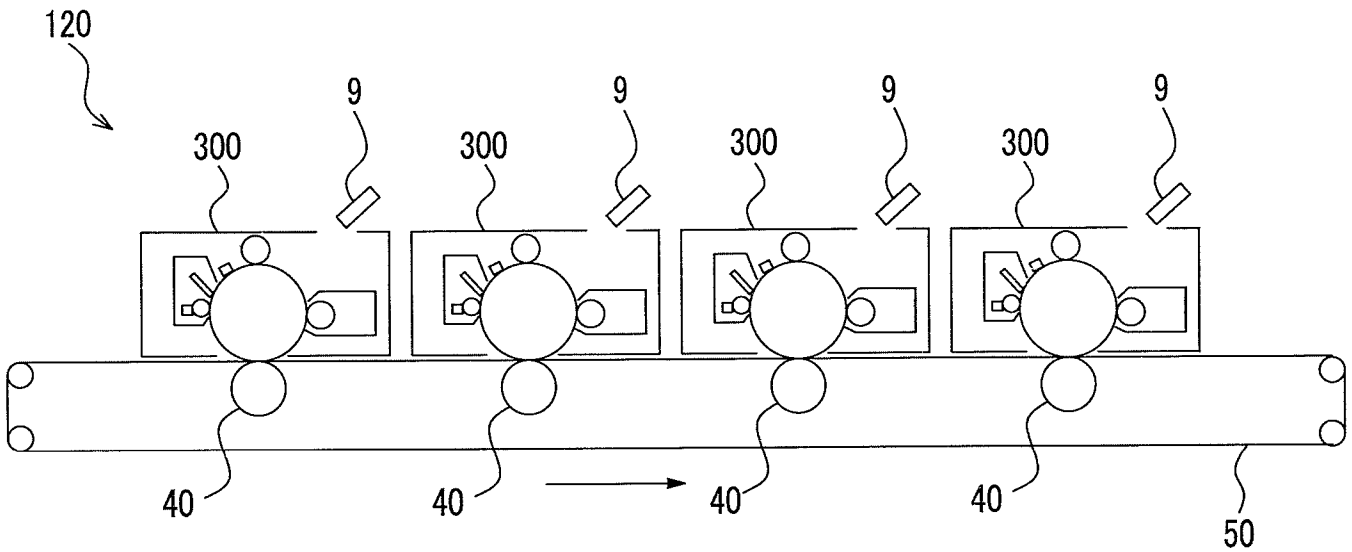
FIG. 5 is a schematic configuration view showing another example of an image forming apparatus according to the exemplary embodiment.

FIG. 5 is a schematic configuration view showing another example of an image forming apparatus according to the exemplary embodiment.

An image forming apparatus 120 shown in FIG. 5 is a tandem type multicolor image forming apparatus including four process cartridges 300 loaded thereon. In the image forming apparatus 120, the four process cartridges 300 are arranged in a line on the intermediate transfer member 50, and one electrophotographic photoreceptor is used for one color. The image forming apparatus 120 includes the same configuration as the image forming apparatus 100, except for being a tandem type.

The image forming apparatus (process cartridge) according to the exemplary embodiment described above is not limited to the configuration described above, and may employ the well-known configuration.

EXAMPLES

The invention will be described more specifically by the following examples, but the invention is not limited thereto.

Preparation of Photoreceptor

Photoreceptor (1)

Preparation of Undercoat Layer 100 parts by weight of zinc oxide (manufactured by TAYCA Corporation, average particle diameter of 70 nm and specific surface area of 15 $m^2/g$) is stirred and mixed with 500 parts by weight of toluene, and 1.3 parts by weight of the silane coupling agent (KBM 503 manufactured by Shin-Etsu Chemical Co., Ltd.) is added thereto and stirred for 2 hours. Then, toluene is distilled by vacuum distillation, and baking is performed at 120° C. for 3 hours to obtain a silane coupling agent surface treated-zinc oxide.

110 parts by weight of zinc oxide subjected to surface treatment is stirred and mixed with 500 parts by weight of tetrahydrofuran, and a solution obtained by dissolving 0.6 parts by weight of alizarin in 50 parts by weight of tetrahydrofuran is added thereto and stirred at 50° C. for 5 hours. Then, zinc oxide to which alizarin is added is filtrated by filtration under reduced pressure, and drying under reduced pressure is further performed at 60° C. to obtain alizarin-attached zinc oxide.

38 parts by weight of a solution obtained by dissolving 60 parts by weight of the alizarin-added zinc oxide, 13.5 parts by weight of curing agent (blocked isocyanate, Sumidur 3175, manufactured by Sumitomo Bayer Urethane Co., Ltd.), 15 parts by weight of a butyral resin (S-Lec BM-1, manufactured by Sekisui Chemical Co., Ltd.) in 85 parts by weight of methyl ethyl ketone, and 25 parts by weight of methyl ethyl ketone are mixed with each other, and dispersed for 2 hours by a sand mill using a glass bead having a diameter of 1 mmϕ, to obtain a dispersion.

0.005 parts by weight of dioctyl tin dilaurate and 40 parts by weight of silicone resin particles (Tosperarl 145, manufactured by GE Toshiba Silicone) are added to obtain the undercoat layer forming coating solution.

A cylindrical aluminum base having a diameter of 30 mm, a length of 340 mm, and a thickness of 1 mm is prepared as a conductive base, the obtained undercoat layer forming coating solution is applied onto the cylindrical aluminum base by a dip coating method, and drying and curing is performed at 170° C. for 40 minutes, to obtain an undercoat layer having a thickness of 18.7 μm.

Preparation of Charge Generation Layer

A mixture formed of 15 parts by weight of hydroxy phthalocyanine as a charge generation material in which Bragg angles (2θ±0.20) of X-ray diffraction spectrum using CuKα characteristics have diffraction peaks at least at positions of 7.3°, 16.0°, 24.9°, and 28.0°, 10 parts by weight of a vinyl chloride-vinyl acetate copolymer resin as a binder resin (VMCH manufactured by Nippon Unicar Company Limited), and 200 parts by weight of n-butyl acetate, is dispersed for four hours by a sand mill using a glass bead having a diameter of 1 mmϕ. 175 parts by weight of n-butyl acetate and 180 parts by weight of methyl ethyl ketone are added to the obtained dispersion and stirred to obtain the charge generation layer forming coating solution.

The obtained charge generation layer forming coating solution is subjected to dip coating on the undercoat layer previously formed on the cylindrical aluminum base, and dried at a room temperature (25° C.) to form a charge generation layer having a film thickness of 0.2 μm.

Preparation of Charge Transport Layer

First, a polycarbonate copolymer (1) is obtained as follows.

106.9 g (0.398 moles) of 1,1-bis(4-hydroxyphenyl)cyclohexane (hereinafter, referred to as "Z"), 24.7 g (0.133 moles) of 4,4'-dihydroxybiphenyl (hereinafter, referred to as "BP"), 0.41 g of hydrosulfite, 825 mL of a 9.1% sodium hydroxide aqueous solution (2.018 moles of sodium hydroxide), and 500 ml of methylene chloride are added and dissolved in a flask including a phosgene suction tube, a thermometer, and a stirrer in the nitrogen atmosphere, and held at a temperature range of 18° C. to 21° C. under stirring, and 76.2 g (0.770 moles) of phosgene is blown thereto for 75 minutes to cause a phosgene reaction. After completing the phosgene reaction, 1.11 g (0.0075 moles) of p-tert-butylphenol and 54 ml of 25% sodium hydroxide aqueous solution (0.266 moles of sodium hydroxide) are added thereto and stirred, and 0.18 mL (0.0013 moles) of triethylamine is added thereto for reaction at a temperature 30° C. to 35° C. for 2.5 hours. After performing acid washing and water washing of the separated methylene chloride phase until inorganic salts and amines are removed, methylene chloride is removed to obtain a polycarbonate copolymer (1). A ratio of constitutional units of Z and BP of this polycarbonate is 75:25 in terms of a molar ratio.

Next, 25 parts by weight of N,N'-diphenyl-N,N'-bis(3-methylphenyl)-[1,1']biphenyl-4,4'-diamine (TPD), 20 parts by weight of a compound represented by the following Structural Formula (A), and 55 parts by weight of the polycarbonate copolymer (1) (viscosity average molecular weight: 50,000) as a binder resin are added to 560 parts by weight of tetrahydrofuran and 240 parts of toluene and dissolved to obtain the charge transport layer forming coating solution. This coating solution is applied onto the charge generation layer and dried at 135° C. for 45 minutes, and a charge transport layer having a film thickness of 20 μm is formed.

(A)

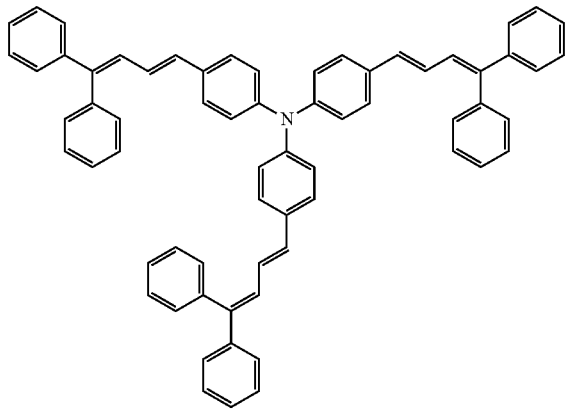

Preparation of Protection Layer 100 parts by weight of Exemplified Compound (I-d)-28 as the reactive charge transport material (specific chain polymerizable charge transport material), 2 parts by weight of VE-073 (manufactured by Wako Pure Chemical Industries, Ltd.) as a polymerization initiator, and 300 parts by weight of isobutyl acetate are mixed and stirred at a room temperature for 12 hours, and the protection layer forming coating solution is prepared.

Next, the obtained protection layer forming coating solution is applied onto the charge transport layer previously formed on the cylindrical aluminum base by a ring coating method at a push-up speed of 180 mm/min. Then, the curing reaction is performed by a nitrogen drying machine including an oxymeter in a state of oxygen concentration equal to or lower than 200 ppm, at a temperature of 160±5° C. for 60 minutes, and a protection layer is formed. A film thickness of the protection layer is 10 μm.

By doing so, a photoreceptor (1) is prepared. The prepared photoreceptor (1) is mounted on an image forming apparatus "Docucentre-IV C2260 manufactured by Fuji Xerox Co., Ltd". An initial image quality test for checking that the image pattern shown in FIG. 6 is output and an image having the desired image density is obtained by the image forming apparatus, is performed.

Photoreceptor (2) to (22) and Reference Photoreceptor (R1)

The undercoat layer, the charge generation layer, and the charge transport layer are formed in this order onto the cylindrical aluminum base by coating, by the same method as that disclosed in the case of the photoreceptor (1). Then, according to Table 1, protection layers are formed in the same manner as in the photoreceptor (1), except for changing the compositions of the protection layer forming coating solution (type and amount of reactive charge transport material (noted as "RCTM" in Table), type and amount of non-reactive charge transport material (noted as "CTM" in Table, and type and amount of additive), and the thickness of the protection layer, and photoreceptors (2) to (22) and a reference photoreceptor (R1) are prepared. The initial image quality test is performed in the same manner as in the case of the photoreceptor (1).

Comparative Photoreceptor (C1)

The undercoat layer and the charge generation layer are formed in this order onto the cylindrical aluminum base by coating by the same method disclosed in the case of the photoreceptor (1).

Then, 25 parts by weight of N,N'-diphenyl-N,N'-bis(3-methylphenyl)-[1,1']biphenyl-4,4'-diamine (TPD), 20 parts by weight of a compound represented by Structural Formula (A), 55 parts by weight of the polycarbonate copolymer (1) (viscosity average molecular weight: 50,000) as a binder resin, 7.3 parts by weight of PTFE fine particles (Lubron L-2 manufactured by Daikin Industries, Ltd.), and 0.35 parts by weight of fluororesin (GF-400 manufactured by TOAGOSEI CO., LTD.) are added to 560 parts by weight of tetrahydrofuran and 240 parts by weight of toluene and dissolved, and dispersed by a high-pressure and wet-type media-less pulverization machine (Nanomizer NMS-200ED manufactured by NANOMIZER Inc.), and the charge generation layer forming coating solution is obtained. This coating solution is applied onto the charge generation layer and dried at 135° C. for 45 minutes, and a charge transport layer having a film thickness of 40 μm is formed.

By doing so, a comparative photoreceptor (C1) is prepared. The initial image quality test thereof is performed in the same manner as in the case of the photoreceptor (1).

Preparation of Toner Particles

Preparation of Cyan Color (C Color) Toner Particles (1)

Synthesis of Crystalline Polyester Resin (1)

After adding 124 parts by weight of ethylene glycol, 22.2 parts by weight of 5-sodium sulfoisophthalic acid dimethyl, 213 parts by weight of dimethyl sebacate, and 0.3 parts by weight of dibutyl tin oxide as a catalyst in a heated and dried three-necked flask, the air in the container is set to be in an inert atmosphere by nitrogen gas by performing a reducing pressure operation, and the components are stirred by mechanical stirring at 180° C. for 5 hours. After that, the mixture is gradually heated to 220° C. under the reduced pressure, stirred for 4 hours, and cooled when the mixture is in a viscous state, and the reaction is stopped, and 220 parts by weight of a crystalline polyester resin (1) is synthesized. By performing molecular weight measurement (polystyrene conversion) by gel permeation chromatography, a weight average molecular weight ($M_w$) of the obtained crystalline polyester resin (1) is 19,000 and a number average molecular weight ($M_n$) thereof is 5,800.

When a melting point (Tm) of the crystalline polyester resin (1) is measured using differential scanning calorimetry (DSC) by the measurement method described above, a clear peak is obtained, and a temperature of a peak top is 70° C.

Preparation of Resin Dispersion (1)

150 parts by weight of the crystalline polyester resin (1) is added into 850 parts by weight of distilled water, heated at 80° C., and stirred and mixed by a homogenizer (Ultra Turrax manufactured by IKA Japan, K.K.), and resin particle dispersion (1) is obtained. Then, 250 parts by weight of a phthalocyanine pigment (PV FAST BLUE manufactured by Dinichiseika Color & Chemicals Mfg. Co., Ltd.), 20 parts by weight of an anionic surfactant (NEOGEN RK manufactured by Dai-Ichi Kogyo Seiyaku Co., Ltd.), and 700 parts by weight of ion exchange water are mixed with each other, dissolved, and dispersed using a homogenizer (Ultra Turrax manufactured by IKA Japan, K.K.), and colorant dispersion (1) in which the colorant (phthalocyanine pigment) are dispersed is prepared.

Preparation of Aggregated Particles 2400 parts by weight of the resin particle dispersion (1), 100 parts by weight of the colorant dispersion (1), 63 parts by weight of a release agent particle dispersion, 6 parts by weight of aluminum sulfate (manufactured by Wako Pure Chemical Industries, Ltd.), and 100 parts by weight of ion exchange water are accommodated in a round stainless steel flask, and a pH thereof is adjusted to 2.0. Then, the mixture is dispersed using a homogenizer (Ultra Turrax T50 manufactured by IKA Japan, K.K.), and heated to 60° C. in an oil bath for heating while stirring. When the mixture is observed using an optical microscope after holding the mixture at 60° C. for 2 hours, the formation of aggregated particles having an average particle diameter of 4.3 μm is checked. When the mixture is observed using an optical microscope after additionally maintaining heating and stirring the mixture at 60° C. for 1 hour, the formation of aggregated particles having a volume average particle diameter of 4.4 μm is checked.

The pH of the aggregated particle solution is 2.4. An aqueous solution obtained by diluting sodium carbonate (Wako Pure Chemical Industries, Ltd.) by 0.5% by weight is gently added thereto, and pH thereof is adjusted to 5.0. After that, the mixture is heated to 75° C. while continuing stirring and held for 3 hours.

Then, after filtrating a reaction product and sufficiently washing by ion exchange water, cyan toner particles (1) are obtained by drying the reaction product using a vacuum drying machine. A melting point of the obtained cyan toner particles (1) is 65° C.

A volume average particle diameter of the obtained cyan toner particles (1) is 4.5 μm and a shape factor SF1 thereof is 133.

Yellow (Y Color) Toner Particles (1)

Yellow (Y color) toner particles (1) are obtained in the same manner as in the preparation of the cyan toner particles (1), except for using a yellow azo pigment instead of the phthalocyanine pigment.

Magenta (M Color) Toner Particles (1)

Magenta (M color) toner particles (1) are obtained in the same manner as in the preparation of the cyan toner particles (1), except for using a quinacridone pigment instead of the phthalocyanine pigment.

Black (K Color) Toner Particles (1)

Black (K color) toner particles (1) are obtained in the same manner as in the preparation of the cyan toner particles (1), except for using carbon black instead of the phthalocyanine pigment.

Preparation of Developer A

Developer A1

As external additives, 0.5 parts by weight of hexamethyldisilazane-treated silica particles (volume average particle diameter of 40 nm), 0.7 parts by weight of titanium compound particles obtained by performing isobutyltrimethoxysilane 50% treatment and firing with respect to metatitanic acid (volume average particle diameter of 30 nm), and 0.18 parts by weight of zinc stearate particles as the fatty acid metal salt particles (Nissan Elector MZ-2 manufactured by NOF CORPORATION, median diameter based on a volume of 1.5 μm) are mixed with each of toner particles of 100 parts by weight of the obtained four color toner particles (1) by a 75 L Henschel mixer for 10 minutes and sieved by a wind classifier, HI-BOLTA300 (manufactured by Toyo Hitec Co., Ltd.), and four color toners (A1) are respectively prepared.

Then, resin coating is performed with respect to 100 parts by weight of ferrite cores having an average particle diameter of 50 μm by a kneader using a mixture of 0.15 parts by weight of vinylidene fluoride and 1.35 parts by weight of a copolymer (polymerization ratio of 80:20) resin of methyl methacrylate and trifluoroethylene, and a carrier is prepared.

8 parts by weight of each of the obtained four color toners (A1) and 100 parts by weight of the obtained carrier are mixed in a 2 liter-V blender, and four color developers are respectively prepared. A set of the obtained four color developers is set as a developer (A1).

Developer A2

Four color toners (A2) are respectively prepared in the same manner as in the preparation of the four color toners (A1), except for changing the amount of the zinc stearate particles from 0.18 parts by weight to 0.12 parts by weight in the preparation of the four color toners (A1).

A developer (A2) is prepared, in the same manner as in the preparation of the developer (A1), except for using the obtained four color toners (A2), instead of the four color toners (A1).

Developer A3

Four color toners (A3) are respectively prepared in the same manner as in the preparation of the four color toners (A1), except for changing the amount of the zinc stearate particles from 0.18 parts by weight to 0.03 parts by weight in the preparation of the four color toners (A1).

A developer (A3) is prepared, in the same manner as in the preparation of the developer (A1), except for using the obtained four color toners (A3), instead of the four color toners (A1).

Developer A4

Four color toners (A4) are respectively prepared in the same manner as in the preparation of the four color toners (A1), except for using zinc stearate particles (zinc stearate S manufactured by NOF CORPORATION, median diameter based on a volume of 12 μm), instead of the zinc stearate particles (Nissan Elector MZ-2 manufactured by NOF CORPORATION, median diameter based on a volume of 1.5 μm) in the preparation of the four color toners (A1).

A developer (A4) is prepared, in the same manner as in the preparation of the developer (A1), except for using the obtained four color toners (A4), instead of the four color toners (A1).

Developer A5

Four color toners (A5) are respectively prepared in the same manner as in the preparation of the four color toners (A1), except for not adding the zinc stearate particles in the preparation of the four color toners (A1).

A developer (A5) is prepared, in the same manner as in the preparation of the developer (A1), except for using the obtained four color toners (A5), instead of the four color toners (A1).

Developer A6

Four color toners (A6) are respectively prepared in the same manner as in the preparation of the four color toners (A1), except for changing the amount of the zinc stearate particles from 0.18 parts by weight to 0.25 parts by weight in the preparation of the four color toners (A1).

A developer (A6) is prepared, in the same manner as in the preparation of the developer (A1), except for using the obtained four color toners (A6), instead of the four color toners (A1).

Developer A7

Four color toners (A7) are respectively prepared in the same manner as in the preparation of the four color toners (A1), except for changing the amount of the zinc stearate particles from 0.18 parts by weight to 0.06 parts by weight in the preparation of the four color toners (A1).

A developer (A7) is prepared, in the same manner as in the preparation of the developer (A1), except for using the obtained four color toners (A7), instead of the four color toners (A1).

Developer A8

Four color toners (A8) are respectively prepared in the same manner as in the preparation of the four color toners (A1), except for using zinc stearate particles (zinc stearate FP manufactured by NOF CORPORATION, median diameter based on a volume of 5.5 μm), instead of the zinc stearate particles (Nissan Elector MZ-2 manufactured by NOF CORPORATION, median diameter based on a volume of 1.5 μm) in the preparation of the four color toners (A1).

A developer (A8) is prepared, in the same manner as in the preparation of the developer (A1), except for using the obtained four color toners (A8), instead of the four color toners (A1).

Developer A9

Four color toners (A9) are respectively prepared, in the same manner as in the preparation of the four color toners (A1), except for using zinc stearate particles (zinc stearate FP manufactured by NOF CORPORATION, median diameter based on a volume of 5.5 μm), instead of the zinc stearate particles (Nissan Elector MZ-2 manufactured by NOF CORPORATION, median diameter based on a volume of 1.5 μm) and changing the amount of the zinc stearate particles from 0.18 parts by weight to 0.005 parts by weight in the preparation of the four color toners (A1).

A developer (A9) is prepared in the same manner as in the preparation of the developer (A1), except for using the obtained four color toners (A9), instead of the four color toners (A1).

Preparation of Developer B

Developer B1

As external additives, 0.5 parts by weight of hexamethyldisilazane-treated silica particles (volume average particle diameter of 40 nm), 0.7 parts by weight of titanium compound particles obtained by performing isobutyltrimethoxysilane 50% treatment and firing with respect to metatitanic acid (volume average particle diameter of 30 nm), 0.18 parts by weight of zinc stearate particles as the fatty acid metal salt particles (Nissan Elector MZ-2 manufactured by NOF CORPORATION, median diameter based on a volume of 1.5 μm), and 0.28 parts by weight of cerium oxide particles as the inorganic abrasive particles (MIREK E10 manufactured by Mitsui Mining and Smelting Co., Ltd., median diameter based on a volume of 650 nm) are mixed with each of toner particles of 100 parts by weight of the obtained four color toner particles (1) by 75 L Henschel mixer for 10 minutes, and sieved by a wind classifier, HI-BOLTA 300 (manufactured by Toyo Hitec Co., Ltd.), and four color toners (B1) are respectively prepared.

Then, resin coating is performed with respect to 100 parts by weight of ferrite cores having an average particle diameter of 50 μm by a kneader using a mixture of 0.15 parts by weight of vinylidene fluoride and 1.35 parts by weight of a copolymer (polymerization ratio of 80:20) resin of methyl methacrylate and trifluoroethylene, and a carrier is prepared.

8 parts by weight of each of four color toners (B1) obtained and 100 parts by weight of the obtained carrier are mixed in a 2 liter-V blender, and four color developers are prepared, respectively. A set of the obtained four color developers are set as a developer (B1).

Developer B2

Four color toners (B2) are respectively prepared, in the same manner as in the preparation of the four color toners (B1), except for changing the amount of the zinc stearate particles from 0.18 parts by weight to 0.12 parts by weight in the preparation of the four color toners (B1).

A developer (B2) is prepared, in the same manner as in the preparation of the developer (B1), except for using the obtained four color toners (B2), instead of the four color toners (B1).

Developer B3

Four color toners (B3) are respectively prepared, in the same manner as in the preparation of the four color toners (B1), except for changing the amount of the zinc stearate particles from 0.18 parts by weight to 0.03 parts by weight in the preparation of the four color toners (B1).

A developer (B3) is prepared, in the same manner as in the preparation of the developer (B1), except for using the obtained four color toners (B3), instead of the four color toners (B1).

Developer B4

Four color toners (B4) are respectively prepared, in the same manner as in the preparation of the four color toners (B1), except for using zinc stearate particles (zinc stearate S manufactured by NOF CORPORATION, median diameter based on a volume of 12 μm), instead of the zinc stearate particles (Nissan Elector MZ-2 manufactured by NOF CORPORATION, median diameter based on a volume of 1.5 μm) in the preparation of the four color toners (B1).

A developer (B4) is prepared, in the same manner as in the preparation of the developer (B1), except for using the obtained four color toners (B4), instead of the four color toners (B1).

Developer B5

Four color toners (B5) are respectively prepared, in the same manner as in the preparation of the four color toners (B1), except for not adding the zinc stearate particles in the preparation of the four color toners (B1).

A developer (B5) is prepared, in the same manner as in the preparation of the developer (B1), except for using the obtained four color toners (B5), instead of the four color toners (B1).

Developer B6

Four color toners (B6) are respectively prepared, in the same manner as in the preparation of the four color toners (B1), except for changing the amount of the zinc stearate particles from 0.18 parts by weight to 0.25 parts by weight in the preparation of the four color toners (B1).

A developer (B6) is prepared, in the same manner as in the preparation of the developer (B1), except for using the obtained four color toners (B6), instead of the four color toners (B1).

Developer B7

Four color toners (B7) are respectively prepared, in the same manner as in the preparation of the four color toners (B1), except for changing the amount of the zinc stearate particles from 0.18 parts by weight to 0.06 parts by weight in the preparation of the four color toners (B1).

A developer (B7) is prepared, in the same manner as in the preparation of the developer (B1), except for using the obtained four color toners (B7), instead of the four color toners (B1).

Developer B8

Four color toners (B8) are respectively prepared, in the same manner as in the preparation of the four color toners (B1), except for using strontium titanate particles (product name: ST-A manufactured by Fuji Titanium Industry Co., Ltd., median diameter based on a volume of 1.5 μm), instead of the cerium oxide particles in the preparation of the four color toners (B1).

A developer (B8) is prepared, in the same manner as in the preparation of the developer (B1), except for using the obtained four color toners (B8), instead of the four color toners (B1).

Developer B9

Four color toners (B9) are respectively prepared, in the same manner as in the preparation of the four color toners (B1), except for changing the amount of the cerium oxide particles from 0.28 parts by weight to 0.14 parts by weight in the preparation of the four color toners (B1).

A developer (B9) is prepared, in the same manner as in the preparation of the developer (B1), except for using the obtained four color toners (B9), instead of the four color toners (B1).

Developer B10

Four color toners (B10) are respectively prepared, in the same manner as in the preparation of the four color toners (B1), except for changing the amount of the cerium oxide particles from 0.28 parts by weight to 0.07 parts by weight in the preparation of the four color toners (B1).

A developer (B10) is prepared, in the same manner as in the preparation of the developer (B1), except for using the obtained four color toners (B10), instead of the four color toners (B1).

Preparation of Developer C

Developer C1

As external additives, 0.5 parts by weight of hexamethyldisilazane-treated silica particles (volume average particle diameter of 40 nm), 0.7 parts by weight of titanium compound particles obtained by performing isobutyltrimethoxysilane 50% treatment and firing with respect to metatitanic acid (volume average particle diameter of 30 nm), 0.18 parts by weight of zinc stearate particles as the fatty acid metal salt particles (Nissan Elector MZ-2 manufactured by NOF CORPORATION, median diameter based on a volume of 1.5 μm), and 0.18 parts by weight of boron nitride particles as the inorganic lubricant particles (NX5 manufactured by Momentive Performance Materials Inc., volume average particle diameter of 5 μm) are mixed with each of toner particles of 100 parts by weight of the obtained four color toner particles (1) by 75 L Henschel mixer for 10 minutes, and sieved by a wind classifier, HI-BOLTA 300 (manufactured by Toyo Hitec Co., Ltd.), and four color toners (C1) are respectively prepared.

Then, resin coating is performed with respect to 100 parts by weight of ferrite cores having an average particle diameter of 50 μm by a kneader using a mixture of 0.15 parts by weight of vinylidene fluoride and 1.35 parts by weight of a copolymer (polymerization ratio of 80:20) resin of methyl methacrylate and trifluoroethylene, and a carrier is prepared.

8 parts by weight of each of four color toners (C1) obtained and 100 parts by weight of the obtained carrier are mixed in a 2 liter-V blender, and four color developers are prepared, respectively. A set of the obtained four color developers are set as a developer (C1).

Developer C2

Four color toners (C2) are respectively prepared, in the same manner as in the preparation of the four color toners (C1), except for changing the amount of the zinc stearate particles from 0.18 parts by weight to 0.10 parts by weight in the preparation of the four color toners (C1).

A developer (C2) is prepared, in the same manner as in the preparation of the developer (C1), except for using the obtained four color toners (C2), instead of the four color toners (C1).

Developer C3

Four color toners (C3) are respectively prepared, in the same manner as in the preparation of the four color toners (C1), except for changing the amount of the zinc stearate particles from 0.18 parts by weight to 0.03 parts by weight in the preparation of the four color toners (C1).

A developer (C3) is prepared, in the same manner as in the preparation of the developer (C1), except for using the obtained four color toners (C3), instead of the four color toners (C1).

Developer C4

Four color toners (C4) are respectively prepared, in the same manner as in the preparation of the four color toners (C1), except for using zinc stearate particles (zinc stearate S manufactured by NOF CORPORATION, median diameter based on a volume of 12 μm), instead of the zinc stearate particles (Nissan Elector MZ-2 manufactured by NOF CORPORATION, median diameter based on a volume of 1.5 μm) in the preparation of the four color toners (C1).

A developer (C4) is prepared, in the same manner as in the preparation of the developer (C1), except for using the obtained four color toners (C4), instead of the four color toners (C1).

Developer C5

Four color toners (C5) are respectively prepared, in the same manner as in the preparation of the four color toners (C1), except for not adding the zinc stearate particles in the preparation of the four color toners (C1).

A developer (C5) is prepared, in the same manner as in the preparation of the developer (C1), except for using the obtained four color toners (C5), instead of the four color toners (C1).

Developer C6

Four color toners (C6) are respectively prepared, in the same manner as in the preparation of the four color toners (C1), except for changing the amount of the zinc stearate particles from 0.18 parts by weight to 0.25 parts by weight in the preparation of the four color toners (C1).

A developer (C6) is prepared, in the same manner as in the preparation of the developer (C1), except for using the obtained four color toners (C6), instead of the four color toners (C1).

Developer C7

Four color toners (C7) are respectively prepared, in the same manner as in the preparation of the four color toners (C1), except for changing the amount of the zinc stearate particles from 0.18 parts by weight to 0.06 parts by weight in the preparation of the four color toners (C1).

A developer (C7) is prepared, in the same manner as in the preparation of the developer (C1), except for using the obtained four color toners (C7), instead of the four color toners (C1).

Developer C8

Four color toners (C8) are respectively prepared, in the same manner as in the preparation of the four color toners (C1), except for not adding the boron nitride particles in the preparation of the four color toners (C1).

A developer (C8) is prepared, in the same manner as in the preparation of the developer (C1), except for using the obtained four color toners (C8), instead of the four color toners (C1).

Developer C9

Four color toners (C9) are respectively prepared, in the same manner as in the preparation of the four color toners (C1), except for not adding the zinc stearate particles and the boron nitride particles in the preparation of the four color toners (C1).

A developer (C9) is prepared, in the same manner as in the preparation of the developer (C1), except for using the obtained four color toners (C9), instead of the four color toners (C1).

Preparation of Cleaning Blade

Cleaning Blade (1)

First, a member for a first layer is formed as follows.

First, a hard segment material formed of polycaprolactone polyol (PLACCEL 205 manufactured by Daicel Corporation, average molecular weight of 529, hydroxyl value of 212 KOHmg/g) and polycaprolactone polyol (PLACCEL 240 manufactured by Daicel Corporation, average molecular weight of 4155, hydroxyl value of 27 KOHmg/g) as a polyol component, and a soft segment material formed of an acrylic resin having two or more hydroxyl groups (ACTFLOW UMB-2005B manufactured by Soken Chemical & Engineering Co., Ltd.) are mixed with each other at a ratio of 8:2 (weight ratio).

Next, 6.26 parts of 4,4'-diphenylmethane diisocyanate as the isocyanate compound (MILLIONATE MT manufactured by Nippon Polyurethane Industry Co., Ltd., hereinafter referred to as "MDI") is added to 100 parts of the mixture of the hard segment material and the soft segment material, for a reaction at 70° C. for 3 hours in the nitrogen atmosphere. The content of the isocyanate compound used in this reaction is selected so that a ratio (isocyanate group/hydroxyl group) of the isocyanate compound with respect to a hydroxyl group included in the reaction system is 0.5.

Then, 34.3 parts of the isocyanate compound is further added thereto for a reaction at 70° C. for 3 hours in the nitrogen atmosphere, and a prepolymer is obtained.

The total amount of the isocyanate compound when obtaining the prepolymer is 40.56 parts.

Next, this prepolymer is heated at 100° C., degassed for 1 hour under the reduced pressure, 7.14 parts of a mixture of 1,4-butane diol and trimethylolpropane (weight ratio=60/40) is added to 100 parts of the prepolymer and sufficiently mixed for 3 minutes so as not to generate bubbles, and a first layer forming composition A1 is prepared.

Then, the first layer forming composition A1 is poured in a centrifugal molding machine, in which a temperature of a die is adjusted to 140° C., for a curing reaction for 1 hour, and a flat first layer is formed.

Meanwhile, a second layer forming composition A1 prepared by the following method is prepared as a member for a second layer.

4,4-diphenylmethane diisocyanate is mixed with dehydration treated-polytetramethyl ether glycol for a reaction at 120° C. for 15 minutes, and a material used with 1,4-butanediol and trimethylolpropane as a curing agent is used for the formed prepolymer.

Next, the second layer forming composition A1 is poured in the centrifugal molding machine after forming the flat first layer as described above, for a curing reaction, and a second layer is formed on the rear surface of the first layer.

The obtained flat plate in which the second layer is formed on the rear surface of the first layer is cooled after cross-linking at 110° C. for 24 hours, cut to have a desired dimensions, and a cleaning blade (1) having a thickness of the first layer of 0.5 mm and a thickness of the second layer of 1.5 mm (thickness ratio to the entire thickness of 25%) is obtained.

When the properties of the single layer of the first layer are measured, the results are as follows.

100% modulus M=7.4 MPa $\alpha$=0.09 (MPa/%)

Breaking elongation S=535%

Impact resilience R=35%

Glass transition temperature Tg=−8° C.

Examples A1 to A26 and Comparative Examples A1 to A8

According to the combination in Table 2, the photoreceptors, the developers, and the cleaning blades are mounted in image forming apparatuses each including a contact charge type charging device ("Docucentre-IV C2260 manufactured by Fuji Xerox Co., Ltd"). These image forming apparatuses are set as image forming apparatuses of Examples A1 to A26 and Comparative Examples A1 to A8.

Examples B1 to B18 and Comparative Examples B1 to B7

According to the combination in Table 6, the photoreceptors, the developers, and the cleaning blades are mounted in image forming apparatuses each including a contact charge type charging device ("Docucentre-IV C2260 manufactured by Fuji Xerox Co., Ltd"). These image forming apparatuses are set as image forming apparatuses of Examples B1 to B18 and Comparative Examples B1 to B7.

Examples C1 to C26 and Comparative Examples C1 to C7

According to the combination in Table 6, the photoreceptors, the developers, and the cleaning blades are mounted in image forming apparatuses each including a contact charge type charging device ("Docucentre-IV C2260 manufactured by Fuji Xerox Co., Ltd"). These image forming apparatuses are set as image forming apparatuses of Examples C1 to C26 and Comparative Examples C1 to C7.

Evaluation

The initial image quality test of outputting the image pattern shown in FIG. 6 to the A4-sized sheet by the image forming apparatus of each example and checking that an image having the desired image density is obtained, is performed.

Then, an output test of outputting 50,000 sheets (corresponding to 150,000 rotations (cycle) of the photoreceptor) in 1) a normal temperature and normal humidity environment (temperature of 20° C. and humidity of 50% RH), 50,000 sheets in 2) a low temperature and low humidity environment (temperature of 28° C. and humidity of 85% RH), and 50,000 sheets in 3) a high temperature and high humidity environment (temperature of 8° C. and humidity of 20% RH), with a job pattern of continuously outputting the image pattern shown in FIG. 6 on 3 sheets of the A4-sized sheet, is performed. This output of the image pattern is performed with transportation in the short direction of the A4-sized sheet (P paper manufactured by Fuji Xerox Co., Ltd.)

Each time the output test is completed in an environment, 1) evaluation of the electrical characteristics of the photoreceptor, 2) measurement of the average abrasion rate (nm/1,000 rotations), maximum abrasion rate (nm/1,000 rotations), and minimum abrasion rate (nm/1,000 rotations) of the photoreceptor, 3) evaluation of an abraded cross-sectional area ($\mu m^2$) of the cleaning blade, 4) evaluation of cracks on the cleaning blade, 5) evaluation of image quality, and 6) evaluation of pass through of the external additive are performed.

However, the 6) evaluation of pass through of the external additive is performed only for the image forming apparatuses of Examples C1 to C26 and Comparative Examples C1 to C7.

Electrical Characteristics of Photoreceptor

For the electrical characteristics of the photoreceptor, a residual potential (Rp) after performing erasing is measured by providing a surface potential probe in a region of the measurement target (position separated from the surface of the electrophotographic photoreceptor by 1 mm) using an electrostatic voltmeter (Trek 334 manufactured by Trek Co., Ltd.), and a difference ($\Delta Rp$) between the initial residual potential and residual potential after printing 50,000 sheets in each environment is calculated. The residual potential is evaluated with the following evaluation criteria.

A+: lower than 20 V

A: equal to or higher than 20 V and lower than 50 V

B: equal to or higher than 50 V and lower than 80 V

C: higher than 80 V

Abrasion Rate of Photoreceptor

The average abrasion rate of the photoreceptor, the maximum abrasion rate of the photoreceptor, and the minimum abrasion rate of the photoreceptor are measured by the method described above. In Table, the unit "(mn/1000 rotations)" is omitted. The note for each abrasion rate in each Table is as follows.

"Wm": average abrasion rate of the photoreceptor in the normal temperature and normal humidity environment "Wmmax": maximum abrasion rate of the photoreceptor in the normal temperature and normal humidity environment "Wmmin": minimum abrasion rate of the photoreceptor in the normal temperature and normal humidity environment "Wl": average abrasion rate of the photoreceptor in the low temperature and low humidity environment "Wlmax": maximum abrasion rate of the photoreceptor in the low temperature and low humidity environment "Wlmin": minimum abrasion rate of the photoreceptor in the low temperature and low humidity environment "Wh": average abrasion rate of the photoreceptor in the high temperature and high humidity environment "Whmax": maximum abrasion rate of the photoreceptor in the high temperature and high humidity environment "Whmin": minimum abrasion rate of the photoreceptor in the high temperature and high humidity environment Abraded Cross-Sectional Area of Cleaning Blade A portion of the cleaning blade in contact with the photoreceptor is observed by a laser microscope, and the abraded cross-sectional area is measured. The abraded cross-sectional area is obtained as an area obtained by subtracting the abraded cross-sectional area after the output test from the cross-sectional area of the initial portion of the blade in contact with the photoreceptor. The abraded cross-sectional area of the cleaning blade is evaluated by the following evaluation criteria.

A+: smaller than 10 $\mu m^2$

A: equal to or greater than 10 $\mu m^2$ and smaller than 20 $\mu m^2$

B: equal to or greater than 20 $\mu m^2$ and smaller than 40 $\mu m^2$

C: equal to or greater than 40 $\mu m^2$

Cracks on Cleaning Blade

After completing the output test in each environment, a solid image having image density of 30% is output to one A4-sized sheet, and a generation state of stripes on the image is observed. The cracks on the cleaning blade are evaluated by the following evaluation criteria.

A+: No stripes generated

A: three or fewer thin stripes are generated

B: more than three and less than ten stripes are generated

C: ten or more clear stripes are generated

Image Quality

After completing the output test in each environment, a solid image having image density of 30% is output to one A4-sized sheet, the obtained image is observed, and image deletion and the unevenness in density are evaluated by the following evaluation criteria.

Evaluation Criteria of Image Deletion

A+: No image deletion

A: No image deletion which is a problem in the viewpoint of image quality

B: slight image deletion occurred

C: image deletion which is a problem in the viewpoint of image quality occurred

Evaluation Criteria of Unevenness in Density

A+: No unevenness in density

A: No unevenness in density which is a problem in the viewpoint of image quality B: slight unevenness in density generated C: unevenness in density which is a problem in the viewpoint of image quality generated Pass Through of External Additive After completing the output test in each environment, a solid image having image density of 30% is output to one A4-sized sheet, three portions of the surface of the photoreceptor which are a center portion in an axial direction and portions separated from both ends by 5 cm are observed with a laser microscope, and an average of the number of the external additives observed in a region of 100 $\mu m^2$ is evaluated by the following evaluation criteria.

A+: the number of the external additives is less than 5

A: the number of the external additives is equal to or more than 5 and less than 10

B: the number of the external additives is equal to or more than 10 and less than 20

C: the number of the external additives is equal to or more than 20

Overall Evaluation

The evaluations described above are combined and the overall evaluation of the electrophotographic photoreceptor and the image forming system is performed. The evaluation criteria are as follows.

A+: particularly excellent

A: excellent

B: slightly problematic but no particular problem in practice

C: problematic in practice

Hereinafter, details and evaluation results of the examples will be shown as a list in Tables 1 to 13.

TABLE 1

| | Composition of protection layer forming coating solution | | | | | | protection layer | Initial |
|---|---|---|---|---|---|---|---|---|
| | RCTM | | CTM | | Additive | | Film | image |
| | Type | Amount | Type | Amount | Type | Amount | thickness | quality test |
| Photoreceptor (1) | (I-d)-28 | 100 parts by weight | — | — | — | | 10 μm | No problem |
| Photoreceptor (2) | (I-d)-28 | 90 parts by weight | Compound (C) | 10 parts by weight | — | | 10 μm | No problem |
| Photoreceptor (3) | (I-d)-28 | 80 parts by weight | Compound (C) | 20 parts by weight | — | | 10 μm | No problem |
| Photoreceptor (4) | (I-d)-28 | 70 parts by weight | Compound (C) | 30 parts by weight | — | | 10 μm | No problem |
| Photoreceptor (5) | (I-d)-28 | 70 parts by weight | Compound (C) | 30 parts by weight | L-2 | 10 parts by weight | 10 μm | No problem |
| Photoreceptor (6) | (I-b)-23 | 100 parts by weight | — | — | — | | 10 μm | No problem |
| Photoreceptor (7) | (I-b)-28 | 100 parts by weight | — | — | — | | 10 μm | No problem |
| Photoreceptor (8) | (I-c)-23 | 100 parts by weight | — | — | — | | 10 μm | No problem |
| Photoreceptor (9) | (I-c)-53 | 90 parts by weight | Compound (C) | 10 parts by weight | — | | 10 μm | No problem |
| Photoreceptor (10) | (I-c)-53 | 80 parts by weight | Compound (C) | 20 parts by weight | — | | 10 μm | No problem |
| Photoreceptor (11) | (I-c)-53 | 70 parts by weight | Compound (C) | 30 parts by weight | — | | 10 μm | No problem |
| Photoreceptor (12) | (I-d)-20 | 100 parts by weight | — | — | — | | 10 μm | No problem |
| Photoreceptor (13) | (I-d)-20 | 70 parts by weight | Compound (C) | 30 parts by weight | L-2 | 10 parts by weight | 10 μm | No problem |
| Photoreceptor (14) | (II)-50 | 100 parts by weight | — | — | — | | 10 μm | No problem |
| Photoreceptor (15) | (II)-56 | 100 parts by weight | — | — | — | | 10 μm | No problem |
| Photoreceptor (16) | (II)-182 | 100 parts by weight | — | — | — | | 10 μm | No problem |
| Photoreceptor (17) | (II)-183 | 100 parts by weight | — | — | — | | 10 μm | No problem |
| Photoreceptor (18) | (II)-183 | 90 parts by weight | Compound (C) | 10 parts by weight | — | | 10 μm | No problem |
| Photoreceptor (19) | (II)-183 | 80 parts by weight | Compound (C) | 20 parts by weight | — | | 10 μm | No problem |
| Photoreceptor (20) | (II)-183 | 70 parts by weight | Compound (C) | 30 parts by weight | — | | 10 μm | No problem |
| Photoreceptor (21) | (II)-183 | 70 parts by weight | Compound (C) | 30 parts by weight | L-2 | 10 parts by weight | 10 μm | No problem |
| Reference Photoreceptor (R1) | Compound (B) | 100 parts by weight | — | — | — | — | 10 μm | Extremely low density |
| Photoreceptor (22) | Compound (B) | 100 parts by weight | — | — | — | — | 4 μm | No problem |

TABLE 2

| Example in which fatty acid metal salt particles are used in toner | | | | | | | |
|---|---|---|---|---|---|---|---|
| | Photoreceptor | Developer | fatty acid metal salt particles | | | Cleaning | Overall |
| Example A | No. | No. | Type | Rmf weight % | Median diameter μm | blade No. | evaluation |
| Example A1 | (1) | (A1) | StZn | 0.18 | 1.5 | (1) | A+ |
| Example A2 | (2) | (A1) | StZn | 0.18 | 1.5 | (1) | A+ |
| Example A3 | (3) | (A2) | StZn | 0.12 | 1.5 | (1) | A+ |
| Example A4 | (4) | (A3) | StZn | 0.03 | 1.5 | (1) | A |
| Example A5 | (5) | (A3) | StZn | 0.03 | 1.5 | (1) | A+ |
| Example A6 | (6) | (A2) | StZn | 0.12 | 1.5 | (1) | A+ |
| Example A7 | (7) | (A2) | StZn | 0.12 | 1.5 | (1) | A+ |
| Example A8 | (8) | (A2) | StZn | 0.12 | 1.5 | (1) | A+ |
| Example A9 | (9) | (A3) | StZn | 0.03 | 1.5 | (1) | A |
| Example A10 | (10) | (A3) | StZn | 0.03 | 1.5 | (1) | A |

TABLE 2-continued

| Example in which fatty acid metal salt particles are used in toner | | | | | | | |
|---|---|---|---|---|---|---|---|
| | Photoreceptor | Developer | fatty acid metal salt particles | | | Cleaning | Overall |
| Example A | No. | No. | Type | Rmf weight % | Median diameter μm | blade No. | evaluation |
| Example A11 | (11) | (A3) | StZn | 0.03 | 1.5 | (1) | A+ |
| Example A12 | (12) | (A2) | StZn | 0.12 | 1.5 | (1) | A+ |
| Example A13 | (13) | (A1) | StZn | 0.18 | 1.5 | (1) | A+ |
| Example A14 | (14) | (A1) | StZn | 0.18 | 1.5 | (1) | A+ |
| Example A15 | (15) | (A1) | StZn | 0.18 | 1.5 | (1) | A+ |
| Example A16 | (16) | (A2) | StZn | 0.12 | 1.5 | (1) | A+ |
| Example A17 | (17) | (A3) | StZn | 0.03 | 1.5 | (1) | A |
| Example A18 | (18) | (A2) | StZn | 0.12 | 1.5 | (1) | A+ |
| Example A19 | (19) | (A2) | StZn | 0.12 | 1.5 | (1) | A+ |
| Example A20 | (20) | (A2) | StZn | 0.12 | 1.5 | (1) | A+ |
| Example A21 | (21) | (A2) | StZn | 0.12 | 1.5 | (1) | A+ |
| Example A22 | (22) | (A2) | StZn | 0.12 | 1.5 | (1) | A+ |
| Example A23 | (1) | (A7) | StZn | 0.06 | 1.5 | (1) | A |
| Example A24 | (1) | (A4) | StZn | 0.18 | 12 | (1) | B |
| Example A25 | (17) | (A4) | StZn | 0.18 | 12 | (1) | B |
| Example A26 | (17) | (A8) | StZn | 0.18 | 5.5 | (1) | B |
| Com. Ex. A1 | (R1) | (A3) | StZn | 0.03 | 1.5 | (1) | C |
| Com. Ex. A2 | (6) | (A3) | StZn | 0.03 | 1.5 | (1) | C |
| Com. Ex. A3 | (7) | (A3) | StZn | 0.03 | 1.5 | (1) | C |
| Com. Ex. A4 | (8) | (A5) | — | 0 | — | (1) | C |
| Com. Ex. A5 | (1) | (A6) | StZn | 0.25 | 1.5 | (1) | B |
| Com. Ex. A6 | (C1) | (A1) | StZn | 0.18 | 1.5 | (1) | C |
| Com. Ex. A7 | (C1) | (A5) | — | 0 | — | (1) | C |
| Com. Ex. A8 | (8) | (A6) | StZn | 0.005 | 5.5 | (1) | C |

TABLE 3

| Example in which fatty acid metal salt particles are used in toner | | | | | | | | | | |
|---|---|---|---|---|---|---|---|---|---|---|
| | Normal temperature and normal humidity | | | | | | | | | |
| Example A | Wmmax | Wmmin | Wm | Rmf/Wm | Wmmax/Wmmin | Residual potential | Abraded cross-sectional area of blade | Cracks on blade | Image deletion | Unevenness in density |
| Example A1 | 0.51 | 0.19 | 0.30 | 0.600 | 2.68 | A+ | A+ | A+ | A+ | A+ |
| Example A2 | 0.58 | 0.28 | 0.44 | 0.409 | 2.07 | A+ | A+ | A+ | A+ | A+ |
| Example A3 | 3.68 | 1.89 | 2.95 | 0.041 | 1.95 | A+ | A+ | A+ | A+ | A+ |
| Example A4 | 9.67 | 4.98 | 7.95 | 0.004 | 1.94 | A+ | A+ | A+ | A+ | A+ |
| Example A5 | 8.01 | 3.56 | 5.66 | 0.005 | 2.25 | A+ | A+ | A+ | A+ | A+ |
| Example A6 | 7.99 | 3.98 | 5.87 | 0.020 | 2.01 | A+ | A+ | A+ | A+ | A+ |
| Example A7 | 9.87 | 6.21 | 7.69 | 0.016 | 1.59 | A+ | A+ | A+ | A+ | A+ |
| Example A8 | 10.56 | 6.21 | 8.15 | 0.015 | 1.70 | A+ | A+ | A+ | A+ | A+ |
| Example A9 | 8.96 | 4.52 | 7.02 | 0.004 | 1.98 | A+ | A+ | A+ | A+ | A+ |
| Example A10 | 8.06 | 4.12 | 6.45 | 0.005 | 1.96 | A+ | A+ | A+ | A+ | A+ |
| Example A11 | 7.86 | 3.78 | 6.07 | 0.005 | 2.08 | A+ | A+ | A+ | A+ | A+ |
| Example A12 | 1.80 | 0.90 | 1.30 | 0.092 | 2.00 | A+ | A+ | A+ | A+ | A+ |
| Example A13 | 3.41 | 1.54 | 2.54 | 0.071 | 2.21 | A+ | A+ | A+ | A+ | A+ |
| Example A14 | 0.31 | 0.10 | 0.19 | 0.947 | 3.10 | A+ | A+ | A+ | A+ | A+ |
| Example A15 | 0.58 | 0.24 | 0.33 | 0.545 | 2.42 | A+ | A+ | A+ | A+ | A+ |
| Example A16 | 0.43 | 0.25 | 0.34 | 0.353 | 1.72 | A+ | A+ | A+ | A+ | A+ |
| Example A17 | 2.88 | 1.54 | 2.24 | 0.013 | 1.87 | A+ | A+ | A+ | A+ | A+ |
| Example A18 | 3.02 | 1.97 | 2.55 | 0.047 | 1.53 | A+ | A+ | A+ | A+ | A+ |
| Example A19 | 4.23 | 2.13 | 3.14 | 0.038 | 1.99 | A+ | A+ | A+ | A+ | A+ |
| Example A20 | 8.47 | 4.43 | 7.01 | 0.017 | 1.91 | A+ | A+ | A+ | A+ | A+ |
| Example A21 | 7.54 | 3.79 | 6.12 | 0.020 | 1.99 | A+ | A+ | A+ | A+ | A+ |
| Example A22 | 7.68 | 3.68 | 5.22 | 0.023 | 2.09 | A+ | A+ | A+ | A+ | A+ |
| Example A23 | 3.66 | 2.14 | 2.91 | 0.021 | 1.71 | A+ | A+ | A+ | A+ | A+ |
| Example A24 | 4.98 | 2.44 | 3.43 | 0.052 | 2.04 | A+ | A+ | A+ | A+ | A+ |
| Example A25 | 5.22 | 2.45 | 3.76 | 0.048 | 2.13 | A+ | A+ | A+ | A+ | A+ |
| Example A26 | 5.01 | 2.25 | 3.44 | 0.052 | 2.23 | A+ | A+ | A+ | A+ | A+ |
| Com. Ex. A1 | 15.81 | 10.22 | 13.32 | 0.002 | 1.55 | A+ | A+ | A+ | A+ | A+ |
| Com. Ex. A2 | 13.34 | 7.98 | 10.56 | 0.003 | 1.67 | A+ | A+ | A+ | A+ | A+ |
| Com. Ex. A3 | 15.95 | 8.46 | 13.11 | 0.002 | 1.89 | A+ | A+ | A+ | A+ | A+ |
| Com. Ex. A4 | 15.22 | 10.01 | 12.10 | 0.000 | 1.52 | A+ | A+ | A+ | A+ | A+ |
| Com. Ex. A5 | 1.80 | 0.90 | 1.30 | 0.192 | 2.00 | A+ | A+ | A+ | A+ | A+ |
| Com. Ex. A6 | 23.31 | 14.11 | 18.46 | 0.010 | 1.65 | A+ | A+ | A+ | A+ | A+ |
| Com. Ex. A7 | 26.15 | 19.46 | 22.31 | 0.000 | 1.34 | A+ | A+ | A+ | A+ | A+ |
| Com. Ex. A8 | 14.99 | 9.95 | 11.95 | 0.0004 | 1.51 | A+ | A+ | A+ | A+ | A+ |

TABLE 4

| Example in which fatty acid metal salt particles are used in toner | | | | | | | | | | |
|---|---|---|---|---|---|---|---|---|---|---|
| | Low temperature and low humidity | | | | | | | | | |
| Example A | Wlmax | Wlmin | Wl | Rmf/ Wl | Wlmax/ Wlmin | Residual potential | Abraded cross-sectional area of blade | Cracks on blade | Image deletion | Unevenness in density |
| Example A1 | 0.60 | 0.25 | 0.47 | 0.383 | 2.40 | A | A+ | A+ | A+ | A+ |
| Example A2 | 0.77 | 0.41 | 0.57 | 0.316 | 1.88 | A+ | A+ | A+ | A+ | A+ |
| Example A3 | 4.15 | 2.55 | 3.39 | 0.035 | 1.63 | A+ | A+ | A+ | A+ | A+ |
| Example A4 | 10.28 | 5.26 | 8.74 | 0.003 | 1.95 | A+ | A | A+ | A+ | A+ |
| Example A5 | 9.06 | 6.07 | 7.15 | 0.004 | 1.49 | A+ | A+ | A+ | A+ | A+ |
| Example A6 | 8.99 | 6.02 | 7.56 | 0.016 | 1.49 | A+ | A+ | A+ | A+ | A+ |
| Example A7 | 9.33 | 6.22 | 8.05 | 0.015 | 1.50 | A+ | A+ | A+ | A+ | A+ |
| Example A8 | 11.32 | 6.68 | 9.03 | 0.013 | 1.69 | A | A+ | A+ | A+ | A+ |
| Example A9 | 9.68 | 4.97 | 8.02 | 0.004 | 1.95 | A+ | A | A+ | A+ | A+ |
| Example A10 | 9.74 | 5.01 | 7.53 | 0.004 | 1.94 | A+ | A | A+ | A+ | A+ |
| Example A11 | 8.97 | 4.81 | 7.08 | 0.004 | 1.86 | A+ | A+ | A+ | A+ | A+ |
| Example A12 | 2.81 | 1.49 | 2.05 | 0.059 | 1.89 | A | A+ | A+ | A+ | A+ |
| Example A13 | 4.02 | 2.11 | 3.03 | 0.059 | 1.91 | A+ | A+ | A+ | A+ | A+ |
| Example A14 | 0.39 | 0.24 | 0.31 | 0.581 | 1.63 | A+ | A+ | A+ | A+ | A+ |
| Example A15 | 0.47 | 0.37 | 0.44 | 0.409 | 1.27 | A+ | A+ | A+ | A+ | A+ |
| Example A16 | 0.70 | 0.41 | 0.53 | 0.226 | 1.71 | A+ | A+ | A+ | A+ | A+ |
| Example A17 | 4.41 | 1.98 | 3.09 | 0.010 | 2.23 | A | A | A+ | A+ | A+ |
| Example A18 | 4.45 | 1.84 | 3.02 | 0.040 | 2.42 | A+ | A+ | A+ | A+ | A+ |
| Example A19 | 5.41 | 2.55 | 3.97 | 0.030 | 2.12 | A+ | A+ | A+ | A+ | A+ |
| Example A20 | 10.21 | 6.97 | 8.19 | 0.015 | 1.46 | A+ | A+ | A+ | A+ | A+ |
| Example A21 | 8.94 | 5.98 | 7.03 | 0.017 | 1.49 | A+ | A+ | A+ | A+ | A+ |
| Example A22 | 8.36 | 5.99 | 7.43 | 0.016 | 1.40 | A+ | A+ | A+ | A+ | A+ |
| Example A23 | 5.23 | 2.14 | 3.46 | 0.017 | 2.44 | A+ | A+ | A+ | A+ | A+ |
| Example A24 | 6.64 | 3.78 | 4.98 | 0.036 | 1.76 | A+ | A+ | A+ | A+ | A+ |
| Example A25 | 6.96 | 5.11 | 5.16 | 0.035 | 1.36 | A+ | A+ | A+ | A+ | A+ |
| Example A26 | 6.53 | 4.99 | 5.06 | 0.036 | 1.31 | A+ | A+ | A+ | A+ | A+ |
| Com. Ex. A1 | 20.13 | 12.27 | 16.10 | 0.002 | 1.64 | C | A+ | A+ | A+ | B |
| Com. Ex. A2 | 15.10 | 9.21 | 12.31 | 0.002 | 1.64 | A+ | A | A | A+ | A+ |
| Com. Ex. A3 | 18.01 | 9.99 | 15.11 | 0.002 | 1.80 | A+ | A | A | A+ | A+ |
| Com. Ex. A4 | 17.99 | 9.65 | 14.98 | 0.000 | 1.86 | A+ | A+ | C | A | A+ |
| Com. Ex. A5 | 0.41 | 0.13 | 0.23 | 1.087 | 3.15 | A+ | A+ | A+ | A+ | B |
| Com. Ex. A6 | 28.83 | 15.01 | 23.01 | 0.008 | 1.92 | A+ | A+ | A+ | A+ | B |
| Com. Ex. A7 | 29.30 | 15.21 | 25.11 | 0.000 | 1.93 | A+ | A+ | A+ | A+ | B |
| Com. Ex. A8 | 17.63 | 9.23 | 14.63 | 0.0003 | 1.91 | A+ | A+ | C | A | A+ |

TABLE 5

| Example in which fatty acid metal salt particles are used in toner | | | | | | | | | | |
|---|---|---|---|---|---|---|---|---|---|---|
| | High temperature and high humidity | | | | | | | | | |
| Example A | Whmax | Whmin | Wh | Rmf/ Wh | Whmax/ Whmin | Residual potential | Abraded cross-sectional area of blade | Cracks on blade | Image deletion | Unevenness in density |
| Example A1 | 0.07 | 0.03 | 0.05 | 3.600 | 2.33 | A+ | A | A+ | A+ | A |
| Example A2 | 0.21 | 0.09 | 0.13 | 1.385 | 2.33 | A+ | A+ | A+ | A+ | A+ |
| Example A3 | 2.98 | 1.57 | 2.02 | 0.059 | 1.90 | A+ | A+ | A+ | A+ | A+ |
| Example A4 | 7.15 | 3.31 | 5.02 | 0.006 | 2.16 | A+ | B | A | A | A |
| Example A5 | 6.02 | 2.66 | 4.03 | 0.007 | 2.26 | A+ | A+ | A+ | A+ | A+ |
| Example A6 | 7.04 | 3.15 | 5.03 | 0.024 | 2.23 | A+ | A+ | A+ | A+ | A+ |
| Example A7 | 7.97 | 3.68 | 6.02 | 0.020 | 2.17 | A+ | A+ | A+ | A+ | A+ |
| Example A8 | 8.05 | 3.88 | 6.52 | 0.018 | 2.07 | A+ | A+ | A+ | A+ | A+ |
| Example A9 | 6.99 | 3.02 | 4.68 | 0.006 | 2.31 | A+ | B | A | A | A |
| Example A10 | 6.98 | 2.99 | 4.52 | 0.007 | 2.33 | A+ | B | A | A | A |
| Example A11 | 5.69 | 2.43 | 4.03 | 0.007 | 2.34 | A+ | A+ | A+ | A+ | A+ |
| Example A12 | 0.29 | 0.15 | 0.22 | 0.545 | 1.93 | A+ | A+ | A+ | A+ | A+ |
| Example A13 | 2.33 | 1.02 | 1.52 | 0.118 | 2.28 | A+ | A+ | A+ | A+ | A+ |
| Example A14 | 0.06 | 0.03 | 0.04 | 4.500 | 2.00 | A+ | A+ | A+ | A+ | A+ |
| Example A15 | 0.06 | 0.04 | 0.05 | 3.600 | 1.50 | A+ | A+ | A+ | A+ | A+ |
| Example A16 | 0.17 | 0.08 | 0.13 | 0.923 | 2.13 | A+ | A+ | A+ | A+ | A+ |
| Example A17 | 1.78 | 0.88 | 1.21 | 0.025 | 2.02 | A+ | B | A | A | A |
| Example A18 | 2.66 | 1.21 | 1.98 | 0.061 | 2.20 | A+ | A+ | A+ | A+ | A+ |
| Example A19 | 3.74 | 1.86 | 2.66 | 0.045 | 2.01 | A+ | A+ | A+ | A+ | A+ |
| Example A20 | 7.14 | 3.22 | 4.87 | 0.025 | 2.22 | A+ | A+ | A+ | A+ | A+ |
| Example A21 | 6.41 | 2.89 | 4.03 | 0.030 | 2.22 | A+ | A+ | A+ | A+ | A+ |
| Example A22 | 6.58 | 2.92 | 4.38 | 0.027 | 2.25 | A+ | A+ | A+ | A+ | A+ |
| Example A23 | 2.69 | 1.13 | 1.98 | 0.030 | 2.38 | A+ | A | A | A | A |
| Example A24 | 4.69 | 1.98 | 3.11 | 0.058 | 2.37 | A+ | B | A | A | B |
| Example A25 | 4.99 | 2.31 | 3.34 | 0.054 | 2.16 | A+ | B | A | A | B |

TABLE 5-continued

| Example in which fatty acid metal salt particles are used in toner | | | | | | | | | | |
|---|---|---|---|---|---|---|---|---|---|---|
| | High temperature and high humidity | | | | | | | | | |
| Example A | Whmax | Whmin | Wh | Rmf/ Wh | Whmax/ Whmin | Residual potential | Abraded cross-sectional area of blade | Cracks on blade | Image deletion | Unevenness in density |
| Example A26 | 4.67 | 2.21 | 3.29 | 0.055 | 2.11 | A+ | B | A | A | B |
| Com. Ex. A1 | 13.56 | 8.21 | 10.34 | 0.003 | 1.65 | B | B | A | A | C |
| Com. Ex. A2 | 10.46 | 6.43 | 8.11 | 0.004 | 1.63 | A+ | B | A | B | C |
| Com. Ex. A3 | 12.89 | 7.68 | 9.68 | 0.003 | 1.68 | A+ | B | A | B | C |
| Com. Ex. A4 | 11.13 | 5.19 | 8.15 | 0.000 | 2.14 | A+ | C | C | C | C |
| Com. Ex. A5 | 0.03 | 0.01 | 0.02 | 12.500 | 3.00 | A+ | B | B | B | B |
| Com. Ex. A6 | 19.15 | 10.12 | 14.31 | 0.013 | 1.89 | A+ | A | A | A+ | C |
| Com. Ex. A7 | 21.76 | 15.03 | 18.33 | 0.000 | 1.45 | A+ | B | A | A+ | C |
| Com. Ex. A8 | 11.05 | 5.13 | 8.10 | 0.001 | 2.15 | A+ | C | C | C | C |

TABLE 6

| Example in which fatty acid metal salt particles and inorganic abrasive particles are used in toner | | | | | | | | | | | |
|---|---|---|---|---|---|---|---|---|---|---|---|
| | | | fatty acid metal salt particles | | | Inorganic abrasive particles | | | | | |
| Example B | Photoreceptor No. | Developer No. | Type | Rmf weight % | Median diameter μm | Type | Rab weight % | Median diameter nm | Rmf/ Rab | Cleaning blade No. | Overall evaluation |
| Example B1 | (1) | (B1) | StZn | 0.18 | 1.5 | CeO2 | 0.28 | 650 | 0.6 | (1) | A+ |
| Example B2 | (2) | (B1) | StZn | 0.18 | 1.5 | CeO2 | 0.28 | 650 | 0.6 | (1) | A+ |
| Example B3 | (3) | (B2) | StZn | 0.12 | 1.5 | CeO2 | 0.28 | 650 | 0.4 | (1) | A+ |
| Example B4 | (4) | (B3) | StZn | 0.03 | 1.5 | CeO2 | 0.28 | 650 | 0.1 | (1) | A |
| Example B5 | (5) | (B3) | StZn | 0.03 | 1.5 | CeO2 | 0.28 | 650 | 0.1 | (1) | A+ |
| Example B6 | (6) | (B4) | StZn | 0.18 | 12 | CeO2 | 0.28 | 650 | 0.6 | (1) | A+ |
| Example B7 | (7) | (B4) | StZn | 0.18 | 12 | CeO2 | 0.28 | 650 | 0.6 | (1) | A+ |
| Example B8 | (12) | (B7) | StZn | 0.06 | 1.5 | CeO2 | 0.28 | 650 | 0.2 | (1) | A+ |
| Example B9 | (13) | (B8) | StZn | 0.18 | 1.5 | SiTiO3 | 0.28 | 1500 | 0.6 | (1) | A+ |
| Example B10 | (14) | (B8) | StZn | 0.18 | 1.5 | SiTiO3 | 0.28 | 1500 | 0.6 | (1) | A+ |
| Example B11 | (16) | (B9) | StZn | 0.18 | 1.5 | CeO2 | 0.14 | 650 | 1.3 | (1) | A+ |
| Example B12 | (17) | (B10) | StZn | 0.18 | 1.5 | CeO2 | 0.07 | 650 | 2.6 | (1) | A |
| Example B13 | (18) | (B10) | StZn | 0.18 | 1.5 | CeO2 | 0.07 | 650 | 2.6 | (1) | A+ |
| Example B14 | (19) | (B3) | StZn | 0.03 | 1.5 | CeO2 | 0.28 | 650 | 0.1 | (1) | A+ |
| Example B15 | (20) | (B4) | StZn | 0.18 | 12 | CeO2 | 0.28 | 650 | 0.6 | (1) | A+ |
| Example B16 | (1) | (B8) | StZn | 0.18 | 1.5 | SiTiO3 | 0.28 | 1500 | 0.6 | (1) | A |
| Example B17 | (1) | (B9) | StZn | 0.18 | 1.5 | CeO2 | 0.14 | 650 | 1.3 | (1) | B |
| Example B18 | (17) | (B10) | StZn | 0.18 | 1.5 | CeO2 | 0.07 | 650 | 2.6 | (1) | B |
| Com. Ex. B1 | (R1) | (B3) | StZn | 0.03 | 1.5 | CeO2 | 0.28 | 650 | 0.1 | (1) | C |
| Com. Ex. B2 | (6) | (B3) | StZn | 0.03 | 1.5 | CeO2 | 0.28 | 650 | 0.1 | (1) | C |
| Com. Ex. B3 | (7) | (B3) | StZn | 0.03 | 1.5 | CeO2 | 0.28 | 650 | 0.1 | (1) | C |
| Com. Ex. B4 | (8) | (B5) | — | 0 | — | CeO2 | 0.28 | 650 | 0.0 | (1) | C |
| Com. Ex. B5 | (1) | (B6) | StZn | 0.25 | 1.5 | CeO2 | 0.28 | 650 | 0.9 | (1) | B |
| Com. Ex. B6 | (C1) | (B1) | StZn | 0.18 | 1.5 | CeO2 | 0.28 | 650 | 0.6 | (1) | C |
| Com. Ex. B7 | (C1) | (B5) | — | 0 | — | CeO2 | 0.28 | 650 | 0.0 | (1) | C |

TABLE 7

| Example in which fatty acid metal salt particles and inorganic abrasive particles are used in toner | | | | | | | | | | |
|---|---|---|---|---|---|---|---|---|---|---|
| | Normal temperature and normal humidity | | | | | | | | | |
| Example B | Wmmax | Wmmin | Wm | Rmf/ Wm | Wmmax/ Wmmin | Residual potential | Abraded cross-sectional area of blade | Cracks on blade | Image deletion | Unevenness in density |
| Example B1 | 0.65 | 0.25 | 0.85 | 0.213 | 2.60 | A+ | A+ | A+ | A+ | A+ |
| Example B2 | 0.75 | 0.38 | 0.68 | 0.265 | 1.97 | A+ | A+ | A+ | A+ | A+ |
| Example B3 | 4.65 | 2.57 | 3.18 | 0.038 | 1.81 | A+ | A+ | A+ | A+ | A+ |
| Example B4 | 10.25 | 5.12 | 8.22 | 0.004 | 2.00 | A+ | A+ | A+ | A+ | A+ |
| Example B5 | 9.25 | 4.51 | 6.25 | 0.005 | 2.05 | A+ | A+ | A+ | A+ | A+ |
| Example B6 | 6.55 | 2.98 | 4.95 | 0.036 | 2.20 | A+ | A+ | A+ | A+ | A+ |
| Example B7 | 9.87 | 5.81 | 6.85 | 0.026 | 1.70 | A+ | A+ | A+ | A+ | A+ |

TABLE 7-continued

| Example in which fatty acid metal salt particles and inorganic abrasive particles are used in toner | | | | | | | | | | |
|---|---|---|---|---|---|---|---|---|---|---|
| | Normal temperature and normal humidity | | | | | | | | | |
| Example B | Wmmax | Wmmin | Wm | Rmf/ Wm | Wmmax/ Wmmin | Residual potential | Abraded cross-sectional area of blade | Cracks on blade | Image deletion | Unevenness in density |
| Example B8 | 1.48 | 0.95 | 1.28 | 0.047 | 1.56 | A+ | A+ | A+ | A+ | A+ |
| Example B9 | 3.22 | 1.21 | 2.18 | 0.083 | 2.66 | A+ | A+ | A+ | A+ | A+ |
| Example B10 | 0.28 | 0.07 | 0.24 | 0.750 | 4.00 | A+ | A+ | A+ | A+ | A+ |
| Example B11 | 0.57 | 0.38 | 0.47 | 0.383 | 1.50 | A+ | A+ | A+ | A+ | A+ |
| Example B12 | 3.58 | 1.89 | 2.54 | 0.071 | 1.89 | A+ | A+ | A+ | A+ | A+ |
| Example B13 | 3.48 | 2.48 | 2.98 | 0.060 | 1.40 | A+ | A+ | A+ | A+ | A+ |
| Example B14 | 4.87 | 2.45 | 3.58 | 0.008 | 1.99 | A+ | A+ | A+ | A+ | A+ |
| Example B15 | 9.14 | 5.18 | 8.14 | 0.022 | 1.76 | A+ | A+ | A+ | A+ | A+ |
| Example B16 | 4.47 | 3.54 | 3.15 | 0.057 | 1.26 | A+ | A+ | A+ | A+ | A+ |
| Example B17 | 5.87 | 3.45 | 4.15 | 0.043 | 1.70 | A+ | A+ | A+ | A+ | A+ |
| Example B18 | 6.14 | 3.17 | 4.58 | 0.039 | 1.94 | A+ | A+ | A+ | A+ | A+ |
| Com. Ex. B1 | 18.45 | 12.25 | 14.35 | 0.002 | 1.51 | A+ | A+ | A+ | A+ | A+ |
| Com. Ex. B2 | 14.45 | 8.15 | 11.67 | 0.003 | 1.77 | A+ | A+ | A+ | A+ | A+ |
| Com. Ex. B3 | 16.58 | 9.85 | 15.25 | 0.002 | 1.68 | A+ | A+ | A+ | A+ | A+ |
| Com. Ex. B4 | 17.25 | 11.52 | 14.65 | 0.000 | 1.50 | A+ | A+ | A+ | A+ | A+ |
| Com. Ex. B5 | 2.15 | 1.45 | 1.87 | 0.134 | 1.48 | A+ | A+ | A+ | A+ | A+ |
| Com. Ex. B6 | 25.67 | 16.58 | 20.14 | 0.009 | 1.55 | A+ | A+ | A+ | A+ | A+ |
| Com. Ex. B7 | 28.05 | 20.98 | 24.05 | 0.000 | 1.34 | A+ | A+ | A+ | A+ | A+ |

TABLE 8

| Example in which fatty acid metal salt particles and inorganic abrasive particles are used in toner | | | | | | | | | | |
|---|---|---|---|---|---|---|---|---|---|---|
| | Low temperature and low humidty | | | | | | | | | |
| Example B | Wlmax | Wlmin | Wl | Rmf/ Wl | Wlmax/ Wlmin | Residual potential | Abraded cross-sectional area of blade | Cracks on blade | Image deletion | Unevenness in density |
| Example B1 | 0.78 | 0.35 | 0.68 | 0.265 | 2.23 | A | A+ | A+ | A+ | A+ |
| Example B2 | 0.98 | 0.68 | 0.78 | 0.231 | 1.44 | A+ | A+ | A+ | A+ | A+ |
| Example B3 | 5.15 | 3.28 | 4.52 | 0.027 | 1.57 | A+ | A+ | A+ | A+ | A+ |
| Example B4 | 12.65 | 6.25 | 9.17 | 0.003 | 2.02 | A+ | A | A+ | A+ | A+ |
| Example B5 | 10.25 | 7.65 | 8.56 | 0.004 | 1.34 | A+ | A+ | A+ | A+ | A+ |
| Example B6 | 7.84 | 5.98 | 7.52 | 0.024 | 1.31 | A+ | A+ | A+ | A+ | A+ |
| Example B7 | 8.95 | 5.92 | 7.85 | 0.023 | 1.51 | A+ | A+ | A+ | A+ | A+ |
| Example B8 | 2.58 | 1.54 | 2.00 | 0.030 | 1.68 | A | A+ | A+ | A+ | A+ |
| Example B9 | 3.74 | 2.02 | 2.58 | 0.070 | 1.85 | A+ | A+ | A+ | A+ | A+ |
| Example B10 | 0.28 | 0.28 | 0.45 | 0.400 | 1.00 | A+ | A+ | A+ | A+ | A+ |
| Example B11 | 0.98 | 0.58 | 0.68 | 0.265 | 1.69 | A+ | A+ | A+ | A+ | A+ |
| Example B12 | 5.15 | 2.57 | 3.57 | 0.050 | 2.00 | A | A | A+ | A+ | A+ |
| Example B13 | 4.89 | 2.45 | 3.65 | 0.049 | 2.00 | A+ | A+ | A+ | A+ | A+ |
| Example B14 | 5.58 | 3.05 | 4.50 | 0.007 | 1.83 | A+ | A+ | A+ | A+ | A+ |
| Example B15 | 11.25 | 7.89 | 9.58 | 0.019 | 1.43 | A+ | A+ | A+ | A+ | A+ |
| Example B16 | 6.34 | 3.05 | 3.95 | 0.046 | 2.08 | A+ | A+ | A+ | A+ | A+ |
| Example B17 | 7.48 | 4.32 | 5.08 | 0.035 | 1.73 | A+ | A+ | A+ | A+ | A+ |
| Example B18 | 7.89 | 5.89 | 6.02 | 0.030 | 1.34 | A+ | A+ | A+ | A+ | A+ |
| Com. Ex. B1 | 22.15 | 14.25 | 17.85 | 0.002 | 1.55 | C | A+ | A+ | A+ | B |
| Com. Ex. B2 | 18.36 | 10.25 | 14.25 | 0.002 | 1.79 | A+ | A | A | A+ | A+ |
| Com. Ex. B3 | 20.15 | 10.64 | 18.62 | 0.002 | 1.89 | A+ | A | A | A+ | A+ |
| Com. Ex. B4 | 18.65 | 10.58 | 17.32 | 0.000 | 1.76 | A+ | A+ | C | A | A+ |
| Com. Ex. B5 | 0.85 | 0.42 | 0.38 | 0.658 | 2.02 | A+ | A+ | A+ | A+ | B |
| Com. Ex. B6 | 29.57 | 17.68 | 25.65 | 0.007 | 1.67 | A+ | A+ | A+ | A+ | B |
| Com. Ex. B7 | 30.54 | 18.65 | 27.68 | 0.000 | 1.64 | A+ | A+ | A+ | A+ | B |

TABLE 9

Example in which fatty acid metal salt particles and inorganic abrasive particles are used in toner

| | High temperature and high humidity | | | | | | | | | |
|---|---|---|---|---|---|---|---|---|---|---|
| Example B | Whmax | Whmin | Wh | Rmf/ Wh | Whmax/ Whmin | Residual potential | Abraded cross-sectional area of blade | Cracks on blade | Image deletion | Unevenness in density |
| Example B1 | 0.09 | 0.05 | 0.08 | 2.250 | 1.80 | A+ | A | A+ | A+ | A |
| Example B2 | 0.32 | 0.15 | 0.18 | 1.000 | 2.13 | A+ | A+ | A+ | A+ | A+ |
| Example B3 | 3.67 | 1.99 | 2.74 | 0.044 | 1.84 | A+ | A+ | A+ | A+ | A+ |
| Example B4 | 8.32 | 3.78 | 5.69 | 0.005 | 2.20 | A+ | B | A | A | A |
| Example B5 | 7.15 | 3.65 | 5.15 | 0.006 | 1.96 | A+ | A+ | A+ | A+ | A+ |
| Example B6 | 6.85 | 3.29 | 4.88 | 0.037 | 2.08 | A+ | A+ | A+ | A+ | A+ |
| Example B7 | 7.53 | 3.48 | 5.91 | 0.030 | 2.16 | A+ | A+ | A+ | A+ | A+ |
| Example B8 | 0.38 | 0.24 | 0.28 | 0.214 | 1.58 | A+ | A+ | A+ | A+ | A+ |
| Example B9 | 2.05 | 0.87 | 1.25 | 0.144 | 2.36 | A+ | A+ | A+ | A+ | A+ |
| Example B10 | 0.16 | 0.11 | 0.10 | 1.800 | 1.45 | A+ | A+ | A+ | A+ | A+ |
| Example B11 | 0.28 | 0.12 | 0.18 | 1.000 | 2.33 | A+ | A+ | A+ | A+ | A+ |
| Example B12 | 2.45 | 1.18 | 1.98 | 0.091 | 2.08 | A+ | B | A | A | A |
| Example B13 | 2.88 | 1.85 | 2.45 | 0.073 | 1.56 | A+ | A+ | A+ | A+ | A+ |
| Example B14 | 4.58 | 2.21 | 2.98 | 0.010 | 2.07 | A+ | A+ | A+ | A+ | A+ |
| Example B15 | 8.74 | 4.87 | 5.62 | 0.032 | 1.79 | A+ | A+ | A+ | A+ | A+ |
| Example B16 | 2.99 | 1.58 | 2.54 | 0.071 | 1.89 | A+ | A | A | A | A |
| Example B17 | 5.33 | 2.21 | 3.78 | 0.048 | 2.41 | A+ | B | A | A | B |
| Example B18 | 5.18 | 2.98 | 3.78 | 0.048 | 1.74 | A+ | B | A | A | B |
| Com. Ex. B1 | 14.25 | 9.51 | 11.28 | 0.003 | 1.50 | B | B | A | A | C |
| Com. Ex. B2 | 11.58 | 8.95 | 10.25 | 0.003 | 1.29 | A+ | B | A | B | C |
| Com. Ex. B3 | 14.25 | 8.65 | 10.25 | 0.003 | 1.65 | A+ | B | A | B | C |
| Com. Ex. B4 | 12.98 | 5.68 | 9.58 | 0.000 | 2.29 | A+ | C | C | C | C |
| Com. Ex. B5 | 0.08 | 0.03 | 0.02 | 12.500 | 2.67 | A+ | B | B | B | B |
| Com. Ex. B6 | 20.45 | 14.25 | 16.88 | 0.011 | 1.44 | A+ | A | A | A+ | C |
| Com. Ex. B7 | 22.68 | 17.62 | 20.25 | 0.000 | 1.29 | A+ | B | A | A+ | C |

TABLE 10

Example in which fatty acid metal salt particles and inorganic lubricant particles are used in toner

| | | | fatty acid metal salt particles | | | Inorganic lubricant particles | | | | |
|---|---|---|---|---|---|---|---|---|---|---|
| Example C | Photoreceptor No. | Developer No. | Type | Rmf weight % | Median diameter μm | Type | Rlu weight % | Volume average particle diameter μm | Cleaning blade No. | Overall evaluation |
| Example C1 | (1) | (C1) | StZn | 0.18 | 1.5 | BN | 0.18 | 5 | (1) | A+ |
| Example C2 | (2) | (C1) | StZn | 0.18 | 1.5 | BN | 0.18 | 5 | (1) | A+ |
| Example C3 | (3) | (C2) | StZn | 0.10 | 1.5 | BN | 0.18 | 5 | (1) | A+ |
| Example C4 | (4) | (C3) | StZn | 0.03 | 1.5 | BN | 0.18 | 5 | (1) | A |
| Example C5 | (5) | (C3) | StZn | 0.03 | 1.5 | BN | 0.18 | 5 | (1) | A+ |
| Example C6 | (6) | (C2) | StZn | 0.10 | 1.5 | BN | 0.18 | 5 | (1) | A+ |
| Example C7 | (7) | (C2) | StZn | 0.10 | 1.5 | BN | 0.18 | 5 | (1) | A+ |
| Example C8 | (8) | (C2) | StZn | 0.10 | 1.5 | BN | 0.18 | 5 | (1) | A+ |
| Example C9 | (9) | (C3) | StZn | 0.03 | 1.5 | BN | 0.18 | 5 | (1) | A |
| Example C10 | (10) | (C3) | StZn | 0.03 | 1.5 | BN | 0.18 | 5 | (1) | A |
| Example C11 | (11) | (C3) | StZn | 0.03 | 1.5 | BN | 0.18 | 5 | (1) | A+ |
| Example C12 | (12) | (C2) | StZn | 0.10 | 1.5 | BN | 0.18 | 5 | (1) | A+ |
| Example C13 | (13) | (C1) | StZn | 0.18 | 1.5 | BN | 0.18 | 5 | (1) | A+ |
| Example C14 | (14) | (C1) | StZn | 0.18 | 1.5 | BN | 0.18 | 5 | (1) | A+ |
| Example C15 | (15) | (C1) | StZn | 0.18 | 1.5 | BN | 0.18 | 5 | (1) | A+ |
| Example C16 | (16) | (C2) | StZn | 0.10 | 1.5 | BN | 0.18 | 5 | (1) | A+ |
| Example C17 | (17) | (C3) | StZn | 0.03 | 1.5 | BN | 0.18 | 5 | (1) | A |
| Example C18 | (18) | (C2) | StZn | 0.10 | 1.5 | BN | 0.18 | 5 | (1) | A+ |
| Example C19 | (19) | (C2) | StZn | 0.10 | 1.5 | BN | 0.18 | 5 | (1) | A+ |
| Example C20 | (20) | (C2) | StZn | 0.10 | 1.5 | BN | 0.18 | 5 | (1) | A+ |
| Example C21 | (21) | (C2) | StZn | 0.10 | 1.5 | BN | 0.18 | 5 | (1) | A+ |
| Example C22 | (22) | (C2) | StZn | 0.10 | 1.5 | BN | 0.18 | 5 | (1) | A+ |
| Example C23 | (1) | (C7) | StZn | 0.06 | 1.5 | BN | 0.18 | 5 | (1) | C |
| Example C24 | (1) | (C4) | StZn | 0.18 | 12 | BN | 0.18 | 5 | (1) | B |
| Example C25 | (17) | (C4) | StZn | 0.18 | 12 | BN | 0.18 | 5 | (1) | B |
| Example C26 | (R1) | (C3) | StZn | 0.10 | 1.5 | BN | 0.18 | 5 | (1) | C |
| Com. Ex. C1 | (6) | (C3) | StZn | 0.03 | 1.5 | BN | 0.18 | 5 | (1) | C |
| Com. Ex. C2 | (7) | (C3) | StZn | 0.03 | 1.5 | BN | 0.18 | 5 | (1) | C |
| Com. Ex. C3 | (8) | (C5) | — | 0 | — | BN | 0.18 | 5 | (1) | C |
| Com. Ex. C4 | (1) | (C6) | StZn | 0.25 | 1.5 | BN | 0.18 | 5 | (1) | B |
| Com. Ex. C5 | (1) | (C9) | — | 0 | — | — | 0 | — | (1) | C |

TABLE 10-continued

| Example in which fatty acid metal salt particles and inorganic lubricant particles are used in toner | | | | | | | | | | |
|---|---|---|---|---|---|---|---|---|---|---|
| | | | fatty acid metal salt particles | | | Inorganic lubricant particles | | | | |
| Example C | Photoreceptor No. | Developer No. | Type | Rmf weight % | Median diameter μm | Type | Rlu weight % | Volume average particle diameter μm | Cleaning blade No. | Overall evaluation |
| Com. Ex. C6 | (C1) | (C1) | StZn | 0.18 | 1.5 | BN | 0.18 | 5 | (1) | C |
| Com. Ex. C7 | (C1) | (C5) | — | 0 | — | BN | 0.18 | 5 | (1) | C |

TABLE 11

| Example in which fatty acid metal salt particles and inorganic lubricant particles are used in toner | | | | | | | | | | | |
|---|---|---|---|---|---|---|---|---|---|---|---|
| | Normal temperature and normal humidity | | | | | | | | | | |
| Example C | Wmmax | Wmmin | Wm | Rmf/ Wm | Wmmax/ Wmmin | Residual potential | Abraded cross-sectional area of blade | Cracks on blade | Pass through of external additives | Image deletion | Unevenness in density |
| Example C1 | 0.48 | 0.18 | 0.29 | 0.632 | 2.68 | A+ | A+ | A+ | A | A+ | A+ |
| Example C2 | 0.55 | 0.27 | 0.42 | 0.431 | 2.07 | A+ | A+ | A+ | A | A+ | A+ |
| Example C3 | 3.50 | 1.80 | 2.80 | 0.036 | 1.95 | A+ | A+ | A+ | A | A+ | A+ |
| Example C4 | 9.19 | 4.73 | 7.55 | 0.004 | 1.94 | A+ | A+ | A+ | A | A+ | A+ |
| Example C5 | 7.61 | 3.38 | 5.38 | 0.006 | 2.25 | A+ | A+ | A+ | A | A+ | A+ |
| Example C6 | 7.59 | 3.78 | 5.58 | 0.018 | 2.01 | A+ | A+ | A+ | A | A+ | A+ |
| Example C7 | 9.38 | 5.90 | 7.31 | 0.014 | 1.59 | A+ | A+ | A+ | A | A+ | A+ |
| Example C8 | 10.03 | 5.90 | 7.74 | 0.013 | 1.70 | A+ | A+ | A+ | A | A+ | A+ |
| Example C9 | 8.51 | 4.29 | 6.67 | 0.004 | 1.98 | A+ | A+ | A+ | A | A+ | A+ |
| Example C10 | 7.66 | 3.91 | 6.13 | 0.005 | 1.96 | A+ | A+ | A+ | A | A+ | A+ |
| Example C11 | 7.47 | 3.59 | 5.77 | 0.005 | 2.08 | A+ | A+ | A+ | A | A+ | A+ |
| Example C12 | 1.71 | 0.86 | 1.24 | 0.081 | 2.00 | A+ | A+ | A+ | A | A+ | A+ |
| Example C13 | 3.24 | 1.46 | 2.41 | 0.075 | 2.21 | A+ | A+ | A+ | A | A+ | A+ |
| Example C14 | 0.29 | 0.10 | 0.18 | 0.997 | 3.10 | A+ | A+ | A+ | A | A+ | A+ |
| Example C15 | 0.55 | 0.23 | 0.31 | 0.574 | 2.42 | A+ | A+ | A+ | A | A+ | A+ |
| Example C16 | 0.41 | 0.24 | 0.32 | 0.310 | 1.72 | A+ | A+ | A+ | A | A+ | A+ |
| Example C17 | 2.74 | 1.46 | 2.13 | 0.014 | 1.87 | A+ | A+ | A+ | A | A+ | A+ |
| Example C18 | 2.87 | 1.87 | 2.42 | 0.041 | 1.53 | A+ | A+ | A+ | A | A+ | A+ |
| Example C19 | 4.02 | 2.02 | 2.98 | 0.034 | 1.99 | A+ | A+ | A+ | A | A+ | A+ |
| Example C20 | 8.05 | 4.21 | 6.66 | 0.015 | 1.91 | A+ | A+ | A+ | A | A+ | A+ |
| Example C21 | 7.16 | 3.60 | 5.81 | 0.017 | 1.99 | A+ | A+ | A+ | A | A+ | A+ |
| Example C22 | 7.30 | 3.50 | 4.96 | 0.020 | 2.09 | A+ | A+ | A+ | A | A+ | A+ |
| Example C23 | 3.48 | 2.03 | 2.76 | 0.022 | 1.71 | A+ | A+ | A+ | C | A+ | A+ |
| Example C24 | 4.73 | 2.32 | 3.26 | 0.055 | 2.04 | A+ | A+ | A+ | A | A+ | A+ |
| Example C25 | 4.96 | 2.33 | 3.57 | 0.050 | 2.13 | A+ | A+ | A+ | A | A+ | A+ |
| Example C26 | 15.02 | 9.71 | 12.65 | 0.008 | 1.55 | C | A+ | A+ | A | A+ | A+ |
| Com. Ex. C1 | 12.67 | 7.58 | 10.03 | 0.003 | 1.67 | A+ | A+ | A+ | B | A+ | A+ |
| Com. Ex. C2 | 15.15 | 8.04 | 12.45 | 0.002 | 1.89 | A+ | A+ | A+ | B | A+ | A+ |
| Com. Ex. C3 | 14.46 | 9.51 | 11.50 | 0.000 | 1.52 | A+ | A+ | A+ | B | A+ | A+ |
| Com. Ex. C4 | 1.71 | 0.86 | 1.24 | 0.202 | 2.00 | A+ | A+ | A+ | A | A+ | A+ |
| Com. Ex. C5 | 1.11 | 0.33 | 0.52 | 0.000 | 3.36 | A+ | A+ | A+ | C | A+ | A+ |
| Com. Ex. C6 | 22.14 | 13.40 | 17.54 | 0.010 | 1.65 | A+ | A+ | A+ | A | A+ | A+ |
| Com. Ex. C7 | 24.84 | 18.49 | 21.19 | 0.000 | 1.34 | A+ | A+ | A+ | B | A+ | A+ |

TABLE 12

| Example in which fatty acid metal salt particles and inorganic lubricant particles are used in toner | | | | | | | | | | | |
|---|---|---|---|---|---|---|---|---|---|---|---|
| | Low temperature and low humidity | | | | | | | | | | |
| Example C | Wlmax | Wlmin | Wl | Rmf/ Wl | Wlmax/ Wlmin | Residual potential | Abraded cross-sectional area of blade | Cracks on blade | Pass through of external additives | Image deletion | Unevenness in density |
| Example C1 | 0.68 | 0.30 | 0.54 | 0.335 | 2.31 | A | A+ | A+ | A | A+ | A+ |
| Example C2 | 0.87 | 0.47 | 0.65 | 0.278 | 1.84 | A+ | A+ | A+ | A | A+ | A+ |
| Example C3 | 4.59 | 2.83 | 3.75 | 0.027 | 1.62 | A+ | A+ | A+ | A | A+ | A+ |
| Example C4 | 11.33 | 5.81 | 9.63 | 0.003 | 1.95 | A+ | A | A+ | A | A+ | A+ |

TABLE 12-continued

| Example in which fatty acid metal salt particles and inorganic lubricant particles are used in toner | | | | | | | | | | | |
|---|---|---|---|---|---|---|---|---|---|---|---|
| | Low temperature and low humidity | | | | | | | | | | |
| Example C | Wlmax | Wlmin | Wl | Rmf/ Wl | Wlmax/ Wlmin | Residual potential | Abraded cross-sectional area of blade | Cracks on blade | Pass through of external additives | Image deletion | Unevenness in density |
| Example C5 | 9.99 | 6.70 | 7.89 | 0.004 | 1.49 | A+ | A+ | A+ | A | A+ | A+ |
| Example C6 | 9.91 | 6.64 | 8.34 | 0.012 | 1.49 | A+ | A+ | A+ | A | A+ | A+ |
| Example C7 | 10.28 | 6.86 | 8.88 | 0.011 | 1.50 | A+ | A+ | A+ | A | A+ | A+ |
| Example C8 | 12.47 | 7.37 | 9.95 | 0.010 | 1.69 | A | A+ | A+ | A | A+ | A+ |
| Example C9 | 10.67 | 5.49 | 8.84 | 0.003 | 1.94 | A+ | A | A+ | A | A+ | A+ |
| Example C10 | 10.73 | 5.53 | 8.30 | 0.004 | 1.94 | A+ | A | A+ | A | A+ | A+ |
| Example C11 | 9.89 | 5.31 | 7.81 | 0.004 | 1.86 | A+ | A+ | A+ | A | A+ | A+ |
| Example C12 | 3.11 | 1.66 | 2.28 | 0.044 | 1.88 | A | A+ | A+ | A | A+ | A+ |
| Example C13 | 4.44 | 2.34 | 3.35 | 0.054 | 1.90 | A+ | A+ | A+ | A | A+ | A+ |
| Example C14 | 0.45 | 0.28 | 0.36 | 0.499 | 1.58 | A+ | A+ | A+ | A | A+ | A+ |
| Example C15 | 0.54 | 0.43 | 0.50 | 0.357 | 1.26 | A+ | A+ | A+ | A | A+ | A+ |
| Example C16 | 0.79 | 0.47 | 0.60 | 0.166 | 1.68 | A+ | A+ | A+ | A | A+ | A+ |
| Example C17 | 4.87 | 2.20 | 3.42 | 0.009 | 2.22 | A | A | A+ | A | A+ | A+ |
| Example C18 | 4.92 | 2.04 | 3.34 | 0.030 | 2.40 | A+ | A+ | A+ | A | A+ | A+ |
| Example C19 | 5.97 | 2.83 | 4.39 | 0.023 | 2.11 | A+ | A+ | A+ | A | A+ | A+ |
| Example C20 | 11.25 | 7.69 | 9.03 | 0.011 | 1.46 | A+ | A+ | A+ | A | A+ | A+ |
| Example C21 | 9.85 | 6.60 | 7.75 | 0.013 | 1.49 | A+ | A+ | A+ | A | A+ | A+ |
| Example C22 | 9.22 | 6.61 | 8.19 | 0.012 | 1.39 | A+ | A+ | A+ | A | A+ | A+ |
| Example C23 | 5.77 | 2.37 | 3.83 | 0.016 | 2.43 | A | B | B | C | A+ | A+ |
| Example C24 | 7.32 | 4.18 | 5.50 | 0.033 | 1.75 | A+ | A+ | A+ | A | A+ | A+ |
| Example C25 | 7.68 | 5.64 | 5.70 | 0.032 | 1.36 | A+ | A+ | A+ | A | A+ | A+ |
| Example C26 | 22.16 | 13.52 | 17.73 | 0.006 | 1.64 | C | A+ | A+ | A | A+ | A |
| Com. Ex. C1 | 16.63 | 10.15 | 13.56 | 0.002 | 1.64 | A+ | A | A | C | A+ | A+ |
| Com. Ex. C2 | 19.83 | 11.01 | 16.64 | 0.002 | 1.80 | A+ | A | A | C | A+ | A+ |
| Com. Ex. C3 | 19.81 | 10.64 | 16.50 | 0.000 | 1.86 | A+ | A+ | C | C | A | A+ |
| Com. Ex. C4 | 0.47 | 0.16 | 0.27 | 0.916 | 2.89 | A+ | A+ | A+ | A | A+ | B |
| Com. Ex. C5 | 1.10 | 0.53 | 2.27 | 0.000 | 2.08 | A+ | A | C | C | C | C |
| Com. Ex. C6 | 31.73 | 16.53 | 25.33 | 0.007 | 1.92 | A+ | A+ | A+ | A | A+ | B |
| Com. Ex. C7 | 32.25 | 16.75 | 27.64 | 0.000 | 1.93 | A+ | A+ | A+ | B | A+ | B |

TABLE 13

| Example in which fatty acid metal salt particles and inorganic lubricant particles are used in toner | | | | | | | | | | | |
|---|---|---|---|---|---|---|---|---|---|---|---|
| | High temperature and high humidity | | | | | | | | | | |
| Example C | Whmax | Whmin | Wh | Rmf/ Wh | Whmax/ Whmin | Residual potential | Abraded cross-sectional area of blade | Cracks on blade | Pass through of external additives | Image deletion | Unevenness in density |
| Example C1 | 0.07 | 0.03 | 0.05 | 3.789 | 2.33 | A+ | A | A+ | A+ | A+ | A |
| Example C2 | 0.20 | 0.09 | 0.12 | 1.457 | 2.33 | A+ | A+ | A+ | A+ | A+ | A+ |
| Example C3 | 2.83 | 1.49 | 1.92 | 0.052 | 1.90 | A+ | A+ | A+ | A+ | A+ | A+ |
| Example C4 | 6.79 | 3.14 | 4.77 | 0.006 | 2.16 | A+ | B | A | A | A | A |
| Example C5 | 5.72 | 2.53 | 3.83 | 0.008 | 2.26 | A+ | A+ | A+ | A+ | A+ | A+ |
| Example C6 | 6.69 | 2.99 | 4.78 | 0.021 | 2.23 | A+ | A+ | A+ | A+ | A+ | A+ |
| Example C7 | 7.57 | 3.50 | 5.72 | 0.017 | 2.17 | A+ | A+ | A+ | A+ | A+ | A+ |
| Example C8 | 7.65 | 3.69 | 6.19 | 0.016 | 2.07 | A+ | A+ | A+ | A+ | A+ | A+ |
| Example C9 | 6.64 | 2.87 | 4.45 | 0.007 | 2.31 | A+ | B | A | A | A | A |
| Example C10 | 6.63 | 2.84 | 4.29 | 0.007 | 2.33 | A+ | B | A | A | A | A |
| Example C11 | 5.41 | 2.31 | 3.83 | 0.008 | 2.34 | A+ | A+ | A+ | A+ | A+ | A+ |
| Example C12 | 0.28 | 0.14 | 0.21 | 0.478 | 1.93 | A+ | A+ | A+ | A+ | A+ | A+ |
| Example C13 | 2.21 | 0.97 | 1.44 | 0.125 | 2.28 | A+ | A+ | A+ | A+ | A+ | A+ |
| Example C14 | 0.06 | 0.03 | 0.04 | 4.737 | 2.00 | A+ | A+ | A+ | A+ | A+ | A+ |
| Example C15 | 0.06 | 0.04 | 0.05 | 3.789 | 1.50 | A+ | A+ | A+ | A+ | A+ | A+ |
| Example C16 | 0.16 | 0.08 | 0.12 | 0.810 | 2.13 | A+ | A+ | A+ | A+ | A+ | A+ |
| Example C17 | 1.69 | 0.84 | 1.15 | 0.026 | 2.02 | A+ | B | A | A | A | A |
| Example C18 | 2.53 | 1.15 | 1.88 | 0.053 | 2.20 | A+ | A+ | A+ | A+ | A+ | A+ |
| Example C19 | 3.55 | 1.77 | 2.53 | 0.040 | 2.01 | A+ | A+ | A+ | A+ | A+ | A+ |
| Example C20 | 6.78 | 3.06 | 4.63 | 0.022 | 2.22 | A+ | A+ | A+ | A+ | A+ | A+ |
| Example C21 | 6.09 | 2.75 | 3.83 | 0.026 | 2.22 | A+ | A+ | A+ | A+ | A+ | A+ |

TABLE 13-continued

| Example in which fatty acid metal salt particles and inorganic lubricant particles are used in toner | | | | | | | | | | | |
|---|---|---|---|---|---|---|---|---|---|---|---|
| | High temperature and high humidity | | | | | | | | | | |
| Example C | Whmax | Whmin | Wh | Rmf/ Wh | Whmax/ Whmin | Residual potential | Abraded cross-sectional area of blade | Cracks on blade | Pass through of external additives | Image deletion | Unevenness in density |
| Example C22 | 6.25 | 2.77 | 4.16 | 0.024 | 2.25 | A+ | A+ | A+ | A+ | A+ | A+ |
| Example C23 | 2.56 | 1.07 | 1.88 | 0.032 | 2.38 | A+ | C | C | A | A+ | A |
| Example C24 | 4.46 | 1.88 | 2.95 | 0.061 | 2.37 | A+ | B | A | A | A | B |
| Example C25 | 4.74 | 2.19 | 3.17 | 0.057 | 2.16 | A+ | B | A | A | A | B |
| Example C26 | 12.88 | 7.80 | 9.82 | 0.010 | 1.65 | C | B | A | A+ | A | A |
| Com. Ex. C1 | 9.94 | 6.11 | 7.70 | 0.004 | 1.63 | A+ | B | A | A | B | C |
| Com. Ex. C2 | 12.25 | 7.30 | 9.20 | 0.003 | 1.68 | A+ | B | A | A | B | C |
| Com. Ex. C3 | 10.57 | 4.93 | 7.74 | 0.000 | 2.14 | A+ | C | C | B | C | C |
| Com. Ex. C4 | 0.03 | 0.01 | 0.02 | 13.158 | 3.00 | A+ | B | B | A | B | B |
| Com. Ex. C5 | 0.11 | 0.05 | 0.08 | 0.000 | 2.20 | A+ | C | C | C | C | C |
| Com. Ex. C6 | 18.19 | 9.61 | 13.59 | 0.013 | 1.89 | A+ | A | A | A | A+ | C |
| Com. Ex. C7 | 20.67 | 14.28 | 17.41 | 0.000 | 1.45 | A+ | B | A | B | A+ | C |

From the above results, it is found that the evaluation result of the unevenness in density is excellent in the examples, compared to that of the comparative examples.

It is also found that each evaluation result of the electrical characteristics of the photoreceptor (residual potential), the abraded cross-sectional area of the cleaning blade ($\mu m^2$), the cracks on the cleaning blade, and image deletion are excellent in the examples.

It is also found that the evaluation result of the pass through of the external additive is excellent in Examples C1 to C26.

From the evaluation results of Comparative Examples A8, A9, B8, B9, C6, and C7 in which the comparative photoreceptor (C1) is used, it is found that, when three types of image pattern having different image density shown as in FIG. 6 continue to be output, the abrasion rate of the photoreceptor is largely different depending on the image pattern, a difference in the film thickness of the photoreceptor (protection layer) is generated, and accordingly, the unevenness in density easily occurs. Since the abrasion of the photoreceptor easily proceeds at a low temperature for increasing the hardness of the cleaning blade, the maximum abrasion rate Wlmax of the photoreceptor in the low temperature and low humidity environment is preferably set to be small as possible, while considering the abrasion of the cleaning blade, and is more preferably equal to or smaller than 10 nm/Kcycle.

Hereinafter, details of abbreviations shown in Table are shown.

RCTM: Reactive Charge Transport Material (I-d)-28: Exemplified Compound (I-d)-28 (refer to the following synthesis method)

(I-b)-23: Exemplified Compound (I-b)-23

(I-b)-28: Exemplified Compound (I-b)-28

(I-c)-23: Exemplified Compound (I-c)-23

(I-c)-53: Exemplified Compound (I-c)-53

(I-d)-20: Exemplified Compound (I-d)-20

(II)-50: Exemplified Compound (II)-50

(II)-56: Exemplified Compound (II)-56

(II)-182: Exemplified Compound (II)-182

(II)-183: Exemplified Compound (II)-183

Compound (B): compound represented by the following Structural Formula (B)

(B)

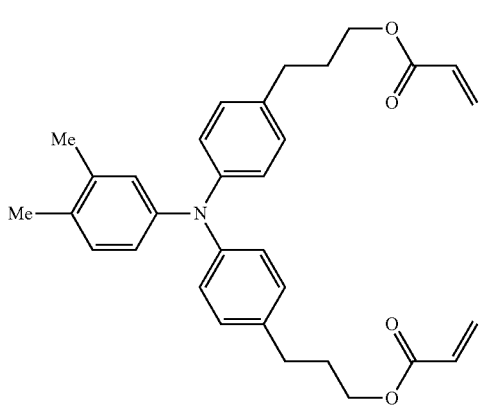

Synthesis of Exemplified Compound (I-d)-28

22 g of the following compound (2), 33 g of t-butoxypotassium, 300 ml of tetrahydrofuran, and 0.2 g of nitrobenzene are added to 500 ml flask and stirred in the nitrogen atmosphere, and a solution obtained by dissolving 25 g of 4-chloro-methyl styrene in 150 ml of tetrahydrofuran is gently added dropwise thereto. After completing dropwise addition, the mixture is heated and refluxed for 4 hours, cooled, poured in water, and extracted by toluene. A toluene layer is sufficiently subjected to water washing and condensed, and the obtained oil matter is refined by silica gel column chromatography to obtain 29 g of oil Exemplified Compound (I-d)-28.

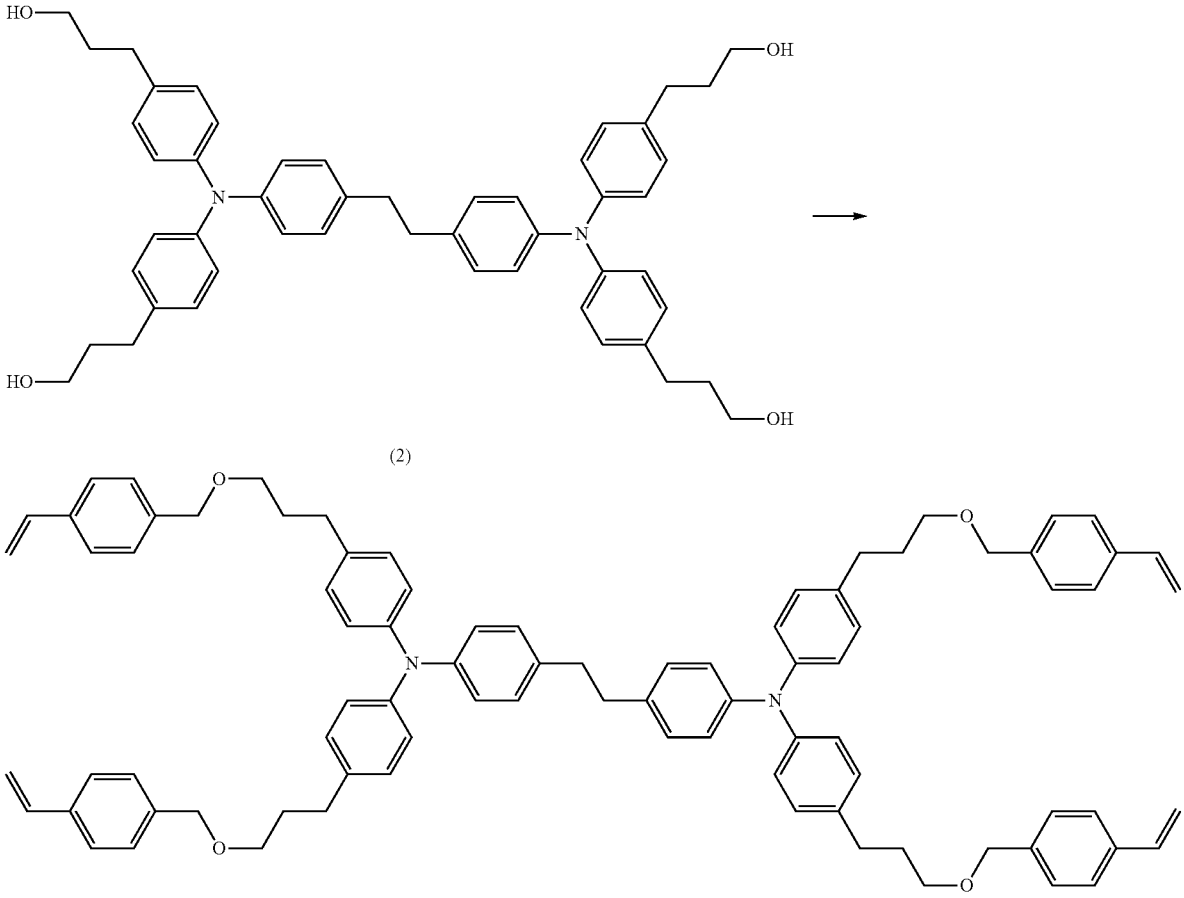

The other Exemplified Compounds are also synthesized based on the synthesis described above.

CTM: Non-Reactive Charge Transport Material

Compound (C): compound represented by the following Structural Formula (C)

(C)

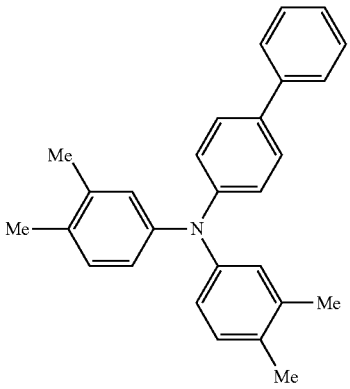

Additive

L-2: tetrafluoroethylene polymer particles, Lubron L-2 (manufactured by Daikin Industries, Ltd.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming method comprising:

charging a surface of an electrophotographic photoreceptor by a charging device disposed to be in contact with or be adjacent to the surface of the electrophotographic photoreceptor, the electrophotographic photoreceptor comprising a conductive base and a photosensitive layer provided on the conductive base, and an uppermost layer of the electrophotographic photoreceptor is configured with a cured film of a composition having a reactive charge transport material;

forming an electrostatic latent image on a charged surface of the electrophotographic photoreceptor;

developing the electrostatic latent image formed on the surface of the electrophotographic photoreceptor with a developer including a toner including toner particles and fatty acid metal salt particles to form a toner image;

transferring the toner image to a surface of a recording medium; and cleaning the surface of the electrophotographic photoreceptor with a cleaning blade in contact with the surface of the electrophotographic photoreceptor, wherein:

the reactive charge transport material is at least one kind selected from chain polymerizable compound represented by the following Formulae (I) and (II):

(I)

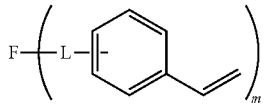

wherein F represents a charge transport skeleton; L represents a divalent linking group containing two or more kinds selected from the group consisting of an alkylene group, an alkenylene group, —C(═O)—, —N(R)—, —S—, and —O—; R represents a hydrogen atom, an alkyl group, an aryl group, or an aralkyl group; and m represents an integer of 1 to 8, (II)

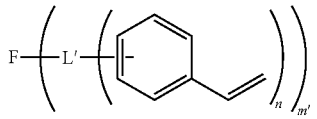

wherein F represents a charge transport skeleton; L' represents a trivalent or tetravalent group derived from alkane or alkene, or an (n+1)-valent linking group containing two or more kinds selected from the group consisting of an alkylene group, an alkenylene group, —C(═O)—, —N(R)—, —S—, and —O—; R represents a hydrogen atom, an alkyl group, an aryl group, or an aralkyl group; m' represents an integer of 1 to 6; and n represents an integer of 2 or 3;

the following characteristic of the fatty acid metal salt particles is satisfied:

Expression (A1): $0.01<Rmf<0.20$, where Rmf is a content (% by weight) of the fatty acid metal salt particles with respect to the entire weight of the toner;

the method is performed using an image forming apparatus that has the following characteristics:

Expression (B1): $0.005<Rmf/Wh<5.000$,

Expression (B2): $0.002<Rmf/Wl<1.000$,

Expression (C1): $1.0<Wh\max/Wh\min<2.5$, and

Expression (C2): $1.0<Wl\max/Wl\min<2.5$;

Wh, Whmax, and Whmin are determined after repeatedly forming an image having three image patterns of different image densities in a high temperature and high humidity environment, and (i) Wh is an average abrasion rate (nm/1,000 rotations) of the electrophotographic photoreceptor, (ii) Whmax is a maximum abrasion rate (nm/1,000 rotations) of the electrophotographic photoreceptor, and (iii) Whmin is a minimum abrasion rate (nm/1,000 rotations) of the electrophotographic photoreceptor; and Wl, Wlmax, and Wlmin are determined after repeatedly forming an image having three image patterns of different image densities in a low temperature and low humidity environment, and (i) Wl is an average abrasion rate (nm/1,000 rotations) of the electrophotographic photoreceptor, (ii) Wlmax is a maximum abrasion rate (nm/1,000 rotations) of the electrophotographic photoreceptor, and (iii) Wlmin is a minimum abrasion rate (nm/1,000 rotations) of the electrophotographic photoreceptor.

2. The image forming method according to claim 1, wherein the fatty acid metal salt particles are particles of zinc stearate having a median diameter based on a volume of 0.1 μm to 10.0 μm.

3. The image forming method according to claim 1, wherein:

the toner further includes inorganic abrasive particles; and during the image forming method, the following characteristic of the inorganic abrasive particles is satisfied:

Expression (A2): $0.01<Rab<0.30$, where Rab is a content (% by weight) of the inorganic abrasive particles with respect to the entire weight of the toner.

4. The image forming method according to claim 2, wherein:

the toner further includes inorganic abrasive particles; and during the image forming method, the following characteristic of the inorganic abrasive particles is satisfied:

Expression (A2): $0.01<Rab<0.30$, where Rab is a content (% by weight) of the inorganic abrasive particles with respect to the entire weight of the toner.

5. The image forming method according to claim 3, wherein the inorganic abrasive particles are particles having a median diameter based on a volume of 0.1 μm to 10.0 μm, and at least one kind of particles selected from the group consisting of cerium oxide particles and strontium titanate particles.

6. The image forming method according to claim 3, wherein during the image forming method, the following characteristic is satisfied:

Expression (D1): $0.1<Rmf/Rab<3.0$.

7. The image forming method according to claim 5, wherein during the image forming method, the following characteristic is satisfied:

Expression (D1): $0.1<Rmf/Rab<3.0$.

8. The image forming method according to claim 1, wherein the toner further includes inorganic lubricant particles.

9. The image forming method according to claim 2, wherein the toner further includes inorganic lubricant particles.

10. The image forming method according to claim 8, wherein the inorganic lubricant particles are boron nitride particles.

11. An image forming apparatus comprising:

an electrophotographic photoreceptor comprising a conductive base and a photosensitive layer provided on the conductive base, wherein an uppermost layer of the electrophotographic photoreceptor is configured with a cured film of a composition having a reactive charge transport material;

a charging unit that is disposed to be in contact with or be adjacent to a surface of the electrophotographic photoreceptor and charges the surface of the electrophotographic photoreceptor;

an electrostatic latent image forming unit that forms an electrostatic latent image on a charged surface of the electrophotographic photoreceptor;

a developing unit that accommodates a developer including a toner including toner particles and fatty acid metal salt particles and develops the electrostatic latent image formed on the surface of the electrophotographic photoreceptor with the developer to form a toner image;

a transferring unit that transfers the toner image to a surface of a recording medium; and a cleaning unit that includes a cleaning blade which is in contact with the surface of the electrophotographic photoreceptor and cleans the surface of the electrophotographic photoreceptor, wherein:

the reactive charge transport material is at least one kind selected from chain polymerizable compound represented by the following Formulae (I) and (II):

(I)

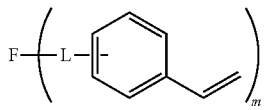

wherein F represents a charge transport skeleton; L represents a divalent linking group containing two or more kinds selected from the group consisting of an alkylene group, an alkenylene group, —C(=O)—, —N(R)—, —S—, and —O—; R represents a hydrogen atom, an alkyl group, an aryl group, or an aralkyl group; and m represents an integer of 1 to 8, (II)

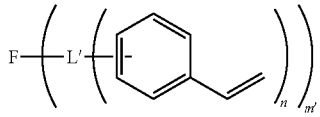

wherein F represents a charge transport skeleton; L' represents a trivalent or tetravalent group derived from alkane or alkene, or an (n+1)-valent linking group containing two or more kinds selected from the group consisting of an alkylene group, an alkenylene group, —C(=O)—, —N(R)—, —S—, and —O—; R represents a hydrogen atom, an alkyl group, an aryl group, or an aralkyl group; m' represents an integer of 1 to 6; and n represents an integer of 2 or 3;

the fatty acid metal salt particles satisfy the following characteristic:

Expression (A1): $0.01<Rmf<0.20$, where Rmf is a content (% by weight) of the fatty acid metal salt particles with respect to the entire weight of the toner;

the image forming apparatus satisfies the following characteristics:

$0.0005<Rmf/Wh<5.000$, Expression (B1):

$0.002<Rmf/Wl<1.000$, Expression (B2):

$1.0<Wh\max/Wh\min<2.5$, and Expression (C1):

$1.0<Wl\max/Wl\min<2.5$; Expression (C2):

Wh, Whmax, and Wmin are determined after repeatedly forming an image having three image patterns of different image densities in a high temperature and high humidity environment, and (i) Wh is an average abrasion rate (nm/1,000 rotations) of the electrophotographic photoreceptor, (ii) Whmax is a maximum abrasion rate (nm/1,000 rotations) of the electrophotographic photoreceptor, and (iii) Whmin is a minimum abrasion rate (nm/1,000 rotations) of the electrophotographic photoreceptor; and Wl, Wlmax, and Wlmin are determined after repeatedly forming an image having three image patterns of different image densities in a low temperature and low humidity environment, and (i) Wl is an average abrasion rate (nm/1,000 rotations) of the electrophotographic photoreceptor, (ii) Wlmax is a maximum abrasion rate (nm/1,000 rotations) of the electrophotographic photoreceptor, and (iii) Wlmin is a minimum abrasion rate (nm/1,000 rotations) of the electrophotographic photoreceptor.

12. A process cartridge comprising:

an electrophotographic photoreceptor comprising a conductive base and a photosensitive layer provided on the conductive base, wherein an uppermost layer is configured with a cured film of a composition having a reactive charge transport material;

a charging unit that is disposed to be in contact with or be adjacent to a surface of the electrophotographic photoreceptor and charges the surface of the electrophotographic photoreceptor;

a developing unit that accommodates a developer including a toner including toner particles and fatty acid metal salt particles and develops the electrostatic latent image formed on the surface of the electrophotographic photoreceptor with the developer to form a toner image; and a cleaning unit that includes a cleaning blade which is in contact with the surface of the electrophotographic photoreceptor and cleans the surface of the electrophotographic photoreceptor, wherein:

the process cartridge is detachable from an image forming apparatus;

the reactive charge transport material is at least one kind selected from chain polymerizable compound represented by the following Formulae (I) and (II):

(I)

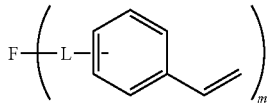

wherein F represents a charge transport skeleton; L represents a divalent linking group containing two or more kinds selected from the group consisting of an alkylene group, an alkenylene group, —C(=O)—, —N(R)—, —S—, and —O—; R represents a hydrogen atom, an alkyl group, an aryl group, or an aralkyl group; and m represents an integer of 1 to 8, (II)

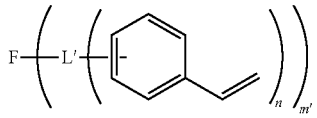

wherein F represents a charge transport skeleton; L' represents a trivalent or tetravalent group derived from alkane or alkene, or an (n+1)-valent linking group containing two or more kinds selected from the group consisting of an alkylene group, an alkenylene group, —C(=O)—, —N(R)—, —S—, and —O—; R represents a hydrogen atom, an alkyl group, an aryl group, or an aralkyl group; m' represents an integer of 1 to 6; and n represents an integer of 2 or 3;

the fatty acid metal salt particles satisfy the following characteristic:

Expression (A1): 0.01<Rmf<0.20, where Rmf is a content (% by weight) of the fatty acid metal salt particles with respect to the entire weight of the toner;

the process cartridge satisfies the following characteristics:

$0.005<Rmf/Wh<5.000$, Expression (B1):

$0.002<Rmf/Wl<1.000$, Expression (B2):

$1.0<Wh\max/Wh\min<2.5$, and Expression (C1):

$1.0<Wl\max/Wl\min<2.5$; Expression (C2):

Wh, Whmax, and Whmin are determined after repeatedly forming an image having three image patterns of different image densities in a high temperature and high humidity environment, and (i) Wh is an average abrasion rate (nm/1,000 rotations) of the electrophotographic photoreceptor, (ii) Whmax is a maximum abrasion rate (nm/1,000 rotations) of the electrophotographic photoreceptor is set as Whmax, and (iii) Whmin is a minimum abrasion rate (nm/1,000 rotations) of the electrophotographic photoreceptor; and Wl, Wlmax, and Wlmin are determined after repeatedly forming an image having three image patterns of different image densities in a low temperature and low humidity environment, and (i) Wl is an average abrasion rate (nm/1,000 rotations) of the electrophotographic photoreceptor, (ii) Wlmax is a maximum abrasion rate (nm/1,000 rotations) of the electrophotographic photoreceptor, and (iii) Wlmin is a minimum abrasion rate (nm/1,000 rotations) of the electrophotographic photoreceptor.

* * * * *